US006409309B1

(12) United States Patent
Tanikawa et al.

(10) Patent No.: US 6,409,309 B1
(45) Date of Patent: Jun. 25, 2002

(54) RECORDING APPARATUS HAVING HIGH RESOLUTION RECORDING FUNCTION

(75) Inventors: Toru Tanikawa, Kanagawa; Minoru Kohno, Tokyo; Hiroyuki Mitsuhashi, Kanagawa, all of (JP)

(73) Assignees: Sony Corporation; Sony Chemicals Corporation, both of Tokyo (JP)

( * ) Notice: Subject to any disclaimer, the term of this patent is extended or adjusted under 35 U.S.C. 154(b) by 0 days.

(21) Appl. No.: 09/061,944

(22) Filed: Apr. 17, 1998

(51) Int. Cl.[7] ..... B41J 2/04; B41J 2/05
(52) U.S. Cl. ..... 347/54; 347/66
(58) Field of Search ..... 347/44, 40, 46, 347/54, 56, 62, 63, 65, 66, 67, 51, 171

(56) References Cited

U.S. PATENT DOCUMENTS 4,723,129 A * 2/1988 Endo et al. ..... 347/56
5,204,689 A * 4/1993 Shirato et al. ..... 347/62
5,658,471 A * 8/1997 Murthy et al. ..... 347/65

FOREIGN PATENT DOCUMENTS

EP 636485 * 2/1995 ..... 347/40

* cited by examiner

*Primary Examiner*—John Barlow
*Assistant Examiner*—Juanita Stephens
(74) *Attorney, Agent, or Firm*—Sonnenschein, Nath & Rosenthal

(57) ABSTRACT

A recording apparatus having recording head units constituted by such that recording materials are heated and are selectively transported to a printing medium in recording material transporting units, and a recording head formed by arraying the recording head units positioned opposite to each other. In each of the recording head units, the recording material transporting units include heating portions for heating the recording materials. A first electrode and a second electrode which are used to energize the heating portion are provided with respect to each of the heating portions in such a manner that the first electrode is located opposite to the second electrode. The first electrode is located between the heating portions. The second electrode is present at edge portions of the recording head units that are positioned opposite to each other.

39 Claims, 104 Drawing Sheets

$d_2 = d_1$ $d_4 > d_1$

RECORDING APPARATUS HAVING HIGH RESOLUTION RECORDING FUNCTION

BACKGROUND OF THE INVENTION

1. Field of the Invention

The present invention generally relates to a recording apparatus. More specifically, the present invention is directed to a printer head, or a printer having a recording head positioned opposite to a printing medium such as a printing paper, also to and a recording solution jetting unit for jetting a recording solution such as a vaporizable dye to this printing medium.

2. Description of the Related Art

Very recently, various needs such as monochromatic recording needs and also color hard copying needs are increased in video cameras, televisions, and image recording fields, for instance, computer graphics. To satisfy these needs, various color hard copy systems have been proposed, for example, the sublimation type thermoelectric system, the melting thermoelectric system, the ink jet system, the electronic photographic system, and the thermal developing silver halide system.

The above-described various color hard copy systems are mainly classified into the dye diffusion thermoelectric system (sublimation type thermoelectric system) and the ink jet system, which may function as a color hard copy type apparatus, capable of easily producing images with high image qualities.

In this dye diffusion thermoelectric system among these recording systems, and ink sheet and a printing medium (printing paper) are made in close contact with each other under certain pressure, a thermal recording head positioned above the ink sheet may apply heat to this ink sheet in response to image information, and a transferring dye is thermally transferred from the ink sheet to a dye accepting layer in response to this heat application. The ink sheet is coated with an ink layer made by distributing a transferring dye (will also be referred to a "recording material" hereinafter) with high density in a properly-selected binder resin. A dye-coated resin for accepting the transferred dye is coated on the printing medium.

A so-called "thermoelectric system" is featured by having instantaneous printing operation, and capable of producing full images with high image qualities substantially equal to those of silver halide color pictures. In this thermoelectric system, for instance, the above-described operation is repeatedly performed as to color image signals for yellow, magenta, and cyan, corresponding to the three primary colors used in the subtraction color mixture.

FIG. 1 schematically shows a front view of a major portion of a printer with employment of such a thermoelectric system. In this printer, a thermosensible recording head (simply will be referred to as a "thermal head" hereinafter) 70 is positioned opposite to a platen roller 71. Between these thermal head 70 and platen roller 71, both an ink sheet 72 made of an ink layer 72*a* formed on a base film 72*b*, and a recording paper (printing medium) 20 made of a dye-coated resin layer (dye accepting layer) 20*a* formed on a paper 20*b* are traveled with being depressed against the thermal head 70 by the platen roller 71 under such a condition that the ink sheet 72 is sandwiched with the recording paper 20.

Then, the ink (transferring dye) contained in the ink layer 72*a* selectively heated by the thermal head 70 is transferred in a dot shape to the dye-coated resign layer 20*a* of the printing medium 20, so that the thermoelectric recording operation is carried out. In general, as to such a thermoelectric recording system, the line system and the serial system are employed. In the line system, a longitudinal-shaped thermal head is positioned perpendicular to a travel direction of a recording paper and is fixedly arranged. In the serial system, a thermal head is reciprocated along a direction perpendicular to a travel direction of a recording paper.

FIG. 2 schematically indicates a plan view of an adjoining portion of a transfer unit of the thermal head 70.

A ceramics substrate 73 is fixed to a portion above a heat radiation plate (not shown) made of a high heat conductivity material (for instance, aluminium).

A glaze layer 74 is formed at one edge portion above the ceramics substrate 73 while a tip portion thereof is left. A large number of heat emitting layers (made of polysilicon layer (P—Si), or a metal having a high resistance) 75 are arranged in such a manner that these heat emitting layers 75 ride the glaze layer 74. Separate electrodes 76 and a common electrode 77 are arranged on the ceramics substrate 73 by being connected to the heat emitting layer 75 in such a manner that these separate electrodes 76 and the common electrode 77 are positioned opposite to each other on each of the heat emitting layer 75 at a summit of the glaze layer 74 while maintaining a small space.

The separate electrodes 76 are elongated near the edge portion of the ceramics substrate 73, and the common electrode 77 is elongated up to the edge portion on the side of the glaze layer 74. The ceramics substrate 73 is covered with an anti-wearing protection layer with involving the heat emitting layer 75 on the separate electrodes 76 and the glaze layer 74, and on the common electrode 77 while the tip portion of the separate electrode 76 is left. It should be noted that this protection layer is omitted from FIG. 2.

However, this system owns such serious drawbacks. That is, a large amount of wastes are produced which are caused by disposing the ink sheets, and the running cost is increased. The serious drawbacks impede the utilization of this system. This drawback is also applied to the melting thermoelectric system.

Additionally, in a full color recording operation, there are some possibilities that the specific color ink which has been once adhered to the recording paper is conversely transferred to other color ink sheets, resulting in color mixtures. As a result, there is such a risk that dirty images are recorded.

Although the thermal developing silver halide system may provide the high image quality, the running cost is increased and also the manufacturing cost of the recording apparatus is increased because the exclusively-used printing paper and the disposable ribbons or the disposable sheets are used.

On the other hand, the ink jet system is described in, for example, Japanese Examined Patent Publication No. 61-59911 published in 1986 and Japanese Examined Patent Publication No. 5-217 published in 1993. In response to the image information, the recording ink droplets are jetted from the nozzles formed in the recording head so as to be adhered to the recording member for the image recording operation by way of the electrostatic attracting system, the continuous vibration generating system (piezoelectric system), and the thermal system (bubble jet system).

As a result, the image transfer operation can be done by using normal paper, and substantially no waste is disposed in such a case that the ink ribbon is used. Thus, the low running cost can be realized. Currently, in particular, since the color images can be simply outputted by the thermal system, this thermal system (bubble jet system) is popularized.

However, in this ink jet system, it is basically difficult to achieve the density gradation within pixels. Thus, it is practically difficult to reproduce such a high-quality image within short time, which may be obtained by way of the dye diffusion thermoelectric system. This image quality may be comparable to that of a silver halide picture.

In other words, in the conventional ink jet recording system, since one ink droplet forms one pixel, the gradation within one pixel can be hardly realized in view of a basic idea, so that the high-quality image cannot be formed. On the other hand, quasi-gradation representation by way of the dither method may be tried to be executed while utilizing high resolution achieved by the ink jetting system. However, this dither method could not produce images having image qualities equivalent to that made by the sublimation type thermoelectric system, but also the transfer speed by this dither method is considerably lowered.

Furthermore, although the electronic photographic system can achieve the low running cost and the high transfer speed, the manufacturing cost of this electronic photographic system is increased.

As previously described, there is no recording methods capable of satisfying all of the following needs, i.e., the image qualities, the running cost, the manufacturing cost of the recording apparatus, and the image transfer time.

To solve the above-described problems, the Inventors of the present invention have proposed the recording method and the recording apparatus in Japanese Laid-open Patent. Application No. 7-89107 corresponding to U.S. Pat. No. 5,592,208 patented on Jan. 7, 1997 entitled "PRINTING METHOD AND A PRINTING APPARATUS FOR CARRYING OUT THE SAME". The recording apparatus of this prior patent filed by the Inventors includes the thermal medium (for instance, optical-heat converting member made of carbon fine particles and a binder, or a thin film of a nickel-cobalt alloy) for supporting/heating the recording material to which heat produced from the heating source (for example, semiconductor laser) is applied. This recording apparatus maintains the interval between the recording material and the printing medium in a range of 1 to 100 $\mu$m. Then, the recording material is vaporized, or sublimated so as to be transferred to the printing medium by heating this recording material via the thermal medium.

Concretely speaking, in accordance with the thermoelectric recording method of this prior patent, the porous structure is formed in the recording material heating unit of the printer, and the surface area of the jetting unit (transfer unit) is increased by this porous structure, so that the recording fluid can be continuously supplied to the recording fluid heating unit by way the capillary phenomenon, and further can be held in this heating unit. Under this condition, the heat amount responding to the recording information is selectively applied by the heating means (for instance, laser light) so as to vaporize a portion of the recording fluid. An amount of recording material is transferred to the printing medium in the form of vapor, or fluid droplets. This recording material amount corresponds to the recording information responding to the electric image formed by the color video camera and the like. As a result, this electric image can be transferred to the printing medium.

As a consequence, in comparison with the known ink jet system, a large number of small-sized fluid droplets can be produced, and also a total number of fluid droplets produced in response to the heating energy corresponding to the recording information, and supplied to the recording fluid heating unit, can be freely controlled in this recording apparatus. Therefore, the multi-level density gradation can be obtained, so that the resulting image quality substantially equal to that of the silver halide recording system can be realized (for instance, full color image).

Also, since this recording system utilizes the vaporization, or sublimation of the dye, the dye accepting layer of the printing medium is no longer heated (conversely, this dye accepting layer should be heated in conventional thermoelectric system). Moreover, both the ink sheet and the printing medium need not be depressed under high pressure. No ink sheet (or ink ribbon) is required. As to this point, there are various merits that the printer can be made compact and in light weight, and also the waste articles can be decreased. Then, since the dye layer of the vaporizing unit is not made in contact with the printing medium, there is no risk that the color mixtures which occur due to the above-explained thermal melting phenomenon, and reverse transfer operation. Even when compatibility between the dye and the dye accepting layer is low, the recording operation ca be done. As a result, varieties of designing and selecting the dyes and the dye accepting layer resins can be widened.

Also, any types of transfer dyes suitable to this recording system may be employed if these transfer dyes own the proper vaporization speed, or the ablation speed, and represent the flowing conditions at a temperature lower than 200° C. under a single dye state, or a mixtured dye state, and further the sufficiently high heat resistance characteristic. Concretely speaking, there are disperse dyes, solvent dyes, basic dyes, and acid dyes. Even when such a dye having a melting point higher than the room temperature is employed, this melting point is lowered by mixing the dyes with each other, or mixing the dye with a volatile substance having a low molecular weight.

Also, any types of printing papers suitable to this recording system may be used if these printing papers own the suitable co-melting characteristic with the transfer dye, are capable easily accepting the transfer dye to emphasize the original color of the transfer dye, and also own the effect to fix the transfer dye. For instance, as to the disperse dye, it is preferable to employ such a printing paper on which a polyester resin, a polyvinyl chloride resin, or an acetate resin is coated, which owns the compatibility with the disperse dye. There is another fixing method by which the image transferred to the printing paper is heated so as to osmose the dye transferred to the surface of this printing paper inside the accepting layer.

As described above, this thermoelectric recording system owns the various features such as compactness, easy maintenance, instantaneous imaging operation, images with high image qualities, and high gradation.

Furthermore, the Inventors of the present invention have proposed the compact heating vaporizing type printer with light weight without requiring an ink ribbon while maintaining the above-described merits of the thermoelectric recording system (see Japanese Laid-open Patent Application No. 7-89108).

This prior patent application is directed to such a printer comprised of the dye storing unit for storing the solid-state vaporizable dye, and the fluid vaporizable dye conducting unit for heating the solid-state vaporizable dye stored in this dye storage unit to produce the dye fluid, and for conducting the dye fluid to a plurality of vaporizing units while maintaining the temperature thereof. Then, the fluid vaporizable dyes conducted to the respective vaporizing units are heated/vaporized so as to be thermally transferred to the printing paper. Further, this printer owns at least one heating means for heating the solid-state vaporizable dye to produce the dye fluid and for maintaining the temperature of this dye fluid, and another heating means for heating/vaporizing the dye. In particular, the above-described heating means is suitable for a heater used to supply electric power. As described above, the heater is employed as the heat source instead of the above laser light, so that the manufacturing cost of this printer can be reduced.

On the other hand, for instance, in the printer used to the line type recording system, the recording head having the length corresponding to the width of the recording paper is required. There is a merit in view of the manufacturing aspect that such a long recording head may be constituted by arranging a plurality of recording head portions with the same module structures (for instance, serial type recording head) along a straight line, so as to function as a single recording head.

In the above-described case that a plurality of recording head portions are arranged on a straight line, in order to produce such an image having high resolution, high recording density, and better gradation, the pitch of the recording material heating unit, or the vaporizing unit within the each of the recording head portions in unit of recording operation must be correctly maintained even in the joint portions among the recording head portions.

In the above-described recording head of the prior patent application, when the dyes are fixed on the printing medium to form the dots, the intervals among the respective dye jetting units (heating units, or transfer units) constitute the dot intervals. In other words, a single dye jetting unit corresponds to one dot, and the dot intervals may give a great influence to the resolution of the printed image. If the dot interval is narrow, then the high resolution can be achieved.

As explained above, to realize the high image resolution, it is one of the important aspects to narrow the intervals among the respective dye jetting units. However, in the above recording head, since the dye is supplied from one dye jetting unit to one dye supply path, narrowing the intervals among the respective dye jetting units so as to realize such a high resolution image can narrow the intervals among the respective dye supply paths.

To this end, if the sectional areas of the dye supply paths are not reduced, then it is difficult to narrow the intervals. However, in this case, the fluid flow areas of the dye supply paths are narrowed, so that there is a risk that a sufficient large amount of dyes could not be supplied to the dye jetting units. In addition, the manufacturing methods of the recording heads as well as the dye supply units would become complex, and further the higher manufacturing precision would be required, resulting in lowering of the manufacturing yield, and increasing of the manufacturing cost.

As previously explained, in these recording heads, a portion of the dyes held in the dye jetting unit is vaporized by selectively applying the head amount corresponding to the recording information to this dye jetting unit, and very small vaporized dye gas, or dye fluid droplets are produced in response to the recording information and then are jetted transferred to the printing medium. It could be recognized that the very small dye droplets which are vaporized and then jetted are moved while being dispersed in response to the jetting distances.

As a result, when the distance between the printing medium and the dye jetting unit of the recording head during the printing operation, the resolution of the image to be transferred is readily changed. As a consequence, in order to produce the image having the high resolution on the printing medium, the dye jetting unit must be located very close to the printing medium, and further the interval between these members must be kept constant. However, the above-explained recording heads have no useful measures capable of positioning these members at very close location and of maintaining a constant interval.

Also, in such a case that the recording head is arranged in such a manner that the dyes are jetted upwardly to be transferred to the printing medium, there are some risks that a sufficient large amount of vaporized/jetted dyes could not be reached to this printing medium. This causes the optical density not to be increased. This reason is given as follows. That is, when the vaporized dyes are jetted upwardly over several micrometers, these vaporized dyes are rapidly cooled by ambient air to thereby be condensed. Then, the condensed dyes are easily dropped on the dye jetting unit and the peripheral portions thereof.

SUMMARY OF THE INVENTION

An object of the present invention is to provide such a recording apparatus capable of producing an image having sufficient optical density, high resolution, high gradation, and a high image quality without any fluctuation, while maintaining the features of the above-described thermoelectric recording system.

Another object of the present invention is to provide a recording apparatus capable of supplying a sufficiently large amount of recording materials to a recording solution jetting unit, and also capable of easily realizing high resolution in low cost.

The present invention has been made to solve the above-described problems, and therefore owns a further object to provide a recording apparatus capable of increasing a transfer efficiency of the above-explained jetted recording materials, capable of improving transfer density in high resolution, and moreover capable of producing a recorded image with a high image quality and superior gradation.

A recording apparatus, according to one aspect of the present invention, is comprised of a recording head having a plurality of recording head portions (for instance, a heater chip 1 will be discussed later). The recording head portion is arranged by that in a plurality of recording material transporting portion, the recording materials are heated and the heated recording materials are transported to a printing medium. In this recording head, these recording head portions are arranged opposite to each other. In each of these plural recording head portions, the recording material transporting portion includes heating portions for heating the recording materials. As to each of these heating portions a first electrode (e.g., return electrode 41B) and a second electrode (e.g., separate electrode 41A), which are used to energize this heating portion, are positioned opposite to each other. The first electrode among the first and second electrodes is positioned between the plural heating portions. Only the second electrode among the first and second electrodes is present at an opposite end portion between the plural recording head portions.

The above expression "selectively transported to printing medium" implies the following transport operations. That is, the recording material is transported from one recording material transporting portion selected from a plurality of recording material transporting portions to the printing medium; the recording materials are transported from all of the recording material transporting portions to the printing medium; and also the recording materials are transported from any of these recording material transporting portions to the printing medium. Also, the above-described "recording apparatus" implies not only printer head made of the above recording heads, but also a printer assembled with this printer head.

The recording apparatus, according to the present invention, is preferably arranged by that the first electrode and the second electrode are arranged in parallel to each other; the first electrode is conducted from one end side of the heating portion; and the second electrode is conducted from the other end side.

The recording apparatus, according to the present invention, is preferably arranged by that the second electrode is a separate electrode connected to a drive circuit unit; and the first electrode is a common electrode for the respective heating portions.

In the above-described recording apparatus, the first electrodes functioning as a common electrode are mutually coupled to one ends of the respective heating portions, and are branched from this coupling portion.

The recording apparatus, according to the present invention, is preferably arranged by that the heating portion is made of a thin-film heating member.

The recording apparatus, according to the present invention, is preferably arranged by that both the plurality of recording head portions, and a printed circuit board for connecting a drive circuit element (e.g., IC chip 16) of the second electrode and the first electrode to an external circuit are fixed to a common base.

Furthermore, the recording apparatus, according to the present invention, is preferably arranged by that the recording apparatus is arranged in such a manner that the heated recording material is transported to the printing medium which is located opposite to the recording material transporting unit under non-contact state.

In the above-described recording apparatus, the recording apparatus is arranged in such a manner that a recording material is vaporized; or ablated by the heating portion, and then the vaporized, or ablated recording material is jetted to the printing medium.

The Inventors of the present invention have executed various experiments and deep research so as to invent more effective structures capable of narrowing intervals among a plurality of dye jetting portions without reducing sectional areas of recording material supply paths. Finally, the Inventors could invent the following recording apparatus.

That is, a recording apparatus, according to another aspect of the present invention, is comprised of a recording head positioned opposite to a printing medium; wherein: the recording head includes: a recording solution jetting portion for jetting a recording solution to the printing medium; a common recording material supply path used to supply the recording material; and a plurality of branch paths branched from the common recording material supply path, for supplying the recording material to the recording material jetting portion; and at least one of the plural branch paths supplies the recording materials to the plurality of recording material jetting portions at the same time. In this case, the term "recording apparatus" covers not only a printer head (will be explained later), but also a printer assembled with this printer head.

In the recording apparatus, according to the present invention, is preferably arranged by that the common recording material supply path is formed between a main body of the recording head and a cover portion provided on the main body; and the branch paths are formed partition walls arranged between the main body of the recording head and the cover portion.

The recording apparatus, according to the present invention, is preferably arranged by that the partition wall is formed as a sheet shape; and the branch path between these partition walls is formed as a slit shape.

The recording apparatus, according to the present invention, is preferably arranged by that the plurality of branch walls branched from the common recording material supply path are mutually communicated with each other in a region of the recording material jetting portion.

The recording apparatus, according to the present invention, is preferably arranged by that a recording solution leakage preventing means is provided at a position near the recording material jetting portion, and on the opposite side to the branch path with respect to the recording material jetting portion. For instance, this recording material leakage preventing means is made of volatile oil paint.

The recording apparatus, according to the present invention, is preferably arranged by that a heating means for heating the recording material to jet the heated recording material is provided on the recording material jetting portion. For example, this heating means is constituted by a high resistance material, and one pair of electrodes capable of energizing the high resistance material.

In this case, the high resistance member and the one pair of electrodes are provided on a surface of the main body of the recording head under the partition wall. For instance, one pair of these electrodes are conducted to one end portion of the main body of the recording head, and one of the conducted portions is connected to a recording head drive circuit. For example, both the main body of the recording head, and a printed circuit board containing a recording head drive circuit unit are fixed to a base member.

Also, the recording material jetting portion preferably contains a porous structural body.

Also, the main body of the recording head preferably has a recording solution storage portion for supplying a recording solution to the common recording material supply path.

Also, a recording solution supply tube may be alternatively provided between the recording material storage portion and the main body of the recording head; and the recording material is supplied via the recording material supply tube to the common recording material supply path.

The recording apparatus, according to the present invention, is preferably arranged by that the recording material is vaporized, or ablated, and then the vaporized, or ablated recording material is jetted to the printing medium which is arranged opposite to the recording material jetting portion under non-contact state.

The Inventors of the present invention have executed various experiments and various research so as to invent more effective means capable of maintaining an interval between a recording solution jetting portion and a printing medium in a recording apparatus.

In other words, a recording apparatus, according to another aspect of the present invention, is arranged by that a recording head positioned opposite to a printing medium is comprised of a recording solution jetting portion for jetting a recording solution to the printing medium; the recording head is relatively inclined with respect to the printing medium to be made in contact with the printing medium; and the recording material jetting portion and the printing medium are arranged in such a manner that a predetermined interval between the recording material jetting portion and the printing medium is kept by the contact made between the recording head and the printing medium. In this case, the term "recording apparatus" covers not only a printer head (will be explained later), but also a printer assembled with this printer head.

In the recording apparatus, according to the present invention, is preferably arranged by that the recording head is made in contact with the printing medium at a predetermined inclination angle with respect to the printing medium on the side of the recording material jetting portion.

The recording apparatus, according to the present invention, is preferably arranged by that the recording head is made in contact with the printing medium in such a manner that an interval between the recording head and the printing medium is gradually narrowed toward the recording material jetting portion.

The recording apparatus, according to the present invention, is preferably arranged by that the interval between the recording head and the printing medium is increased on the side where the recording head is positioned opposite to the printing medium while the recording head is separated from the contact position between the recording head and the printing medium to the opposite side with respect to the recording material jetting portion.

Also, the recording head is preferably, relatively slid with respect to the printing medium. For example, the recording material jetting portion of the recording head is positioned downwardly, opposite to the printing medium so as to carry out the recording operation by the recording head.

Then, the recording head preferably includes: a common recording material supply path for supplying the recording material; and a branch path branched from the common recording material supply path, for supplying the recording material to the recording material jetting portion.

In this case, the common recording material supply path is formed between a main body of the recording head and a cover portion provided with the main body; a plurality of partition walls are provided between the main body of the recording head and the cover portion; and branch paths are formed among the partition walls.

Also, a heating means for heating the recording material to jet the heated recording material is provided on the recording material jetting portion. For instance, the heating means is constituted by a high resistance material, and one pair of electrodes capable of energizing the high resistance material.

In this case, the high resistance member and one pair of electrodes are provided on a surface of the main body of the recording head under the partition wall. For example, one pair of these electrodes are conducted to one end portion of the main body of the recording head, and one of the conducted portions is connected to a recording head drive circuit.

In this case, both the main body of the recording head, and a printed circuit board containing a recording head drive circuit unit are fixed to a base member.

Further, this recording material jetting portion preferably contains a porous structural body.

Also, the main body of the recording head has a recording solution storage portion for supplying a recording solution to the common recording material supply path.

Alternatively, a recording solution supply tube may be provided between the recording material storage portion and the main body of the recording head; and the recording material may be supplied via the recording material supply tube to the common recording material supply path.

Also, the recording apparatus, according to the present invention, is preferably arranged by that the recording material is vaporized, or ablated, and then the vaporized, or ablated recording material is jetted to the printing medium which is arranged opposite to the recording material jetting portion under non-contact state.

BRIEF DESCRIPTION OF THE DRAWINGS

For a more better understanding of the present invention, reference is made of a detailed description to be read in conjunction with the accompanying drawings, in which:

FIG. 119 is a sectional view for representing another manufacturing step of the printer head according to this embodiment;

FIG. 120 is a sectional view for representing another manufacturing step of the printer head according to this embodiment;

FIG. 121 is a sectional view for representing another manufacturing step of the printer head according to this embodiment;

FIG. 122 is a sectional view for representing another manufacturing step of the printer head according to this embodiment;

FIG. 123 is a sectional view for representing another manufacturing step of the printer head according to this embodiment;

FIG. 124 is a sectional view for representing another manufacturing step of the printer head according to this embodiment;

FIG. 125 is a sectional view for representing another manufacturing step of the printer head according to this embodiment;

FIG. 126 is a sectional view for representing another manufacturing step of the printer head according to this embodiment;

FIG. 127 is a sectional view for representing another manufacturing step of the printer head according to this embodiment;

FIG. 128 is a sectional view for representing another manufacturing step of the printer head according to this embodiment;

FIG. 129 is a sectional view for representing another manufacturing step of the printer head according to this embodiment;

FIG. 130 is a sectional view for showing a further manufacturing step of the printer head according to this embodiment;

Figure 131:
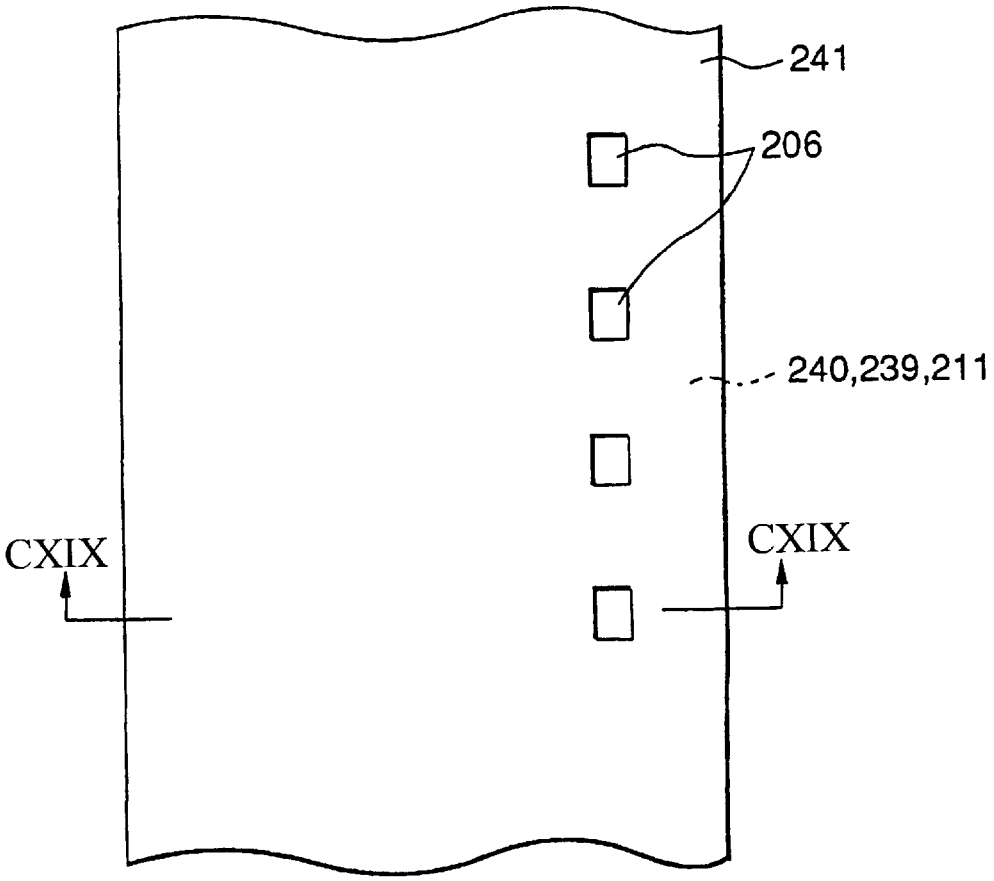
Figure 132:
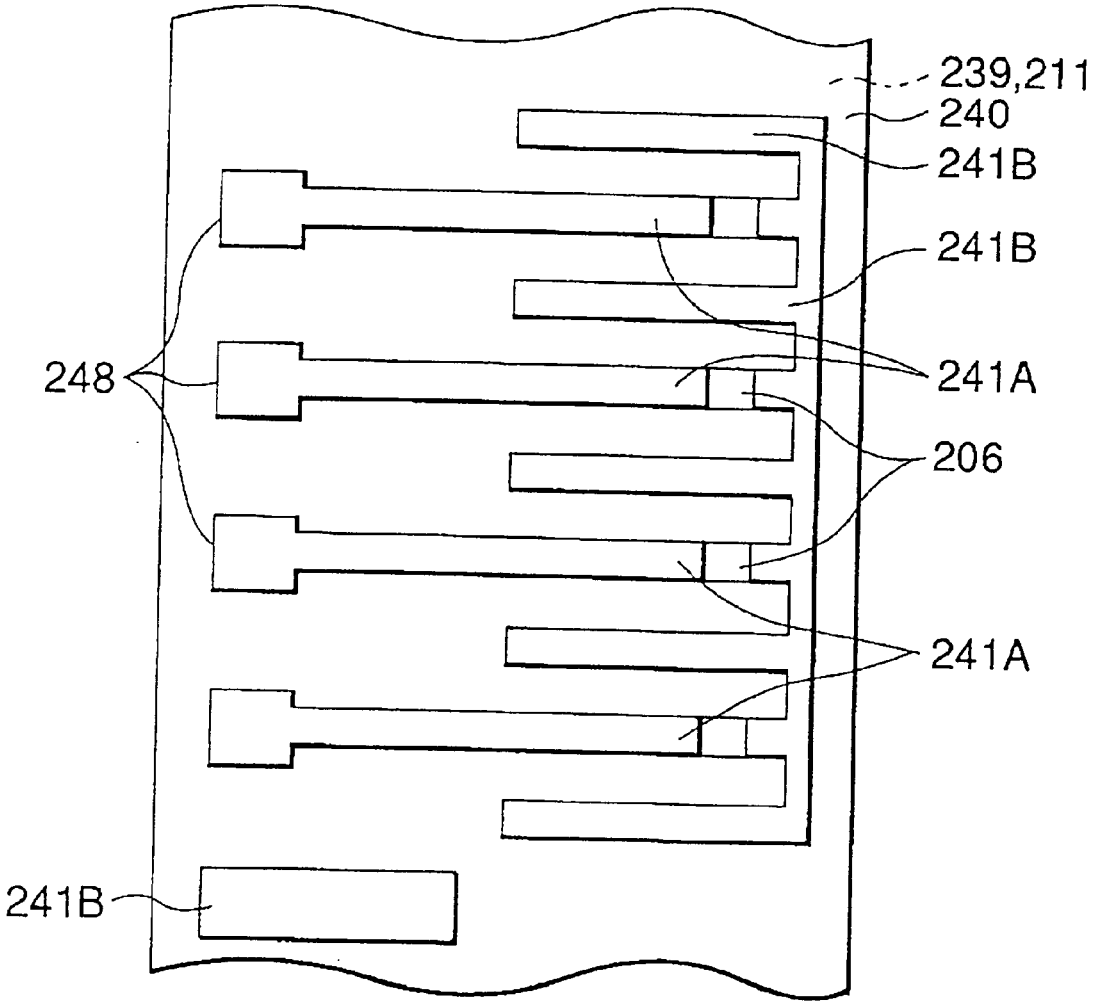
Figure 133:
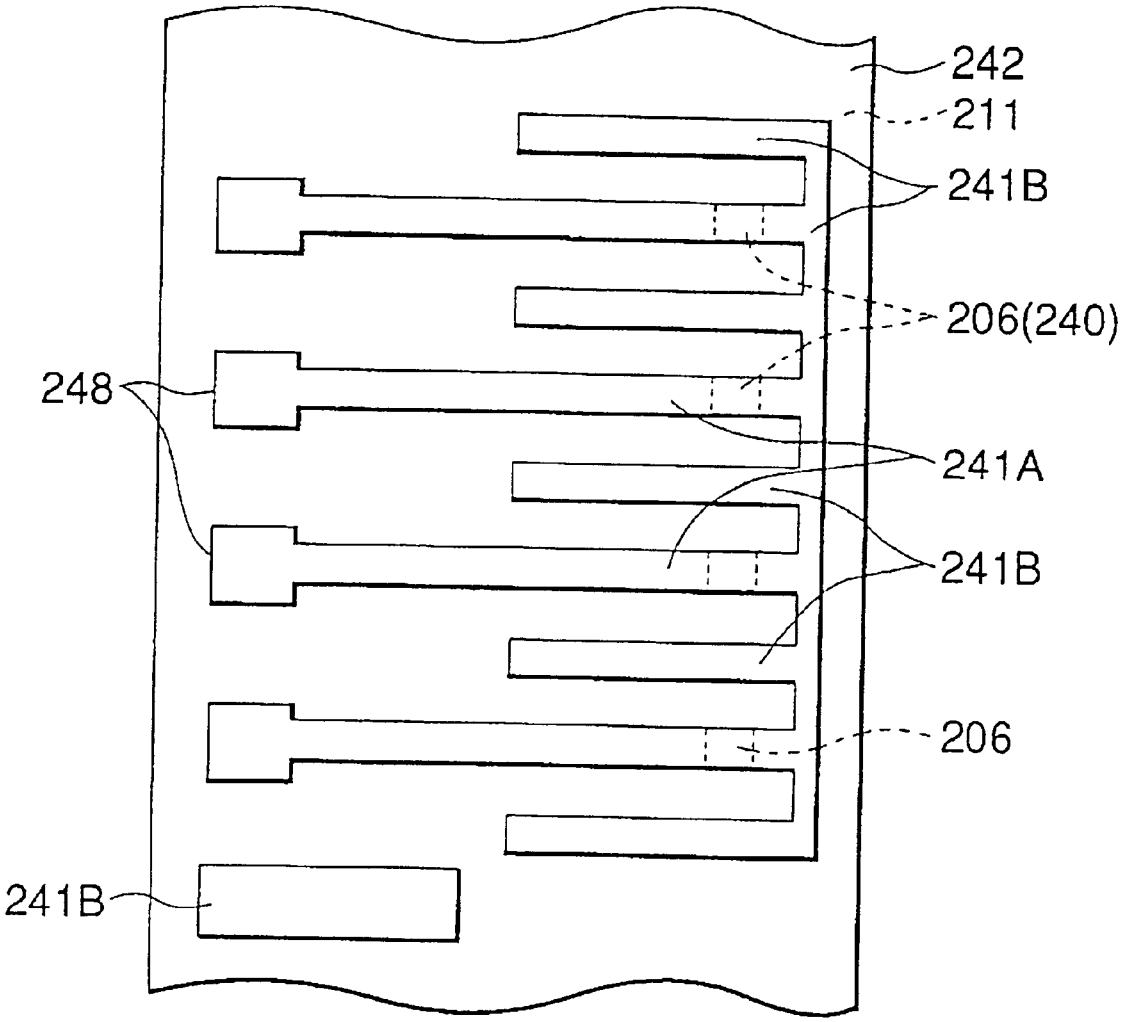
Figure 134:
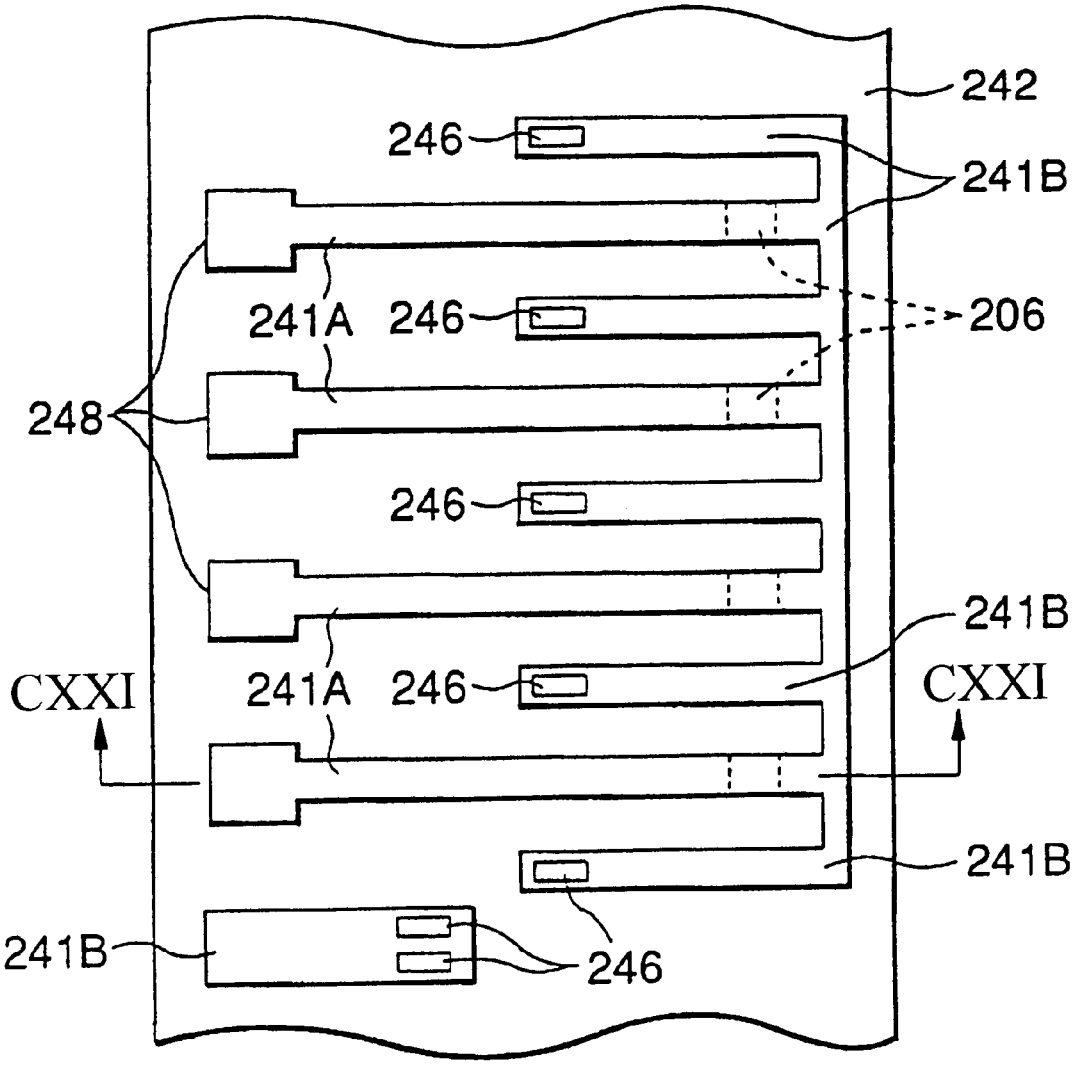
Figure 135:
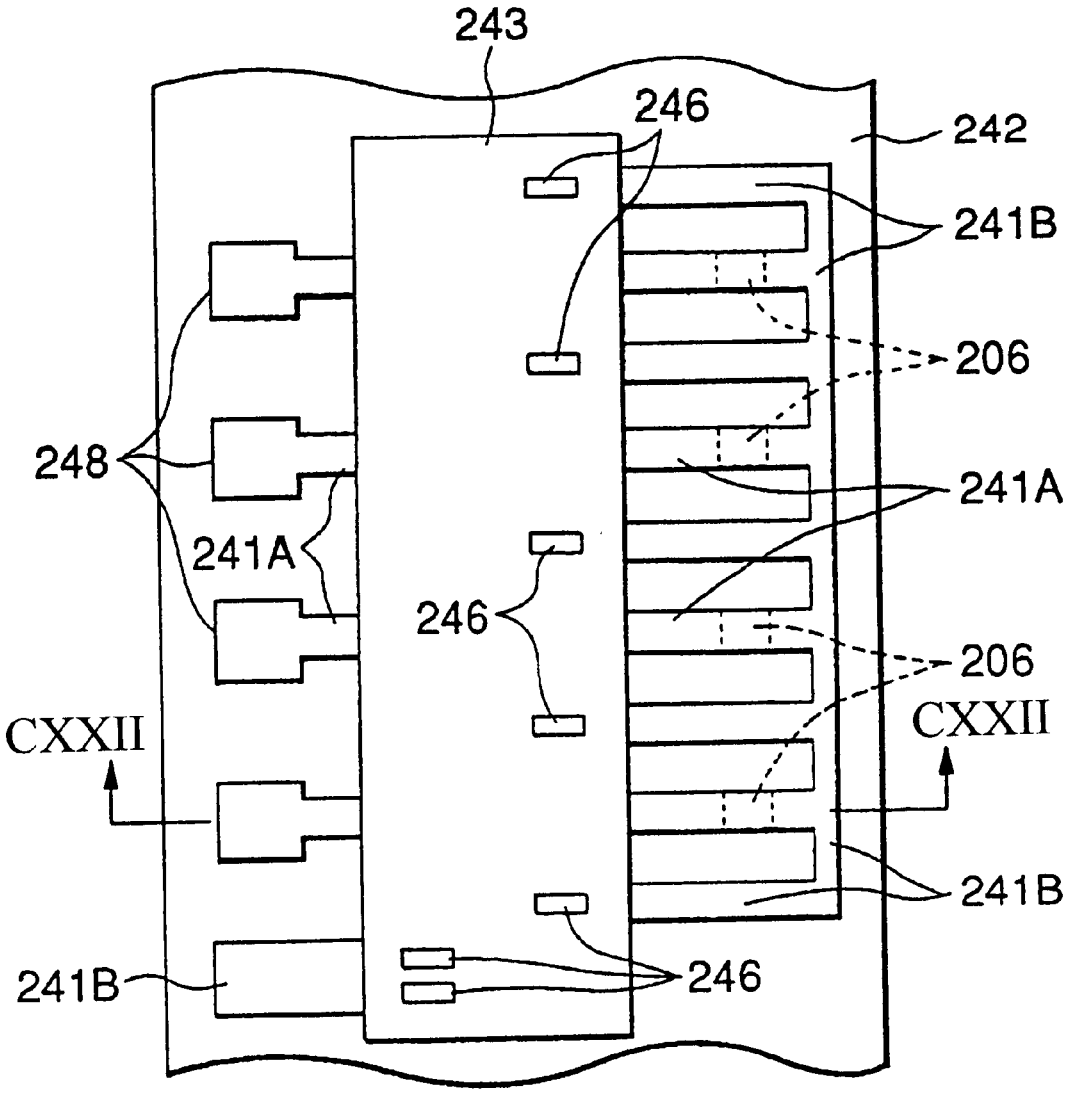
Figure 136:
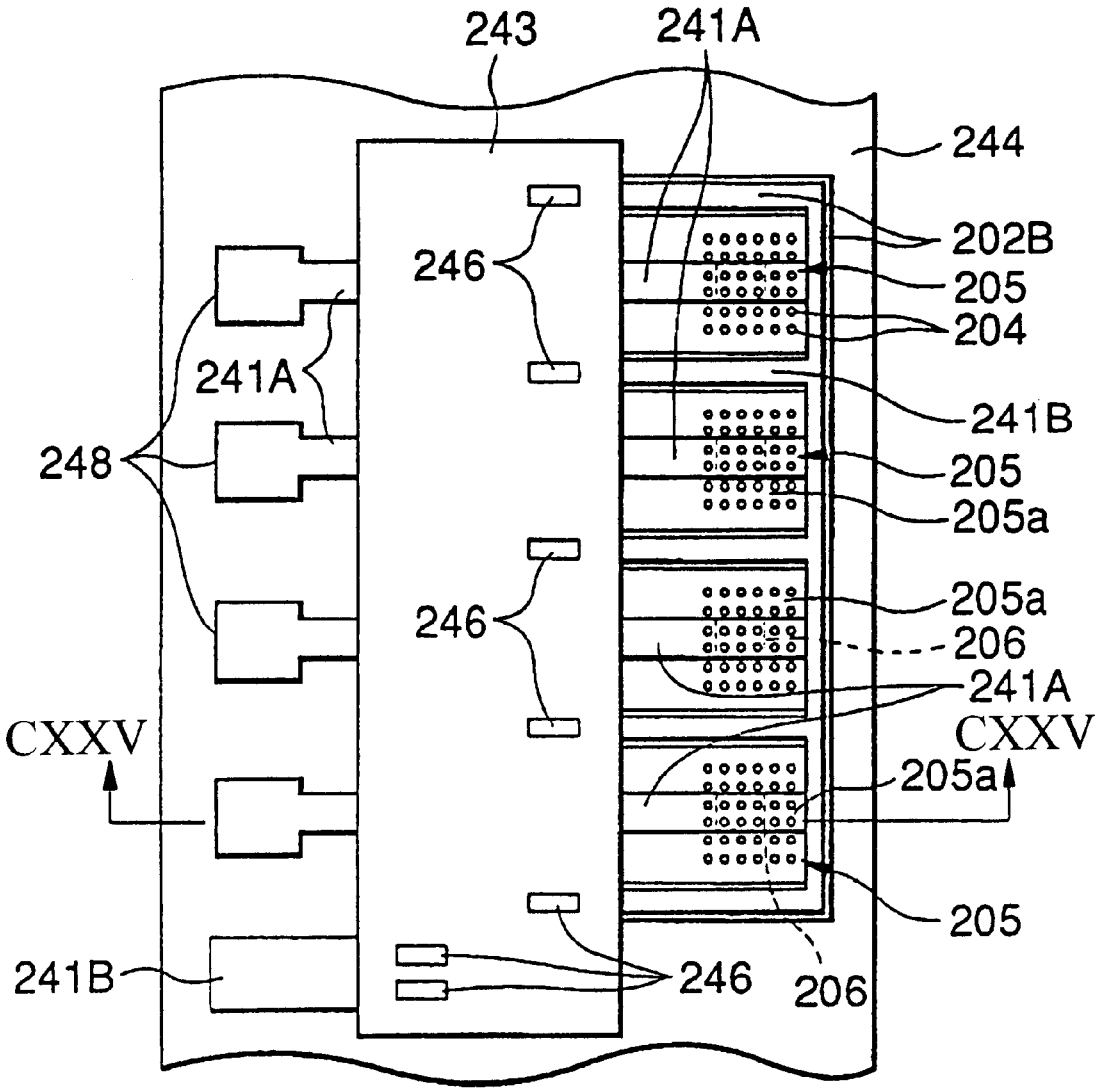
Figure 137:
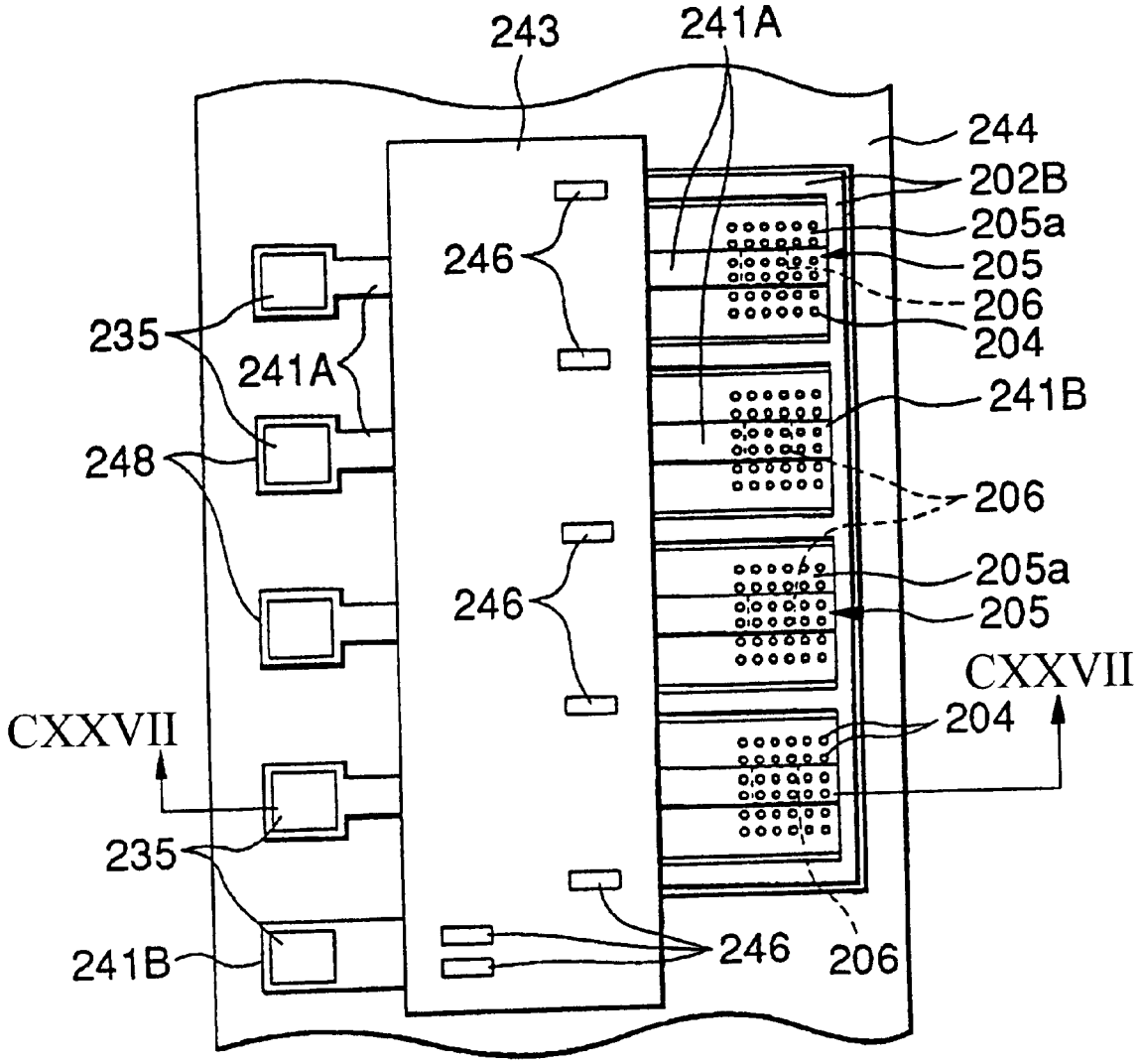
Figure 138:
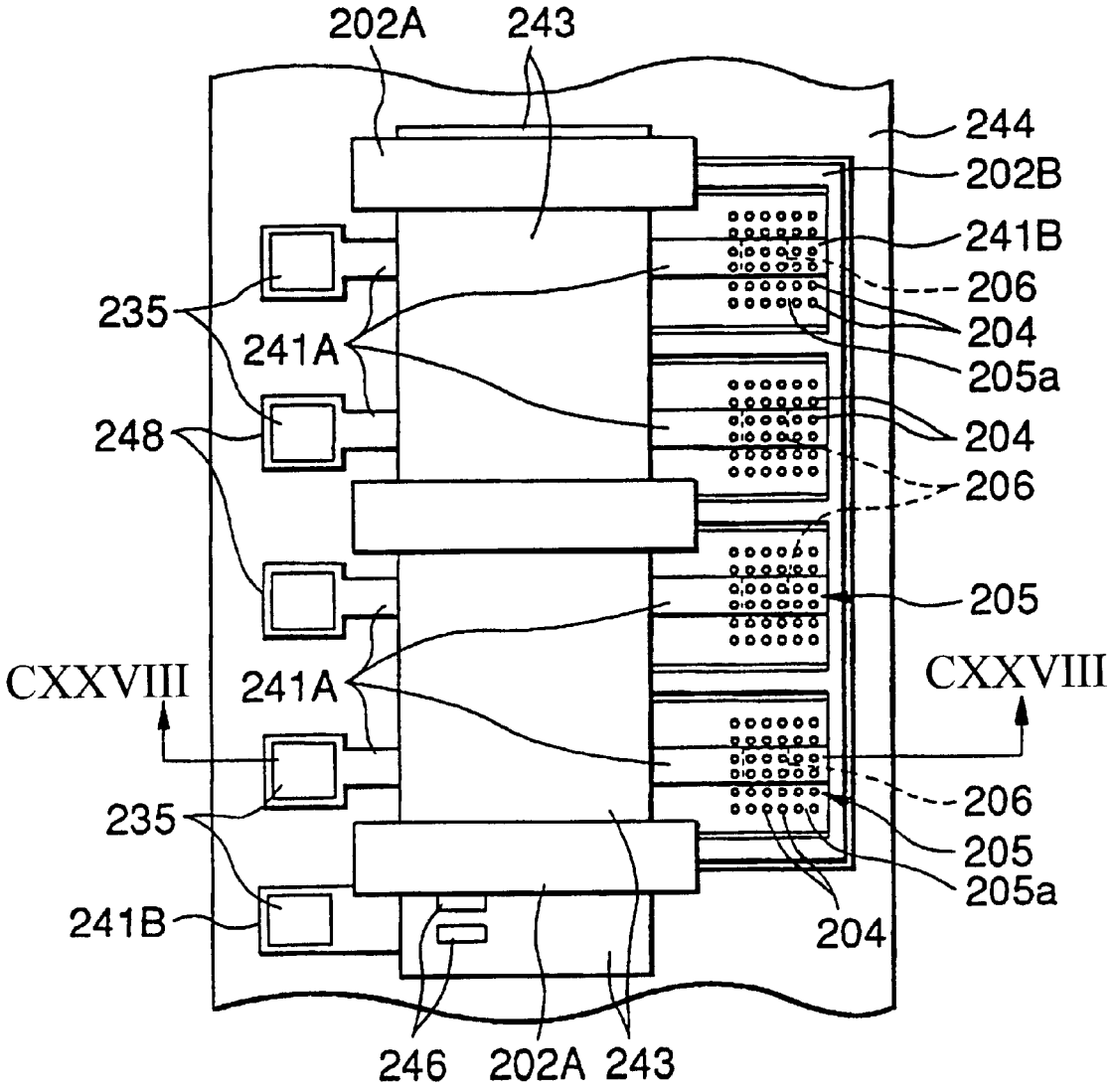
Figure 139:
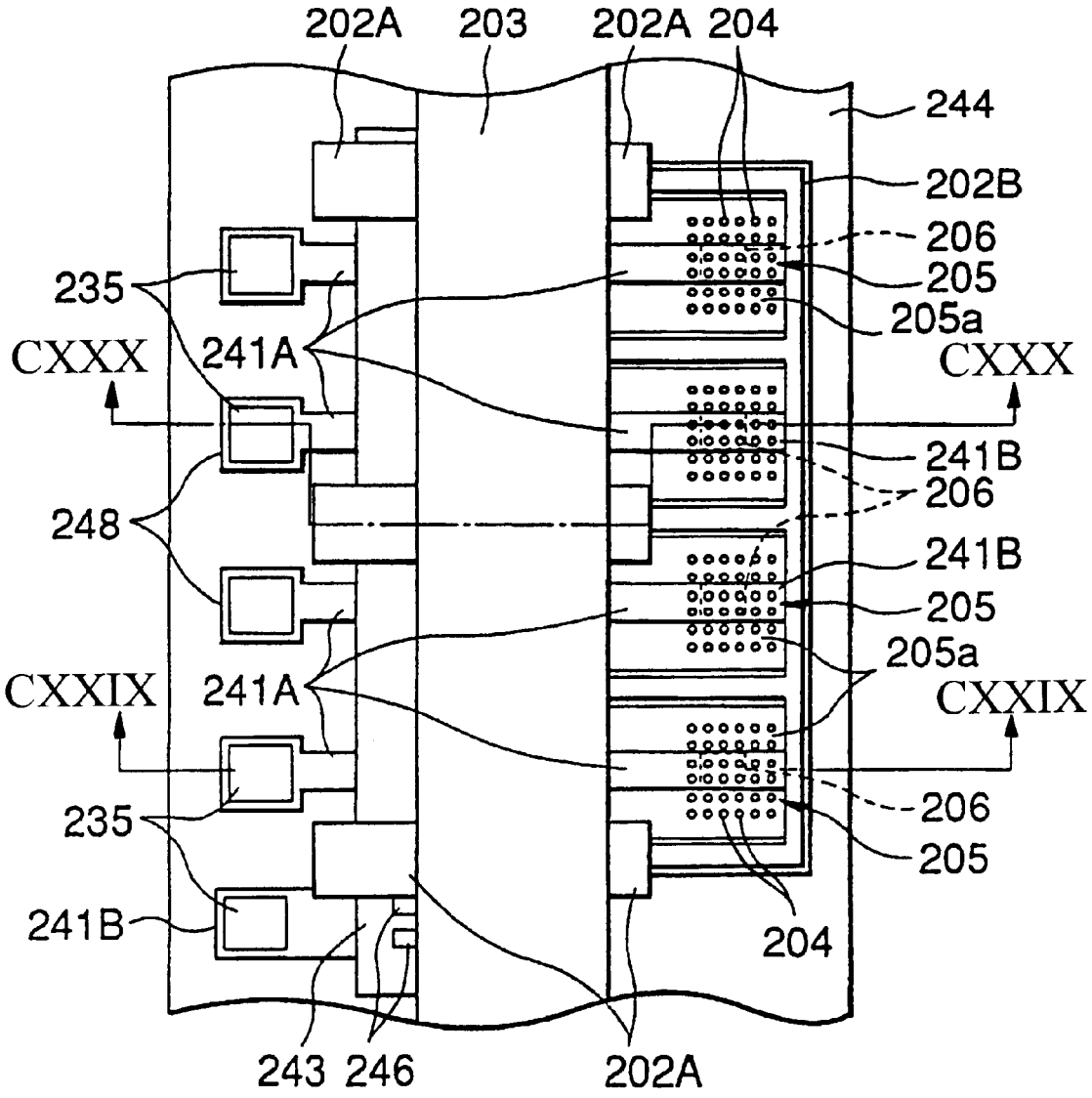
Figure 140:
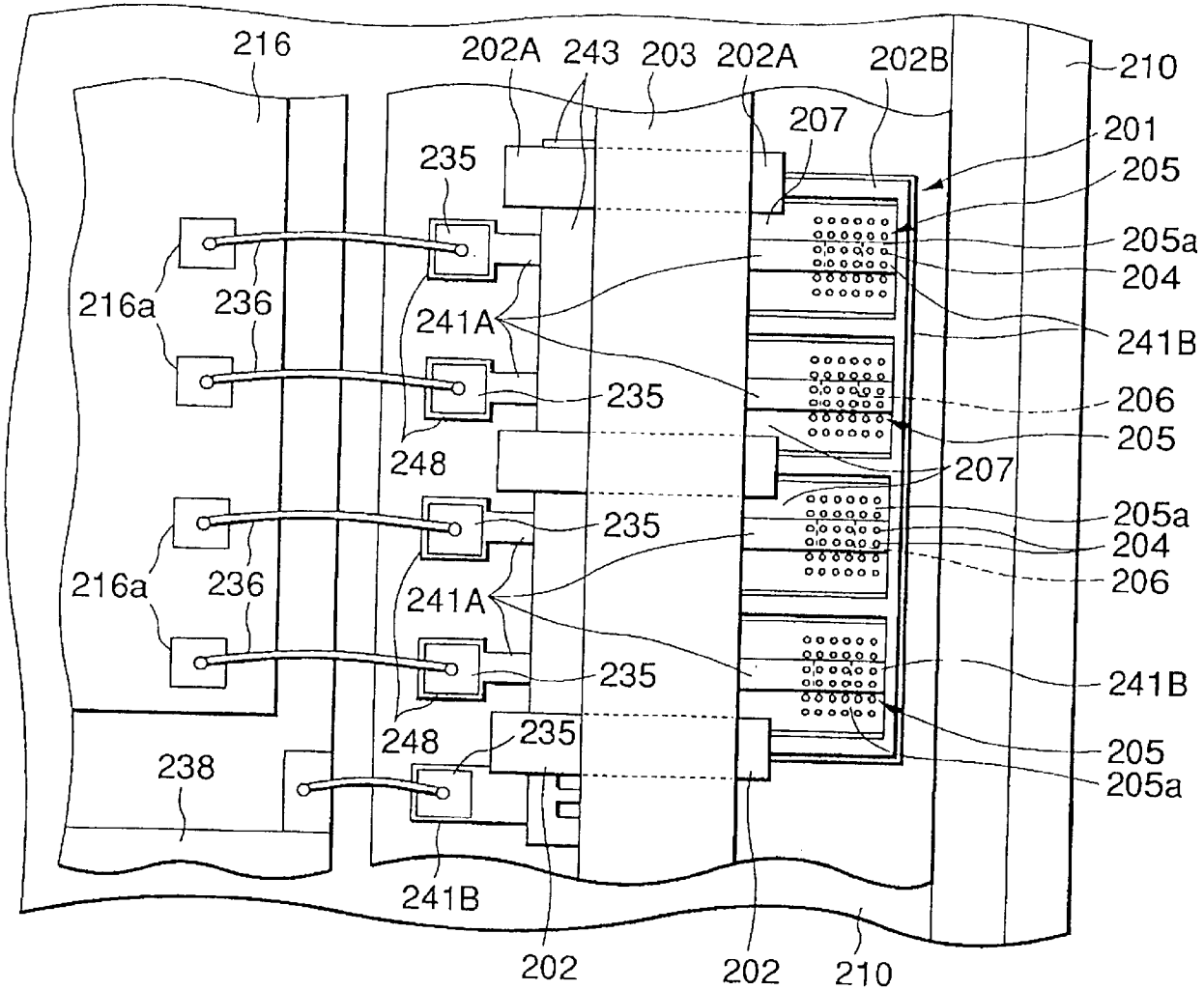
Figure 141:
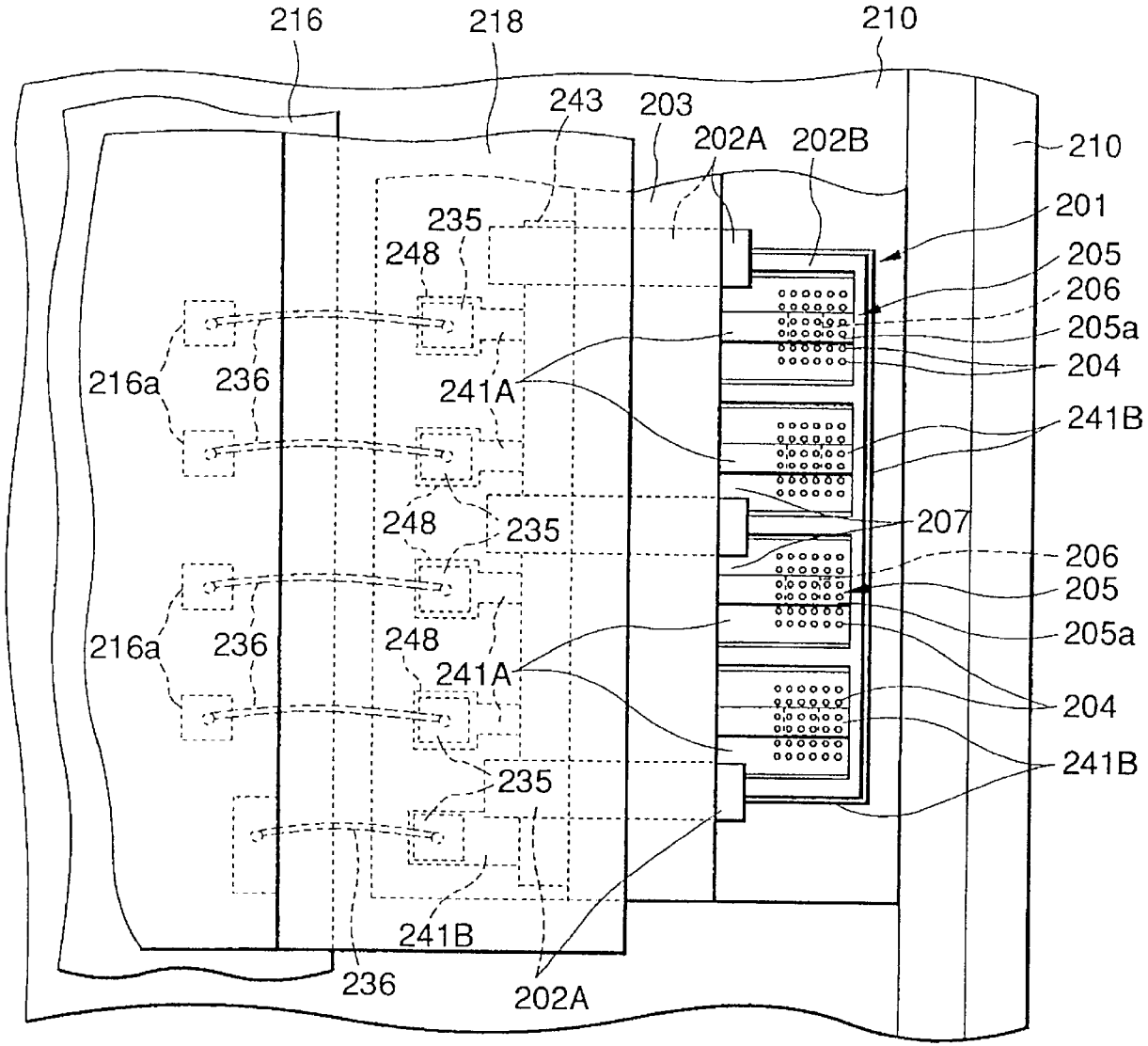
Figure 142:
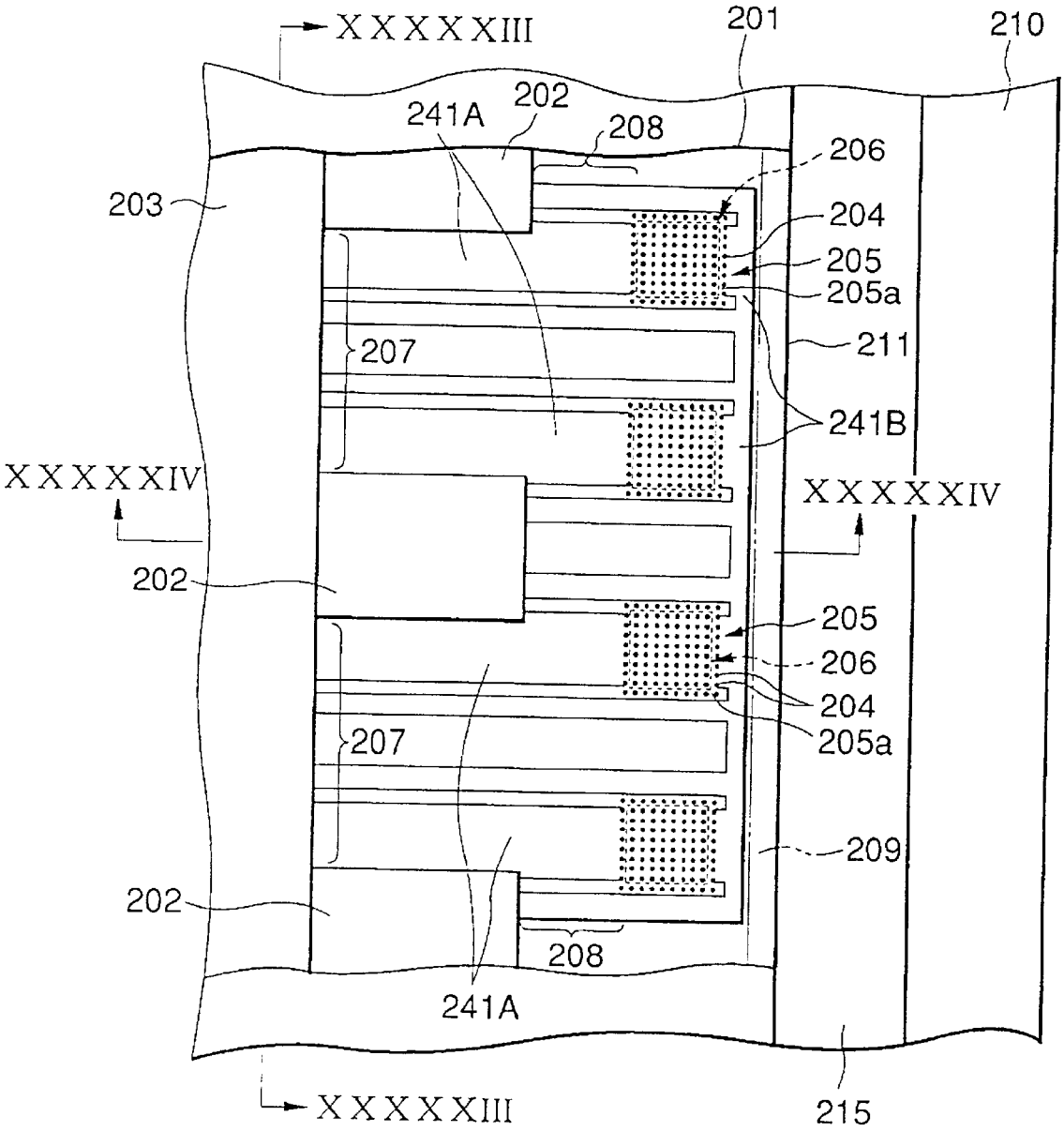
Figure 143:
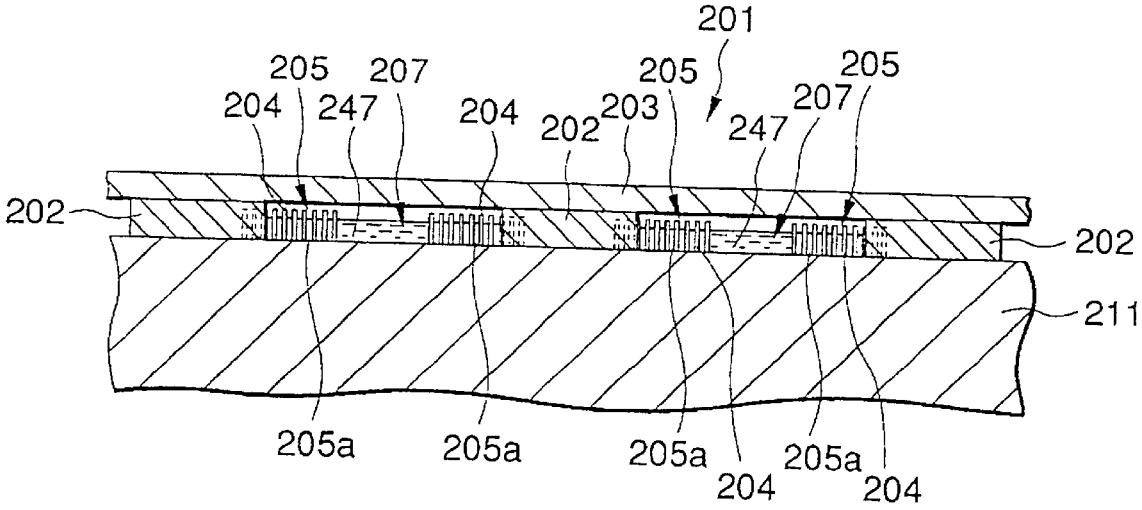
Figure 144:
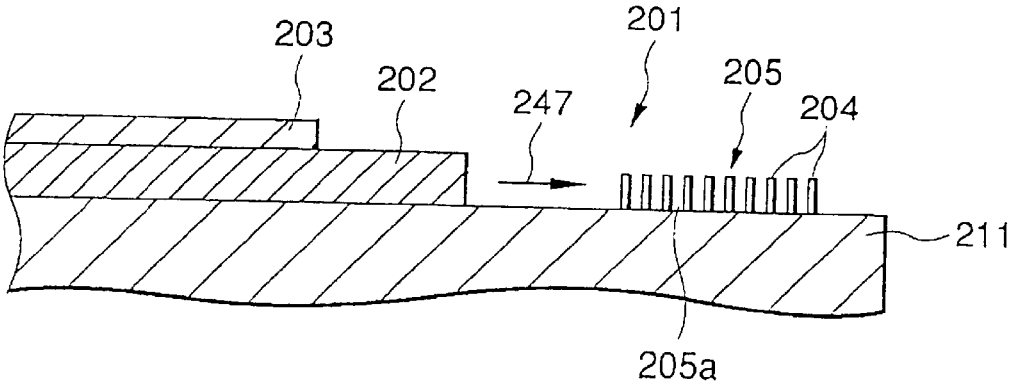
Figure 145:
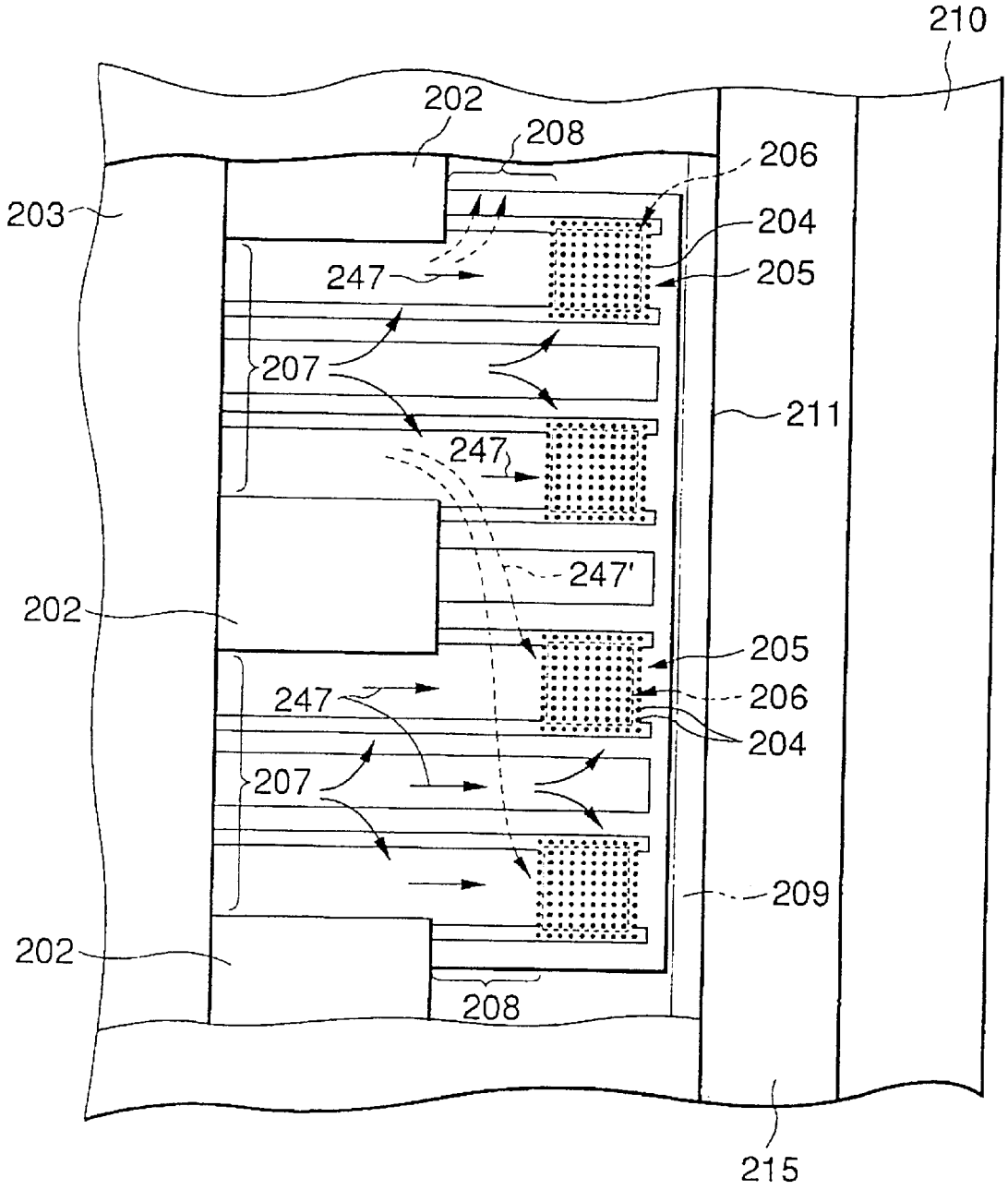

FIG. 131 is a plan view for indicating one manufacturing step of the printer head according to this embodiment;

FIG. 132 is a plan view for showing another manufacturing step of the printer head according to this embodiment;

FIG. 133 is a plan view for showing another manufacturing step of the printer head according to this embodiment;

FIG. 134 is a plan view for showing another manufacturing step of the printer head according to this embodiment;

FIG. 135 is a plan view for showing another manufacturing step of the printer head according to this embodiment;

FIG. 136 is a plan view for showing another manufacturing step of the printer head according to this embodiment;

FIG. 137 is a plan view for showing another manufacturing step of the printer head according to this embodiment;

FIG. 138 is a plan view for showing another manufacturing step of the printer head according to this embodiment;

FIG. 139 is a plan view for showing another manufacturing step of the printer head according to this embodiment;

FIG. 140 is a plan view for showing another manufacturing step of the printer head according to this embodiment;

FIG. 141 is a plan view for indicating a further manufacturing step of the printer head according to this embodiment;

FIG. 142 is a plan view for representing a major portion of a printer head according to a further embodiment of the present invention;

FIG. 143 is a sectional diagram for indicating the printer head, taken along a line XXXXXIII—XXXXXIII of FIG. 142;

FIG. 144 is a sectional diagram for indicating the printer head, taken along a line XXXXXIV—XXXXXIV of FIG. 142; and FIG. 145 is a plan view for showing a major flow portion of dye in the printer head according to this embodiment.

DETAILED DESCRIPTION OF THE PREFERRED EMBODIMENTS

Before describing various examples of preferred embodiments, an explanation will now be made of a recording head by which, for example, a recording operation for an A4 paper size is carried out in the line method.

The recording head employed in the printer disclosed in the above-explained prior invention filed by the same Inventors can be manufactured by using the normal semiconductor manufacturing facility. Since substrates are cut out from a semiconductor wafer, as to a line type printer, approximately 21 sheets of head substrates in which a recording width of a recording head is selected to be on the order of 20 mm may be cut out from a single wafer W having a diameter of, e.g., 4 inches, because the diameter of this wafer is approximately 100 mm. It should be noted that only 3 sheets of a substrate 111 of a recording head having a maximum length of on the order of 80 mm produceable from this single wafer W can be obtained, and accordingly, only the region near the diameter of this wafer is useable, resulting in many waste wafer portions. It is practically difficult to manufacture such a head having the maximum length of 80 mm.

On the other hand, very recently, the size of the wafer under mass production is selected to be 8 inches, namely a diameter of 200 mm, so that a recording head having an A4 paper size (recording width=200 mm to 216 mm) can be hardly manufactured from this 8-inch wafer.

However, since the most popular size of printers is the A4 paper size, there is a significant meaning when a single recording head having this A4 paper size is manufactured. Under such a circumstance, it is necessarily required to manufacture one quasi-A4-sized head by connecting a plurality of heads having shorter recording widths.

Figure 1:
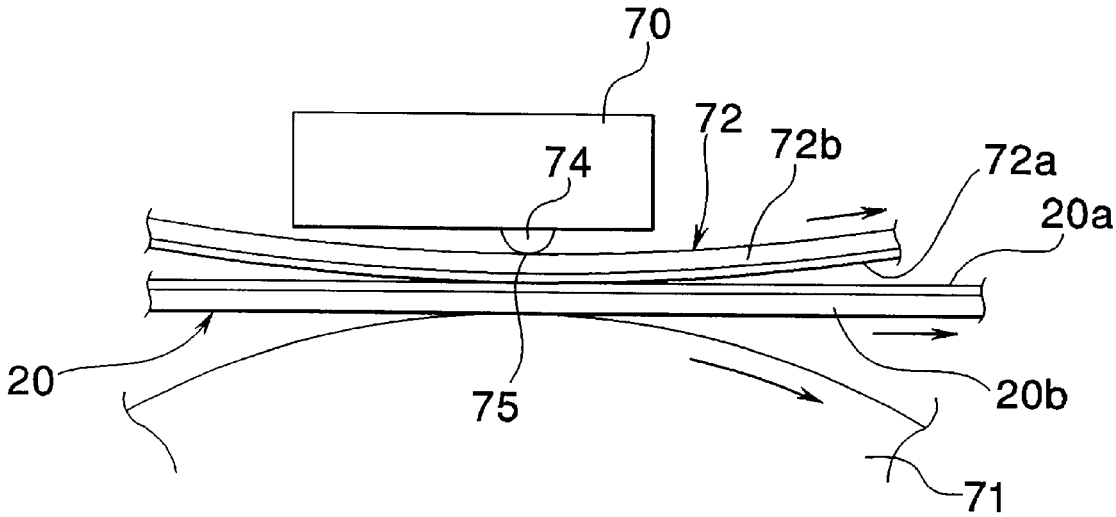
FIG.1 PRIOR ART
FIG. 1 schematically shows a front view for explaining the recording operation by using the conventional thermal head.

On the other hand, in the case that a heater (heating element) is used in a heat source, a common electrode is commonly used to all of the heating elements every heater chip, or heater chip. Accordingly, in order to increase a current capacity, a width of this common electrode must be made wider than that of a separate electrode. In thermal heads shown in FIG. 1 and FIG. 2, a common electrode 77 having a wider width is provided near edge portions of heating elements.

To execute a recording operation under untouched condition as in the prior-filed invention by the same Inventors, the recording material transporting unit must be positioned opposite to the printing medium with keeping a predetermined interval. The spacer for correctly keeping this predetermined interval must be provided near the heating element. In order to correctly maintain the height of this spacer, the spacer must be directly provided on the substrate. Since the width of the region where the common electrode is provided is only 50 $\mu$m, the common electrode having the wider width cannot be provided near the heating element. For instance, the necessary width of this common electrode is on the order of 3 mm.

Figure 2:
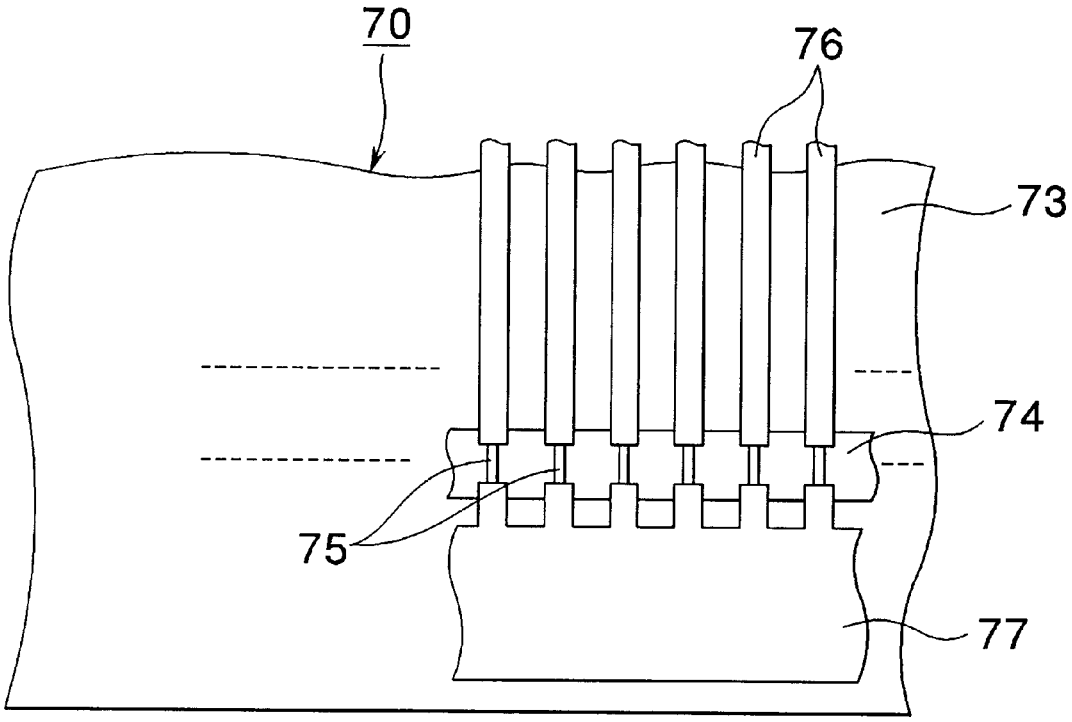
FIG.2 PRIOR ART
FIG. 2 is a plan view for partially representing the inner portion of the conventional thermal head.
Figure 5:
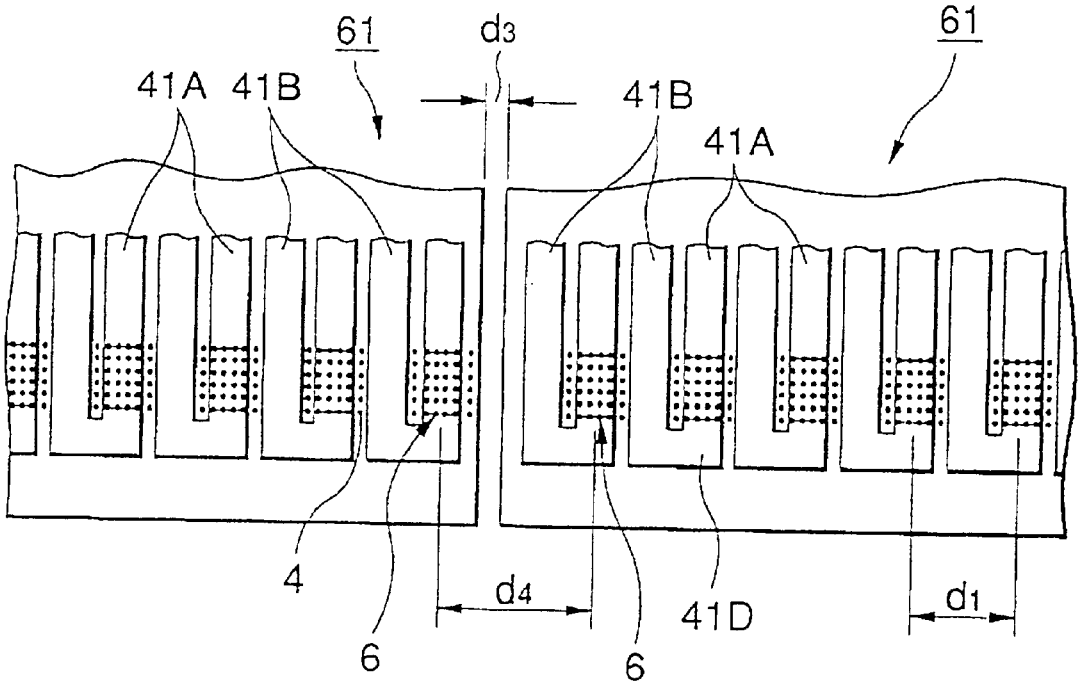
FIG. 5 is a plan view for schematically showing electrodes around a heat emitting portion of a heater chip similar to that of FIG. 3, which is conceived before the inventive idea of the present invention is completed.

As a result, as indicated in FIG. 5, the following solution idea may be conceived: An electrode 41D (having a width substantially equal to that of separate electrode 41A) provided on the opposite side of the heating element 6 of the separate electrode 41A is bent to thereby form a return electrode 41B located in parallel to the separate electrode 41A. Then, these return electrodes are connected to a common conductive film (not shown), which may constitute a common electrode. Also, when the common electrode having such a wider width as shown in FIG. 2 is provided, this common electrode having the wider width must be returned near an edge portion of a printed circuit board (not shown) in order to be connected to this printed circuit board. In this case, the pitches of the heating elements 6 are largely varied at joint portions when the heater chips are arranged as previously described, resulting in inconvenient conditions.

However, even when the heater chip 61 of FIG. 5 is employed, apparently the following problems occur in the case that the heater chips 61 are arranged along a straight line.

FIG. 5 represents, as previously described, the joint portions when the heater chips are arranged. The heater chips 61 contain the heat emitting portion 6, and further contain a separate electrode 41A for supplying a current to the heat emitting portion 6, and return electrodes 41B which are connected to each other at the tip portions, resulting in a common electrode. There is a group of small cylindrical members 4 above the heat emitting portion 6, which may form a vaporizing portion. When the recording density is selected to be 300 dots/inch, a pitch "d1" at which the heating elements 6 are arranged is equal to 0.0847 mm. A small clearance is established from the electrodes (separate electrode 41A and return electrode 41B) to the cutting section. When a margin "d3" used to alignment among the heater chips 61 is selected to be approximately 0.02 mm, a distance "d4" between the heating elements 6 of the edge portion would become approximately 0.132 mm. Thus, the above-described pitch "d1" of 0.0847 mm could not be maintained at this place. As a consequence, the resolution, the optical density, and the gradation at the joint portion would be deteriorated.

As a consequence, if such heater chips are merely arranged, then a single quasi-long head cannot be formed under better condition.

It should be understood that although detailed embodiments of the present invention will now be described, the present invention is not apparently limited to the below-mentioned embodiments.

Figure 3:
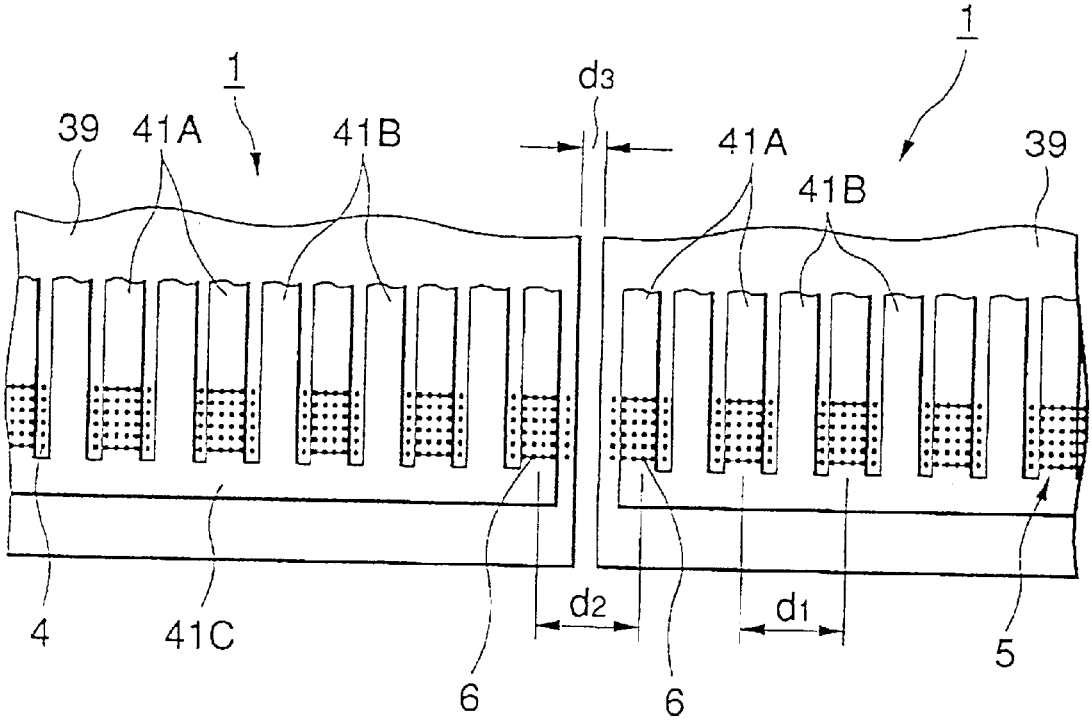
FIG. 3 is a plan view for schematically indicating electrodes located peripheral to a heat emitting portion of a heater chip according to an embodiment of the present invention.

FIG. 3 is a plan view for schematically showing a joint portion in which heater chips of a recording head are arranged, which is similar to FIG. 5. It should also be noted that the same reference numerals shown in FIG. 5 will be employed as those for indicating the same, or similar elements of FIG. 3.

Heating elements 6 are arranged on the heater chip 1 along a straight line. A separate electrode 41A for selectively supplying a current to the heating elements, and a common electrode 41C directly connected to the respective heating elements are provided.

Both a width of this common electrode 41C, and a width of a return electrode 41B branched from the common electrode 41C are made substantially equal to a width of the separate electrode 41A. The return electrode 41B is penetrated through the respective heating elements 6 and the respective separate electrodes 41A, and is arranged in parallel to the separate electrode 41A.

Figure 6:
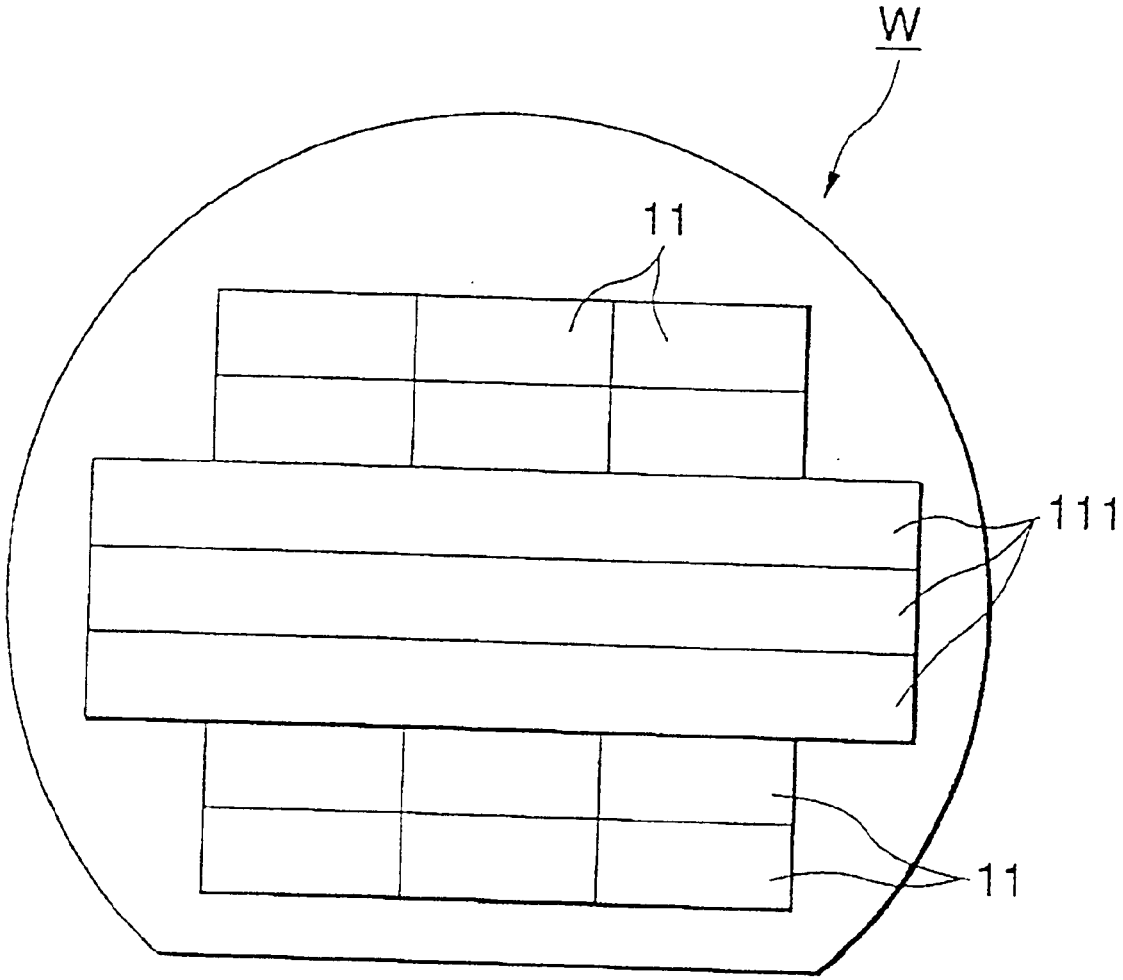
FIG. 6 is a plan view for representing how to cut out the substrate of the heater chip from the semiconductor wafer.

An edge portion of each of the return electrodes 41B is connected to a common conductive film, which will be explained later with reference to FIG. 6.

A group of small cylindrical members 4 is formed on each of the heating elements 6, which constitutes a recording solution jetting portion 5. The recording material jetting portion 5 may hold a recording material, and also may jet the heated dye to a printing medium (not shown).

A specific attention should be paid to the following fact. That is, the return electrode 41B is not provided at the edge portion of the heater chip 1, but is provided only among the respective heating elements 6, and also only among the respective separate electrodes 41A. As previously explained, the common electrode 41C is directly connected to the respective heating elements 6, so that the return electrode can be omitted at the edge portion of the heater chip 1, and the return electrodes, the total number of which is smaller than that of the separate electrodes by 1, may sufficiently function as the common electrode.

A more important aspect is given as follows: That is, as previously described, even when the interval "d3" of the heater chips is set to be 0.02 mm, since no return electrode is provided at the edge portion of the heater chip 1, the pitch "d2" of the heating elements at the edge portion of the heater chip can be made equal to the same dimension (0.0847 mm) as the pitch of the heating elements provided in the heater chip. As a consequence, as explained above, the pitch change of the heating elements at the joint portion of the heater chips can be eliminated, so that the image can be recorded in the better resolution without any fluctuation, with the better optical density and the better gradation.

Figure 4:
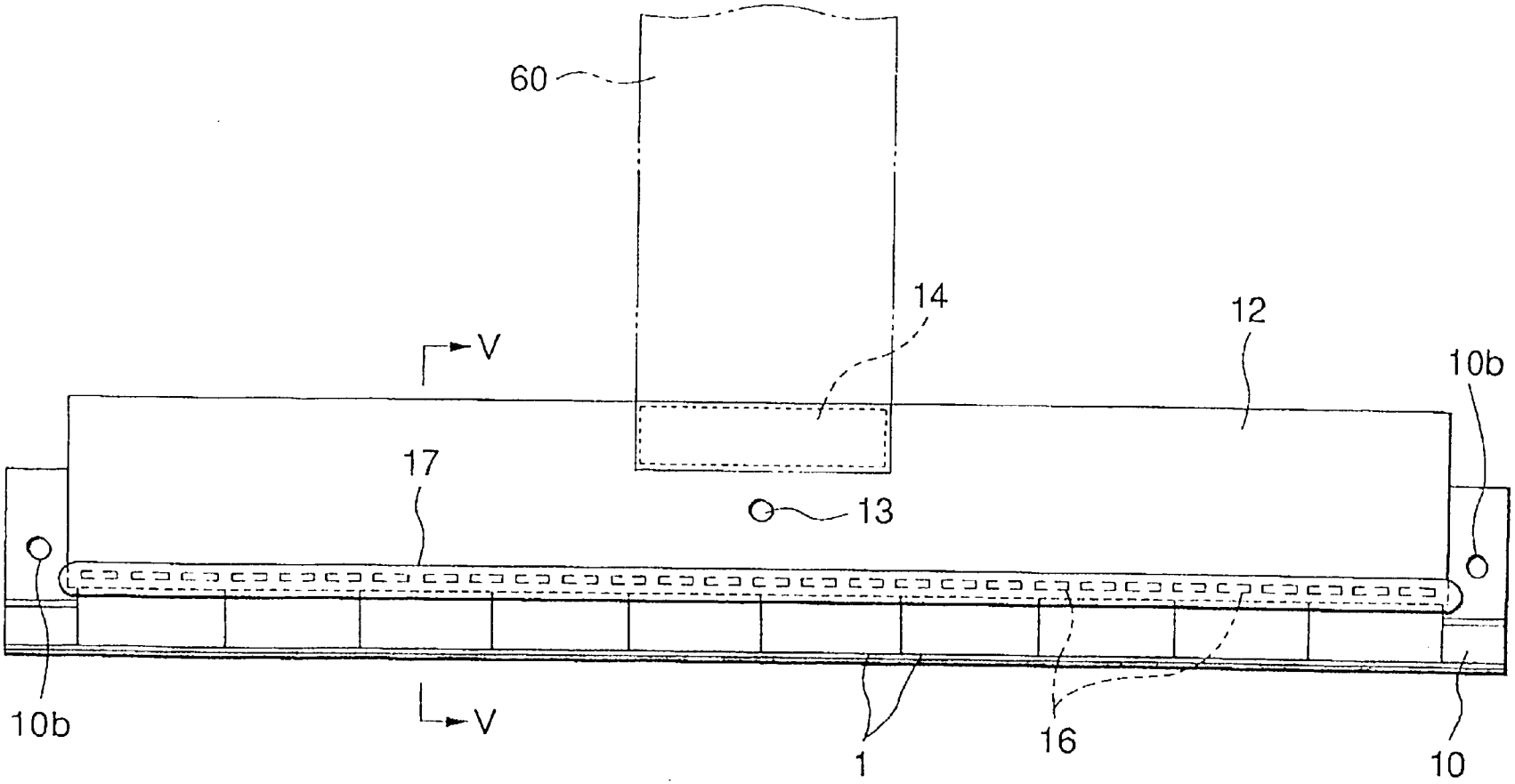
FIG. 4 is a rear surface view for schematically showing a recording head according to an embodiment of the present invention.
Figure 7:
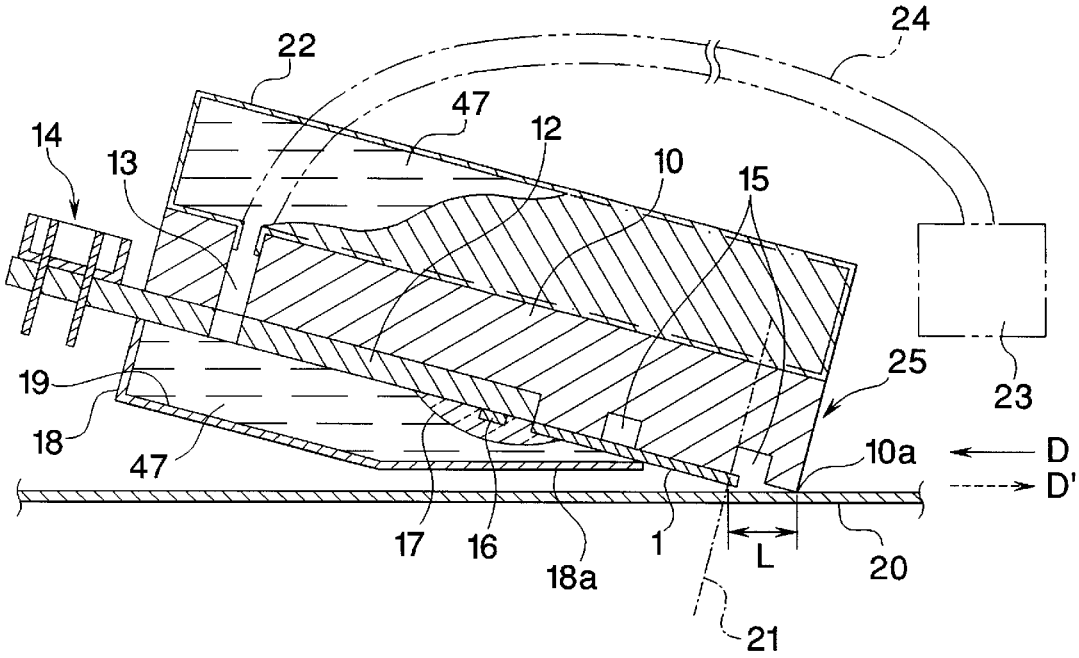
FIG. 7 is a sectional view of a recording head according to an embodiment of the present invention, namely sectional view of the recording head, taken along a line V—V of FIG. 4.

FIG. 4 is a rear view for showing a head used to an A4-paper size printer, and FIG. 7 is a sectional view for representing the head, taken along a line V—V of FIG. 4. It should be understood that for the sake of easy understandings, a cover 18 shown in FIG. 7 has been removed.

In this printer head of this example, a heater chip 1 (will be referred to as a "module" hereinafter) is fixed on a head base 10 by using an adhesive agent having a heat radiation characteristic. A vaporizing unit constructed of 256 elements in the density of 300 dots/inch is assembled into the heater chip 1. The head base 10 is made of a metal having a better heat conductivity such as aluminium and copper. As the adhesive agent, TSE 3281-G (TOSHIBA SILICONE: tradename) is used. To achieve a high speed operation, it is preferable to employ an adhesive agent having a high heat conductivity. However, in case of a low speed operation, a sufficient efficiency may be achieved by lowering the heat conductivity so as to reduce the heat radiation. Therefore, various types of adhesive agents may be selected, depending upon the utilization. A printer head having a recording width of 216.832 mm may be manufactured by arranging 10 sets of such heater chips 1 having the same structure (namely, same module structures).

Also, IC chips 16 are adhered on the head base 10 in such a manner that these IC chips are arranged on a dye-bonded printer circuit board 12. The IC chips 16, the heater chips 1, and the printed circuit board 12 are connected to each other by employing wire bonds to constitute a drive circuit. The IC chips 16 are protected by a coating 17 by a silicone resin, or an epoxy resin. As the packaging (mounting) method of the IC chips, not only the above-explained wire bonding method, but also other packaging method such as TAB may be utilized.

Then, a connector 14 is mounted on the printed circuit board 12 so as to be connected to circuit elements within the printer.

A cover 18 made by press-treating a stainless steel plate is adhered on these elements by using the silicone resin, or the epoxy resin so as to seal these elements. Then, a recording material (dye) conducting hole 13 is formed in both the printed circuit board 12 and the head base 10. An inner surface of the cover 18 may constitute a common dye supplying path 19 which accepts a dye 47 conducted from the dye conducting hole 13 and then supplies this dye 47 to a branching path (reference numeral 7 shown in FIG. 43 to FIG. 46, will be explained later). Also, the head base 10 owns such a structure that this head base 10 is fixed via a mounting hole 10*b* of FIG. 4 to the recording head 25 by a screw.

Then, as shown in FIG. 7, this cover 18 is shaped as a box as an entire shape in such a way that an inclined surface 18*a* is formed on a surface located opposite to the printing medium 20 in accordance with use conditions (will be discussed later), and a side surface thereof constitutes a wall surface. Then, a tip portion of this cover 18 is closely made in contact with the heater chip 1, both the printed circuit board 12 and an adhesive surface of the cover 18 to the heater chip 1 are sealed by an adhesive agent in order that the dye 47 is not leaked.

In accordance with the recording head 25 formed in this manner, as indicated in FIG. 7, one end 10*a* of the head base 10 positioned on the side of the provision of the heater chip 1 is made in contact with the printing medium 20, so that while a preselected angle can be maintained with respect to the printing medium 20, an interval between a center 21 of the dye jetting portion 5 (namely, a center of heat emitting portion 6) and the printing medium 20 can be kept constant.

In FIG. 7, an arrow "D" of a solid line indicates a scanning direction of the recording head 25 during printing operation, whereas another arrow "D'" of a broken line indicates a returning direction of the recording head 25 after printing operation. As a consequence, during the printing operation, the heating element is heated in response to a signal corresponding to image data supplied via the connector 14 provided at another edge portion of the printed circuit board 12 so as to vaporize the dye 47 from the dye jetting portion 5, and then the vaporized dye 47 is jetted to the printing medium 20. A wiring pattern formed on the printed circuit board 12 is connected via the connector 14 to a flexible signal cable (ribbon cable in this example) (not shown in detail).

The dye 47 which has been jetted to be adhered onto the surface of the printing medium 20 is sufficiently fixed on this printing medium 20 for a time duration during which the recording head is moved over a distance "L" between the center 21 of the dye jetting portion on the heating element 6 and a contact portion 10*a* of the head base 10 with respect to the printing medium 20, and then this contact portion 10*a* reaches the center 21 of the dye jetting portion (namely, adhered position of dye). Accordingly, there is no risk that the adhered dye is scratched, or dirtied since the contact portion 10*a* is made contact with the adhered dye. Also, since there is such an effect that waving surfaces of the printing medium 20 can be flattened by this contact portion 10*a*, the printed images having the better image qualities can be produced.

In accordance with this embodiment, since the recording material jetting portion of the recording head 25 is set under downward condition, the jetted dyes are rapidly cooled by ambient air to be condensed. The condensed dyes are directly dropped and adhered onto the printing medium 20, so that most of the jetted dyes can be transferred to this printing medium 20. It should be understood that this recording material jetting portion may be used under upward condition.

As the method for conducting the dye 47 from the head base 10 side to the dye conducting hole 13, for instance, a detachable type dye reservoir tub 22 is mounted on a rear portion of the head base 10, and the dye 47 is automatically injected via the dye conducting hole 13 to the commonly used dye supplying path 19 by receiving gravity.

It should also be noted that as indicated by a virtual line, the bottom wall of the dye reservoir tub 22 is made in a thin-plate shape and is inclined so as to have a rectangular-shaped inside sectional plane. Then, since the recording head 25 is inclined in a reverse direction during the non-operation condition, the dye left inside this dye reservoir tub 22 may be supplied from the dye conducting hole 13 onto the cover 18 so as to be recorded on the printing medium. Also, as indicated by a virtual line in this drawing, the dye reservoir tub 23 may be provided at a place apart from the recording head 25, and thus the dye 47 may be alternatively supplied via a flexible conducting tube 24 which connects the reservoir tub 23 to the dye conducting hole 13.

As the dye 47, a yellow (Y) dye, a magenta (M) dye, and a cyan (C) dye were used which were produced by solving 15 weight % of solvent yellow 56, disperse red 1, solvent blue 35, respectively, into dibutyl phthalate at 50° C. When this dye 47 heated at 50° C. is conduced into the dye reservoir tub 22 of the recording head 25, the dye 47 may be automatically conduced via the path 13 to the recording portion.

Figure 8:
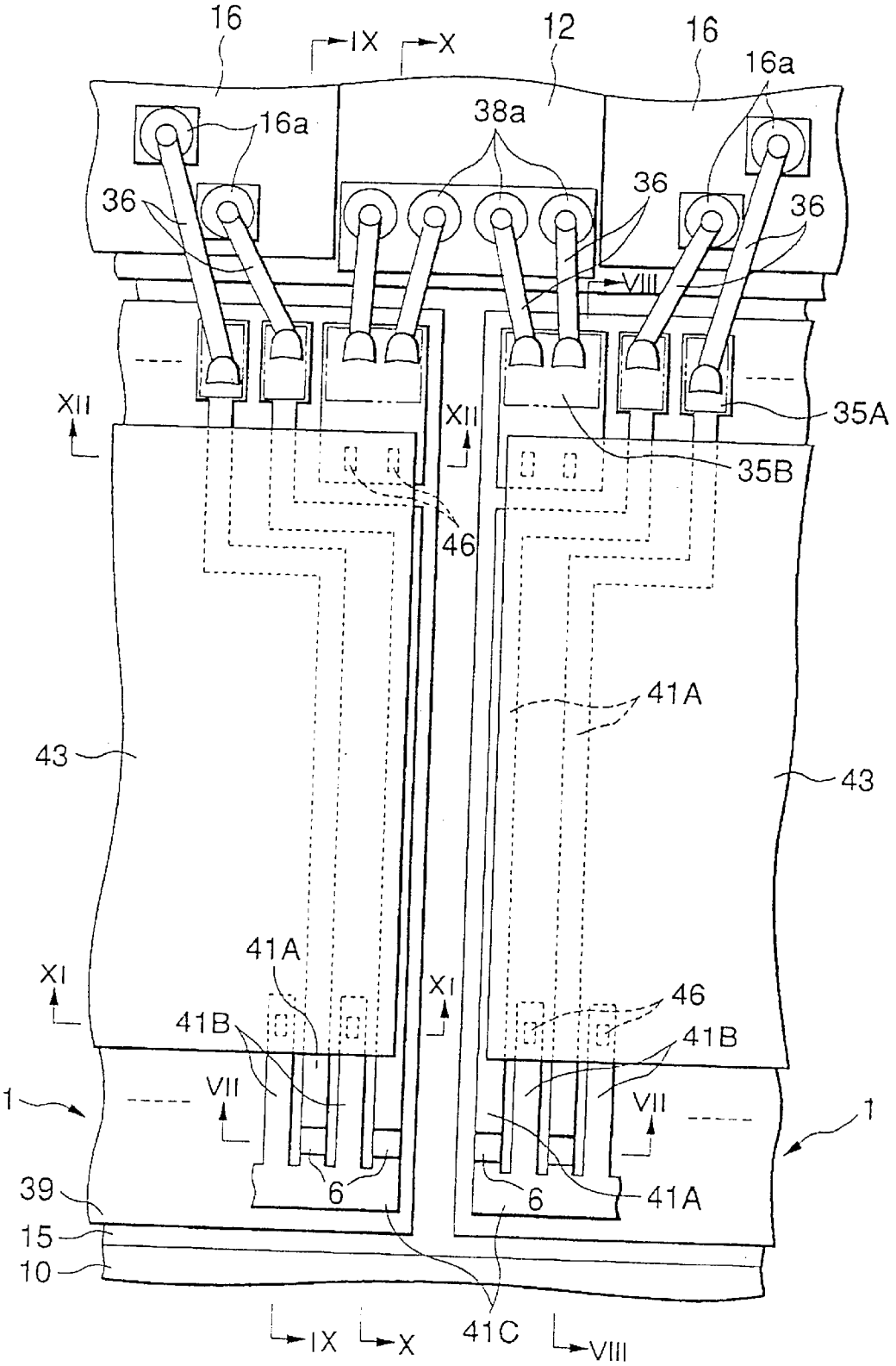
FIG. 8 is a plan view for partially indicating electric connections made within the heater chip of FIG. 3.
Figure 9:
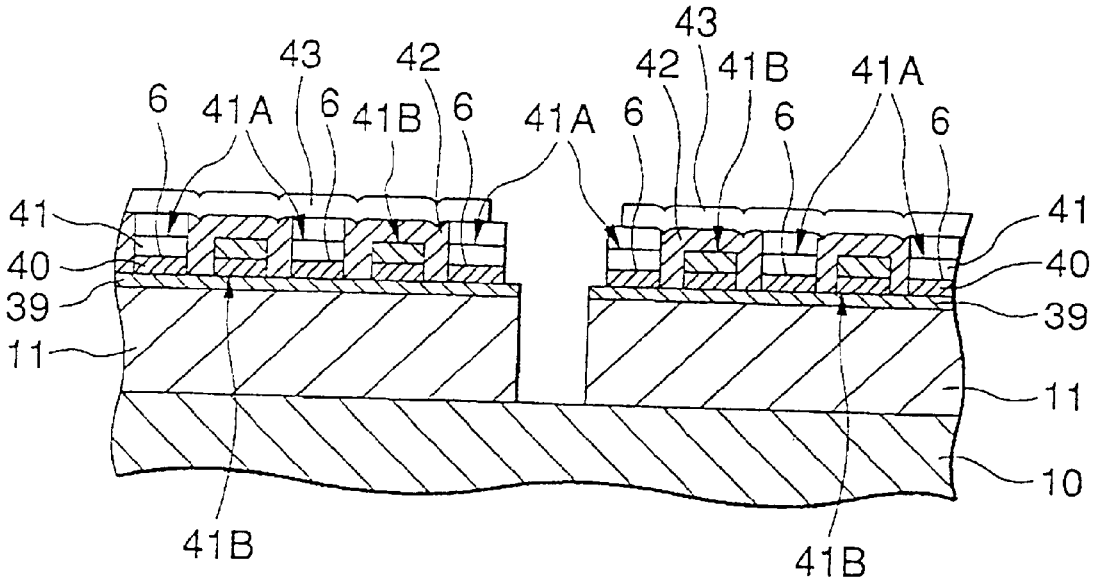
FIG. 9 is a sectional view for showing the recording head, taken along a line VII—VII of FIG. 8.
Figure 10:
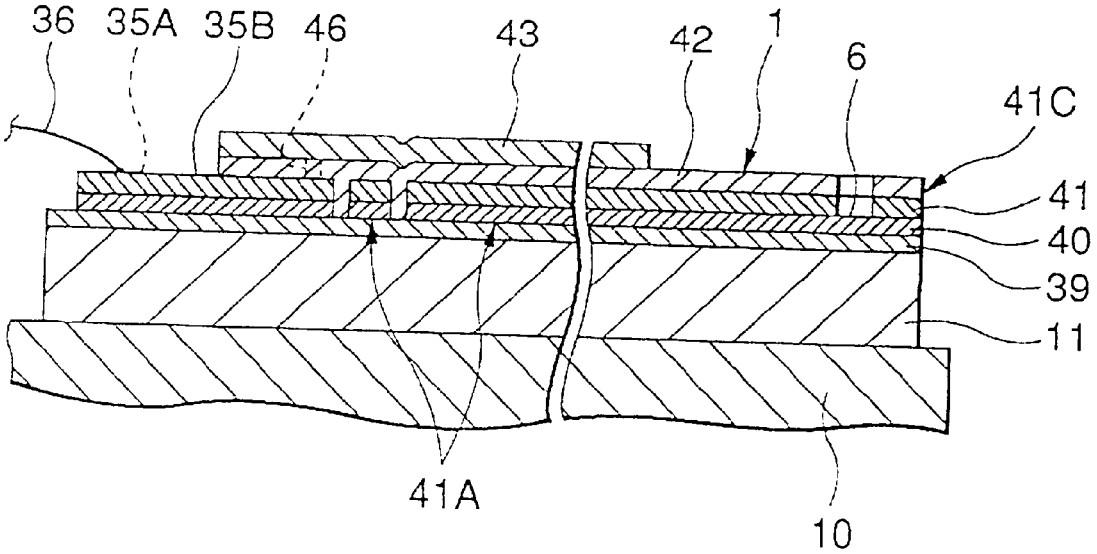
FIG. 10 is a sectional view for showing the recording head, taken along a line VIII—VIII of FIG. 8.
Figure 11:
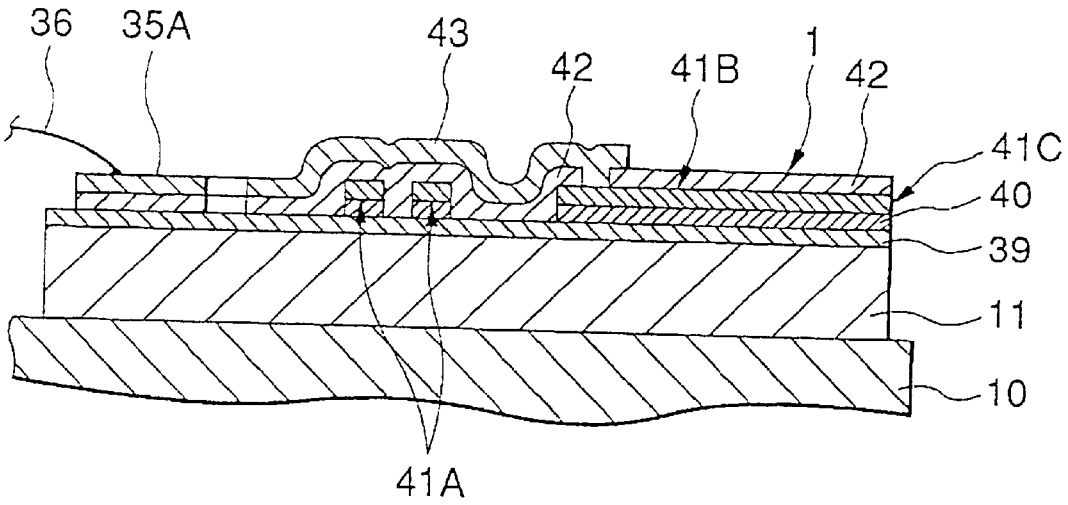
FIG. 11 is a sectional view for showing the recording head, taken along a line IX—IX of FIG. 8.
Figure 12:
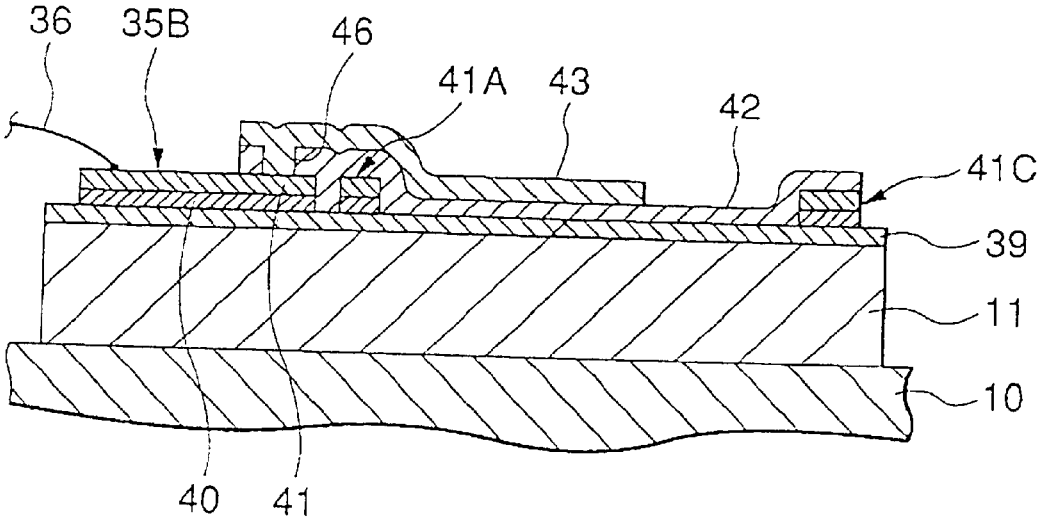
FIG. 12 is a sectional view for showing the recording head, taken along a line X—X of FIG. 8.
Figure 13:
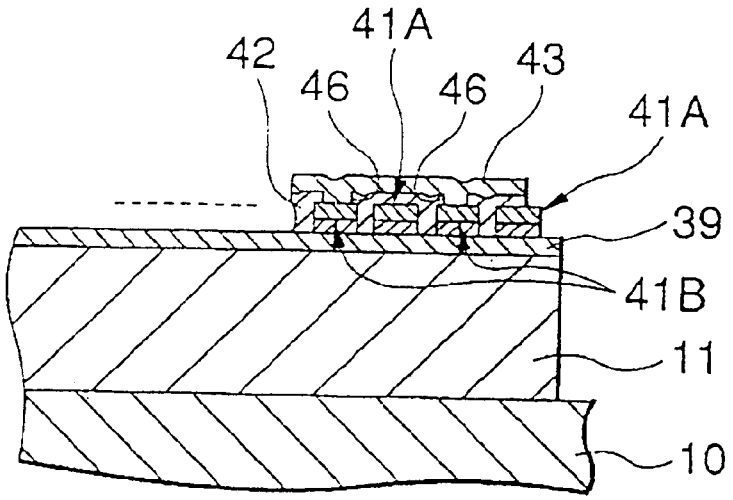
FIG. 13 is a sectional view for showing the recording head, taken along a line XI—XI of FIG. 8.
Figure 14:
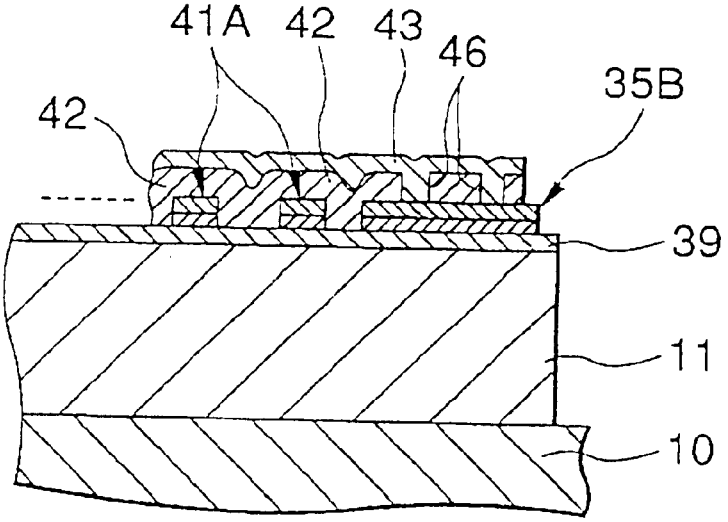
FIG. 14 is a sectional view for showing the recording head, taken along a line XII—XII of FIG. 8.

Next, a description will now be made of an electric connection made in the heater chip 1. FIG. 8 is a plan view for representing an electric circuit connection. FIG. 9 is a sectional view of this electric circuit connection, taken along a line VII—VII of FIG. 8. FIG. 10 is a sectional view of this electric circuit connection, taken along a line VIII—VIII of FIG. 8. FIG. 11 is a sectional view of this electric circuit connection, taken along a line IX—IX of FIG. 8. FIG. 12 is a sectional view of this electric circuit connection, taken along a line X—X of FIG. 8. FIG. 13 is a sectional view of this electric circuit connection, taken along a line XI—XI of FIG. 8. FIG. 14 is a sectional view of this electric circuit connection, taken along a line XII—XII of FIG. 8.

The separate electrode 41A, the return electrode 41B, the common electrode 41C, and the bonding pad 35B for the common electrode are wired by way of a first electrode layer made of a higher conductive member such as aluminium. The bonding pad 35A for the common electrode is extended to a tip portion of the separate electrode 41A.

An insulating film made of an insulating material such as silicon oxide and silicon nitride is formed on the first electrode layer. A through hole 46 is partially formed in this insulating film, and the common electrode 43 formed in a second electrode layer made of a higher conductive member on the insulating film is connected to this through hole 46. The return electrode 41B is further connected from the common electrode 43 in the second electrode layer is connected via the through hole 46 to the bonding pad 35B for the common electrode at the first layer. The bonding pad 35B for the common electrode is connected to the bonding pad 38*a* for the common electrode formed on the printed circuit board 12, by the bonding wire 36, which constitute an electric circuit.

On the other hand, the separate electrode 41A is wired by the first electrode layer and then is reached to the bonding pad 35A for the separate electrode. This bonding pad 35A for the separate electrode is connected to the IC chip 16 by the bonding wire 36, which constitute another electric circuit.

It should also be noted that although the region other than the exposed portion (namely, region surrounded within virtual line of FIG. 8) of the bonding pads 35A and 35B made of the aluminium layer is protected by a layer of silicon oxide ($SiO_2$), this protective layer is omitted from FIG. 8 to FIG. 14.

Referring now to FIG. 4 to FIG. 8, a more detailed explanation is made of a connection portion between the electrodes of the heater chip 1 and the IC chip 16, and also a connection between the electrodes of the printed circuit board 12 and the IC chip 16. FIG. 13 is an enlarged plan view for partially showing these connections, namely indicates only one (right end) of 4 pieces of the IC chips 16 arranged on the printed circuit board 12 every one heater chip 1.

Each of large numbers of separate electrodes 41A formed on the heater chip 1 is connected to one bonding pad 16*a* of the IC chip 16 by the bonding wire 36, and the common electrode 41B of the heater chip 1 is connected to a common electrode wire line 38 of the printed circuit board 12. The other pad 16*b* of the IC chip 16 is connected to a circuit wire line (pattern) 37 of the printed circuit board 12 by the bonding wire 36. The respective wire lines 37 and 38 are conducted via a through hole 60 to the connector 14, depending upon places.

As a result, a signal in response to image information supplied from an FPC (not shown) connected to the connector 14 is furnished via this connector 14 from the circuit wire line 37 of the printed circuit board 12 through the IC chip 16 to a preselected separate electrode 41A of the heater chip 1.

Then each of the heaters 6 (concretely speaking, polysilicon heating member) provided between the separate electrode 41A of the heater chip 1 and the common electrode 41B is energized so as to heat the dye 47 held in the small cylindrical member (4) group shown in FIG. 3 formed on the heaters 6, so that the heated dye 47 is jetted to the printing medium 20.

As a result, a sufficient amount of dyes 47 must be continuously held during the image recording operation in the dye jetting portion 5 having the porous structure and constructed of the small cylindrical member (4) group. Moreover, the dyes 47 which are consumed by the image recording operation must be supplied without any problem. This requirement can be sufficiently satisfied by the below-mentioned structures which will be described with reference to FIG. 43 to FIG. 46.

Practically speaking, the supply of the selection signal to the separate electrode 41A is readily controlled by the following manner. That is, a common block is constituted with respect to a plurality of separate electrodes, and the heating members are individually, or wholly driven within this common block.

Figure 16:
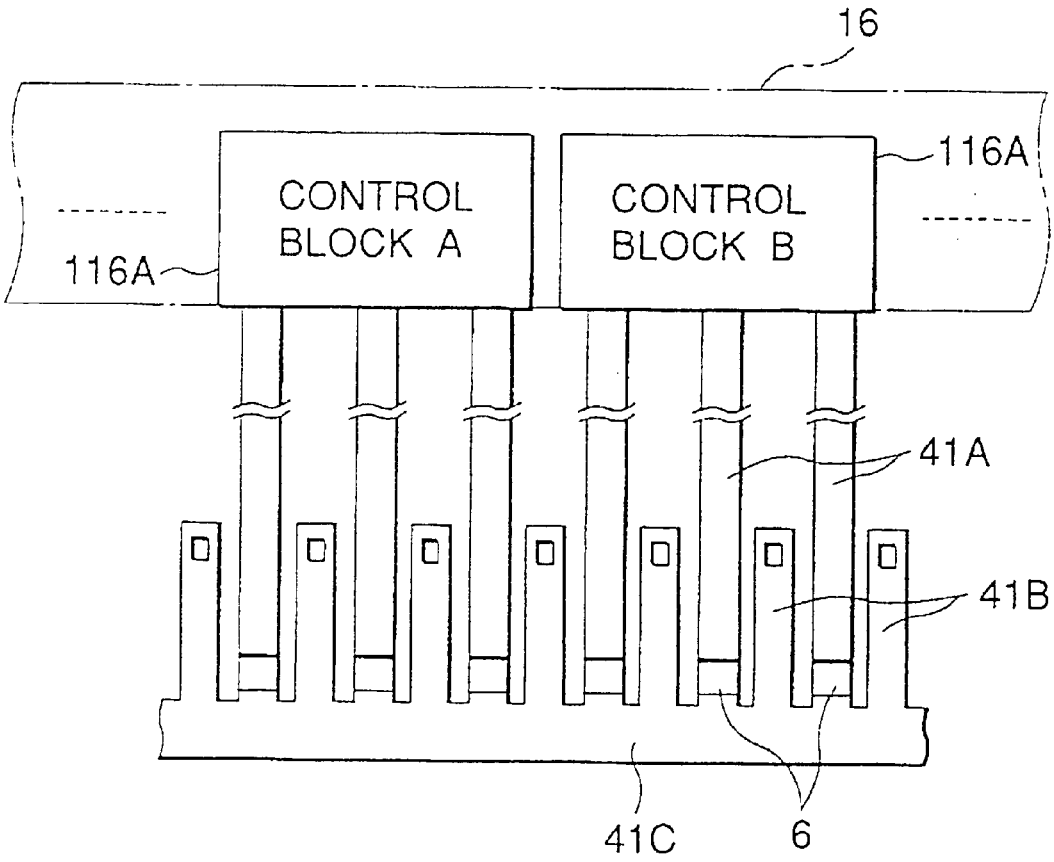
FIG. 16 is a schematic diagram for explaining one mechanism of a heat emitting portion drive control.
Figure 17:
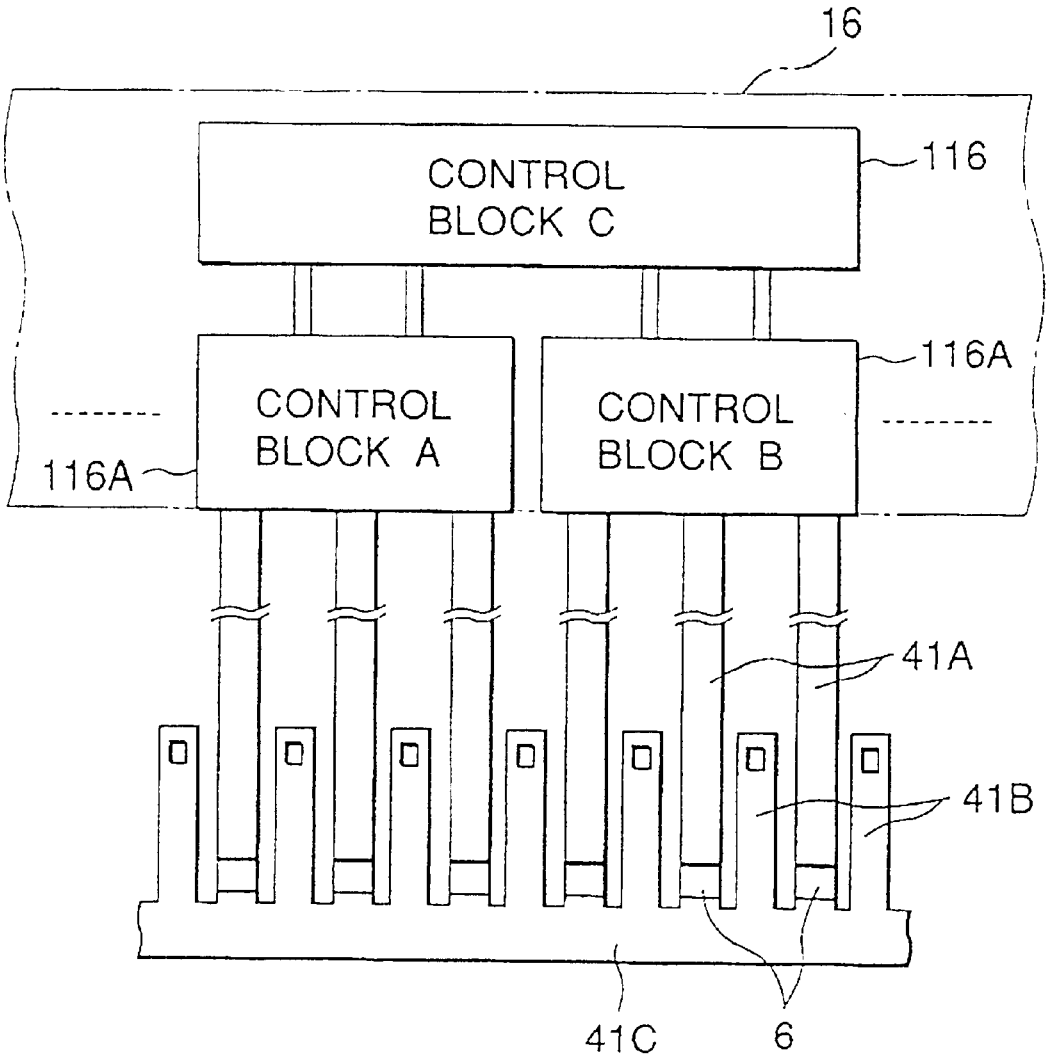
FIG. 17 is a schematic diagram for explaining another mechanism of the heat emitting portion drive control.

FIG. 16 is a schematic diagram for showing a control arrangement for the IC chip 16. As shown in FIG. 16, control blocks A, B, . . . (reference numeral 116A) are provided in the IC chip 16, and the heating element 6 is driven by each of these control blocks A, B, . . . . FIG. 17 schematically shows another example in which a control block C (reference numeral 116) for controlling the respective control blocks A , B, . . . , (reference numeral 116A) is employed. Thus, the heating element 6 is driven by each of the control blocks 116A.

Next, a manufacturing step of the above-described recording head according to this embodiment will now be explained. FIG. 18 to FIG. 33 are sectional views for representing the heater chips in the respective manufacturing steps. FIG. 34 to FIG. 42 are plan views for showing the heater chips in a portion of the manufacturing steps corresponding to the above-described manufacturing steps. It should be understood that FIG. 18 to FIG. 33 show sectional views at the position corresponding to the line VIII—VIII of FIG. 8.

Figure 18:
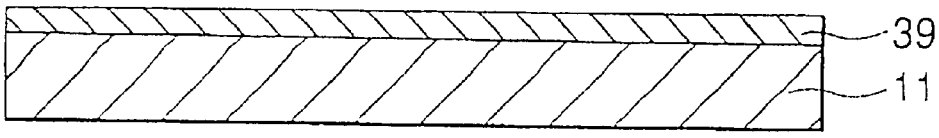
FIG. 18 is a sectional view for indicating one manufacturing step of the heater chip according to the embodiment of the present invention.

FIG. 18 represents a first manufacturing step at which a silicon wafer having a better heat radiation characteristic (namely, high thermal conductivity) is used as a substrate 11, and an $SiO_2$ layer 39 having a thickness of on the order of 1 to 2 $\mu$m is formed on this substrate 11 by way of the thermal oxidation method, or the CVD (chemical vapor deposition) method. Since the $SiO_2$ layer 39 may function as a heat storage layer immediately under the heating element (reference numeral 6 in FIG. 10, will be discussed later), the thickness of this $SiO_2$ layer 39 must be determined by considering the heat radiation characteristic of the heat sink of aluminium which constitutes a base.

Figure 19:
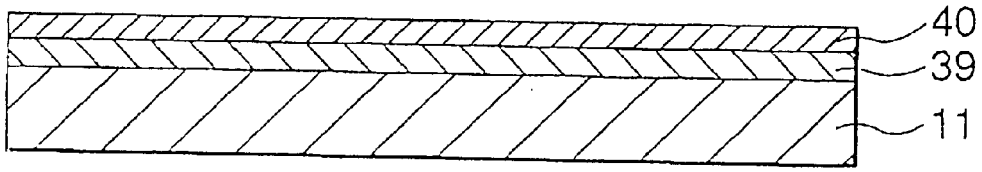
FIG. 19 is a sectional view for showing another manufacturing step of the heater chip according to the embodiment of the present invention.

Subsequently, as indicated in FIG. 19, a film of a polysilicon layer 40 which constitutes a resistance member (heating element) is formed on the $SiO_2$ layer 39 by way of the decompression CVD method under such a condition that a thickness of this polysilicon film layer is on the order of 0.4 $\mu$m. The film of this polysilicon layer 40 is manufactured by doping phosphorus in order that a sheet resistance thereof is on the order of 4 k$\Omega$.

Figure 20:
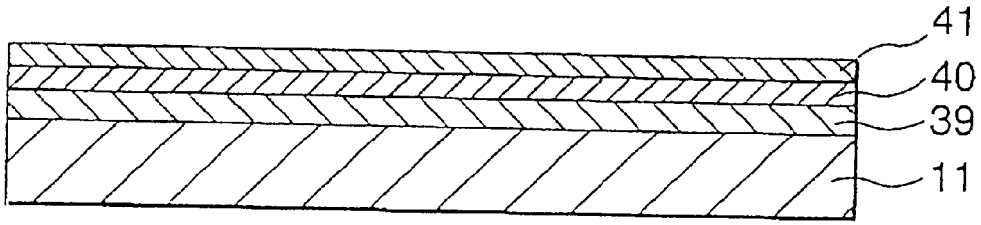
FIG. 20 is a sectional view for showing another manufacturing step of the heater chip according to the embodiment of the present invention.

Next, as indicated in FIG. 20, a film of aluminium 41 into which titanium is slightly doped is formed on the polysilicon layer 40 by way of the sputtering method. In this case, any metals other than aluminium, such as gold, copper, and platinum may be used as the conductive material.

Figure 21:
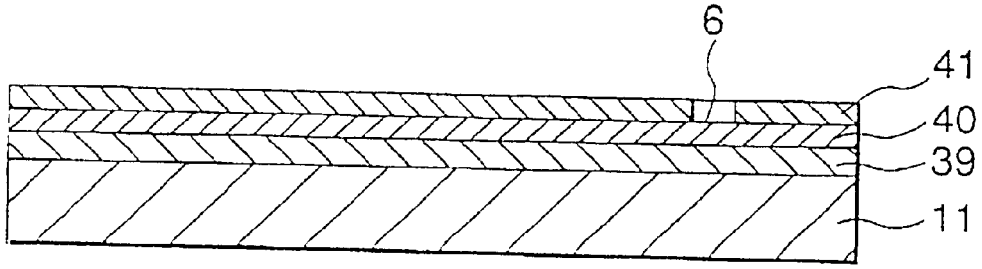
FIG. 21 is a sectional view (i.e., sectional view, taken along a line XIX—XIX of FIG. 34) for representing another manufacturing step of the heater chip according to the embodiment of the present invention.
Figure 34:
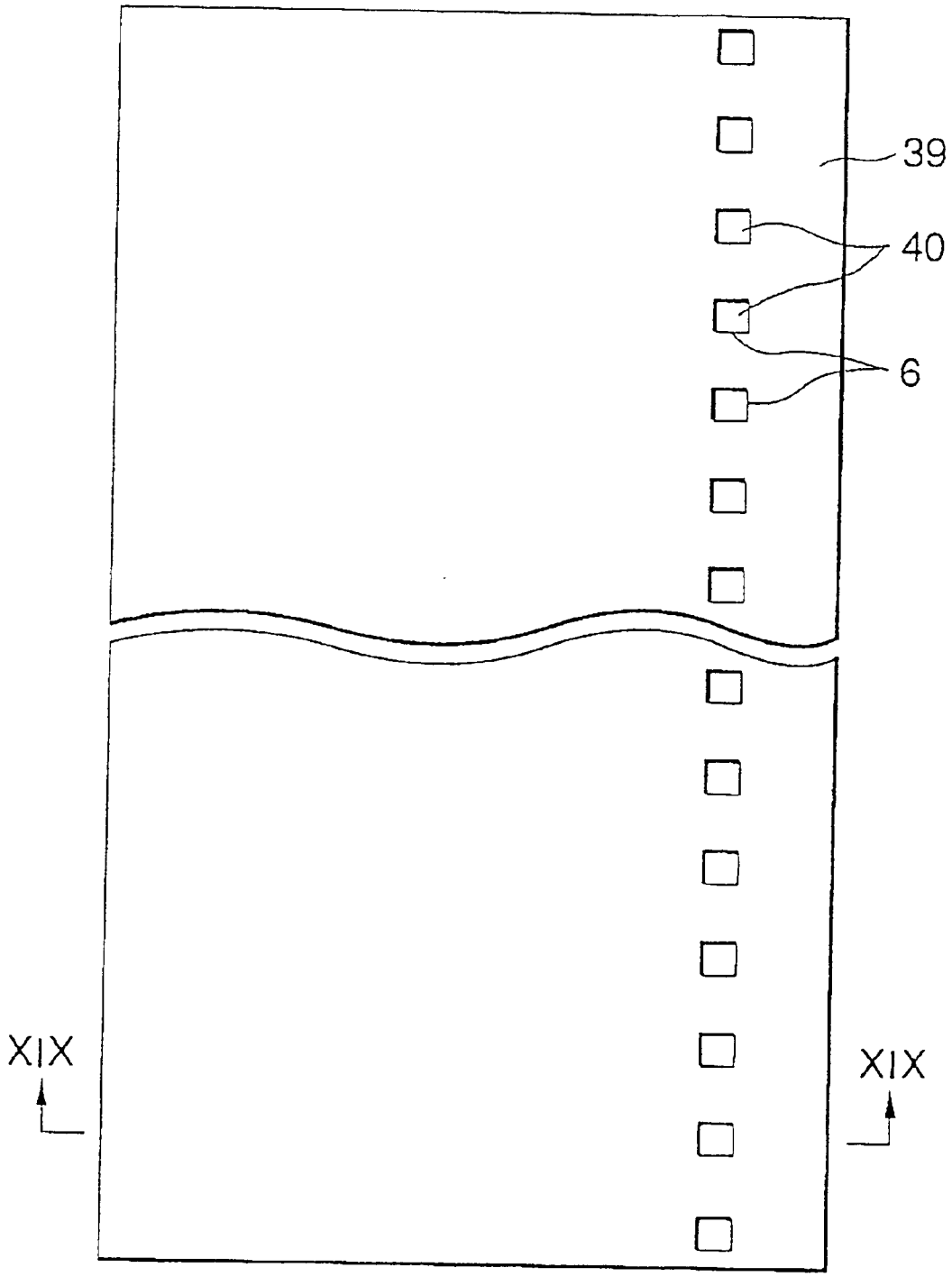
FIG. 34 is a plan view for indicating one manufacturing step of the heater chip according to the embodiment of the present invention.

Next, as shown in FIG. 21, in order to expose the polysilicon layer 40 where the heater 6 is formed as the heating element 6, photoresist having a preselected pattern is formed, and aluminium of this portion is selectively removed by way of the etching process. In this etching process, a mixtured acid fluid is used as the etching fluid by mixing the following acid and water at the below-mentioned ratio: phosphoric acid:nitric acid:acetic acid:water=4:1:4:1. Then, FIG. 34 is a plan view for indicating this condition. FIG. 21 is a sectional view taken along a line XIX—XIX of FIG. 34.

Figure 22:
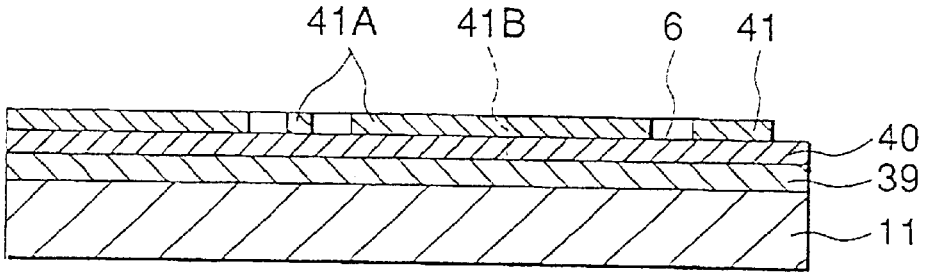
FIG. 22 is a sectional view (i.e., sectional view, taken along a line XX—XX of FIG. 35) for indicating another manufacturing step of the heater chip according to the embodiment of the present invention.
Figure 35:
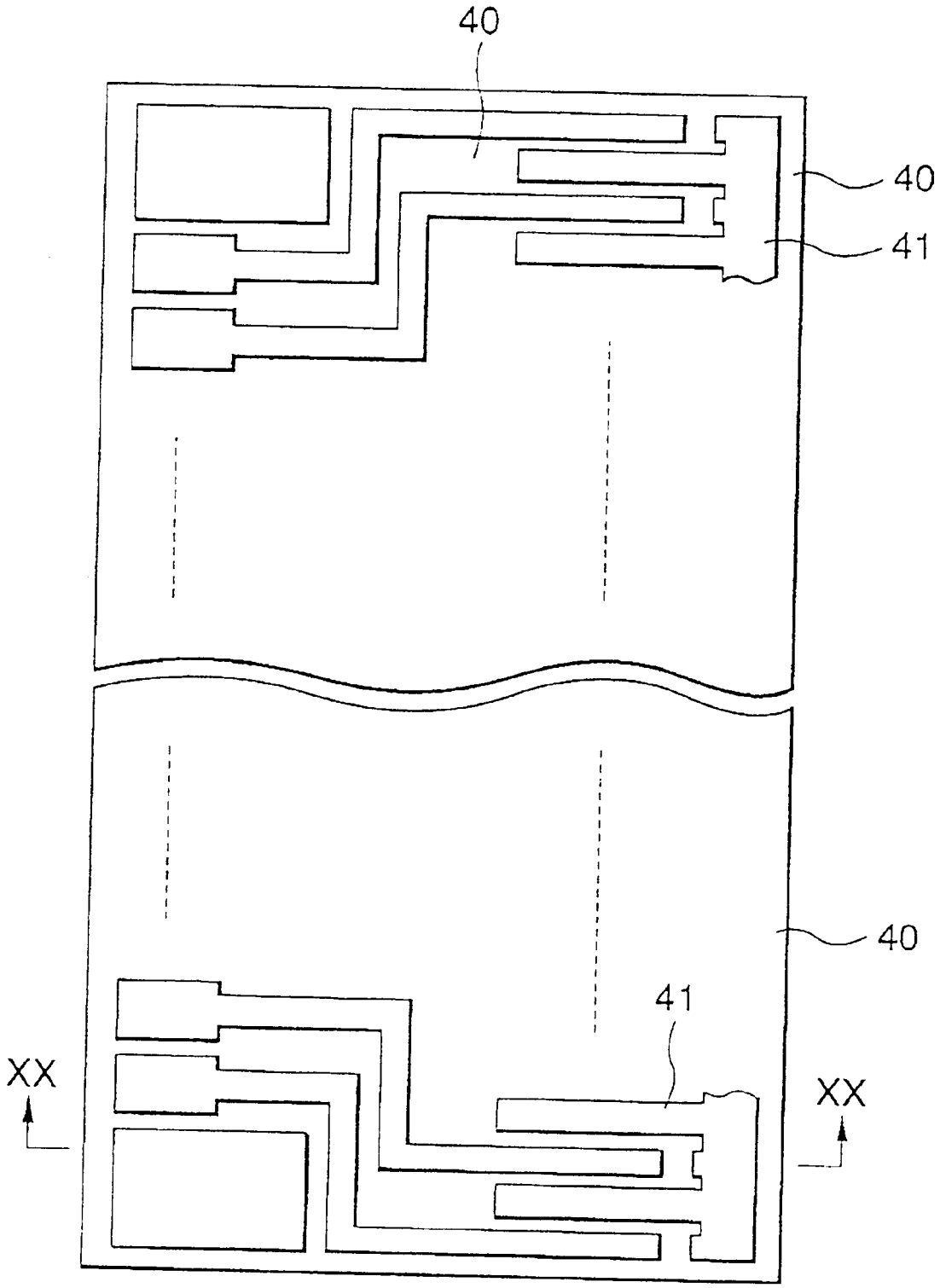
FIG. 35 is a plan view for representing another manufacturing step of the heater chip according to the embodiment of the present invention.

Next, as indicated in FIG. 22, wiring patterns used to energize the respective heating elements 6 are formed by way of the etching process. That is, while photoresist is used as a mask, aluminium is etched away by using the above-described etching fluid to form conductor patterns, so that such patterns as shown in FIG. 35 are formed. FIG. 22 is a sectional view, taken along a line XX—XX of FIG. 34.

Figure 23:
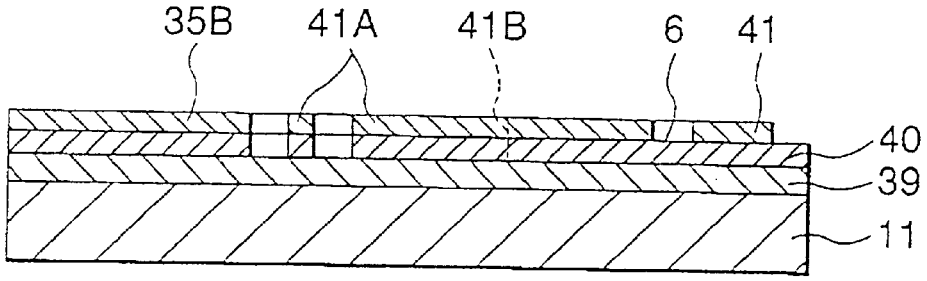
FIG. 23 is a sectional view (i.e., sectional view, taken along a line XXI—XXI of FIG. 36) for representing another manufacturing step of the heater chip according to the embodiment of the present invention.
Figure 36:
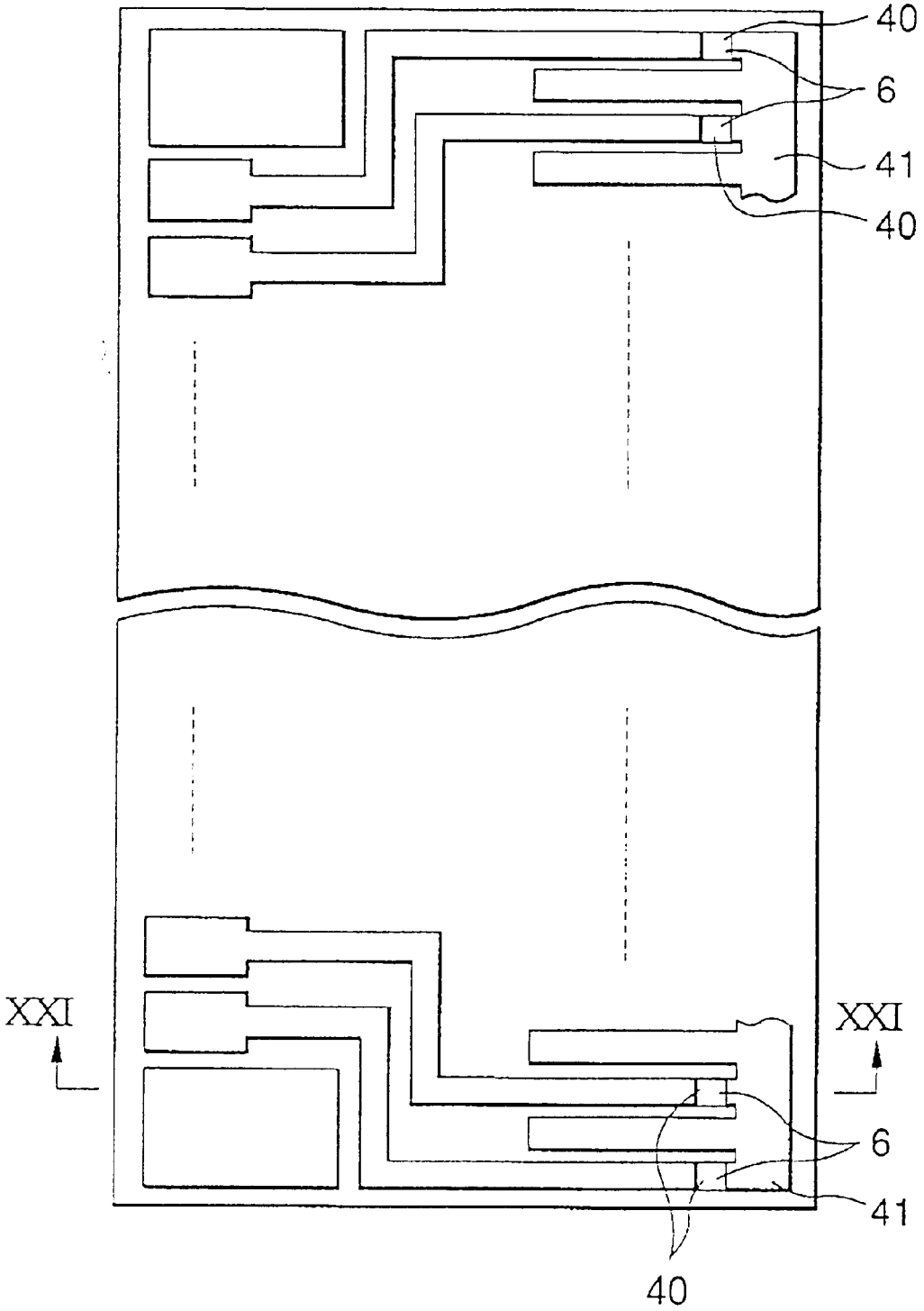
FIG. 36 is a plan view for representing another manufacturing step of the heater chip according to the embodiment of the present invention.

Subsequently, as indicated in FIG. 23, the polysilicon layer 40 which is not etched away by the above-described etching fluid, but therefore is left is etched away by using carbon fluoride gas ($CF_4$) by way of the RIE (reactive ion etching) method, while using the above-described photoresist as a mask in such a manner that this polysilicon layer 40 is formed as a pattern similar to an aluminium layer 41. A plan view of this condition is shown in FIG. 36. FIG. 23 is a sectional view, taken along a line XXI—XXI of FIG. 36.

At this time, since the photoresist is located on the polysilicon layer 40 of the heating element 6, the polysilicon layer 40 of this portion is not etched away. As a result, the polysilicon layer 40 is processed as the conductor pattern having the same shape as the aluminium layer 41 other than the heating elements which are exposed at the preceding step of FIG. 21. Aluminium is made in ohmic-contact with polysilicon by executing a heating process at the subsequent step, which may function as a conductor. Then, the portion 6 where polysilicon is exposed becomes a resistive member having a high resistance value, which may function as a resistive heating heater.

Figure 24:
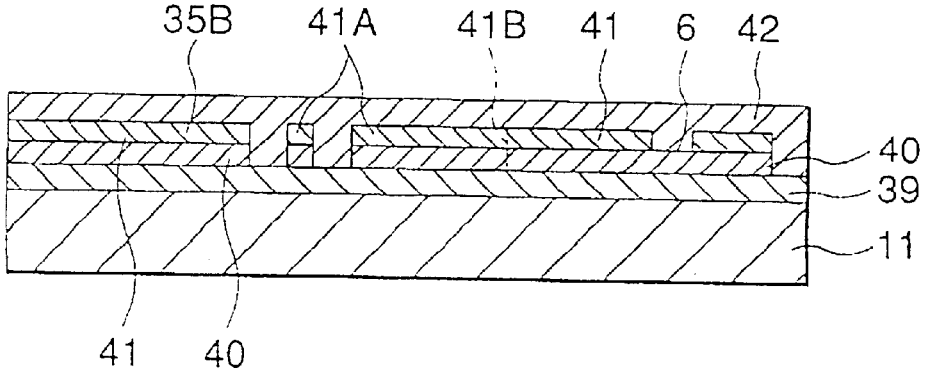
FIG. 24 is a sectional view for showing another manufacturing step of the heater chip according to the embodiment of the present invention.

Next, as shown in FIG. 24, an $SiO_2$ layer 42 having a thickness of on the order of 0.5 $\mu$m is formed on the entire surfaces of the conductor patterns and the heater portion, which have been manufactured in the above-explained manner by way of the CVD method. This is an insulating film used to form two-layer wiring patterns of the common electrode 41B.

Figure 25:
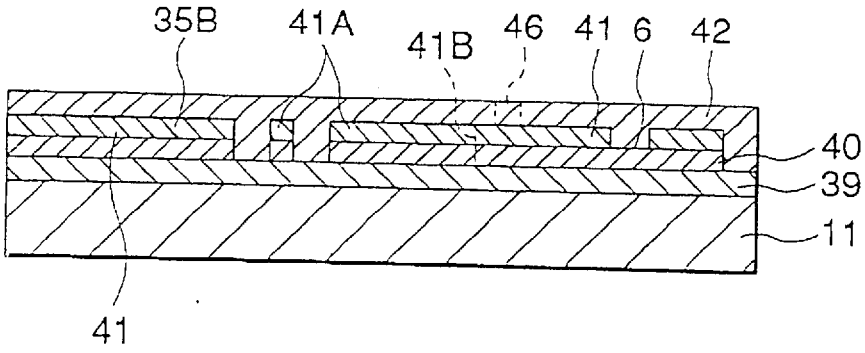
FIG. 25 is a sectional view (i.e., sectional view, taken along a line XXIII—XXIII of FIG. 37) for representing another manufacturing step of the heater chip according to the embodiment of the present invention.
Figure 37:
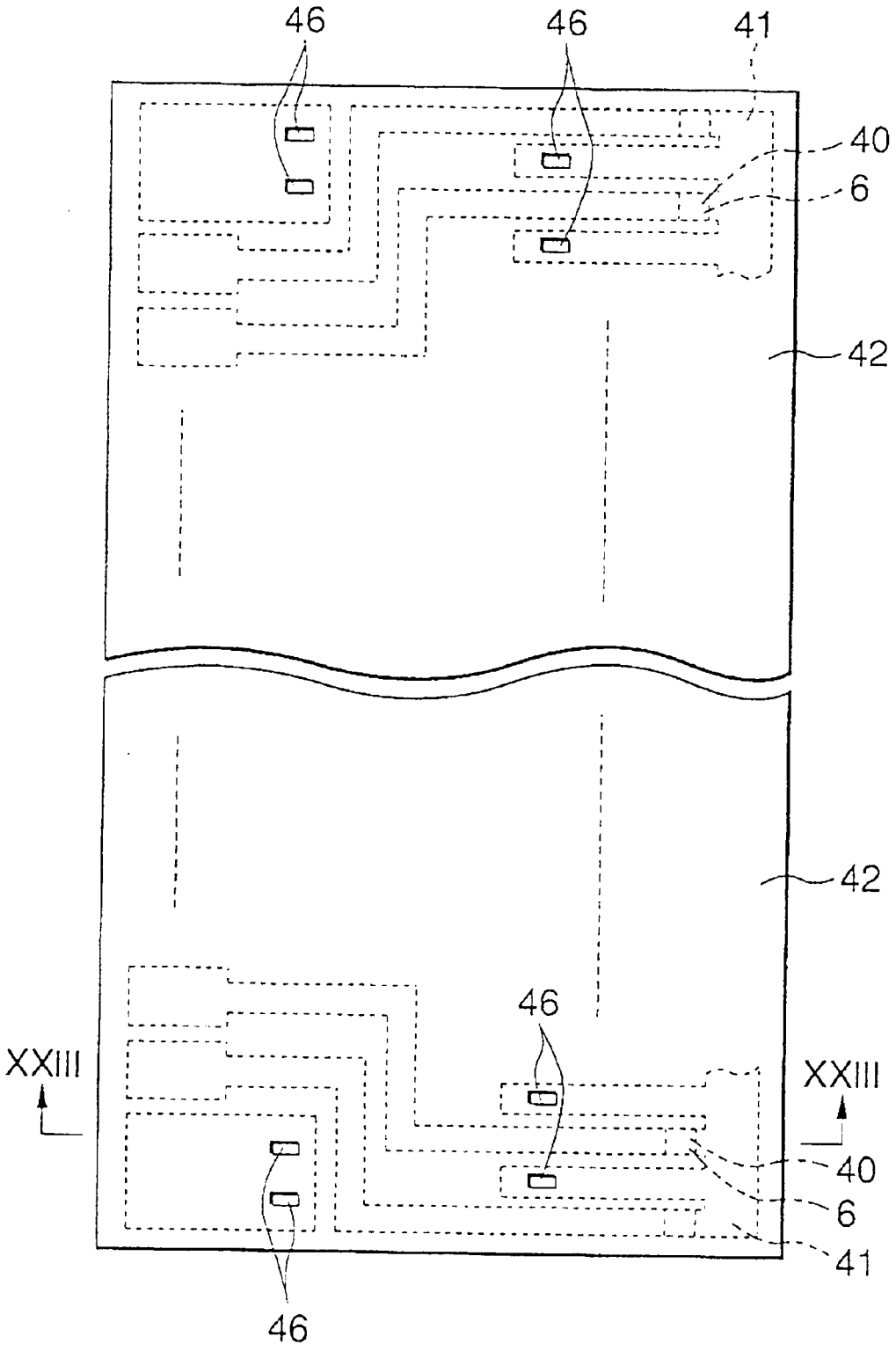
FIG. 37 is a plan view for representing another manufacturing step of the heater chip according to the embodiment of the present invention.

Next, photoresist having a predetermined pattern is formed. While using this pattern as a mask, as indicated in FIG. 25, the $SiO_2$ layer 42 is etched away by way of the RIE method to thereby form a through hole 46 used to conduct a first layer of aluminium wiring line 41 to a second layer of aluminium wiring line which is formed at a subsequent step. A plan view of this condition is indicated in FIG. 37. FIG. 25 is a sectional view, taken along a line XXIII—XXIII of FIG. 37.

Figure 26:
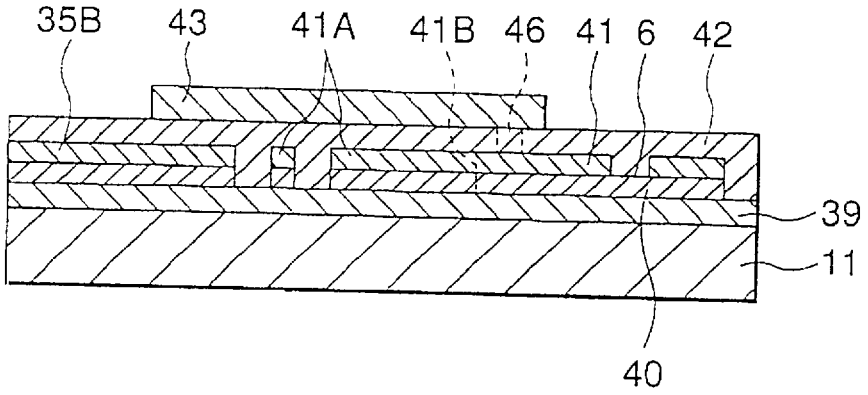
FIG. 26 is a sectional view (i.e., sectional view, taken along a line XXIV—XXIV of FIG. 38) for indicating another manufacturing step of the heater chip according to the embodiment of the present invention.
Figure 38:
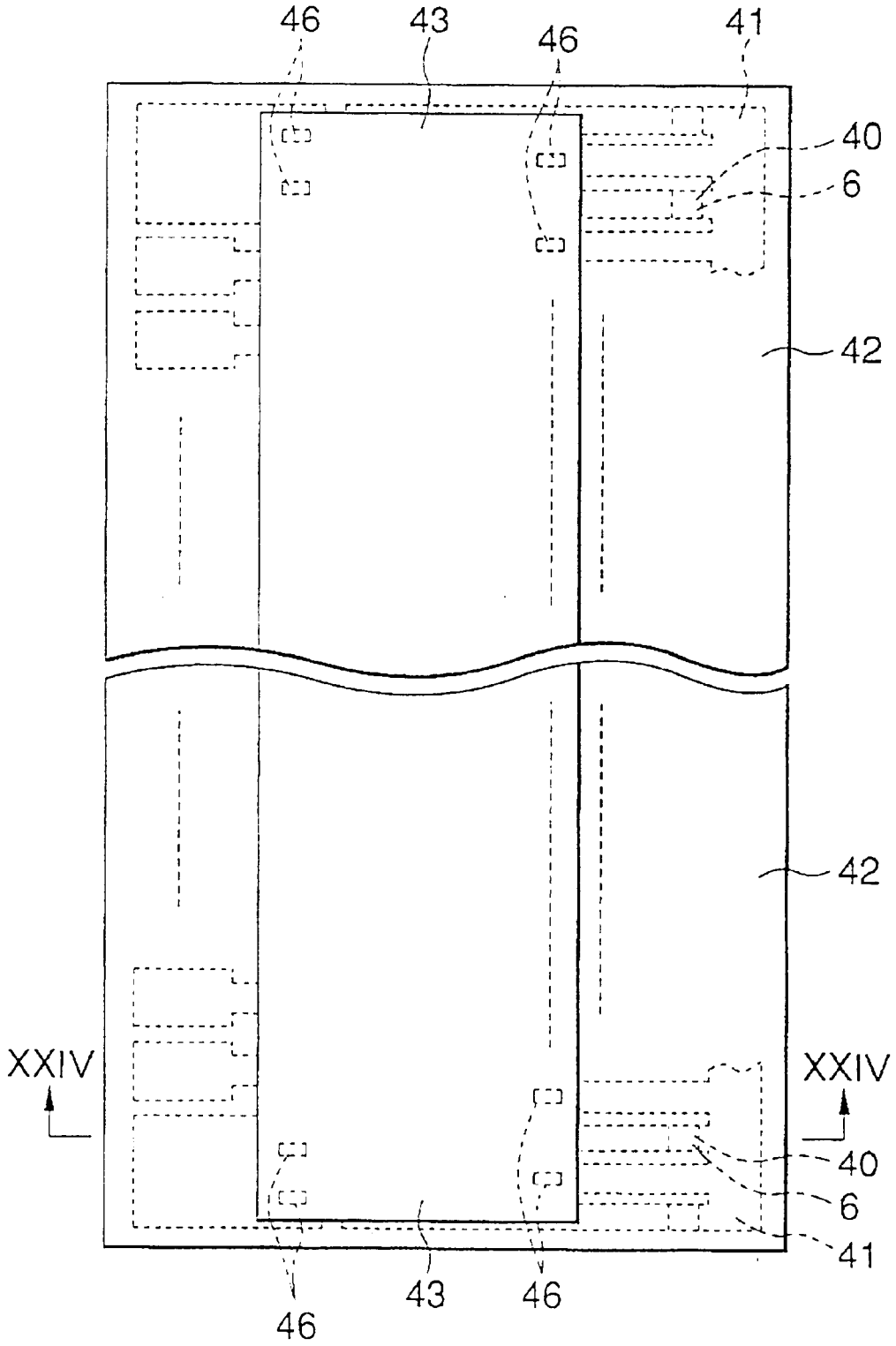
FIG. 38 is a plan view for representing another manufacturing step of the heater chip according to the embodiment of the present invention.

Subsequently, as indicated in FIG. 26, an aluminium film having a thickness of on the order of 1.0 $\mu$m is formed by way of the sputtering method under such a condition as shown in FIG. 25. Photoresist having a predetermined pattern is formed. Then, while using this photoresist as a mask, aluminium is etched away by using an etching fluid. The second layer of the aluminium wiring line 43 which has been formed in this manner is made as a pattern capable of covering a wide range except for the bonding pad portions 35A and 35B, so that the resistance value of the common electrode 41B can be made low as being permitted. A plan view of this condition is indicated in FIG. 38. FIG. 26 is a sectional view, taken along a line XXIV—XXIV of FIG. 38.

Figure 27:
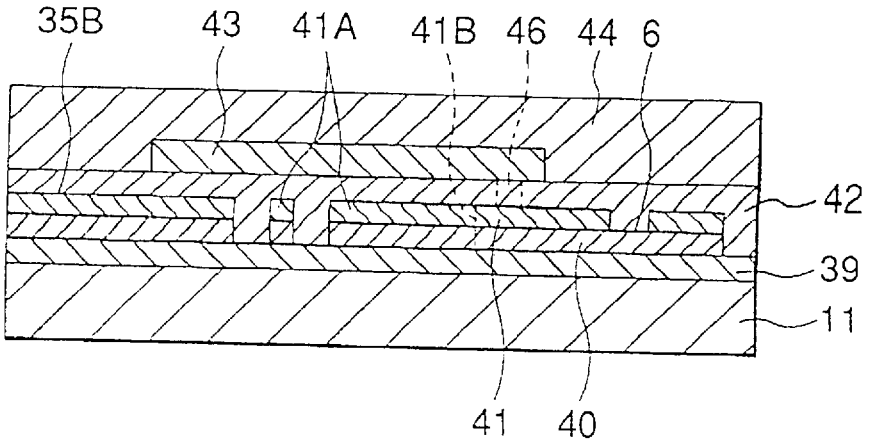
FIG. 27 is a sectional view for showing another manufacturing step of the heater chip according to the embodiment of the present invention.

Next, after a film of an $SiO_2$ layer having a thickness of on the order of 0.5 $\mu$m and functioning as a protective film has been formed by way of the CVD method, this $SiO_2$ layer film is annealed for 30 minutes at a temperature of 450° C. within a nitrogen atmosphere. After a sintering process is carried out in order to make up an ohmic-contact between polysilicon (reference numeral 40) and the aluminium electrode (reference numeral 41), as shown in FIG. 27, a film of an $SiO_2$ layer 44 having a thickness of on the order of 6 $\mu$m is formed by way of the CVD method.

Figure 28:
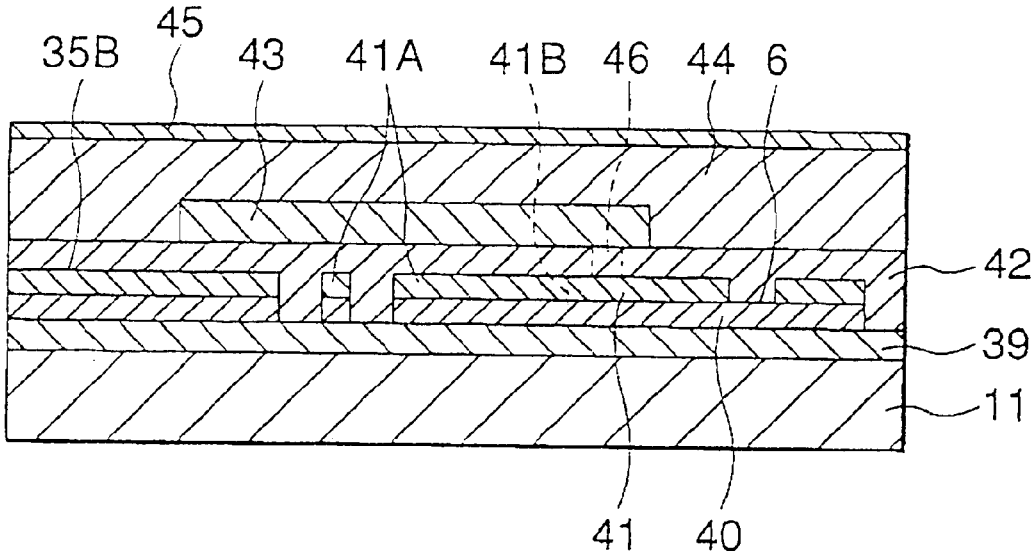
FIG. 28 is a sectional view for showing another manufacturing step of the heater chip according to the embodiment of the present invention.

Next, as shown in FIG. 28, a film of a nickel film 45 (in actual, laminated film of Ti/Ni) having a thickness of on the order of 0.2 $\mu$m is formed by way of the vacuum vapor deposition method, and this nickel film 45 constitutes a metal mask when the small cylindrical member 4 and a dye storage portion 5*a*. In this case, in order to improve the close fitting characteristic between the $SiO_2$ film 44 and the nickel film 45, after titanium having a thickness of 0.02 $\mu$m has been vapor-deposited, a nickel film is continuously vapor-deposited.

Figure 29:
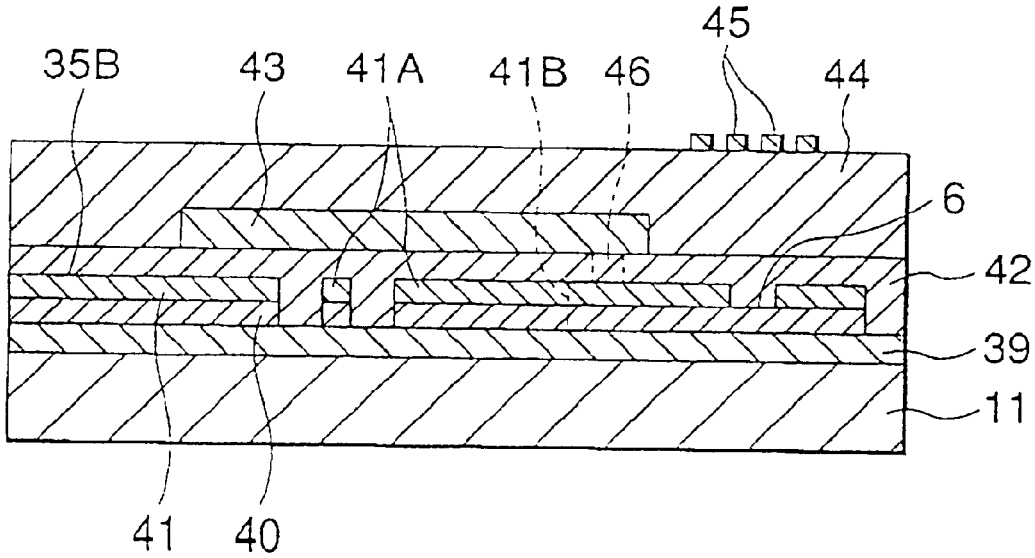
FIG. 29 is a sectional view for showing another manufacturing step of the heater chip according to the embodiment of the present invention.

Next, as indicated in FIG. 29, in order to form the small cylindrical member 4 and the dye storage portion 5*a*, photoresist having a predetermined pattern is formed, and the unnecessary titanium/nickel film 45 is removed by the ion milling apparatus to thereby form a metal mask 45. A plan shape under this condition is similar to the next FIG. 39.

Figure 30:
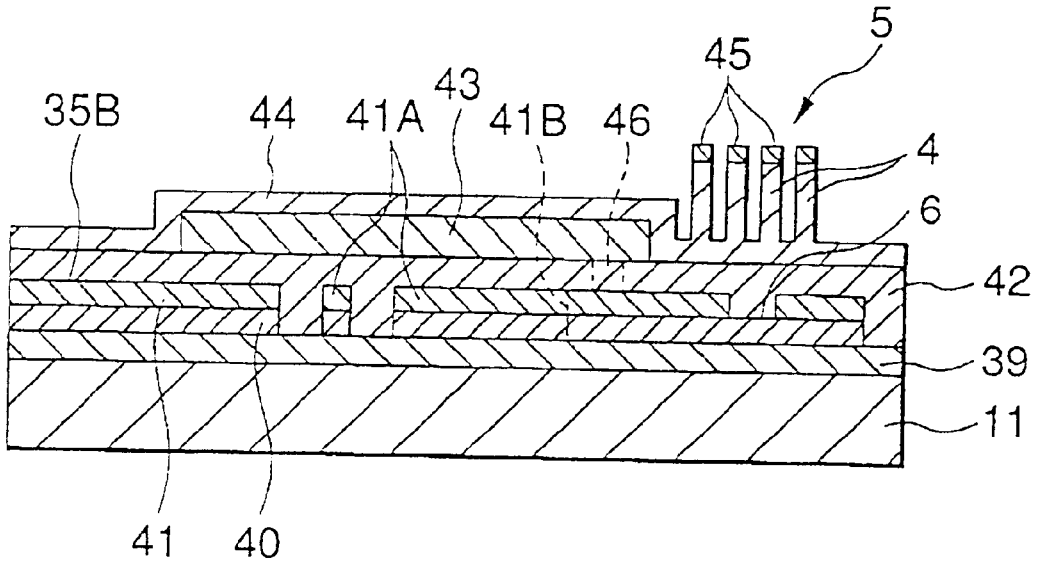
FIG. 30 is a sectional view (i.e., sectional view, taken along a line XXVIII—XXVIII of FIG. 39) for representing another manufacturing step of the heater chip according to the embodiment of the present invention.
Figure 39:
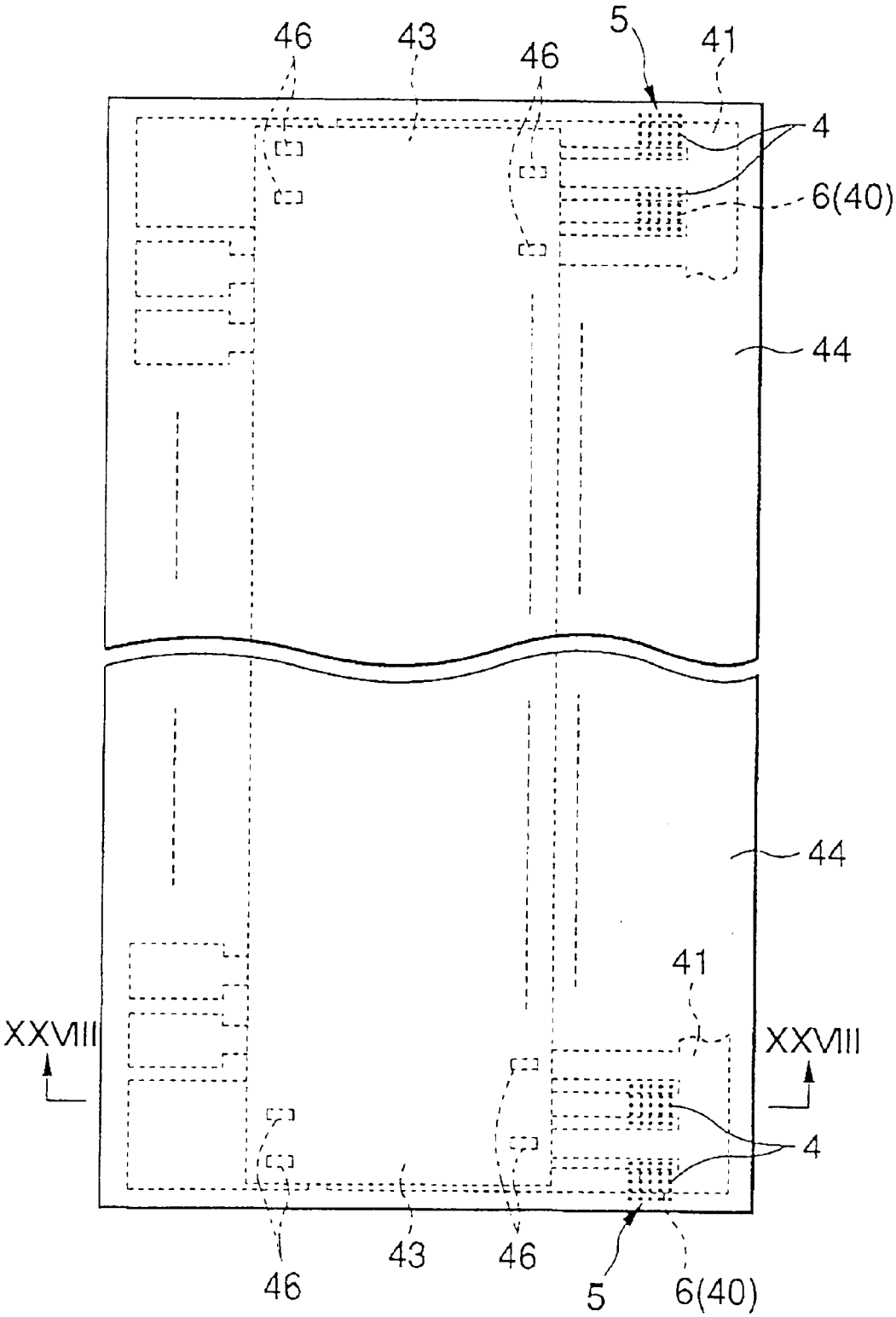
FIG. 39 is a plan view for representing another manufacturing step of the heater chip according to the embodiment of the present invention.

Thereafter, as shown in FIG. 30, while employing the titanium/nickel film 45 formed as a predetermined pattern as a mask, the $SiO_2$ film 44 is treated by way of the RIE (reactive ion etching) method so as to form the recording material storage portion 5*a* and the small cylindrical member (4) group in the $SiO_2$ layer 44, so that the dye jetting portion 5 is constituted. These members are formed on each of the heating elements 6. A plan view under this condition is shown in FIG. 39. FIG. 30 is a sectional view, taken along a line XXVIII—XXVIII of FIG. 39.

Figure 31:
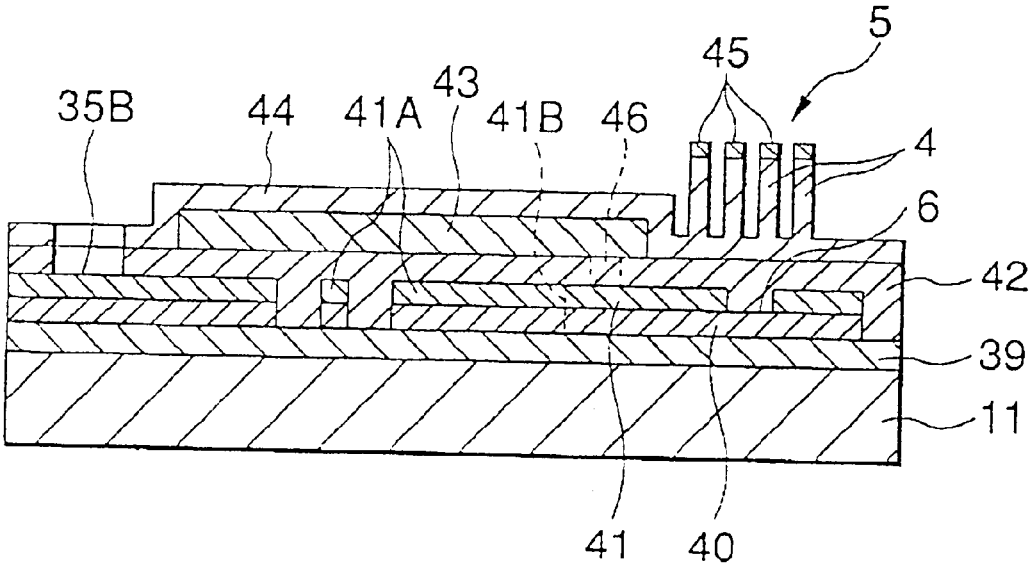
FIG. 31 is a sectional view (i.e., sectional view, taken along a line XXIX—XXIX of FIG. 40) for indicating another manufacturing step of the heater chip according to the embodiment of the present invention.
Figure 40:
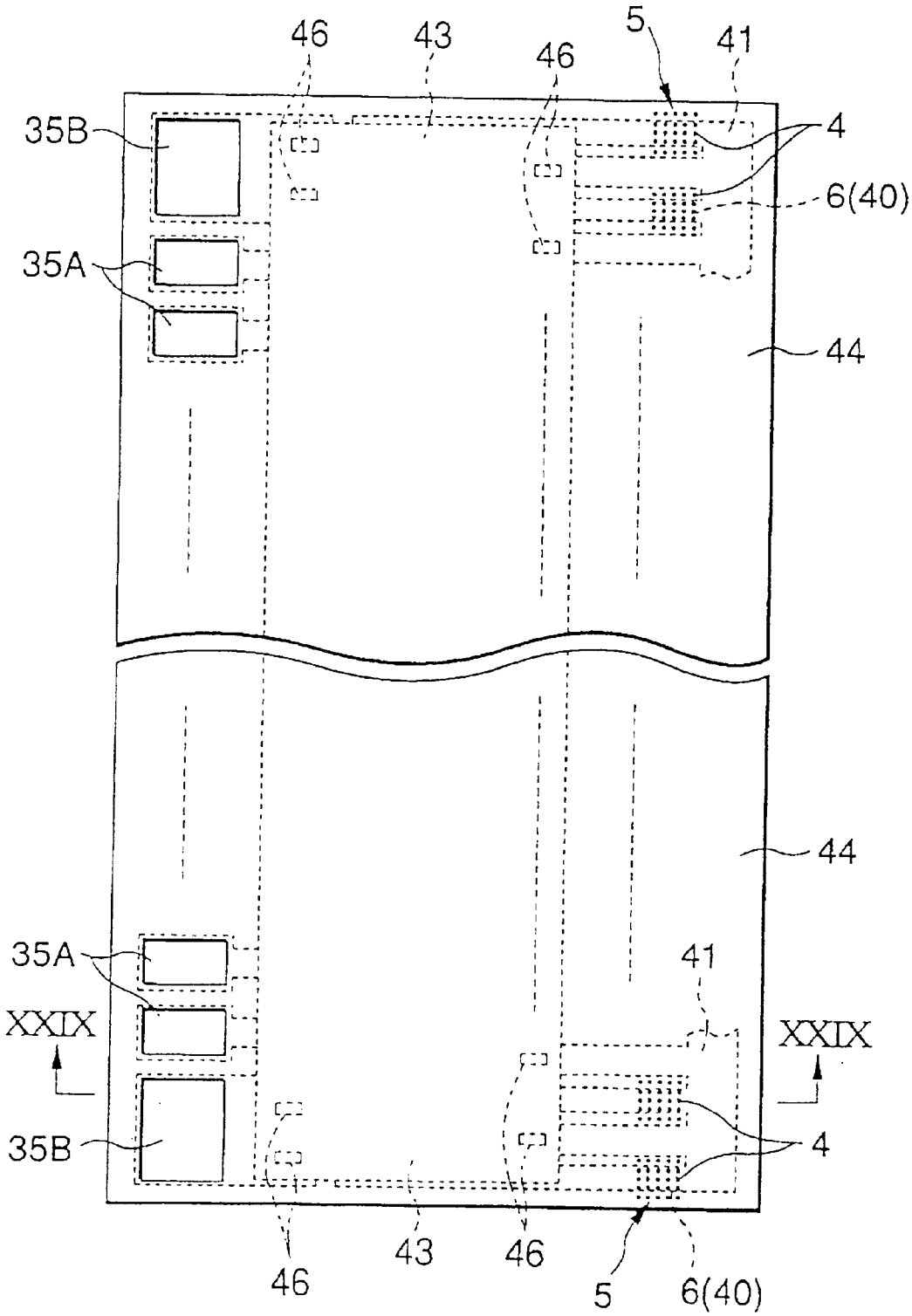
FIG. 40 is a plan view for representing another manufacturing step of the heater chip according to the embodiment of the present invention.

Next, as indicated in FIG. 31, photoresist having a predetermined pattern is formed in order to open the bonding pad 35A for the separate electrode and the bonding pad 35B for the common electrode. Then, $SiO_2$ is etched away by way of the RIE method, so that aluminium 41A and 41B of electrodes are exposed as bonding pads. A plan view under this condition is shown in FIG. 40. FIG. 31 is a sectional view, taken along a line XXIX—XXIX of FIG. 40.

Figure 32:
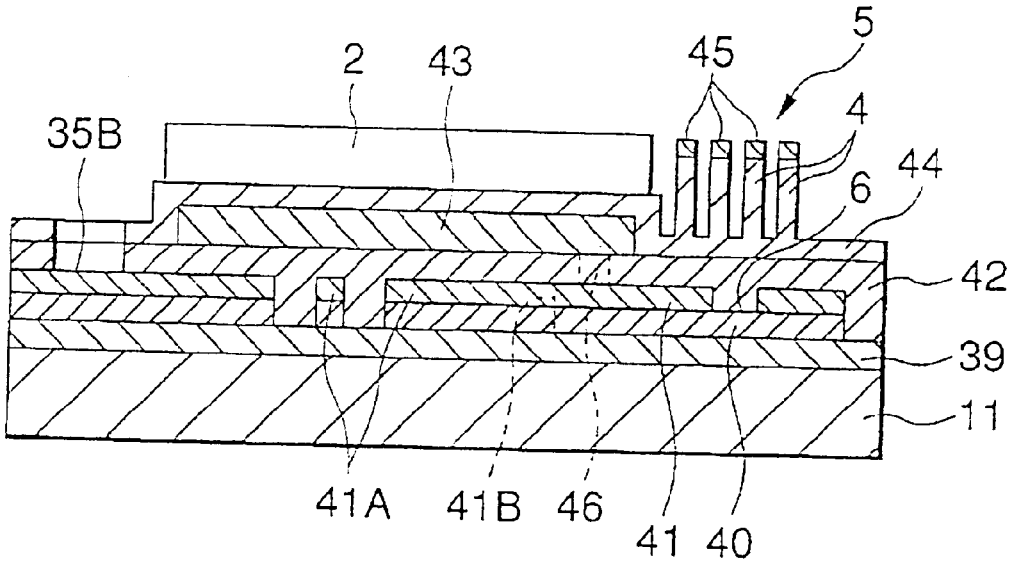
FIG. 32 is a sectional view (i.e., sectional view, taken along a line XXX—XXX of FIG. 41) for representing another manufacturing step of the heater chip according to the embodiment of the present invention.
Figure 41:
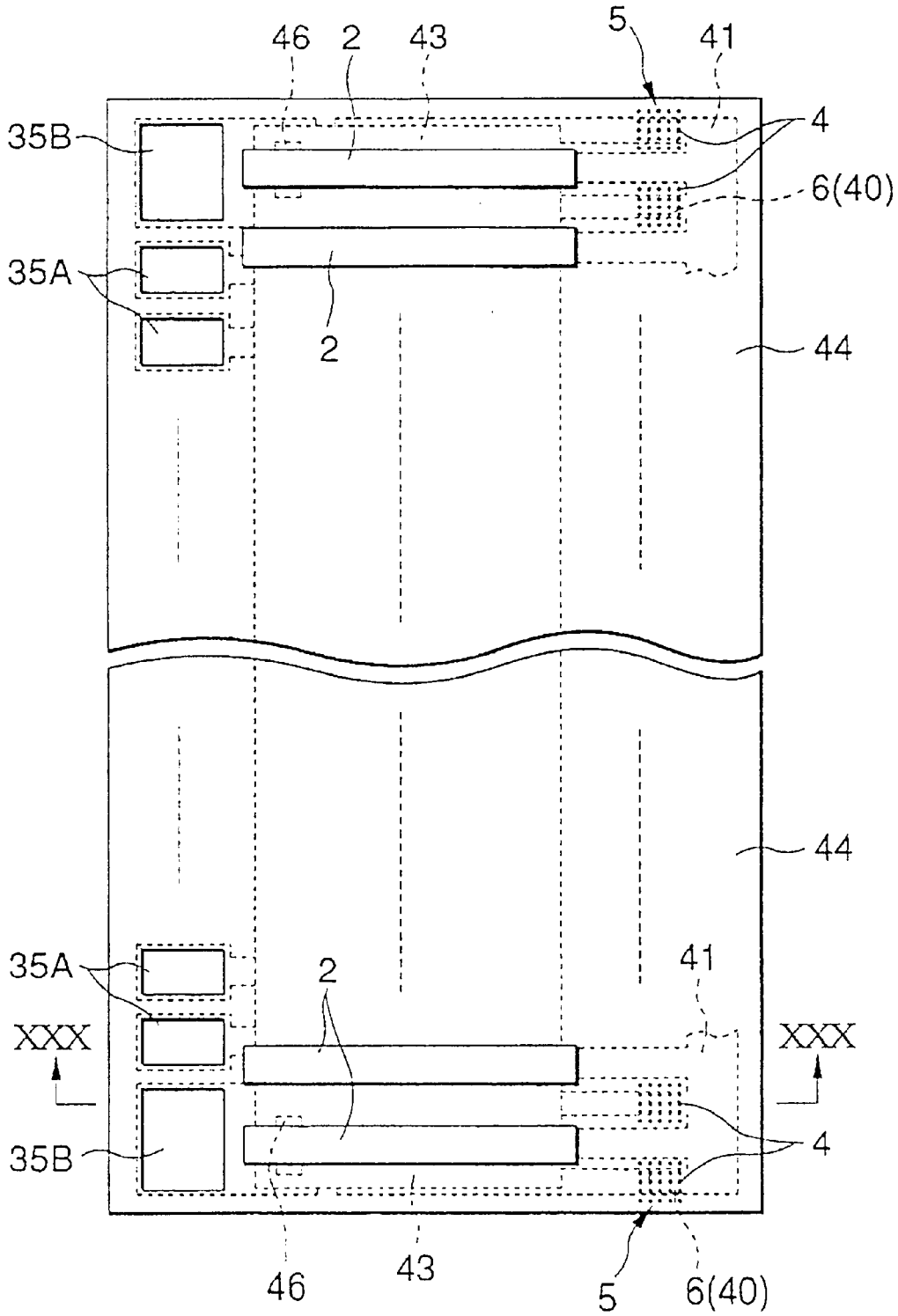
FIG. 41 is a plan view for representing another manufacturing step of the heater chip according to the embodiment of the present invention.

Subsequently, as shown in FIG. 32, a dry film (sheet resist) having a thickness of on the order of 25 $\mu$m is laminated as a branch path wall 2, and a patterning process is carried out with respect to a pattern of the dye supplying branch path. A plan view under this condition is shown in FIG. 41. FIG. 32 is a sectional view, taken along a line XXX—XXX of FIG. 41.

Figure 33:
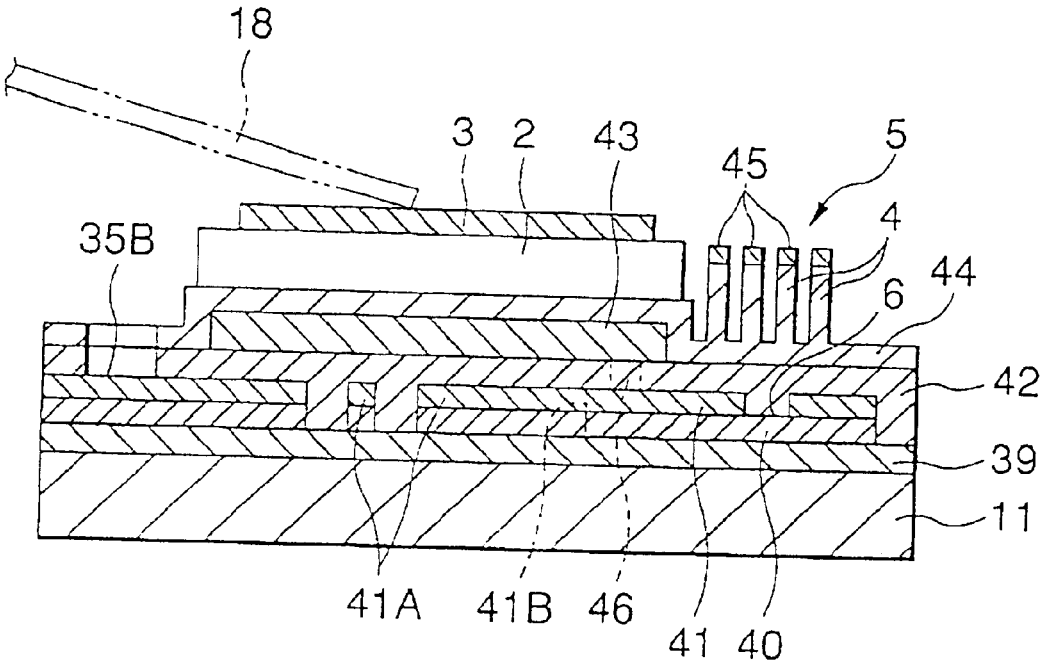
FIG. 33 is a sectional view (i.e., sectional view, taken along a line XXXI—XXXI of FIG. 42) for indicating another manufacturing step of the heater chip according to the embodiment of the present invention.
Figure 42:
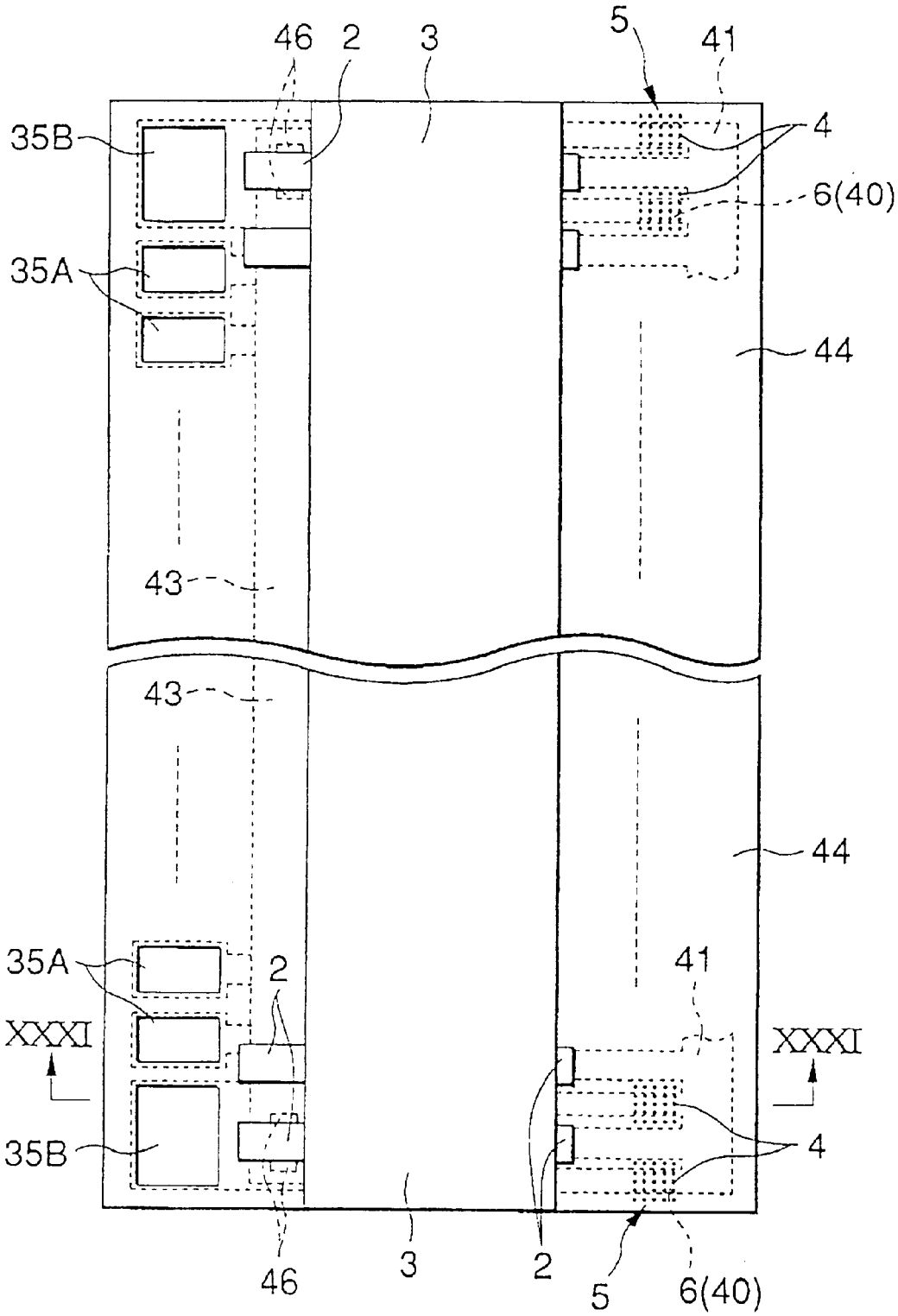
FIG. 42 is a plan view for representing another manufacturing step of the heater chip according to the embodiment of the present invention.

Next, as represented in FIG. 33, a nickel sheet having a thickness of on the order of 25 $\mu$m and having a lateral side longer than a longitudinal side is employed as a lid 3, and this lid 3 is positioned perpendicular to the above-explained branch wall 2. This lid 3 is depressed against the branch path wall 2 under pressure of 4 to 6 kg/cm$^2$ at a temperature of 150 to 180° C. for approximately 5 minutes so as to be thermally pressured with each other. A plan view under this condition is indicated in FIG. 42. FIG. 33 is a sectional view, taken along a line XXXI—XXXI of FIG. 42. As a result, a slit-shaped branch path (reference numeral 7 shown in FIG. 43 to FIG. 46) is formed as a dye path. This slit-shaped branch path owns a height of on the order of 25 $\mu$m, and the same width as the interval between both edge portions of the two heating elements 6—6. It should be noted that the above-described cover 18 is indicated as a virtual line in FIG. 33.

As described above, the heating elements (heater) 6 for heating the dye, the respective wiring conductors involving the electrodes 41A and 41B, the group of the small cylindrical members 4, and the dye supplying branch path 7 are formed on the substrate 11. The resulting members/substrate 11 are cut by a preselected size of the heater chip 1, so that the above-explained manufacturing steps are completed.

The heater chip 1 manufactured in accordance with the above-described manufacturing steps is adhered on the head base 10, the bonding pad 35A of each of the separate electrodes 41A is connected to the pad 16*a* of the IC chip 16 mounted on the printed circuit board 12, which corresponds to this bonding pad 35A, by way of the bonding wire 36, and further the bonding pad 35B of the common electrode 41B of the heater chip 1 is connected to the pad of the printed circuit board by the bonding wire 36.

Next, a description will now be made of a dye supplying path, according to a preferred embodiment, for supplying the dye to each of the dye jetting portions 5 within the heater chip 1.

Figure 43:
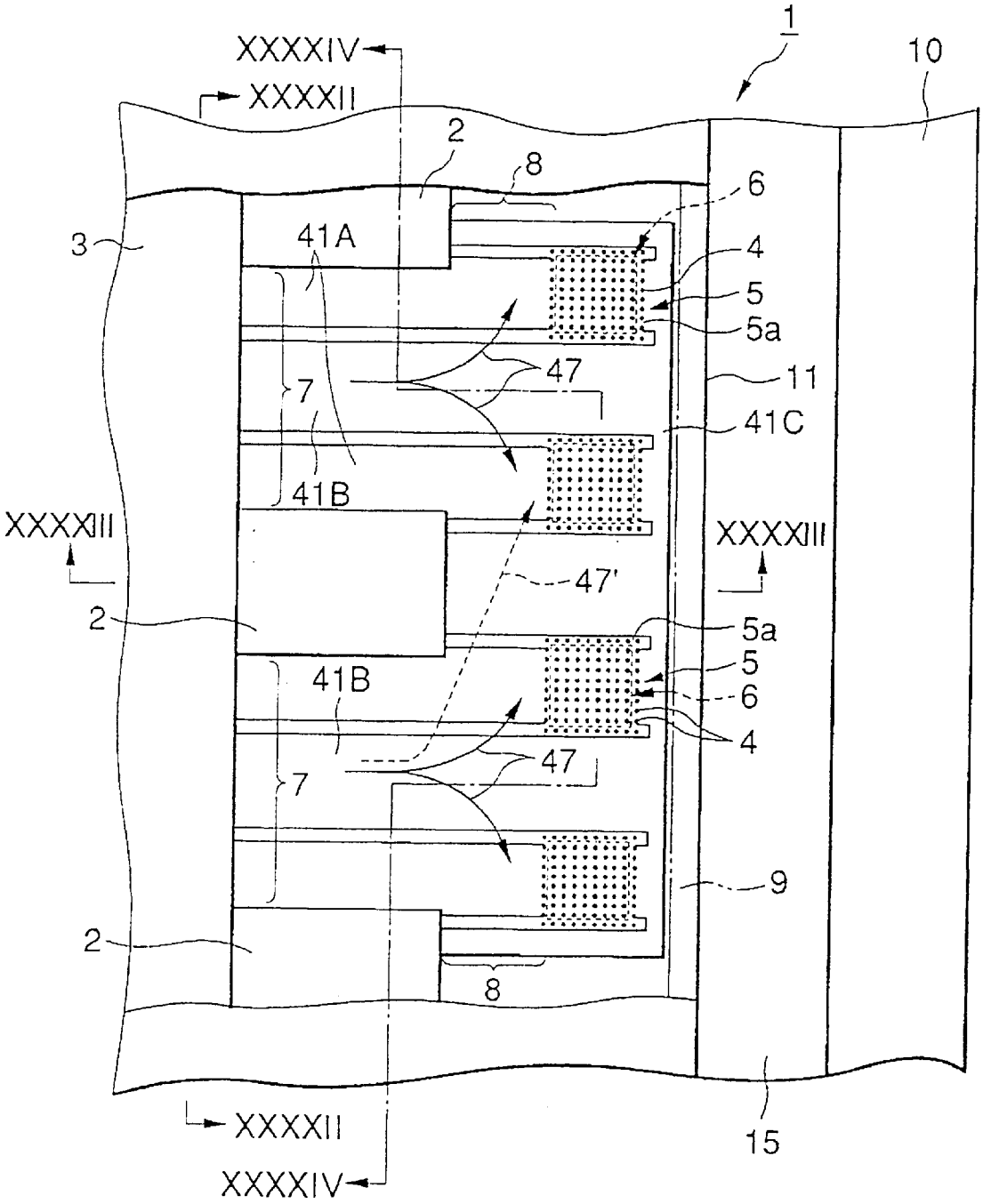
FIG. 43 is a plan view for schematically showing a recording solution supplying path provided in the heater chip according to the embodiment of the present invention.
Figure 44:
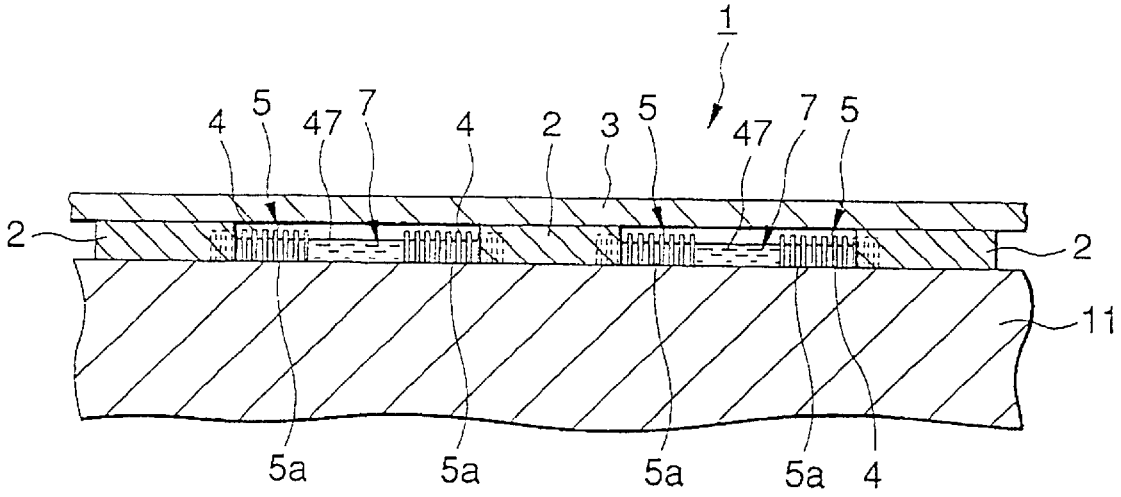
FIG. 44 is a sectional view of the recording material supplying path, taken along a line XXXXII—XXXXII shown in FIG. 43.
Figure 45:
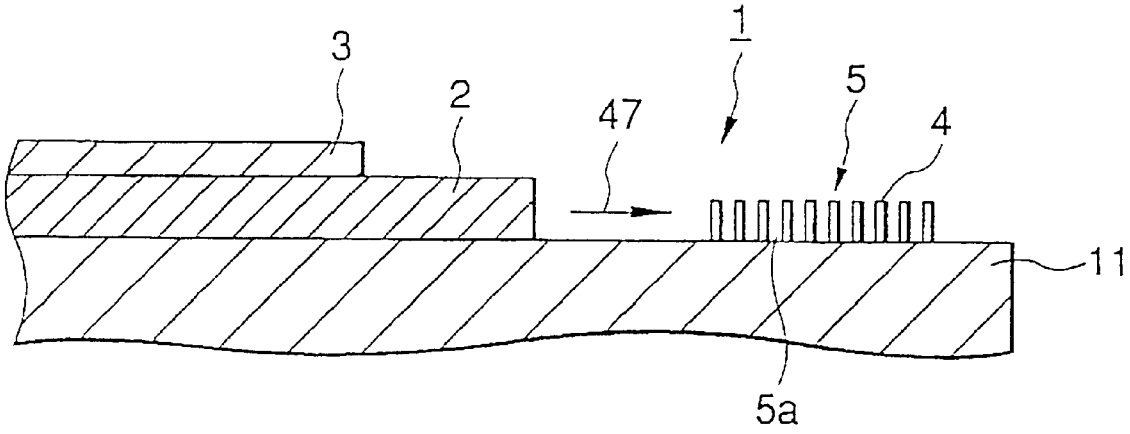
FIG. 45 is a sectional view of the recording material supplying path, taken along a line XXXXIII—XXXXIII shown in FIG. 43.
Figure 46:
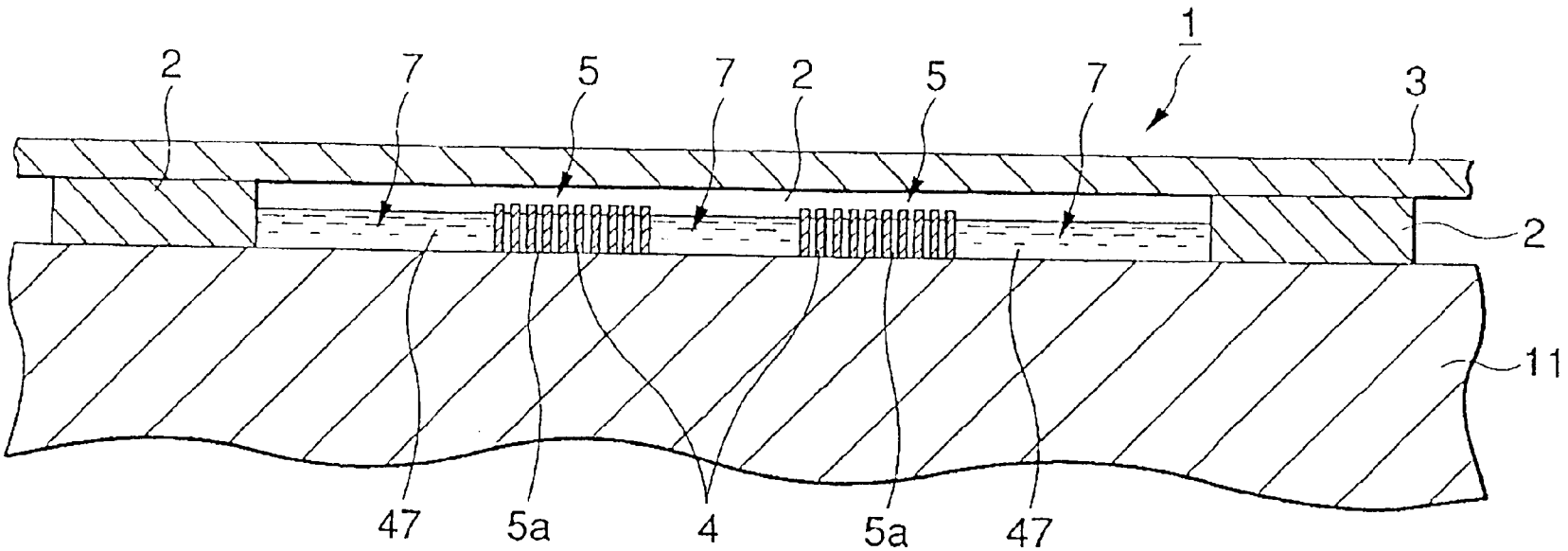
FIG. 46 is a sectional view of the recording material supplying path, taken along a line XXXXIV—XXXXIV shown in FIG. 43.

FIG. 43 is a plan view for indicating a major portion of the heater chip 1. FIG. 44 is a sectional view, taken along a line XXXXII—XXXXII of FIG. 43. FIG. 45 is a sectional view, taken along a line XXXXIII—XXXXIII of FIG. 43. FIG. 46 is a sectional view, taken along a line XXXXIV—XXXXIV of FIG. 43.

The heater chip 1 according to this embodiment is supported by the head base 10 in an integral body, and the dye jetting portion 5 constituted of the small cylindrical member 4 is arranged at a tip portion. The dye 47 is supplied from the branch path 7 partitioned by the branch path wall 2 to the dye jetting portion 5 positioned on both side of a tip portion thereof.

In the dye jetting unit 5, a porous structure is formed by, for example, $SiO_2$, and this porous structure is constituted by a group of vary fine small cylindrical members 4, the width and the diameter of which are smaller than, or equal to 10 $\mu$m (for example, 1 to 4 $\mu$m), the interval of which is smaller than, or equal to 10 $\mu$m (for instance, 1 to 4 $\mu$m), and the height of which is smaller than, or equal to 20 $\mu$m (for instance, 1 to 10 $\mu$m). This small cylindrical member (4) group constitutes the dye storage portion 5*a* for holding/storing the dye 47 based on the capillary phenomenon. Then, the dye 7 stored in this storage portion 5*a* is heated by the heater 6 to be jetted.

The dye 47 is supplied from the commonly used dye supply path 19 (see FIG. 7) via a plurality of branched branch paths 7. Then, this branch path 7 is formed by the branch path wall 2 made of a dry film (for example, sheet resist) having a thickness smaller than, or equal to 50 $\mu$m (for example, 10 to 30 $\mu$m), a lid 3 made of a nickel sheet having a thickness smaller than, or equal to 100 $\mu$m (for instance, 20 to 30 $\mu$m), and a substrate 11 made of silicon having a thickness smaller than, or equal to 5 mm (for example, 0.2 to 1 mm). As indicated in FIG. 44 and FIG. 46, this branch path 7 is constituted as a slit-shaped space.

The branch path wall 2 is provided in such a manner that this branch path wall 2 is projected to an intermediate position between a tip portion of the lid 3 and a plurality (in this case, two) of dye jetting portions 5. As a result, the dye 47 is mainly supplied to the dye jetting portions 5 arranged on both sides of the each branch path 7 on the tip side, as indicated as an arrow. Then, a region defined prior to the edge of the branch path wall 2 may constitute a communication portion 8 through which the dye 47 may flow into the respective dye jetting portions 5 arranged in an array. Then, volatile oil paint 9 made of fluorine compound is coated on the edge portion of the substrate 11 in order that the entered dye 47 is not leaked from the substrate 11.

As indicated in FIG. 7, in this recording head, both the printed circuit board 12 and the heater chip 1 are adhered onto the head base 10 made of aluminium and having the heat sink function by employing an adhesive agent of silicon compound. Furthermore, the cover 18 is adhered onto the members by using the same adhesive agent.

Also, as apparent from FIG. 7, the mounting portion of the head base 10 for the printed circuit board 12 is made thin, which is defined by the thickness of the printed circuit board 12. A height of the base band 10 on which the printed circuit board 12 is being mounted, and which involves the IC chip 16 for driving the heating element mounted on this printed circuit board 12, is substantially equal to a height of an upper surface of the heater chip 1 mounted in parallel to this printed circuit board 12.

To uniformly adhere the heater chip 1 onto the joint portion of the heater chip 1, grooves 15 and 15 are formed on the head base 10. Thus, the unnecessary adhesive agent used to adhere the heater chip 1 may be escaped into these grooves 15 and 15.Then, both the connection portion between the electrode on the heater chip 1 and the IC chip 16, and also the connection portion between the IC chip 16 and the wiring lines on the printed circuit board 12 are coated with the coating material JCR (junction coating resin) 17 of silicon compound, which is thermally hardened in order to protect the bonding wires for connection purposes.

As indicated in FIG. 7, the dye conducting hole 13 penetrated through the head base 10 is provided on the printed circuit board 12, and then the fluid-conditioned dye 47 is conducted from the head base 10 to the space between the cover 18 and this base 10.Then, the cover 18 is adhered/sealed in order to cover a portion of the printed circuit board 12 and a portion of the heater chip 1. The inner surface of this cover 18 accepts the dye 47 conducted from the dye conducting hole 13, and constitutes the commonly used dye supply path 19 for supplying the dye 47 to the above-explained branch paths.

With employment of the above-explained structure, the dye 47 contained in the commonly used dye supply path 19 of FIG. 7 can be supplied via the branch path 7 and the communication portion 8 of FIG. 43 to the dye jetting portion 5 without any problem.

Since the dye 47 supplied via the branch path 7 is simultaneously supplied to two sets of the jetting portions 5 and 5, even when the space between the recording material jetting structures 5 and 5 is narrowed in correspondence with high resolution required for a printed image, the space between the recording material supply paths 7 and 7 need not be narrowed, so that a sufficient amount of the dyes can be performed. Also, since the manufacturing method of the recording apparatus does not become complex and further no high precision is required in the manufacturing steps of the recording material supply path 7, the yield of manufacturing this recording apparatus is increased, as compared with that of the conventional recording apparatus, and moreover the manufacturing cost thereof can be suppressed.

Also, the branch path wall 2 is provided in such a manner that this branch path wall 2 is projected up to the intermediate portion between the lid 3 and the dye jetting portion 5, and the portion where the branch path wall 2 is not present constitutes the communication portion 8. As a result, the branch path 7 can also supply the dye 47 to such a dye jetting portion 5 other than the original region to which the dye 47 is mainly supplied (namely, dye jetting portions on the adjoining branch paths).

In the conventional system, when the space between the recording material jetting structures 5 and 5 becomes narrow, the space between the recording material supply paths is accordingly narrowed. As a result, the sectional areas of the individual recording supply paths are narrowed. As a result, there is a risk that when the recording material is jetted from the recording material jetting structure to the printing medium located opposite thereto, the necessary/sufficient amounts of recording material cannot be supplied to the recording material jetting structure. However, in accordance with the structures shown in FIG. 43 to FIG. 46, since the sectional areas of the individual recording material supply paths 7 are determined not by the space between the recording material jetting structures 5 and 5, even when the space between the recording material jetting structures 5 and 5 becomes narrow, the necessary/sufficient amounts of recording materials can be supplied/secured to the recording material jetting structures.

In FIG. 43, an arrow 47 of a slid line denotes a flow of the dye 47 by the branch path 7 to the original dye supply region, whereas another arrow 47' of a broken line shows a flow of the dye 47' to the region other than the original dye supply region. As a consequence, even when the dye 47 is not supplied from a predetermined branch path 7 due to some reason, the dye 47' may be supplied from another branch path 7, so that there is no problem in the printing operation.

It should be noted that, for example, even when the small cylindrical member (4) group is not present in the dye jetting portion 5, the recording material may be jetted. Even in such a case, the current may flow through a predetermined separate electrode 41A in response to image information, and thus the heater 6 provided under the dye jetting portion 5 is heated by this current, so that the dye 47 existing above this dye jetting portion 5 may be vaporized and jetted. However, in such a case that the jetting structure constructed of the small cylindrical member 4 is employed, when the surface tension of the dye 47 is lowered due to the heating action, a sufficient amount of dyes 47 can be held in the dye jetting portion 5, and therefore, the dye can be jetted under better condition.

In accordance with this embodiment, as previously explained, since the dimension of the branch path 7 required to supply the dye is not restricted by the space between the dye jetting portions 5 and 5, a sufficient amount of dyes 47 can be supplied to the respective dye jetting portions 5, and also the manufacturing method does not require high precision and complex requirements.

Since such a structure is employed, a large number of dye jetting portions 5 per a unit area can be provided. Accordingly, the dot intervals are narrowed so as to increase the dot density, so that the high image resolution can be realized.

It should also be noted that in FIG. 43, the branch path wall 2 may be extended up to the tip portion of the heater chip 1, and the communication portion 8 may be omitted. Thus, the dye 47 may be alternatively supplied from one branch path 7 to two sets of the right/left dye jetting portions 5 and 5. Even in such a case, since there is no problem to supply the necessary amount of dyes 47, this alternative structure may achieve a similar effect as that of the previous structure.

Figure 47:
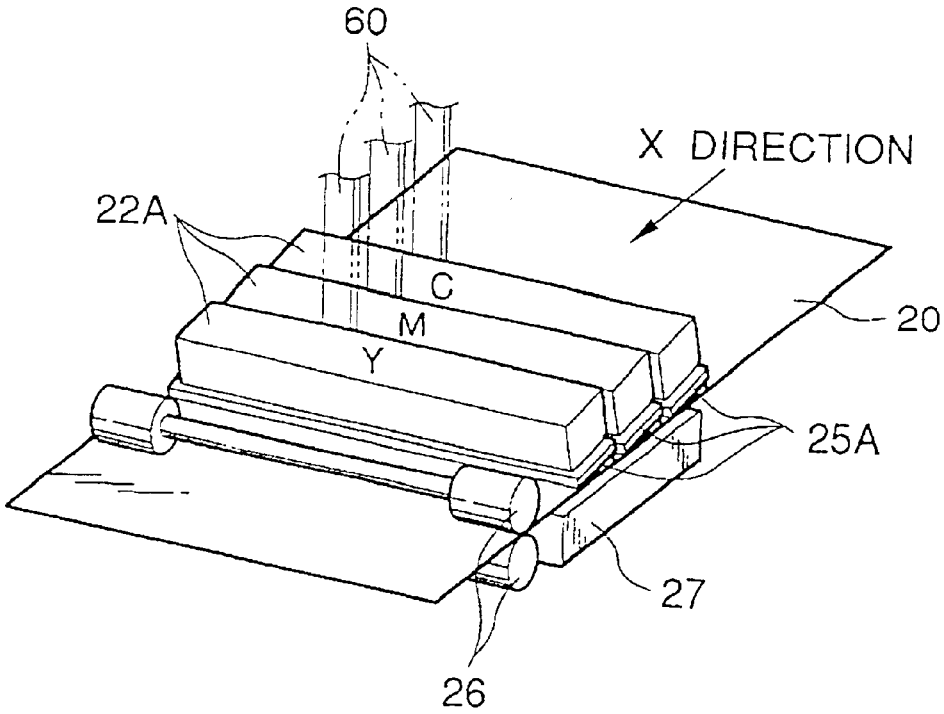
FIG. 47 is a perspective view for indicating a major portion of a line type recording apparatus under recording operation according to the embodiment of the present invention.
Figure 48:
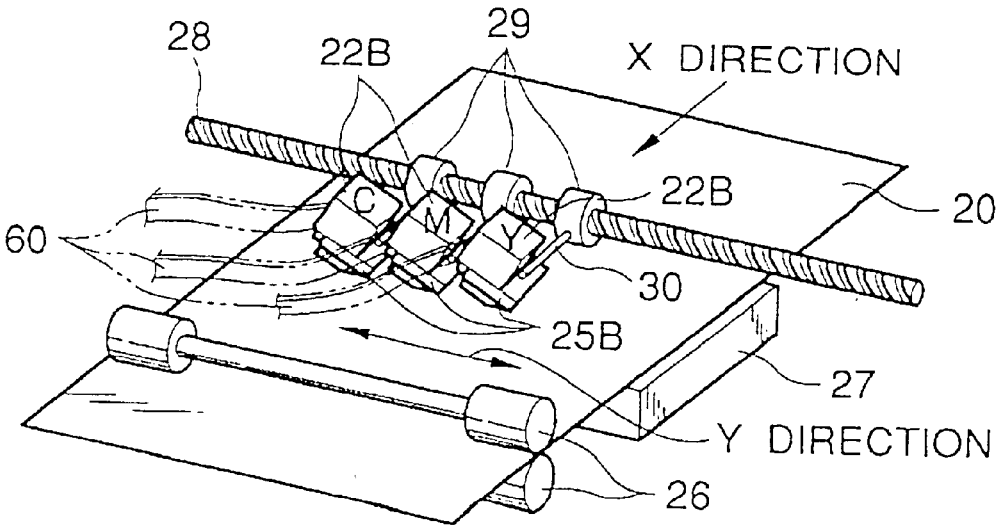
FIG. 48 is a perspective view for indicating a major portion of a serial type recording apparatus under recording operation according to the embodiment of the present invention.

FIG. 47 is a perspective view for schematically indicating one use condition that the above-explained recording head manufactured in accordance with this embodiment is applied to the line type recording system. FIG. 48 is a perspective view for schematically representing another use condition that the above-explained recording head manufactured in accordance with this embodiment is applied to the serial type recording system.

In the case of this line type recording system, as shown in FIG. 47, for instance, 10 sets of the heater chips are arranged to establish a length corresponding to the width of the printing medium 20, by which a recording head 25A is constructed. This recording head 25A is arranged along the X direction with respect to each of three colors. A dye reservoir tub 22A for storing one of three-primary-color dyes Y (yellow), M (magenta), and C (cyan) is mounted on this recording head 25A.

The printing medium 20 which is positioned opposite to the above-explained recording head 25A and is sandwiched by this recording head 25A and a platen 27, is printed by the recording head 25A. After a predetermined printing operation is carried out, while the printing medium 20 is transferred along the X direction by a feed roller 26, the subsequent printing operations are executed.

In the case of the serial type recording system, as indicated in FIG. 48, dye reservoir tubs 22 for storing, for instance, three-primary-color (Y, M, C) dyes (further black dye may be added) are mounted on 3 sets of recording heads 25B arranged in parallel to each other. The recording heads are coupled to a movable piece 29 which is engaged via a coupling member 30 to a feed shaft 28. Since this feed shaft 28 is engaged with the movable piece 29 by using a screw, the respective recording heads 25B are reciprocated along the Y direction in connection with the rotations of the feed shaft 28 by a drive source (not shown).

On the other hand, the printing medium 20 arranged opposite to this recording head 25B is transferred along the X direction by the feed roller 26 every time the recording head 25B is scanned for 1 line. As a result, the printing operation is carried out by the recording head 25B with respect to the printing medium 20 positioned to be sandwiched between the platen 27 and the recording head 25B.

A total number of heater chips arranged in the recording head 25B shown in FIG. 48 is smaller than that of heater chips arranged in the recording head 25A shown in FIG. 47. Then, the structure of the heater chip is completely commonly used in the recording heads 25A and 25B. Therefore, the same heater chips may be commonly used for the recording heads 25A and 25B, which is very useful to manufacture these recording heads.

In FIG. 47 and FIG. 48, a ribbon cable 60 connected to the printed circuit board is indicated by a virtual line.

It should be understood that in the serial type recording head, the larger a total number of heater chips are arranged, the wider the recording width recorded by scanning the head along the Y direction becomes. Thus, a total scanning number of this Y direction may be reduced. Based upon such an alternative idea, the plural heater chips whose quantity is equal to the entire length of the printing medium 20 along the longitudinal direction (i.e., X direction) are arranged along a straight line, and the image recording operation for one printing medium may be performed by scanning this recording head one time along the Y direction. In this alternative case, the printing medium is moved along the X direction by a distance equal to the length of this printing medium.

In the above-described embodiment, as indicated in FIG. 8, since no return electrode is provided on both sides of the heater chip 1, a total number of return electrodes 41B is decreased by 1, as compared with a total number of discrete electrodes 41A as to a single heater chip 1. Also, the bonding pads 35B for the common electrodes are arranged on both sides of the printed circuit board 12. As a consequence, the pitch of the bonding pads 35A for the separate electrodes must be slightly narrower than the pitch of the heating elements 6. As a consequence, all of these separate electrodes 35A could not be arranged along one straight line, but are successively bent two times on the side of the bonding pads 35B and 35A. Then, a central separate electrode becomes a straight line.

Figure 49:
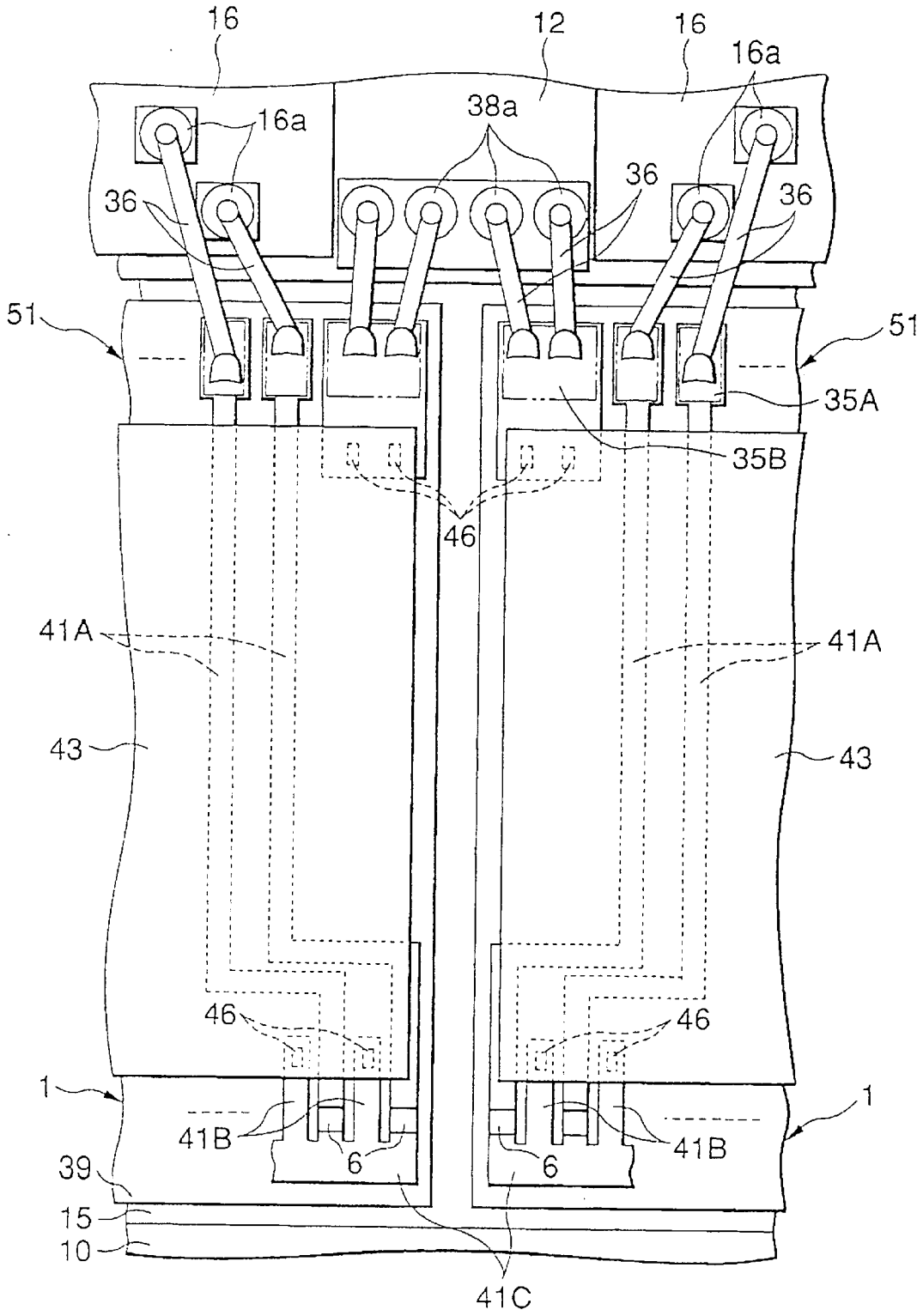
FIG. 49 is a plan view for partially showing an electric connection within a heater chip according to another embodiment of the present invention, similar to that of FIG. 8.

To the contrary, in the heater chip 51 shown in FIG. 49, the separate electrodes 41A are extended in a straight line form from the IC chip (16) side to the heating elements, and are successively bent on the side of the heating element. As a consequence, the separate electrodes may be readily arranged between the IC chip (16) side and the heating element.

As described above, the separate electrodes may be bent in various manners. For instance, the bonding pad for the common electrode is arranged at a center of the edge portion on the side of the printed circuit board, the separate electrodes are successively bent from the bonding pad for the common electrode, and then the separate electrodes located at both ends may be formed in a straight line.

Furthermore, contrary to FIG. 8 and FIG. 49, the separate electrode is connected to a tip portion of the heating member 6 (namely, tip portion located opposite to printed circuit board 12), while this separate electrode is bent two times, this bent separate electrode is connected to the bonding pad 35A for the separate electrode, and a straight-shaped return electrode may be connected to the edge portion located opposite to the above-explained edge portion of the heating element 6.

While the embodiments of the present invention have been described, the above-described embodiments may be modified based on the technical idea of the present invention.

For instance, the structures, shapes, and materials of the respective portions/members of the heater chip and also the recording heads may be changed from those of the above-described portions/members. Also, when the recording operation is carried out, the printing medium may be moved, or both the recording head and the printing medium are jointly moved to perform the mutual movement. Also, various modifications, or various combinations may be employed as to the shape, material, and size of the above-described heater 6. The substrate 11 may be manufactured by employing ceramics such as alumina and also the thermal characteristic of the recording head may be controlled by the heating member, the thermal insulating member, and the substrate.

The height, the sectional/plan shape, the density, and the material of the small cylindrical member 4 formed in the vaporizing portion may be varied. For example, a pattern fitted to the pillar-shaped member (namely, negative-to-positive inverted shape) is formed by photoresist, and a metal pillar such as nickel may be formed by way of the electrolytic plating method. In this case, a film having an electric conductivity may be previously formed as an under layer.

The pillar-shaped member forming method by the plating method can omit such lengthy process operations as the $SiO_2$ film forming process, the metal mask forming process, the $SiO_2$ etching process, as compared with the pillar-shaped member forming method of $SiO_2$. As a result, the pillar-shaped members can be formed within very short time by mass production.

The porous structure to be formed in the vaporizing portion is not limited to the above-described porous structure, but may be changed. For instance, in the case of a pillar member, a height thereof, a plan/sectional shape thereof, and density thereof may be changed. Alternatively, this porous structure may be formed at any places in which a very fine pattern is required, porous nature is required, or an enlargement of a surface area is required. As the porous structure, not only the pillar-shaped member, but also a wall-shaped member, a beads assembling member, and a fiber member may be manufactured.

Also, not only the dye vaporizing type thermoelectric system, but also the previously explained thermoelectric system by ablation may be utilized. In any of these systems, either the dyes or the recording materials are jetted to be transferred.

Also, a total number of recording material storage units for storing the recording materials (dyes), the dot number, and a total numbers of heating members and also of vaporizing portions may be varied. Alternatively, the arrangement shape and the size are not limited to those of the above-described embodiments.

Also, the structures and the shapes of the dye storage portion, the dye supply portion, the reading head, and the printer are not limited to the above-described structures/shapes, but may be properly modified. Further, other proper materials may be employed as the materials of the respective portions for constructing the recording head.

As to the recording dye, the three colors, i.e., magenta, yellow, cyan (additionally, black) are used to carry out the full color recording operation. Alternatively, a two-color printing operation, a monochromatic printing operation, or a black/white printing operation may be performed.

Also, the heating element may be made of a metal, or a metallic material. Alternatively, a head base material may be formed by a high heat conductivity material such as aluminium, and ceramics, whereas the thermal characteristic of the recording head may be controlled by the heating element, the heat insulating material, and the head base material.

Furthermore, the present invention may also be applied to such an ink jet type recording system. That is, a recording fluid containing a recording solution and a substance (namely, carrier), the volume of which is expanded by melting, or dispensing and heating this recording material is supplied. The condition of this recording fluid is changed by being heated to produce fluid droplets, and then the fluid droplets are transported to a printing medium located opposite to the recording head. Alternatively, the present invention may be applied to, for instance, a contact type recording system with employment of a thermal head.

The above-explained recording apparatus owns the recording head in which a plurality of recording head portions are arranged opposite to each other. In each of the plural recording head portions, the first electrode and the second electrode are employed so as to energize the heating elements, the first electrode is located between the heating elements with respect to each of the heating elements for heating the recording member so as to be transferred to the printing medium. Only the second electrode is present at the edge portions located opposite to each other among a plurality of recording heads. Accordingly, the pitch of the heating members provided in the recording head portion can be correctly maintained even in the edge portions opposite to each other between the respective recording head portions (namely, joint portion of recording head portions). This is because the second electrode is located, but the first electrode is not located at the edge portions opposite to each other of the recording head portion. It is possible to avoid that the distance between the heating elements at the opposite edge portions becomes larger than the pitch of the heating elements provided in the recording head portion, since the first electrode is located at this opposite edge portion.

As a result, the pitch of the heating members can be correctly maintained over a plurality of recording head portions. Therefore, the resolution, the optical density, and the gradations are not deteriorated at the opposite edge portions of the recording portion, and the recording characteristic with the high image quality can be obtained without any fluctuation.

Moreover, a plurality of recording head portions are arranged, so that each of these recording head portions can be made compact, and further the recording head having the desirable recording width can bed produced, resulting in the cost saving. Further, the recording widths may be freely defined by selecting a total number of recording head portions, so that the recording apparatus can be readily designed.

Figure 50:
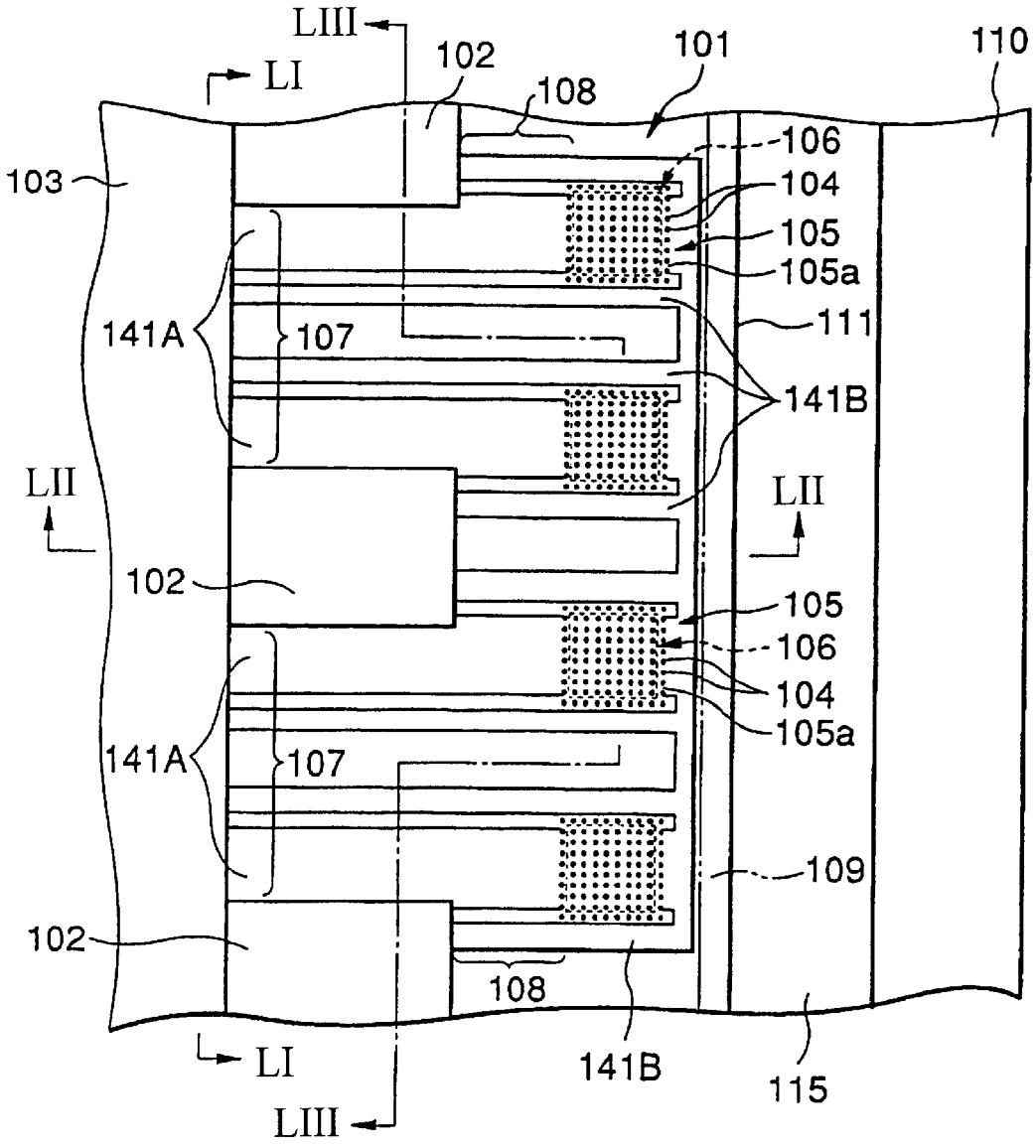
FIG. 50 is a plan view for schematically indicating a major portion of a printer head according to another embodiment of the present invention.
Figure 51:
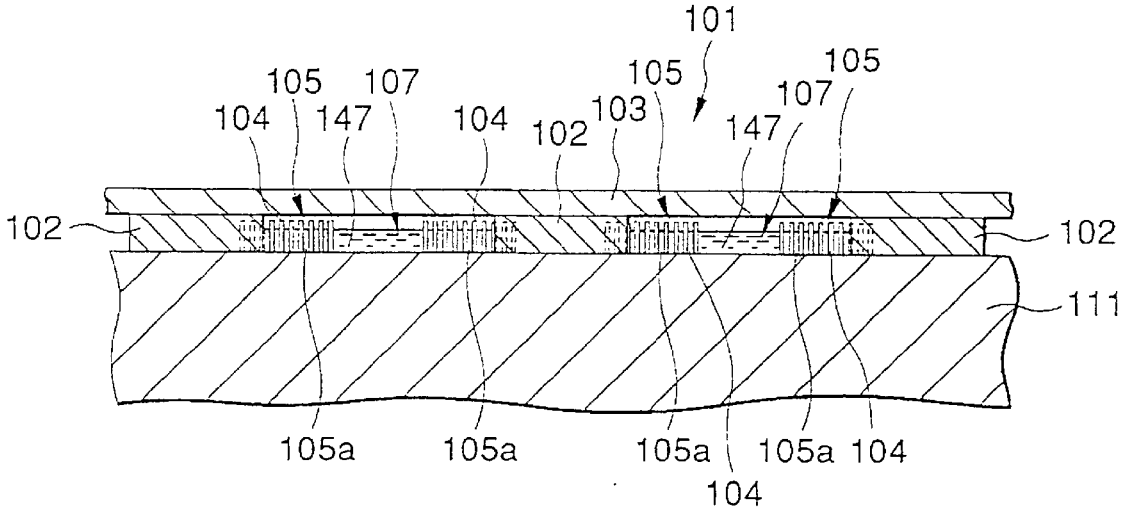
FIG. 51 is a sectional view of the printer head, taken along a line LI—LI shown in FIG. 50.
Figure 52:
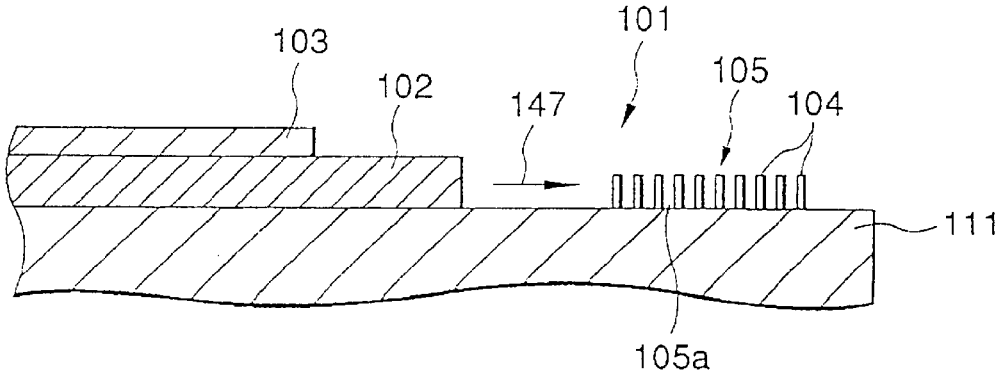
FIG. 52 is a sectional view of the printer head, taken along a line LII—LII shown in FIG. 50.
Figure 53:
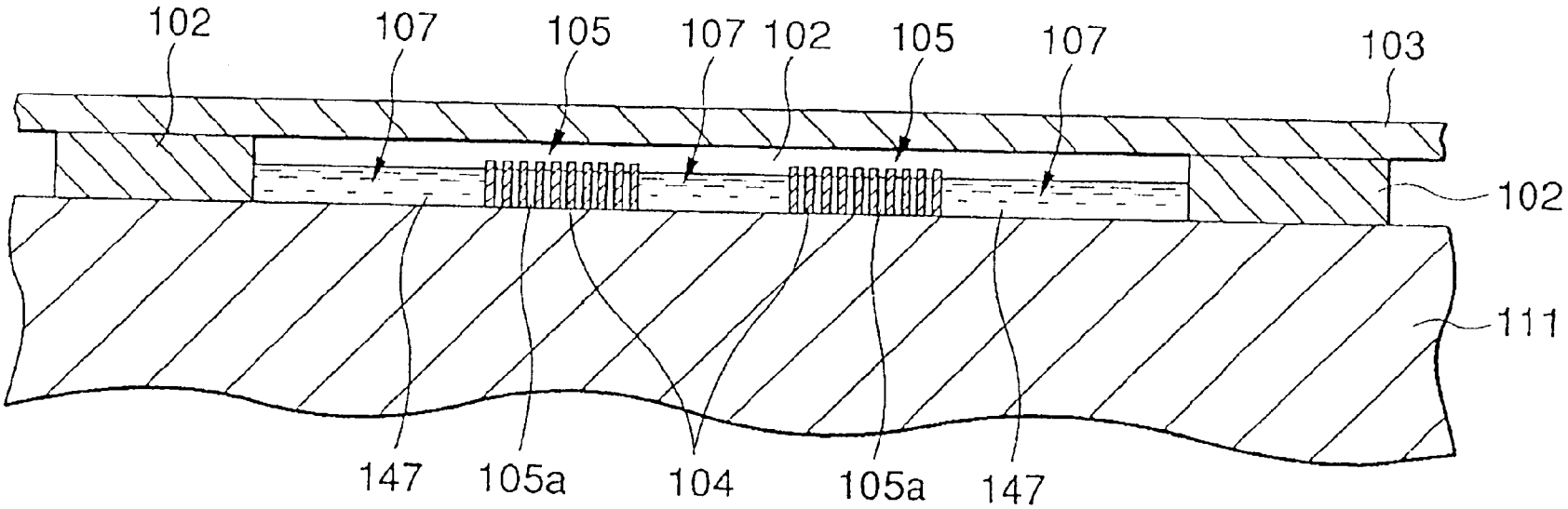
FIG. 53 is a sectional view of the printer head, taken along a line LIII—LIII shown in FIG. 50.

FIG. 50 is a plan view for indicating a major portion of a non-contact type dye jetting mode printer head according to another embodiment of the present invention. FIG. 51 is a sectional view for showing the printer head, taken along a line LI—LI of FIG. 50. Similarly, FIG. 52 is a sectional view, taken along a line LII—LII of FIG. 50. FIG. 53 is a sectional view, taken along a line LIII—LIII of FIG. 50.

The heater chip 101 of the printer head according to this embodiment is supported by the head base 110 in an integral body, and the dye jetting portion 105 constituted of the small cylindrical member 104 is arranged at a tip portion. The dye 147 is supplied from the branch path 107 partitioned by the branch path wall 102 to the dye jetting portion 105 positioned on both side of a tip portion thereof.

In the dye jetting unit 105, a porous structure is formed by, for example, $SiO_2$, and this porous structure is constituted by a group of vary fine small cylindrical members 104, the width and the diameter of which are smaller than, or equal to 10 $\mu$m (for example, 1 to 4 $\mu$m), the interval of which is smaller than, or equal to 10 $\mu$m (for instance, 1 to 4 $\mu$m), and the height of which is smaller than, or equal to 20 $\mu$m (for instance, 1 to 10 $\mu$m). This small cylindrical member (104) group constitutes the dye storage portion 105*a* for holding/storing the dye 147 based on the capillary phenomenon. Then, the dye 147 stored in this storage portion 105*a* is heated by the heater to be jetted.

The dye 147 is supplied from the commonly used dye supply path 119 via a plurality of branched branch paths 107. Then, this branch path 107 is formed by the branch path wall 102 made of a dry film (for example, sheet resist) having a thickness smaller than, or equal to 50 $\mu$m (for example, 10 to 30 $\mu$m), a lid 103 made of a nickel sheet having a thickness smaller than, or equal to 100 $\mu$m (for instance, 20 to 30 $\mu$m), and a substrate 111 made of silicon having a thickness smaller than, or equal to 5 mm (for example, 0.2 to 1 mm). As indicated in FIG. 51 and FIG. 53, this branch path 107 is constituted as a slit-shaped space.

The branch path wall 102 is provided in such a manner that this branch path wall 102 is projected to an intermediate position between a tip portion of the lid 103 and a plurality (in this case, two) of dye jetting portions 105. As a result, the dye 147 is mainly supplied to the dye jetting portions 105 arranged on both sides of the each branch path 107 on the tip side. Then, a region defined prior to the edge of the branch path wall 102 may constitute a communication portion 108 through which the dye 147 may flow into the respective dye jetting portions 105 arranged in an array. Then, volatile oil paint 109 made of fluorine compound is coated on the edge portion of the substrate 111 in order that the entered dye 147 is not leaked from the substrate 111.

Figure 54:
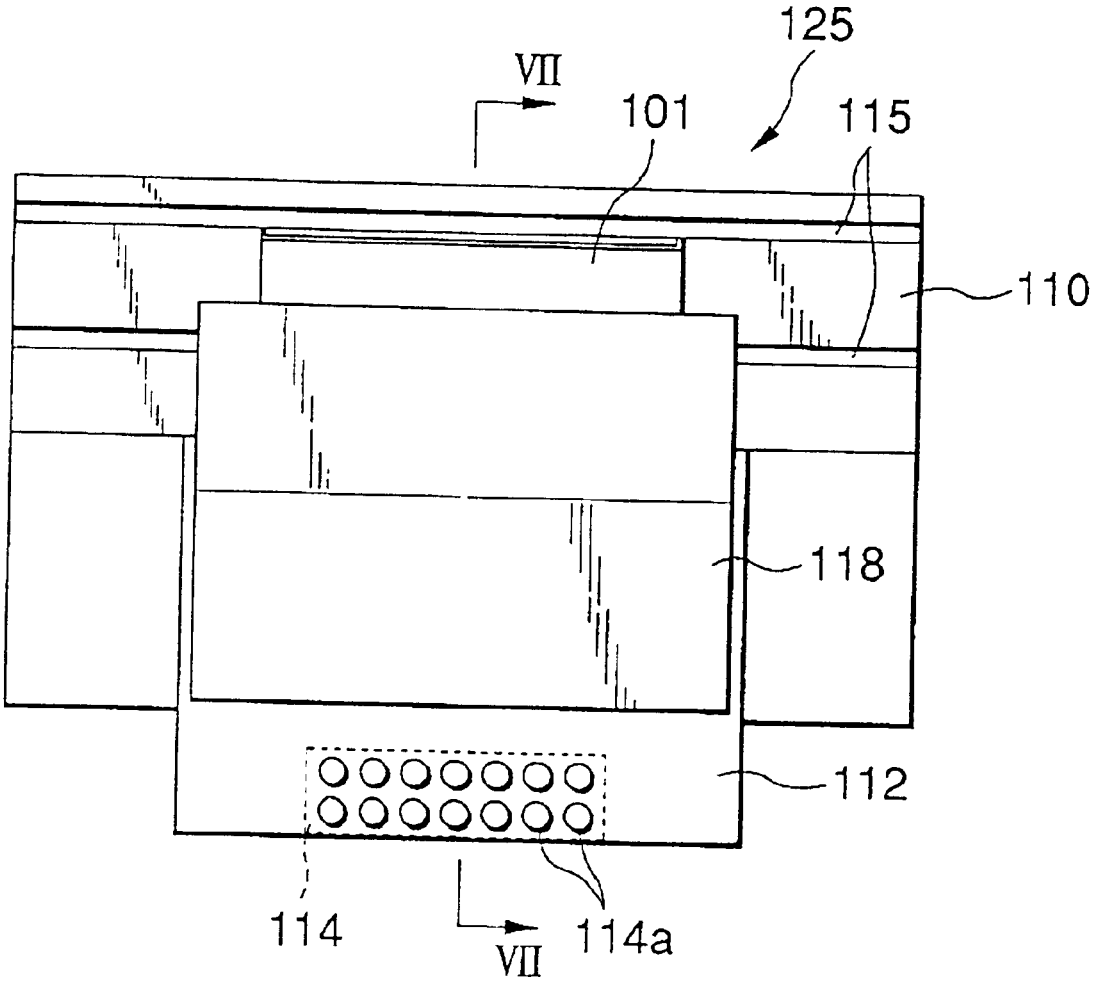
FIG. 54 is a plan view for indicating the printer head of this embodiment.

FIG. 54 is a plan view for showing a recording head 125 containing the above explained heater chip 101. In this recording head 125, both the printed circuit board 112 and the heater chip 101 are adhered onto the head base 110 made of aluminium and having the heat sink function by employing an adhesive agent of silicone compound. Furthermore, the cover 118 is adhered onto the members by using the same adhesive agent.

Figure 55:
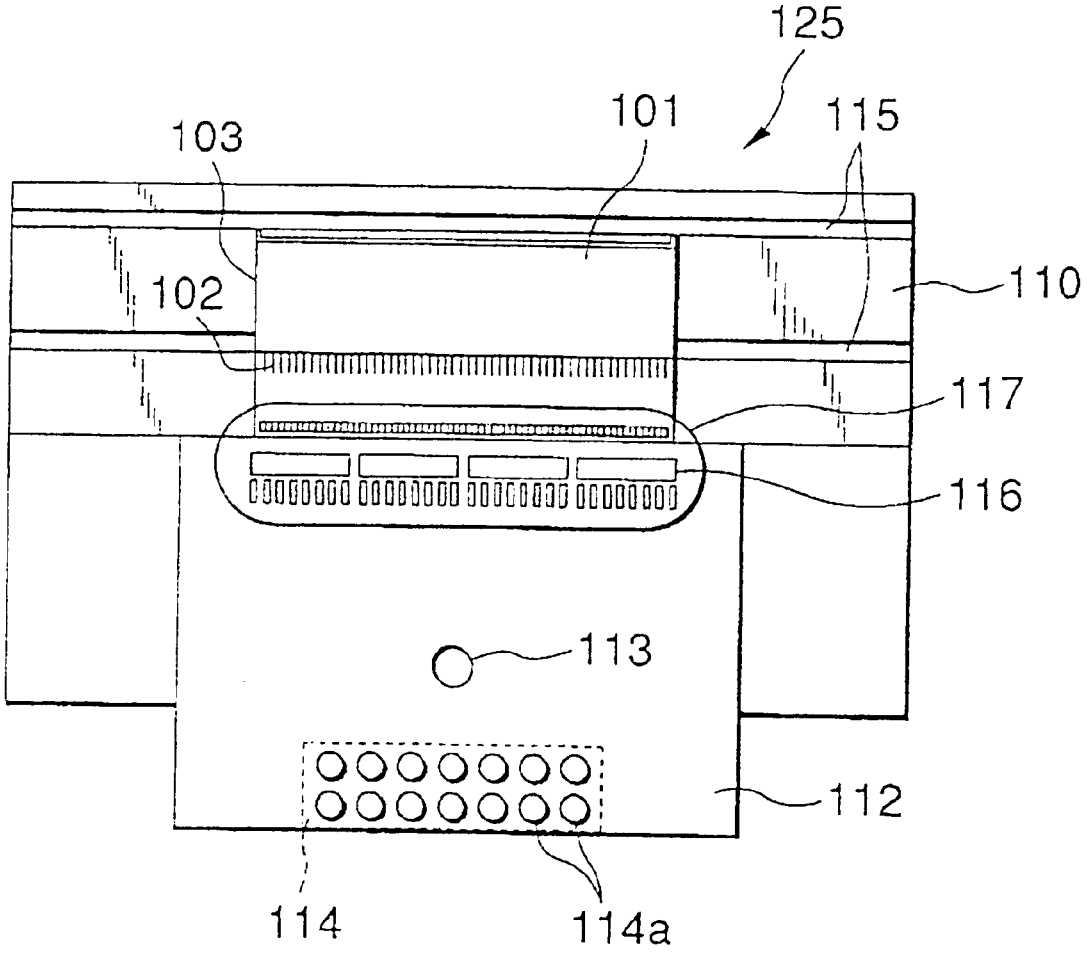
FIG. 55 is a plan view for showing such a condition that a cover is removed from the printer head of this embodiment.
Figure 56A:
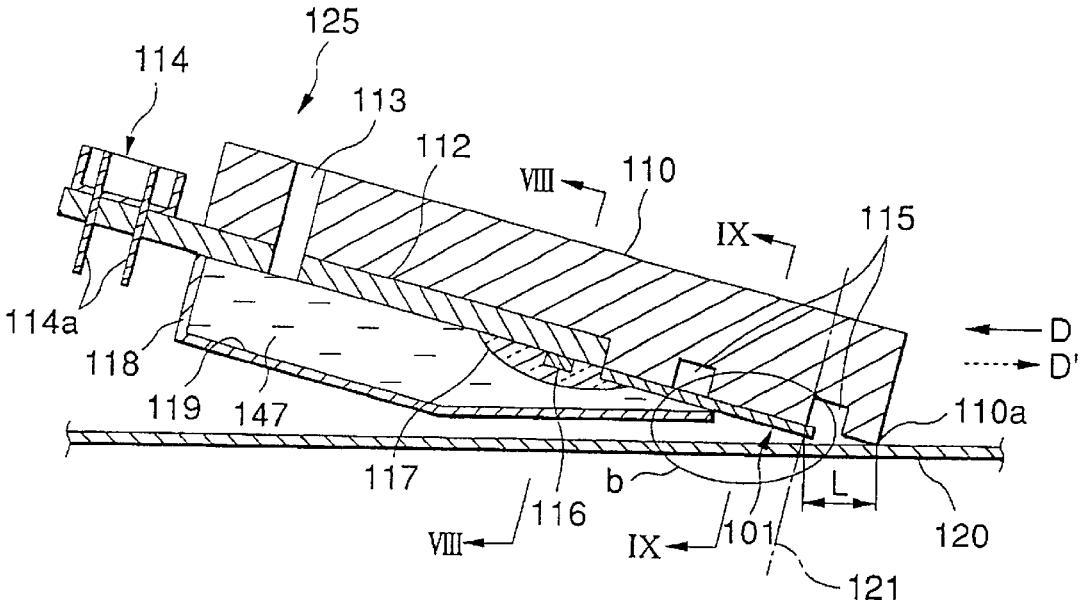
FIG. 56A is a sectional view, taken along a line VII—VII of FIG. 54.
Figure 56B:
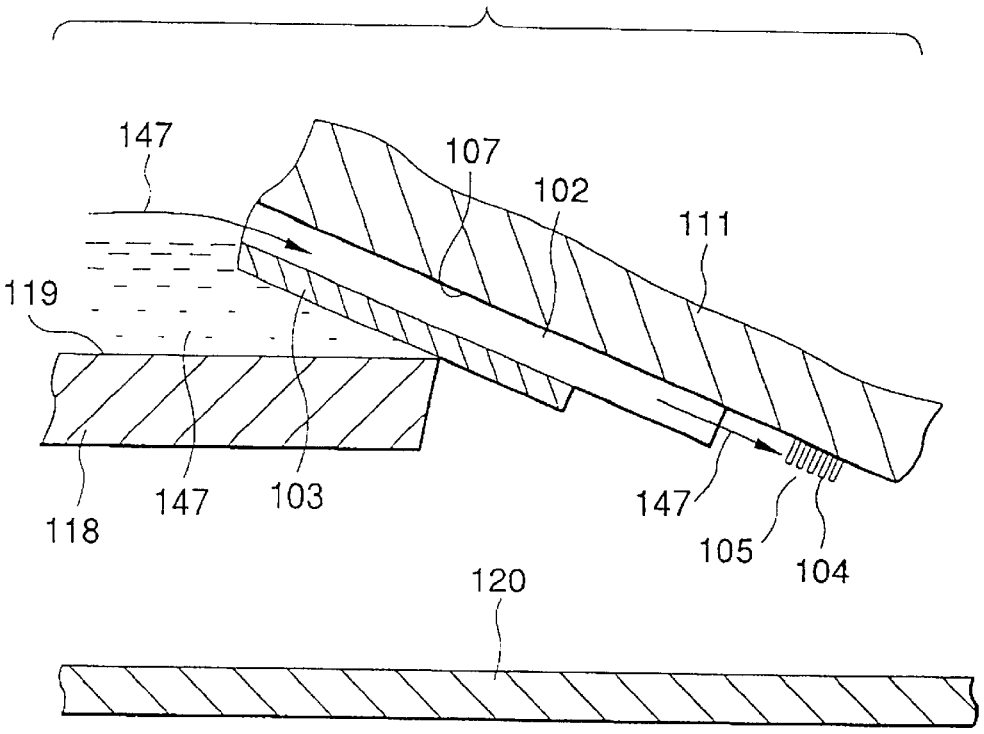
FIG. 56B is an enlarged sectional view for showing a portion "b" of FIG. 56A.

FIG. 55 is a plan view for indicating such a condition that the cover 118 has been removed from the condition shown in FIG. 54. Also, FIG. 56 is a sectional view, taken along a line VII—VII of FIG. 54. Also, as apparent from FIG. 56A and FIG. 56B, the mounting portion of the head base 110 for the printed circuit board 112 is made thin, which is defined by the thickness of the printed circuit board 112. A height of the base band 110 on which the printed circuit board 112 is being mounted, and which involves the IC chip 116 for driving the heating element mounted on this printed circuit board 112, is substantially equal to a height of an upper surface of the heater chip 101 mounted in parallel to this printed circuit board 112.

To uniformly adhere the heater chip 101 onto the joint portion of the heater chip 101, a groove 115 is formed on the head base 110. Thus, the unnecessary adhesive agent used to adhere the heater chip 101 may be escaped into this groove 115. Then, as shown in FIG. 55 and FIG. 56A, both the connection portion between the electrode on the heater chip 101 and the IC chip 116, and also the connection portion between the IC chip 116 and the wiring lines on the printed circuit board 112 are coated with the coating material JCR (junction coating resin) 117 of silicone compound, which is thermally hardened in order to protect the bonding wires for connection purposes.

As indicated in FIG. 55 and FIG. 56A, a dye conducting hole 113 penetrated through the head base 110 is provided on the printed circuit board 112, and then the fluid-conditioned dye 147 is conducted from the head base 110 to the space between the cover 118 and this base 110. Then, the cover 118 is adhered/sealed in order to cover a portion of the printed circuit board 112 and a portion of the heater chip 101. The inner surface of this cover 118 accepts the dye 147 conducted from the dye conducting hole 113, and constitutes the commonly used dye supply path 119 for supplying the dye 147 to the above-explained branch paths 107.

Figure 57:
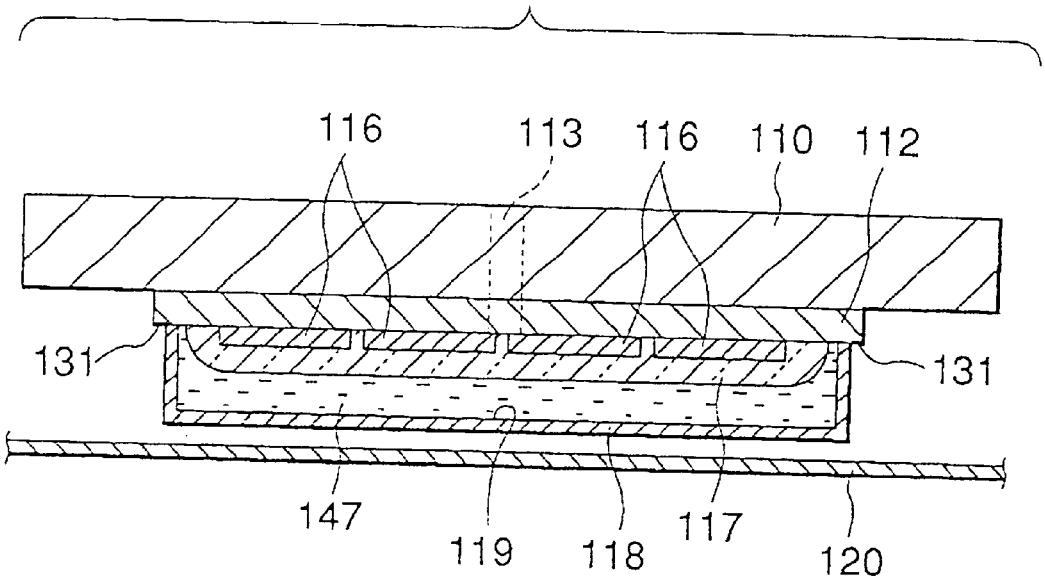
FIG. 57 is a sectional view, taken along a line VIII—VIII of FIG. 56A.
Figure 58:
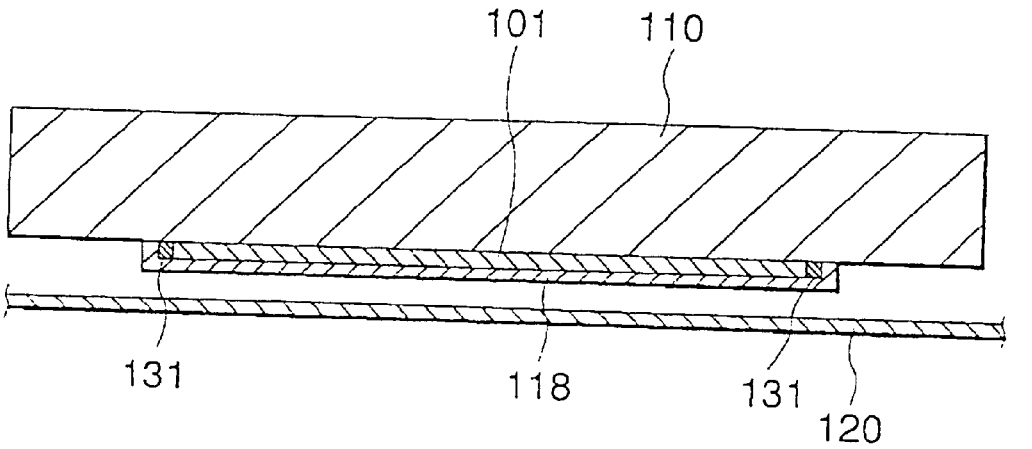
FIG. 58 is a sectional view, taken along a line IX—IX of FIG. 56A.
Figure 59:
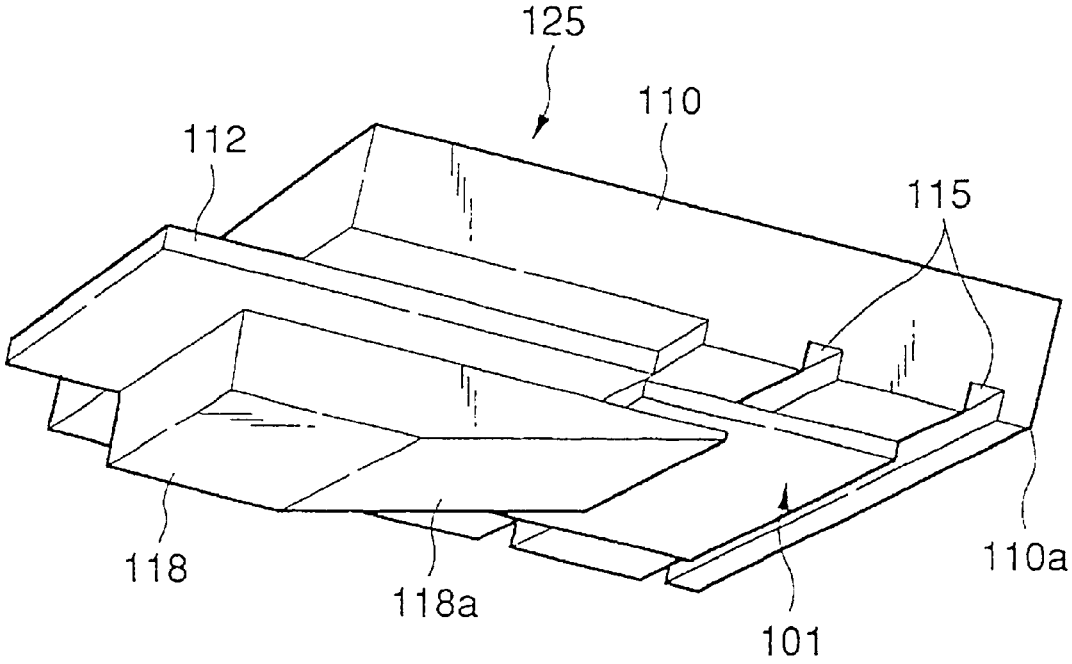
FIG. 59 is a perspective view for schematically showing the printer head according to this embodiment.

Then, as shown in FIG. 56A and FIG. 59, this cover 118 is shaped as a box as an entire shape in such a way that an inclined surface 118*a* is formed on a surface located opposite to the printing medium 120 in accordance with use conditions (will be discussed later), and a side surface thereof constitutes a wall surface as shown in FIG. 57. Then, a tip portion of this cover 118 is closely made in contact with the heater chip 101 as shown in FIG. 58, both the printed circuit board 112 and an adhesive surface of the cover 118 to the heater chip 101 are sealed by an adhesive agent in order that the dye 147 is not leaked.

Also, a portion near the tip portion of the cover 118 is arranged in FIG. 56B, as indicated by an enlarged sectional view of the portion "b" of FIG. 56A. That is, the dye 147 supplied from the commonly used dye supply path 119 is distributed to a branch path 107 having a slip-shaped fine space formed by the branch path wall 102 and the lid 103 on the substrate 111 of the heater chip 101, and then is conduced as indicated by an arrow. This conducted dye 147 is absorbed into the dye storage unit 105 constructed of the small cylindrical member (104) group as indicated by an arrow of FIG. 56B (namely, sectional view taken along line A—A of FIG. 3) by the capillary phenomenon, and then is stored/held in this dye storage unit 105.

In accordance with the recording head 125 formed in this manner, as indicated in FIG. 56A, one end 110*a* of the head base 110 positioned on the side of the provision of the heater chip 110 is made in contact with the printing medium 120, so that while a preselected angle can be maintained with respect to the printing medium 120, an interval between a center 121 of the dye jetting portion 105 (namely, a center of heat emitting portion) and the printing medium 120 can be kept constant.

In FIG. 56A, an arrow "D" of a solid line indicates a scanning direction of the recording head 125 during printing operation, whereas another arrow "D'" of a broken line indicates a returning direction of the recording head 125 after printing operation. As a consequence, during the printing operation, the heating element is heated in response to a signal corresponding to image data supplied via the connector 114 provided at another edge portion of the printed circuit board 112 so as to vaporize the dye 147 from the dye jetting portion 105, and then the vaporized dye 147 is jetted to the printing medium 120. A wiring pattern formed on the printed circuit board 112 is connected via the connector 114 to a flexible FPC (flexible print circuit) (not shown in detail).

The dye 147 which has been jetted to be adhered onto the surface of the printing medium 120 is sufficiently fixed on this printing medium 120 for a time duration during which the recording head is moved over a distance "L" between the center 121 (namely, adhere position of dye) of the dye jetting portion 105 and a contact portion 110*a* of the head base 110 with respect to the printing medium 120, and then this contact portion 110*a* reaches the center 121 of the dye jetting portion (namely, adhered position of dye). Accordingly, there is no risk that the adhered dye is scratched, or dirtied since the contact portion 110*a* is made contact with the adhered dye. Also, since there is such an effect that waving surfaces of the printing medium 120 can be flattened by this contact portion 110*a*, the printed images having the better image qualities can be produced.

In accordance with this embodiment, since the recording material jetting portion of the recording head 125 is set under downward condition, the jetted dyes are rapidly cooled by ambient air to be condensed. The condensed dyes are directly dropped and adhered onto the printing medium 120, so that most of the jetted dyes can be transferred to this printing medium 120. It should be understood that this recording material jetting portion 105 may be used under upward condition.

Figure 60:
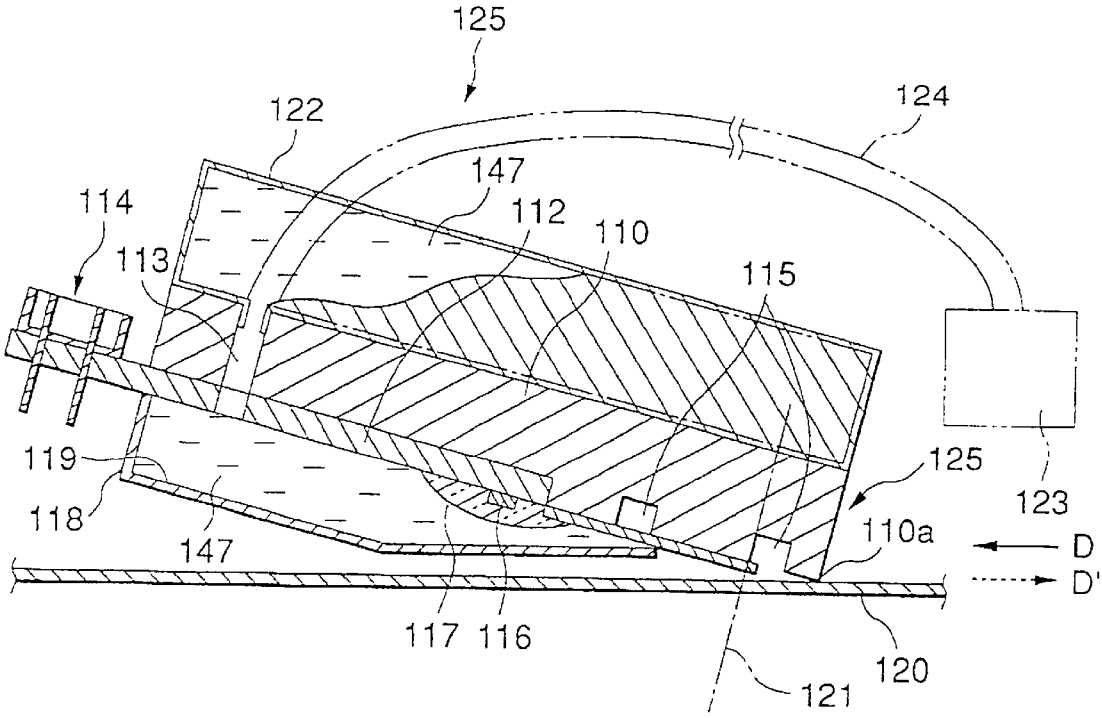
FIG. 60 is a sectional view for showing such a condition that a dye reservoir tub is mounted on the printer head according to this embodiment.

As the method for conducting the dye 147 from the head base (110) side to the dye conducting hole 113, as shown in FIG. 60, a detachable type dye reservoir tub 122 is mounted on a rear portion of the head base 110, and the dye 147 is automatically injected via the dye conducting hole 113 to the commonly used dye supplying path 119 by receiving gravity.

It should also be noted that as indicated by a virtual line, the bottom wall of the dye reservoir tub 122 is made in a thin-plate shape and is inclined so as to have a rectangular-shaped inside sectional plane. Then, since the recording head 125 is inclined in a reverse direction during the non-operation condition, the dye left inside this dye reservoir tub 122 may be supplied from the dye conducting hole 113 onto the cover 118 so as to be recorded on the printing medium.

Also, as indicated by a virtual line in this drawing, the dye reservoir tub 123 may be provided at a place apart from the recording head 125, and thus the dye 147 may be alternatively supplied via a flexible conducting tube 124 which connects the reservoir tub 123 to the dye conducting hole 113.

As the dye 147, a yellow (Y) dye, a magenta (M) dye, and a cyan (C) dye were used which were produced by solving 15 weight % of solvent yellow 156, disperse red 101, solvent blue 135, respectively, into dibutyl phthalate at 50° C. When this dye 147 heated at 50° C. is conduced into the dye reservoir tub 122 of the recording head 125, the dye 147 may be automatically conduced via the path 113 to the recording portion.

Figure 61A:
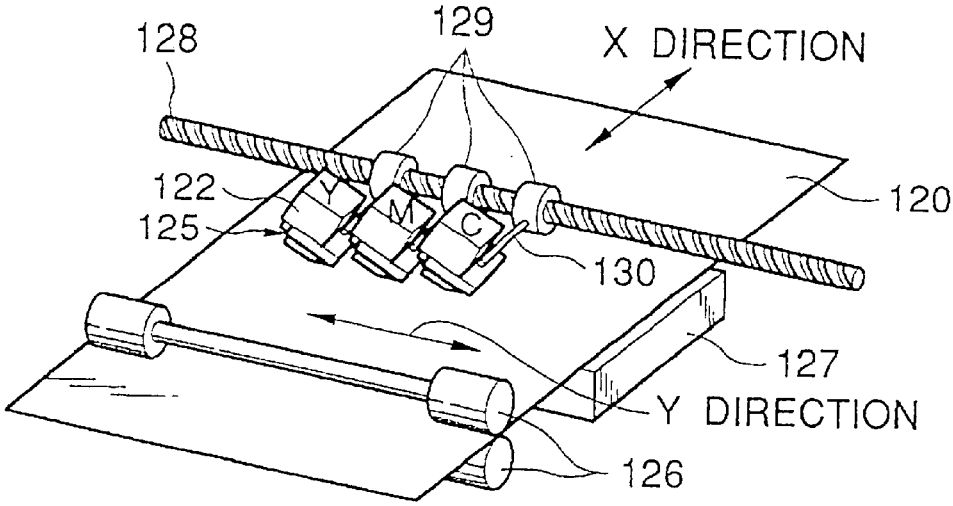
FIG. 61A is a perspective view for schematically showing a use condition by a serial type printer head according to this embodiment.
Figure 61B:
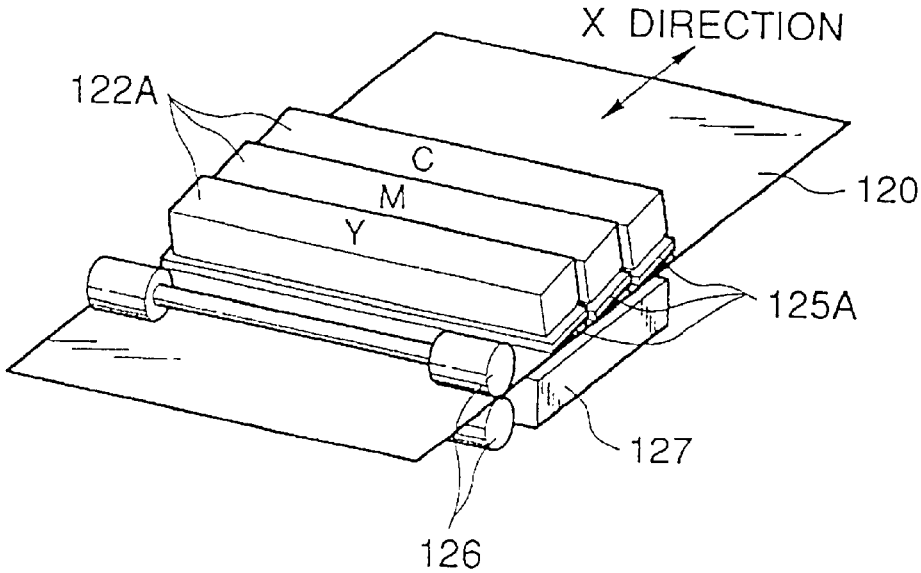
FIG. 61B is a perspective view for schematically indicating a use condition by a line type printer head according to this embodiment.

FIG. 61A and FIG. 61B are a perspective views for schematically indicating use conditions that the above-explained recording head manufactured in accordance with this embodiment is applied. FIG. 61A is a perspective view for schematically representing one use condition that the above-explained recording head manufactured in accordance with this embodiment is applied to the serial type recording system. FIG. 61B represents another example that this recording head is applied to the line system.

In the case of the serial type recording system, as indicated in FIG. 61A, dye reservoir tubs 122 (see FIG. 60) for storing, for instance, three-primary-color (Y, M, C) dyes (further black dye may be added) are mounted on 3 sets of recording heads 125 arranged in parallel to each other. The recording heads are coupled to a movable piece 129 which is engaged via a coupling member 130 to a feed shaft 128. Since this feed shaft 128 is engaged with the movable piece 129 by using a screw, the respective recording heads 125 are reciprocated along the Y direction in connection with the rotations of the feed shaft 128 by a drive source (not shown).

On the other hand, the printing medium 120 arranged opposite to this recording head 125 is transferred along the X direction by the feed roller 126 every time the recording head 125 is scanned for 1 line. As a result, the printing operation is carried out by the recording head 125 with respect to the printing medium 120 positioned to be sandwiched between the platen 127 and the recording head 125.

In the case of this line type recording system, as shown in FIG. 61B, a recording head 125A having a length corresponding to the width of the printing medium 120 is arranged along the X direction with respect to each of three colors. A dye reservoir tub 122A for storing one of three-primary-color dyes Y (yellow), M (magenta), and C (cyan) is mounted on this recording head 125A.

As a consequence, the printing medium 120 which is positioned opposite to the above-explained recording head 125A and is sandwiched by this recording head 125A and a platen 127, is printed by the recording head 125A. After a predetermined printing operation is carried out, while the printing medium 120 is transferred along the X direction by a feed roller 126, the subsequent printing operations are executed.

The recording head 125 according to this embodiment owns such a small-sized width as indicated in FIG. 61A, whereas the recording head 125A of the line system shown in FIG. 61B owns such a long-sized width. However, there are only differences in the dimensions and specifications, but these structures and basic ideas are identical to each other. Accordingly, this content is not shown.

Figure 62:
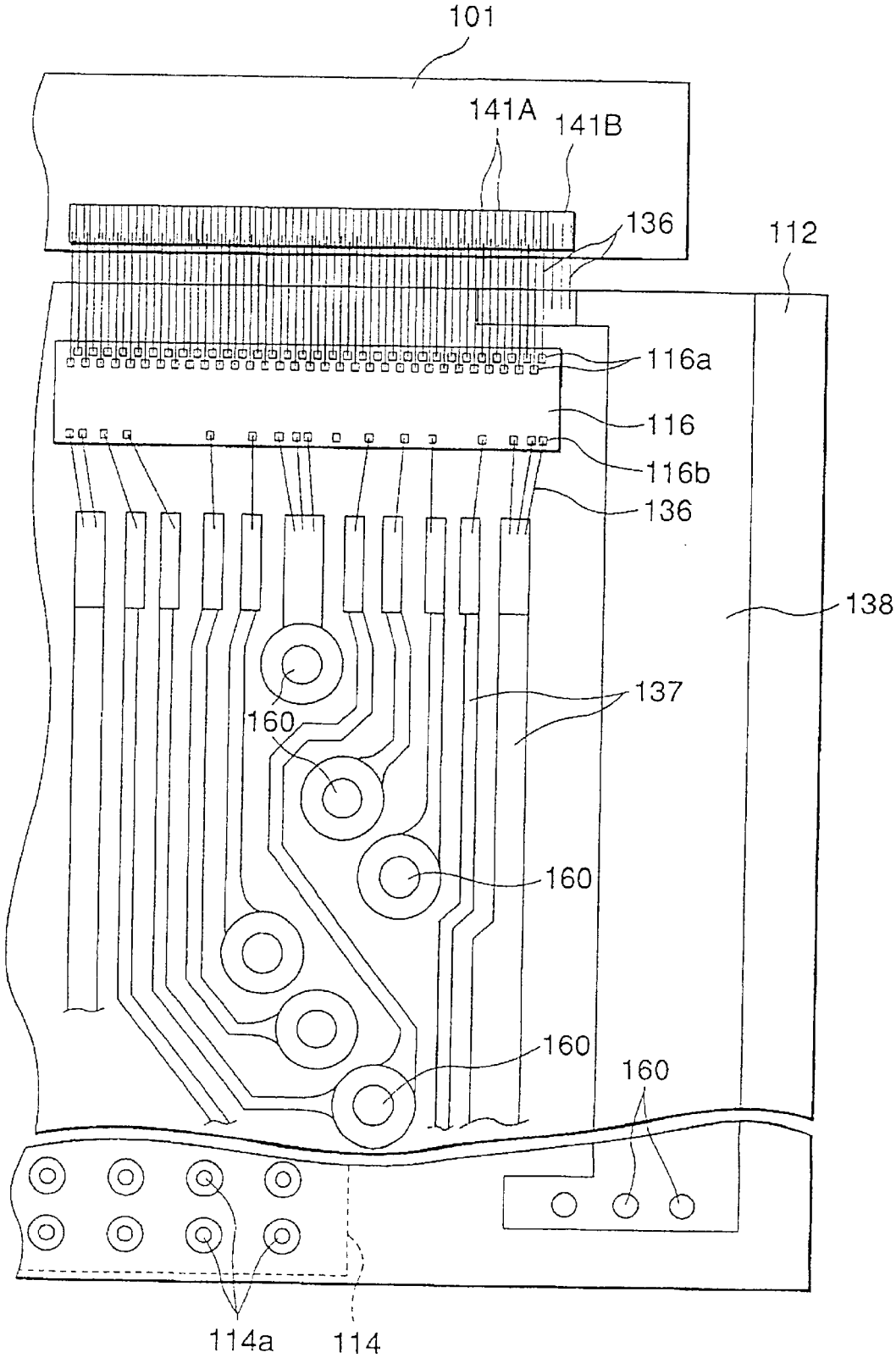
FIG. 62 is a plan view for indicating a portion of the printer head according to this embodiment.

Referring now to FIG. 55, a more detailed explanation is made of a connection portion between the electrodes of the heater chip 101 and the IC chip 116, and also a connection between the electrodes of the printed circuit board 112 and the IC chip 116. FIG. 62 is an enlarged plan view for partially showing these connections, namely indicates only one (right end) of 4 pieces of the IC chips 116 arranged on the printed circuit board 112.

Each of large numbers of separate electrodes 141A formed on the heater chip 101 is connected to one bonding pad 116*a* of the IC chip 116 by the bonding wire 136, and the common electrode 141B of the heater chip 101 is connected to a common electrode wire line 138 of the printed circuit board 112. The other pad 116*b* of the IC chip 116 is connected to a circuit wire line (pattern) 137 of the printed circuit board 112 by the bonding wire 136. The respective wire lines 137 and 138 are conducted via a through hole 160 to the connector 114, depending upon places.

As a result, a signal in response to image information supplied from a signal cable (ribbon cable in this case) (not shown) connected to the connector 114 is furnished via this connector 114 from the circuit wire line 137 of the printed circuit board 112 through the IC chip 116 to a preselected separate electrode 141A of the heater chip 101.

Then, each of the heaters 106 (concretely speaking, polysilicon heating member) provided between the separate electrode 141A of the heater chip 101 and the common electrode 141B is energized so as to heat the dye 147 held in the small cylindrical member (104) group formed on the heaters 106, so that the heated dye 147 is jetted to the printing medium 120.

As a result, a sufficient amount of dyes 147 must be continuously held during the image recording operation in the dye jetting portion 105 having the porous structure and constructed of the small cylindrical member (104) group. Moreover, the dyes 147 which are consumed by the image recording operation must be supplied without any problem. This requirement can be sufficiently satisfied by the below-mentioned structures which will be described with reference to FIG. 63.

As previously explained, according to the head 125 of this embodiment, since the dye 147 supplied via the branch path 107 is simultaneously supplied to two sets of the jetting portions 105, even when the space between the recording material jetting structures 5 and 5 is narrowed in correspondence with high resolution required for a printed image, the space between the recording material supply paths 7 and 7 need not be narrowed, so that a sufficient amount of the dyes can be performed. Also, since the manufacturing method of the recording apparatus does not become complex and further no high precision is required in the manufacturing steps of the recording material supply path 7, the yield of manufacturing this recording apparatus is increased, as compared with that of the conventional recording apparatus, and moreover the manufacturing cost thereof can be suppressed.

Also, the branch path wall 102 is provided in such a manner that this branch path wall 102 is projected up to the intermediate portion between the lid 103 and the dye jetting portion 105, and the portion where the branch path wall 102 is not present constitutes the communication portion 108. As a result, the branch path 107 can also supply the dye 147 to such a dye jetting portion 105 other than the original region to which the dye 147 is mainly supplied (namely, dye jetting portions on the adjoining branch paths).

In the conventional system, when the space between the recording material jetting structures 5 and 5 becomes narrow, the space between the recording material supply paths is accordingly narrowed. As a result, the sectional areas of the individual recording supply paths are narrowed. As a result, there is a risk that when the recording material is jetted from the recording material jetting structure to the printing medium located opposite thereto, the necessary/sufficient amounts of recording material cannot be supplied to the recording material jetting structure. However, in accordance with the structures, since the sectional areas of the individual recording material supply paths 107 are determined not by the space between the recording material jetting structures 105, even when the space between the recording material jetting structures 105 becomes narrow, the necessary/sufficient amounts of recording materials can be supplied/secured to the recording material jetting structures.

Figure 63:
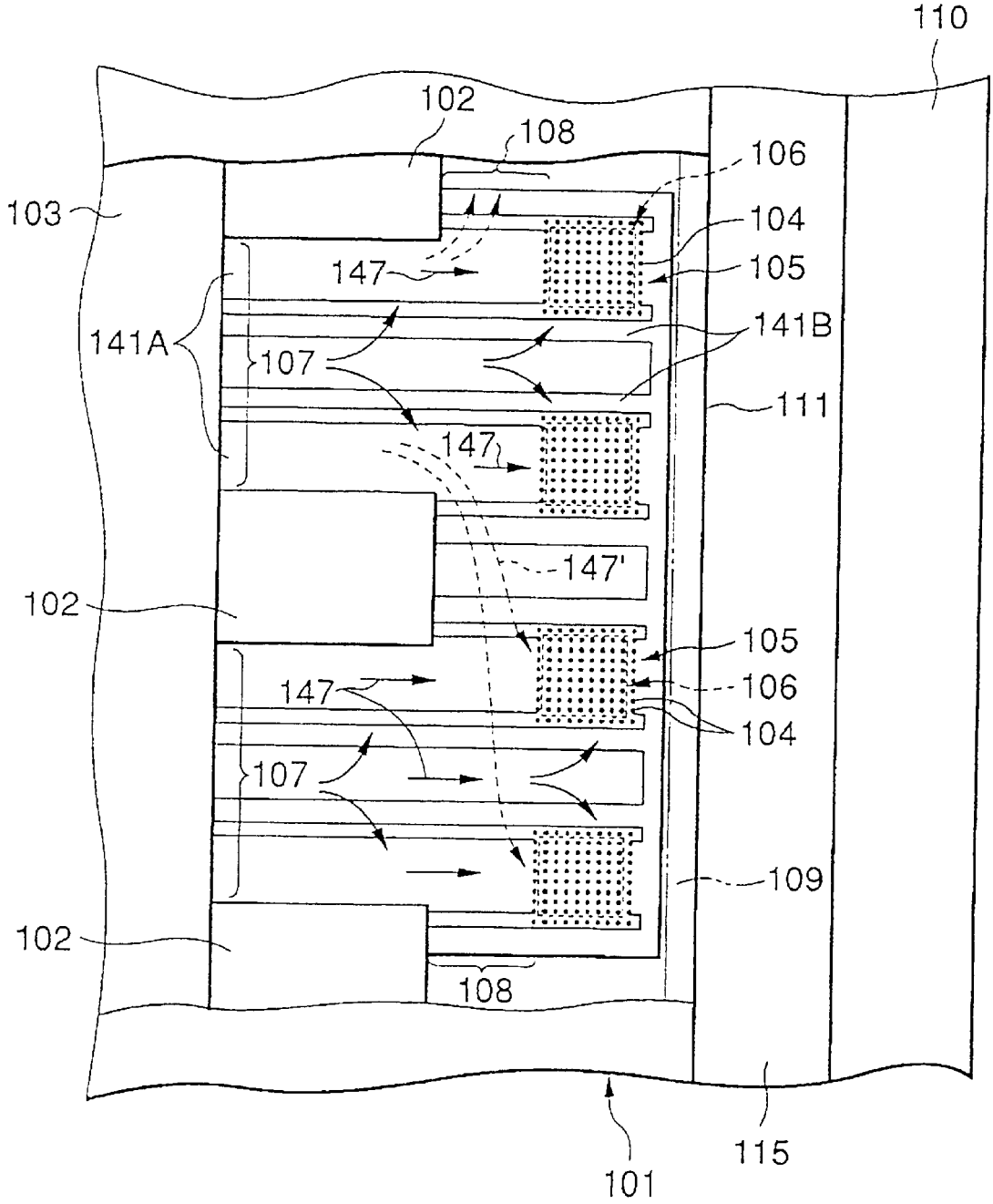
FIG. 63 is a plan view for showing a major flow portion of the dye in a heater chip according to this embodiment.

In FIG. 63, an arrow 147 of a solid line denotes a flow of the dye 147 by the branch path 147 to the original dye supply region, whereas another arrow 147' of a broken line shows a flow of the dye 147' to the region other than the original dye supply region. As a consequence, even when the dye 147 is not supplied from a predetermined branch path 107 due to some reason, the dye 147' may be supplied from another branch path 107, so that there is no problem in the printing operation.

It should be noted that, for example, even when the small cylindrical member (104) group is not present in the dye jetting portion 105, the recording material may be jetted. Even in such a case, the current may flow through a predetermined separate electrode 141A in response to image information, and thus the heater 106 provided under the dye jetting portion 105 is heated by this current, so that the dye 147 existing above this dye jetting portion 105 may be vaporized and jetted. However, in such a case that the jetting structure constructed of the small cylindrical member 104 is employed, when the surface tension of the dye 147 is lowered due to the heating action, a sufficient amount of dyes 147 can be held in the dye jetting portion 105, and therefore, the dye can be jetted under better condition.

Next, a manufacturing step of the above-described head according to this embodiment will now be explained. FIG. 64 to FIG. 78 are sectional views for representing the heater chips in the respective manufacturing steps. FIG. 79 to FIG. 87 are plan views for showing the heater chips in a portion of the manufacturing steps corresponding to the above-described manufacturing steps.

Figure 64:
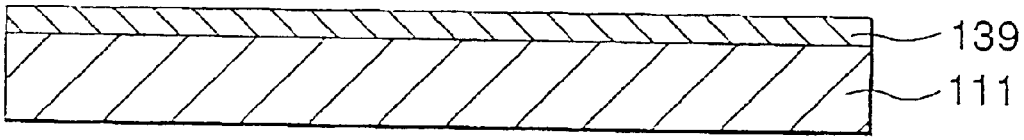
FIG. 64 is a sectional view for schematically representing one manufacturing step of the heater chip according to this embodiment.

FIG. 64 represents a first manufacturing step at which a silicon wafer having a better heat radiation characteristic (namely, high thermal conductivity) is used as a substrate 111, and an $SiO_2$ layer 139 having a thickness of on the order of 1 to 2 $\mu$m is formed on this substrate 111 by way of the thermal oxidation method, or the CVD (chemical vapor deposition) method. Since the $SiO_2$ layer 139 may function as a heat storage layer immediately under the heating element (will be discussed later), the thickness of this $SiO_2$ layer 139 must be determined by considering the heat radiation characteristic of the heat sink of aluminium which constitutes a base. FIG. 64 shows a portion mainly corresponding to the sectional view, taken along a line III—III of FIG. 3.

Figure 65:
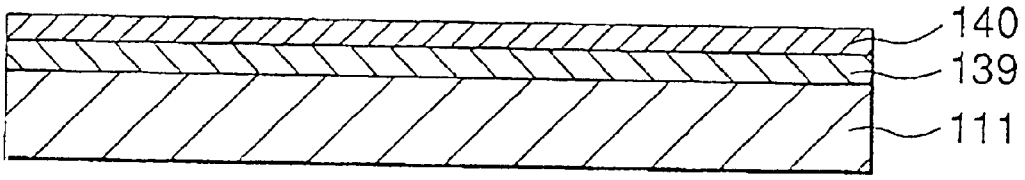
FIG. 65 is a sectional view for schematically indicating another manufacturing step of the heater chip according to this embodiment.

Subsequently, as indicated in FIG. 65, a film of a polysilicon layer 140 which constitutes a resistance member (heating element) is formed on the $SiO_2$ layer 139 by way of the decompression CVD method under such a condition that a thickness of this polysilicon film layer is on the order of 0.4 μm. The film of this polysilicon layer 140 is manufactured by doping phosphorus in order that a sheet resistance thereof is on the order of 4 kΩ.

Figure 66:
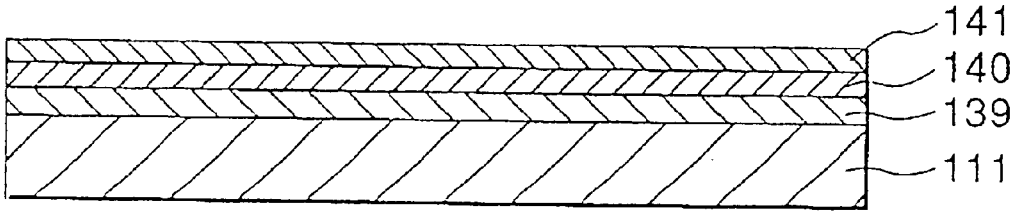
FIG. 66 is a sectional view for schematically indicating another manufacturing step of the heater chip according to this embodiment.

Next, as indicated in FIG. 66, a film of aluminium 141 into which titanium is slightly doped is formed on the polysilicon layer 140 by way of the sputtering method under such a condition that a thickness of this polysilicon film layer is on the order of 0.7 μm. In this case, any metals other than aluminium, such as gold, copper, and platinum may be used as the conductive material.

Figure 67:
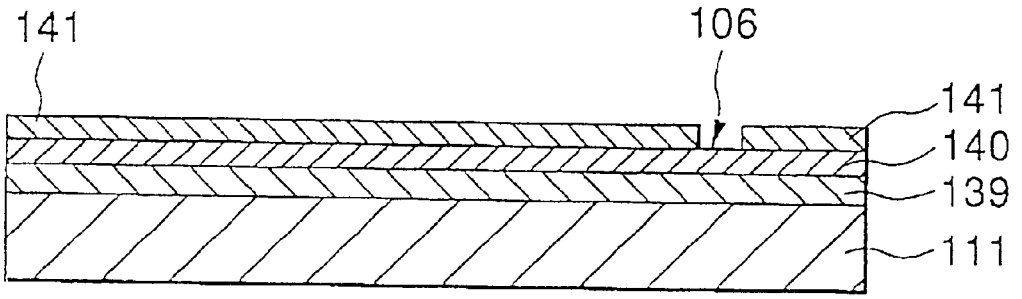
FIG. 67 is a sectional view for schematically indicating another manufacturing step of the heater chip according to this embodiment.
Figure 69:
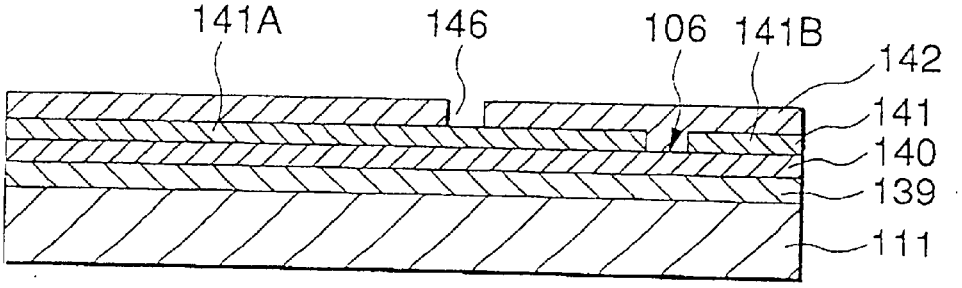
FIG. 69 is a sectional view for schematically indicating another manufacturing step of the heater chip according to this embodiment.
Figure 79:
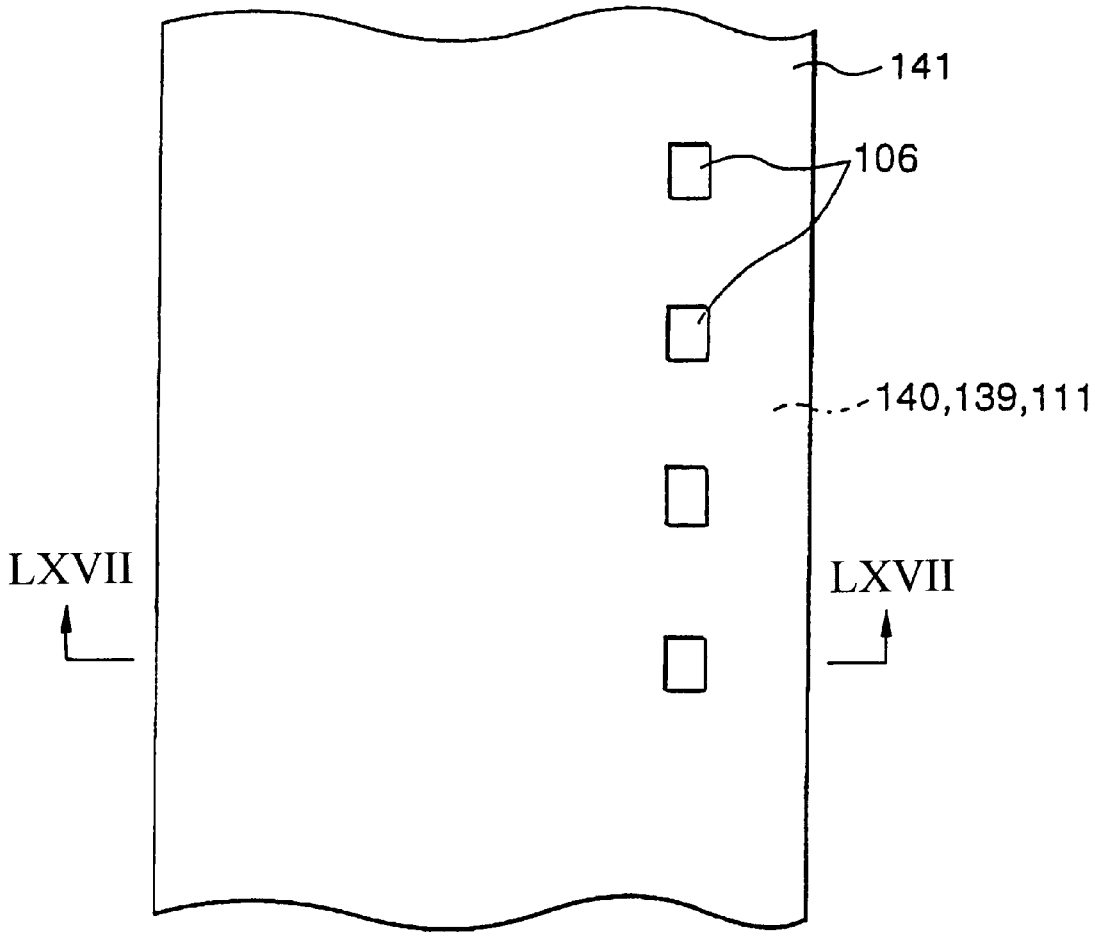
FIG. 79 is a plan view for schematically indicating a manufacturing step of the heater chip according to another embodiment.

Next, as shown in FIG. 67, in order to expose the polysilicon layer 140 where the heater 106 is formed as the heating element 106, photoresist having a preselected pattern is formed, and aluminium of this portion is selectively removed by way of the etching process. In this etching process, a mixtured acid fluid is used as the etching fluid by mixing the following acid and water at the below-mentioned ratio: phosphoric acid:nitric acid:acetic acid:water=4:1 :4:1. Then, FIG. 79 is a plan view for indicating this condition. FIG. 69 is a sectional view taken along a line LXVII—LXVII of FIG. 79.

Figure 80:
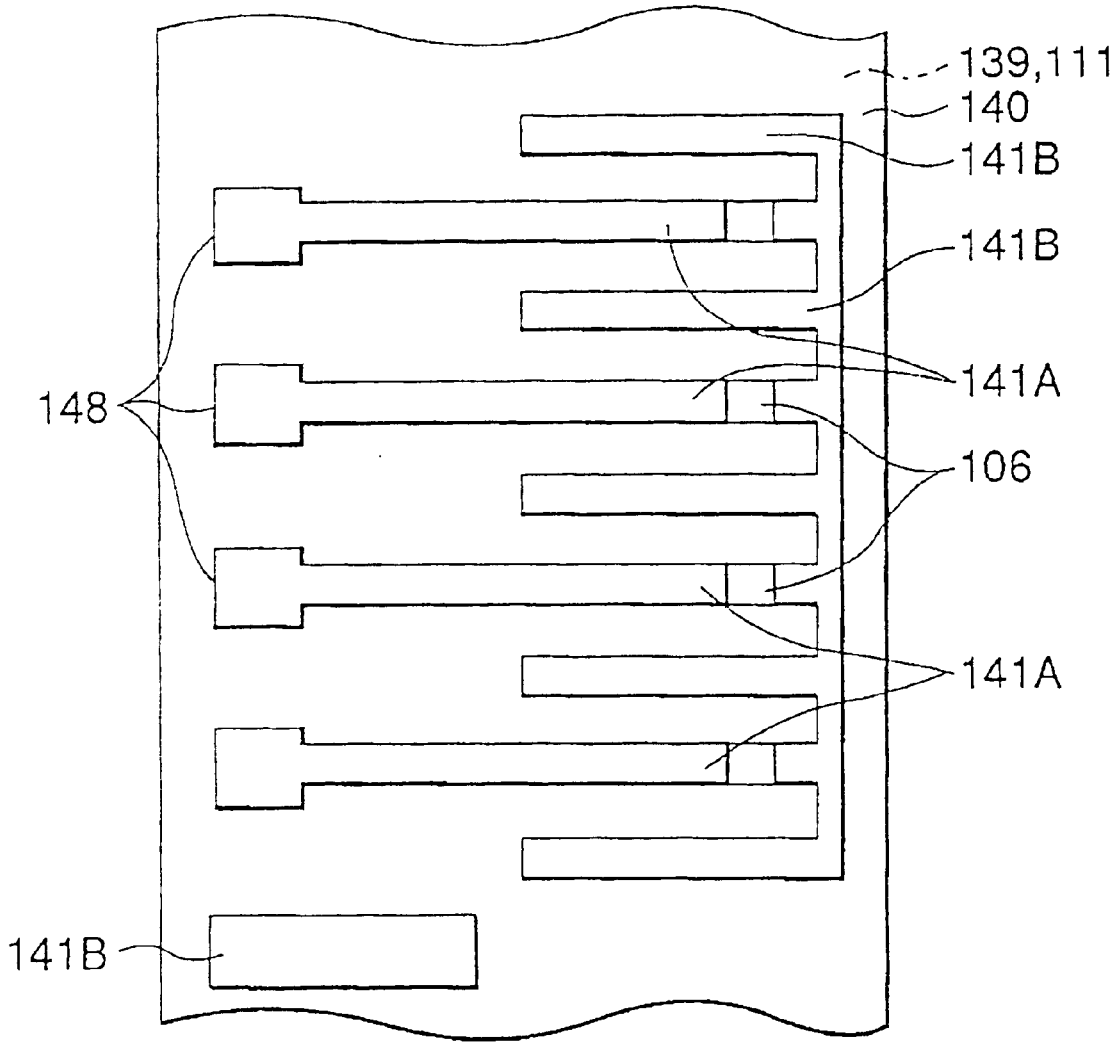
FIG. 80 is a plan view for schematically showing another manufacturing step of the heater chip according to this embodiment.

Next, wiring patterns used to energize the respective heater portions 106 are formed by way of the etching process. That is, while photoresist is used as a mask, aluminium is etched away by using the above-described etching fluid to form conductor patterns, so that such patterns as shown in FIG. 80 are formed. It should be noted that in FIG. 80, the plan shapes of the respective aluminium patterns shown in FIG. 3 are simply illustrated.

Figure 81:
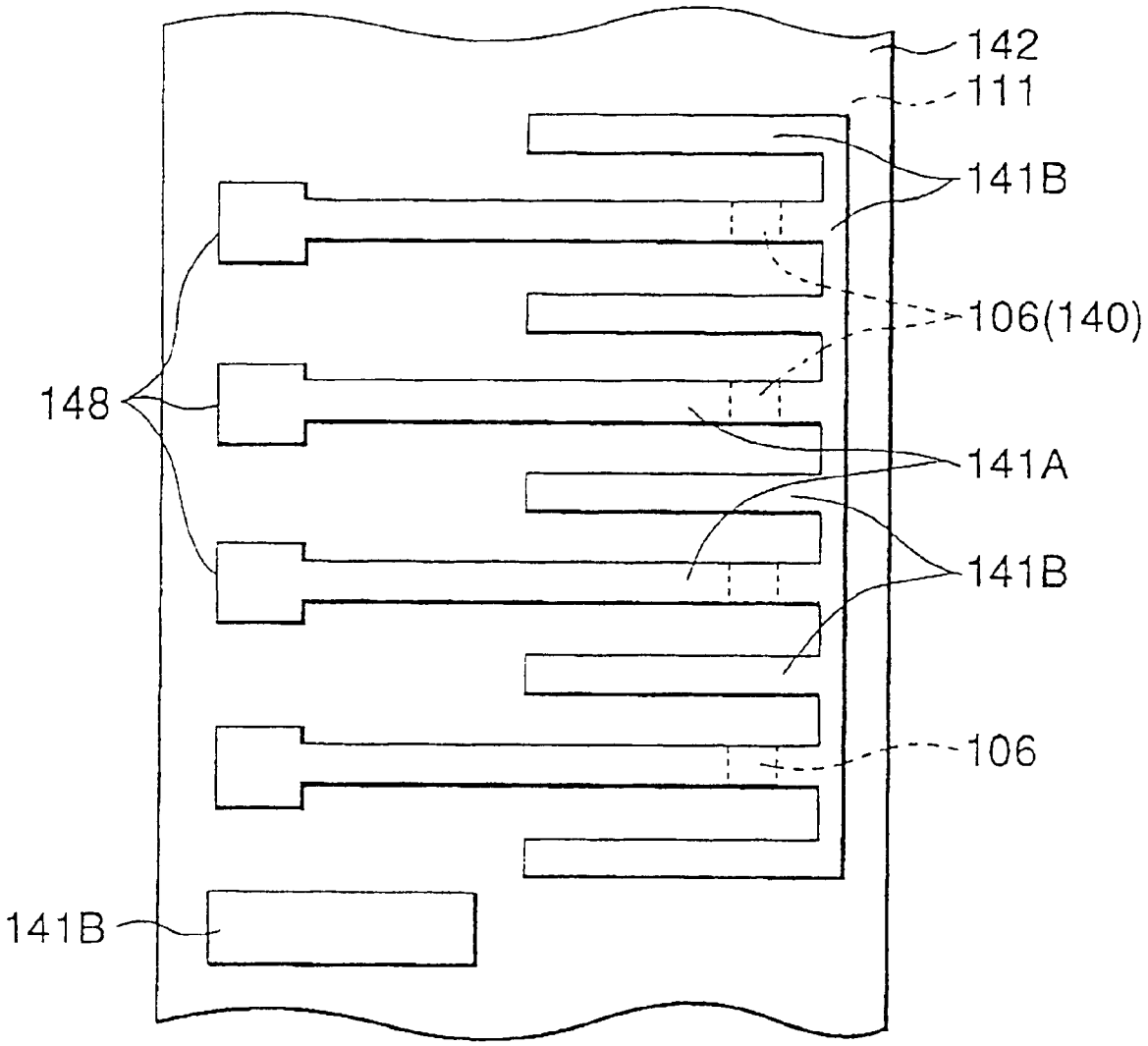
FIG. 81 is a plan view for schematically showing another manufacturing step of the heater chip according to this embodiment.

Subsequently, the polysilicon layer 140 which is not etched away by the above-described etching fluid, but therefore is left is etched away by using carbon fluoride gas ($CF_4$) by way of the RIE (reactive ion etching) method, while using the above-described photoresist as a mask in such a manner that this polysilicon layer 140 is formed as a pattern similar to an aluminium layer 141. A plan view of this condition is shown in FIG. 81.

At this time, since the photoresist is located on the polysilicon layer 140 of the heating element 106, the polysilicon layer 140 of this portion is not etched away. As a result, the polysilicon layer 140 is processed as the conductor pattern having the same shape as the aluminium layer 141 other than the heating elements which are exposed at the preceding step of FIG. 67. Aluminium is made in ohmic-contact with polysilicon by executing a heating process at the subsequent step, which may function as a conductor. Then, the portion 106 where polysilicon is exposed becomes a resistive member having a high resistance value, which may function as a resistive heating heater.

Figure 68:
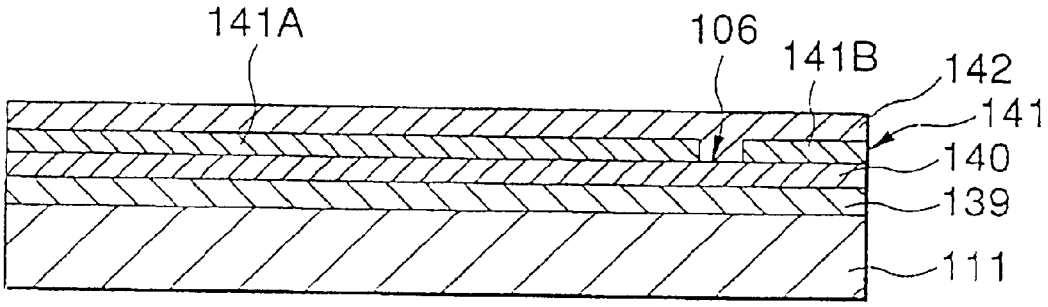
FIG. 68 is a sectional view for schematically indicating another manufacturing step of the heater chip according to this embodiment.

Next, as shown in FIG. 68, an $SiO_2$ layer 142 having a thickness of on the order of 0.5 μm is formed on the entire surfaces of the conductor patterns and the heater portion, which have been manufactured in the above-explained manner by way of the CVD method. This is an insulating film used to form two-layer wiring patterns of the common electrode 141B.

Figure 82:
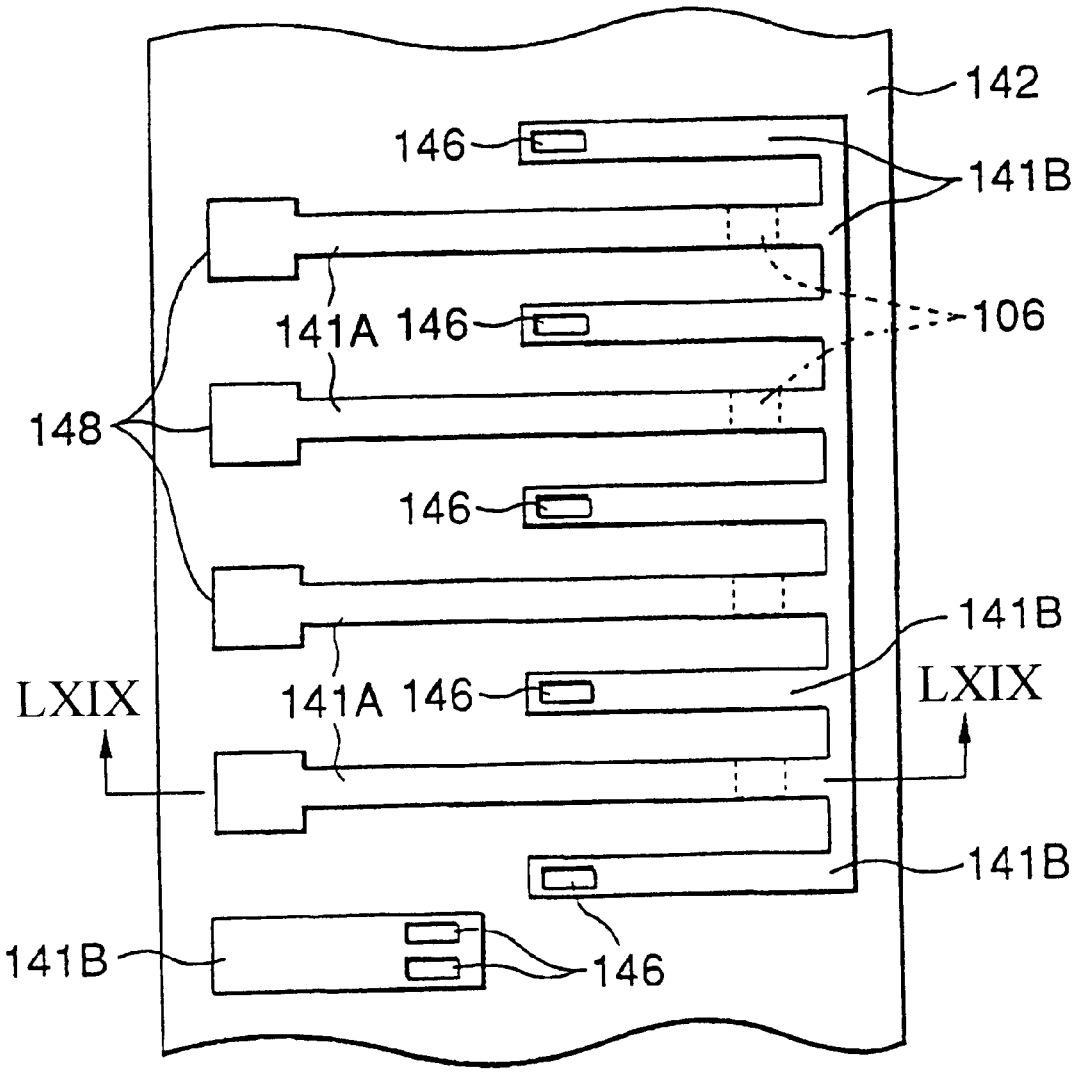
FIG. 82 is a plan view for schematically showing another manufacturing step of the heater chip according to this embodiment.

Next, as shown in FIG. 69, photoresist having a predetermined pattern is formed. While using this pattern as a mask, the $SiO_2$ layer 142 is etched away by way of the RIE method to thereby form a through hole 146 used to conduct a first layer of aluminium wiring line 141 to a second layer of aluminium wiring line which is formed at a subsequent step. A plan view of this condition is indicated in FIG. 82. FIG. 69 is a sectional view, taken along a line LXIX—LXIX of FIG. 82.

Figure 70:
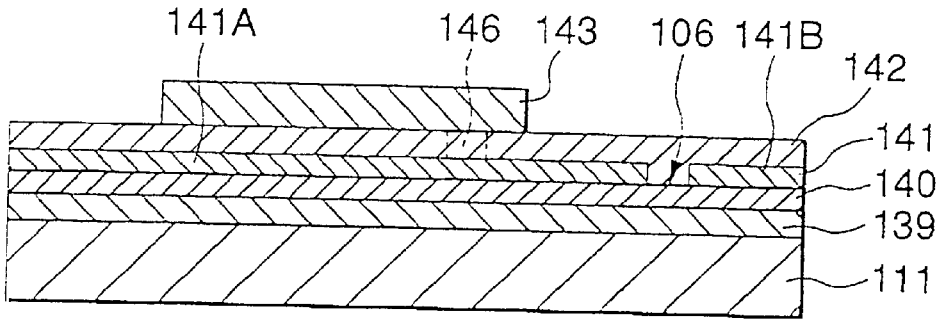
FIG. 70 is a sectional view for schematically indicating another manufacturing step of the heater chip according to this embodiment.
Figure 83:
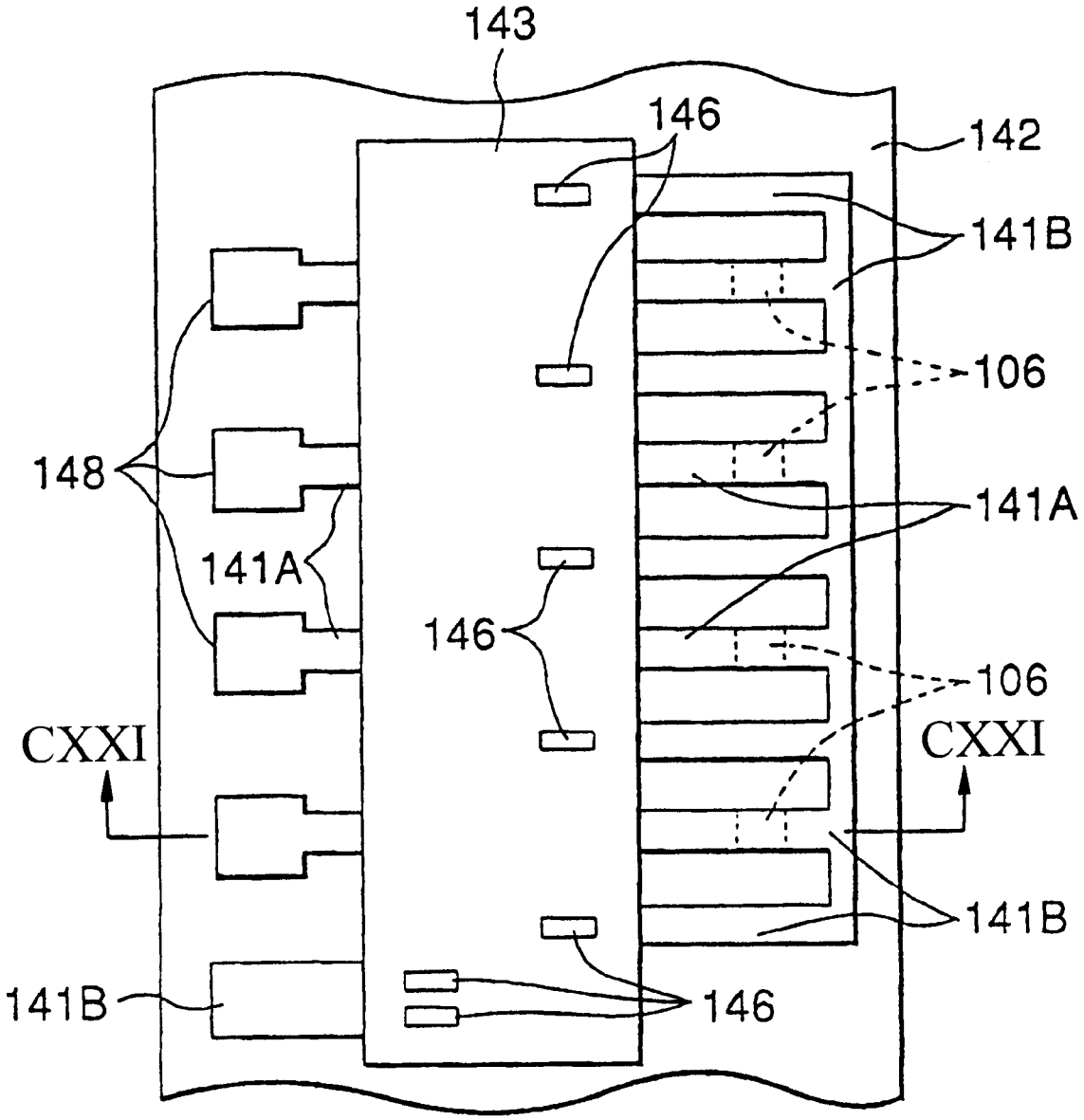
FIG. 83 is a plan view for schematically showing another manufacturing step of the heater chip according to this embodiment.
Figure 121:
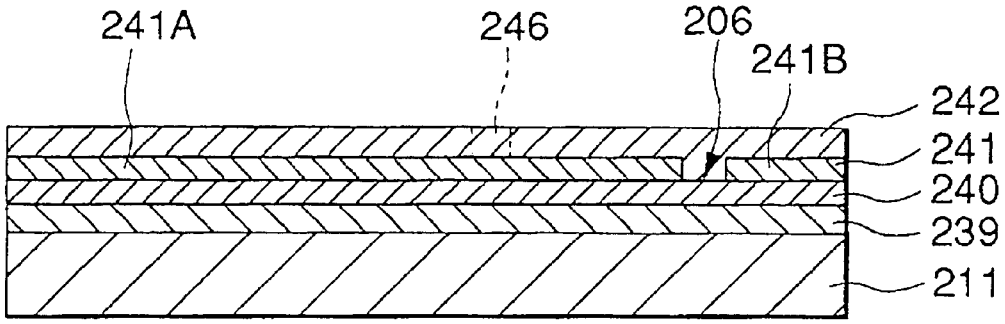

Subsequently, as indicated in FIG. 70, an aluminium film having a thickness of on the order of 1.0 μm is formed by way of the sputtering method under such a condition as shown in FIG. 69. Photoresist having a predetermined pattern is formed. Then, while using this photoresist as a mask, aluminium is etched away by using an etching fluid. The second layer of the aluminium wiring line 143 which has been formed in this manner is made as a pattern capable of covering a wide range except for the heater portion 106, and the electrode extracting portion 148, so that the resistance value of the common electrode 14141B can be made low as being permitted. A plan view of this condition is indicated in FIG. 83. FIG. 121 is a sectional view, taken along a line CXXI—CXXI of FIG. 83.

Figure 71:
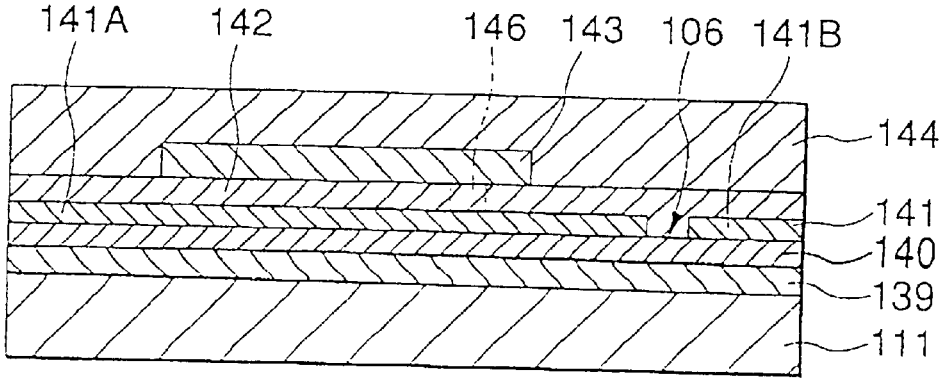
FIG. 71 is a sectional view for schematically indicating another manufacturing step of the heater chip according to this embodiment.

Next, after a film of an $SiO_2$ layer having a thickness of on the order of 0.5 μm and functioning as a protective film has been formed by way of the CVD method, this $SiO_2$ layer film is annealed for 30 minutes at a temperature of 450° C. within a nitrogen atmosphere. After a sintering process is carried out in order to make up an ohmic contact between polysilicon (reference numeral 140) and the aluminium electrode (reference numeral 141), as shown in FIG. 71, a film of an $SiO_2$ layer 144 having a thickness of on the order of 6 μm is formed by way of the CVD method.

Figure 72:
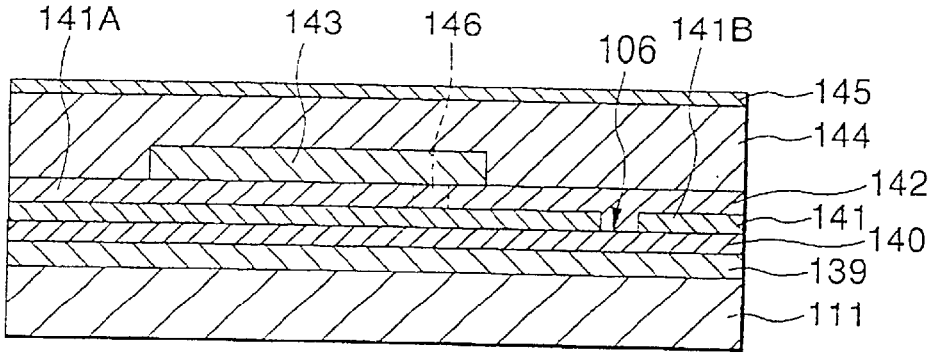
FIG. 72 is a sectional view for schematically indicating another manufacturing step of the heater chip according to this embodiment.

Next, as shown in FIG. 72, a film of a nickel film 145 (in actual, laminated film of Ti/Ni) having a thickness of on the order of 0.2 μm is formed by way of the vacuum vapor deposition method, and this nickel film 145 constitutes a metal mask when the small cylindrical member 104 and a dye storage portion 105*a*. In this case, in order to improve the close fitting characteristic between the $SiO_2$ film 144 and the nickel film 145, after titanium having a thickness of 0.02 μm has been vapor-deposited, a nickel film is continuously vapor-deposited.

Figure 73:
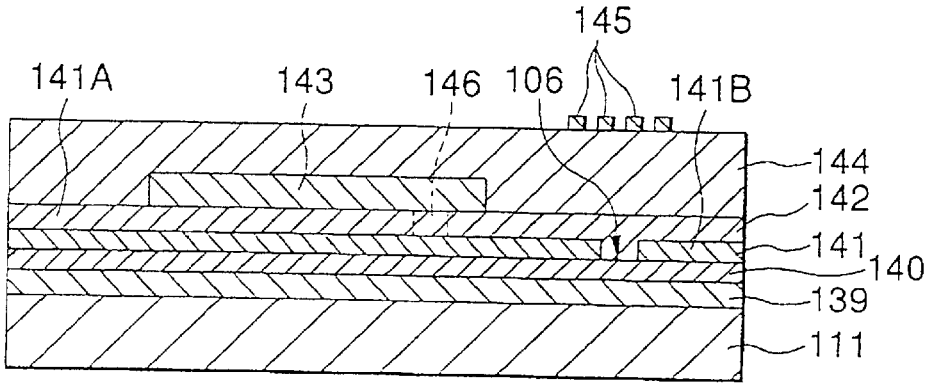
FIG. 73 is a sectional view for schematically indicating another manufacturing step of the heater chip according to this embodiment.
Figure 84:
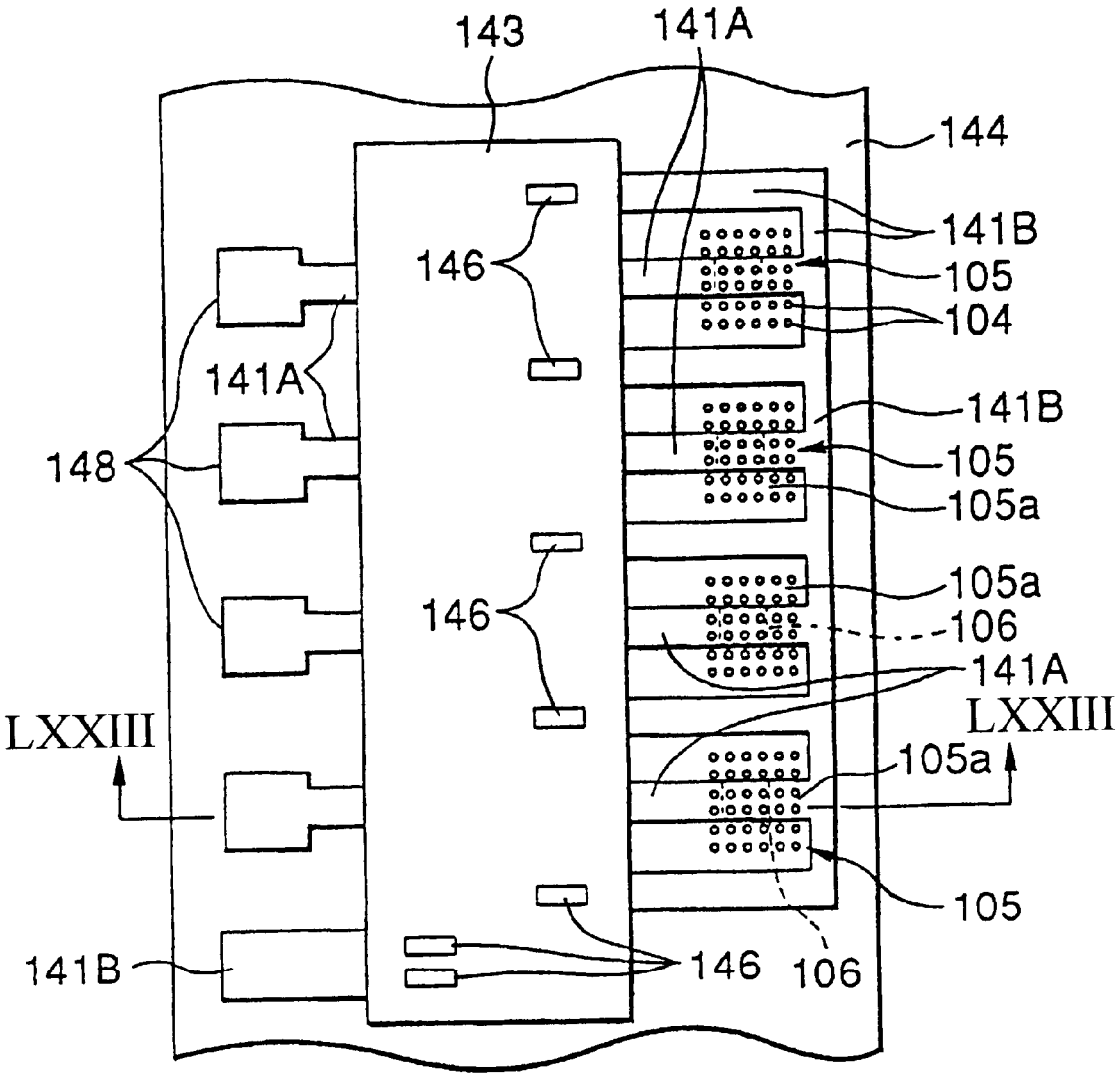
FIG. 84 is a plan view for schematically showing another manufacturing step of the heater chip according to this embodiment.

Next, as indicated in FIG. 73, in order to form the small cylindrical member 104 and the dye storage portion 105*a*, photoresist having a predetermined pattern is formed, and the unnecessary titanium/nickel film 145 is removed by the ion milling apparatus to thereby form a metal mask 145. A plan shape under this condition is FIG. 84, and FIG. 73 is a sectional view, taken along a line LXXIII—LXXIII of FIG. 84.

Figure 74:
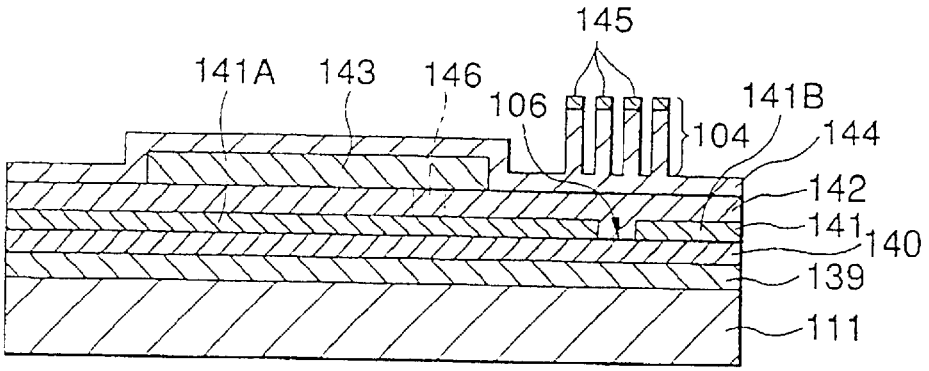
FIG. 74 is a sectional view for schematically indicating another manufacturing step of the heater chip according to this embodiment.

Thereafter, as shown in FIG. 74, while employing the titanium/nickel film 145 formed as a predetermined pattern as a mask, the $SiO_2$ film 144 is treated by way of the RIE (reactive ion etching) method so as to form the recording material storage portion 105*a* and the small cylindrical member (104) group in the $SiO_2$ layer 144, so that the dye jetting portion 105 is constituted. These members are formed on each of the heating elements.

Figure 75:
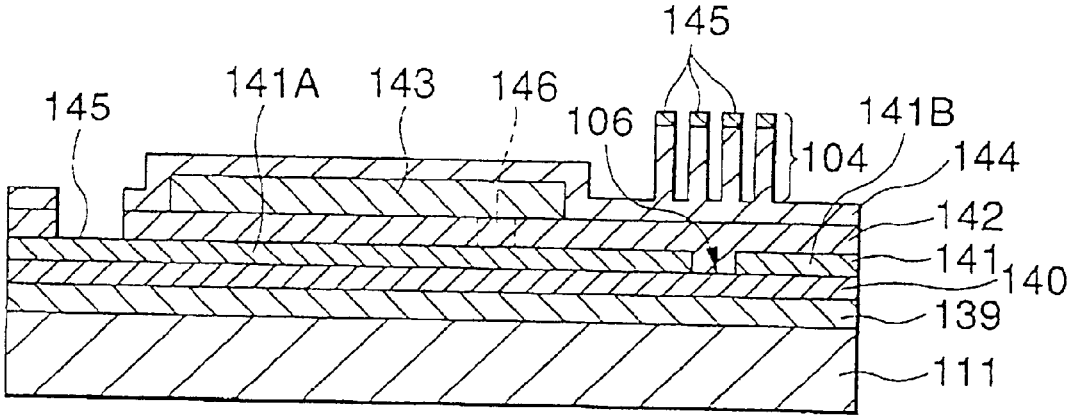
FIG. 75 is a sectional view for schematically indicating another manufacturing step of the heater chip according to this embodiment.
Figure 85:
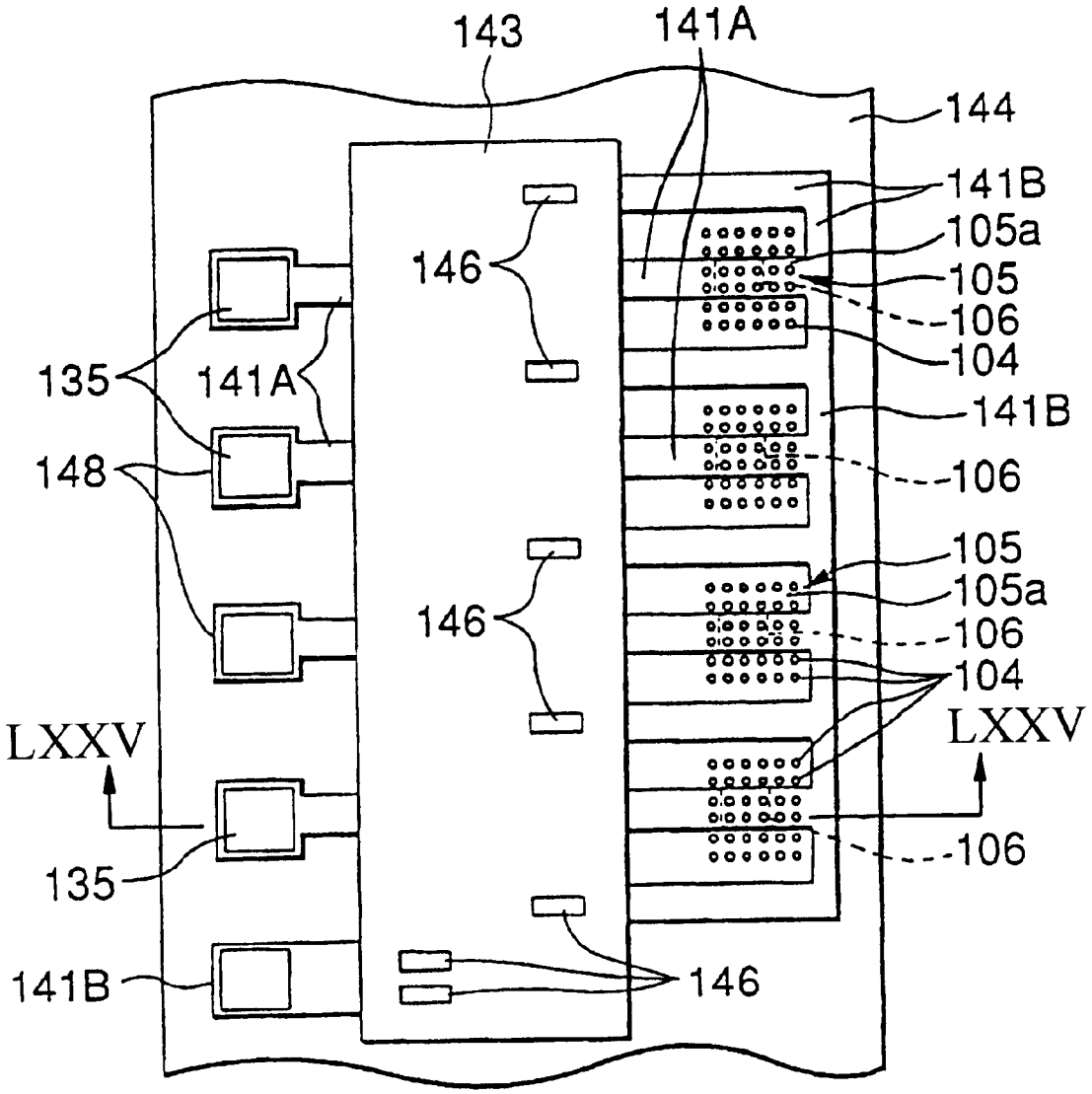
FIG. 85 is a plan view for schematically showing another manufacturing step of the heater chip according to this embodiment.

Next, as indicated in FIG. 75, photoresist having a predetermined pattern is formed in order to open the bonding pad 135A for the separate electrode and the bonding pad for the common electrode. Then, $SiO_2$ is etched away by way of the RIE method, so that aluminium 141A and 141B of electrodes are exposed as bonding pads. A plan view under this condition is shown in FIG. 85. FIG. 75 is a sectional view, taken along a line LXXV—LXXV of FIG. 85.

Figure 76:
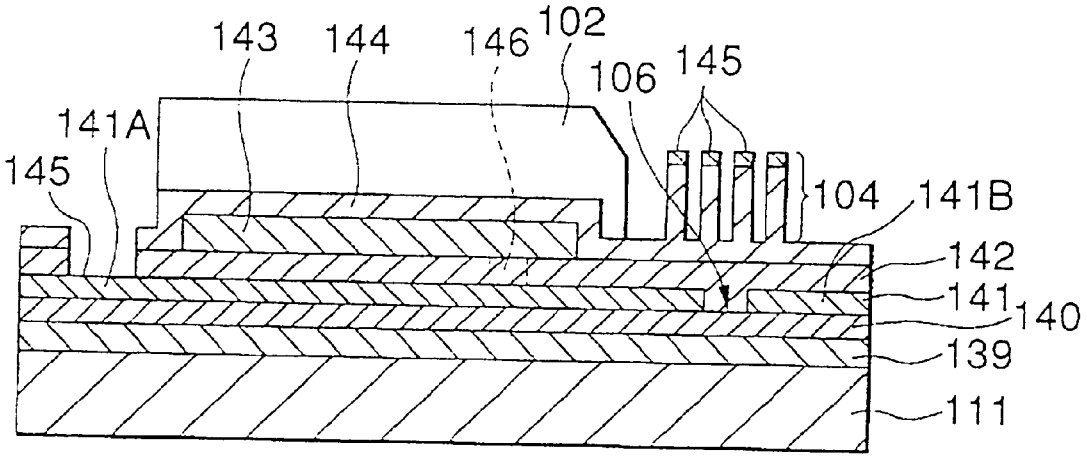
FIG. 76 is a sectional view for schematically indicating another manufacturing step of the heater chip according to this embodiment.
Figure 86:
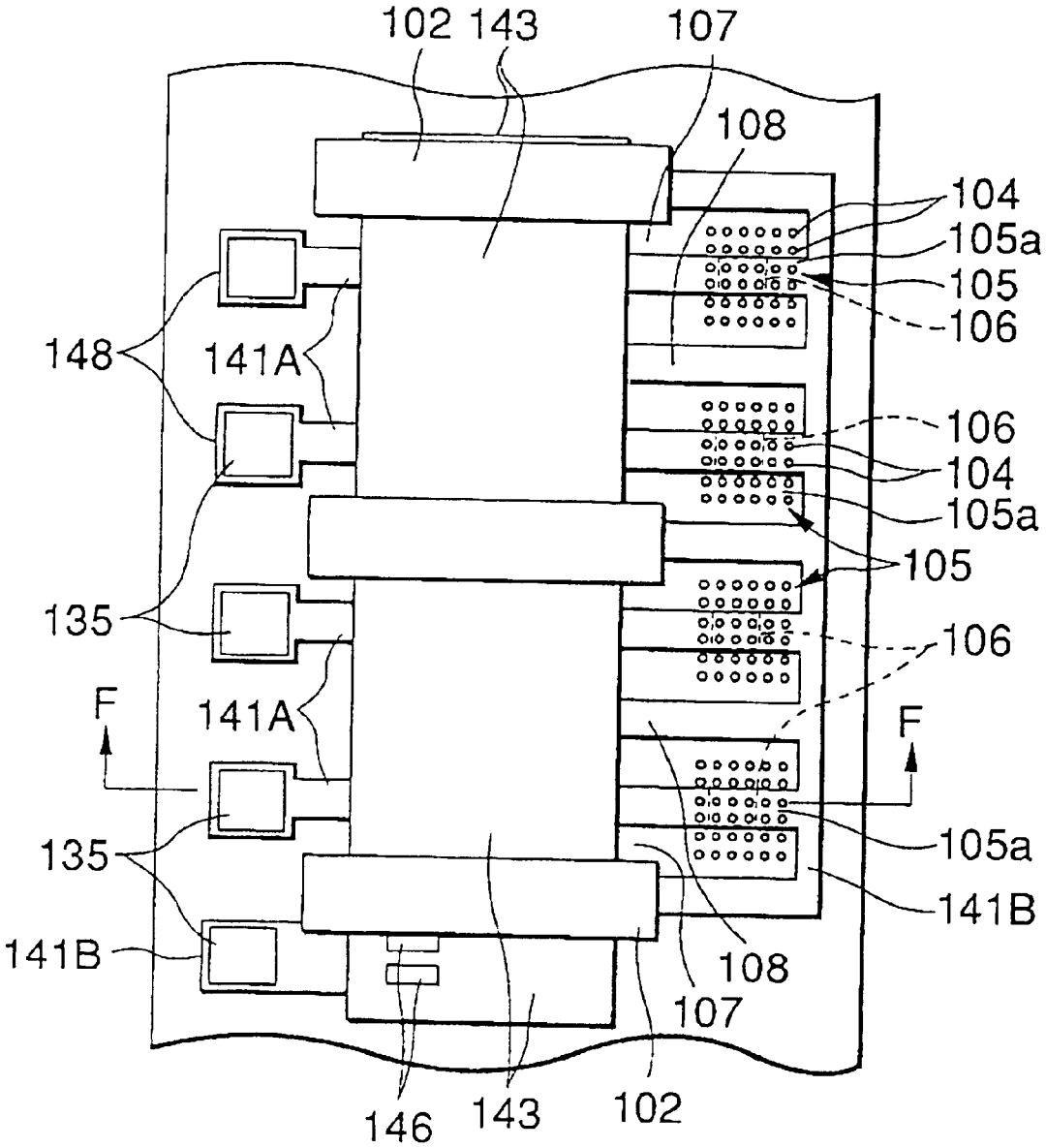
FIG. 86 is a plan view for schematically showing another manufacturing step of the heater chip according to this embodiment.

Subsequently, as shown in FIG. 76, a dry film (sheet resist) having a thickness of on the order of 25 μm is laminated as a branch path wall 102, and a patterning process is carried out with respect to a pattern of the dye supplying branch path. A plan view under this condition is shown in FIG. 86. FIG. 76 is a sectional view, taken along a line LXXVI—LXXVI of FIG. 86.

Figure 77:
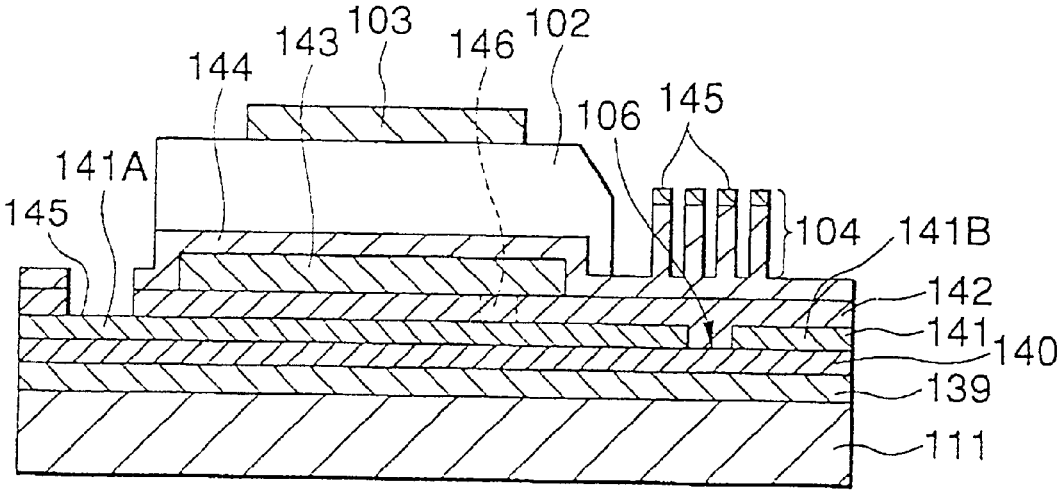
FIG. 77 is a sectional view for schematically indicating another manufacturing step of the heater chip according to this embodiment.
Figure 87:
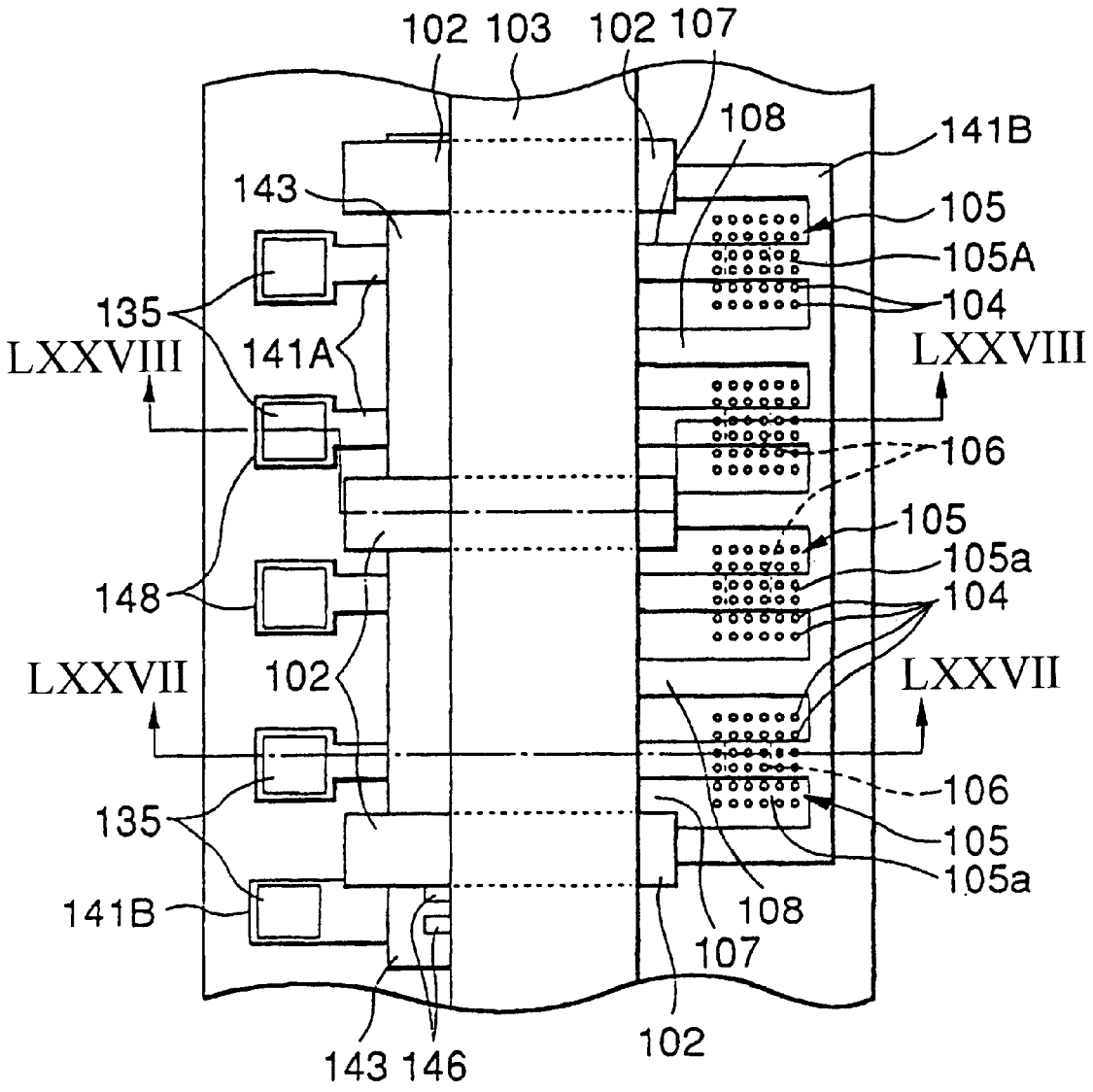
FIG. 87 is a plan view for schematically representing a further manufacturing step of the heater chip according to this embodiment.
Figure 88:
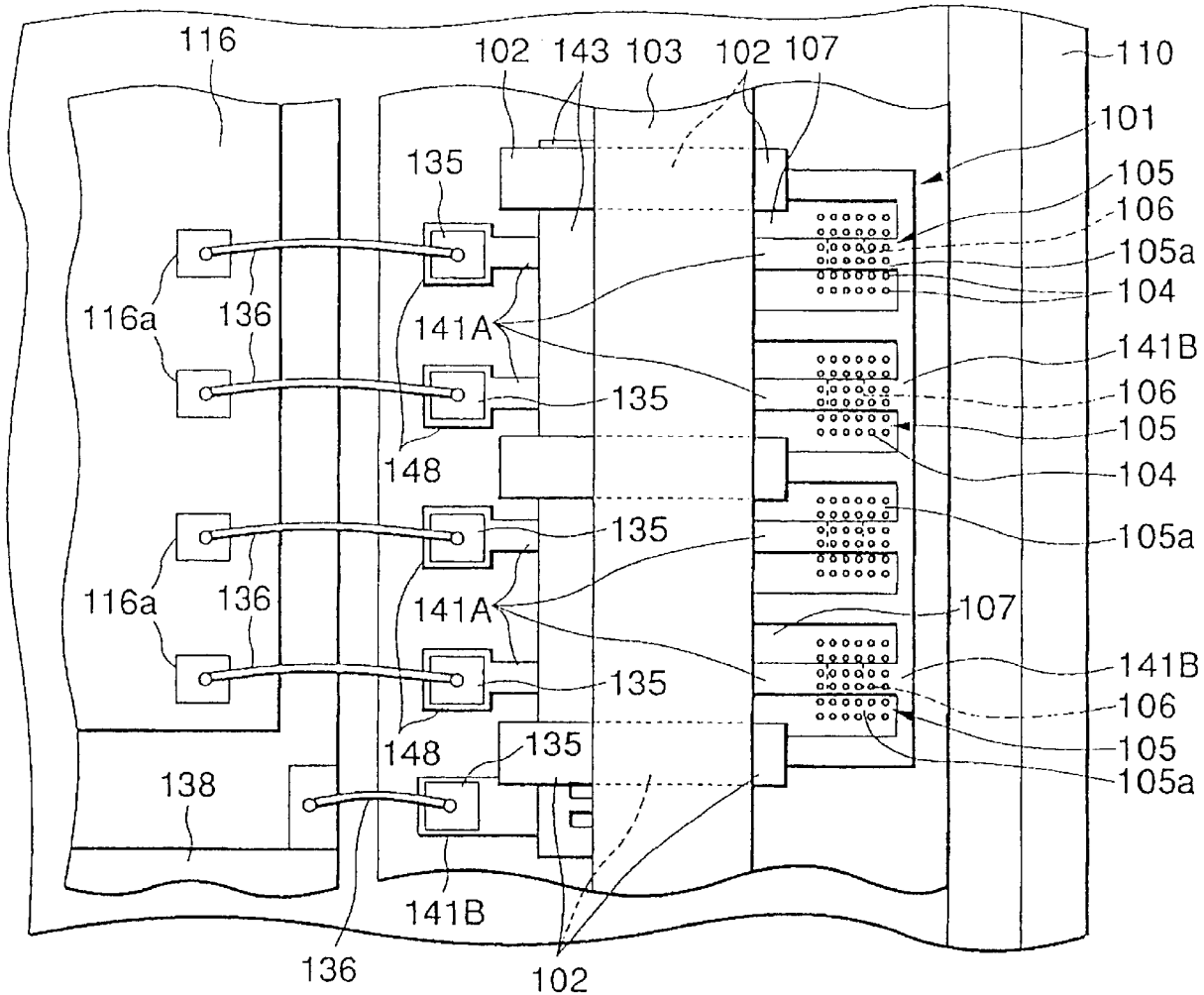
FIG. 88 is a plan view for schematically showing a major portion of a connection between the heater chip and an IC chip by using a bonding wire.

Next, as represented in FIG. 77, a nickel sheet having a thickness of on the order of 25 μm and having a lateral side longer than a longitudinal side is employed as a lid 103, and this lid 103 is positioned perpendicular to the above-explained branch wall 102. This lid 103 is depressed against the branch path wall 102 under pressure of 4 to 6 kg/cm$^2$ at a temperature of 150 to 180° C. for approximately 5 minutes so as to be thermally pressured with each other. A plan view under this condition is indicated in FIG. 87. FIG. 77 is a sectional view, taken along a line LXXVII—LXXVII of FIG. 87. As a result, a slit-shaped branch path 107 is formed as a dye path. This slit-shaped branch path owns a height of on the order of 25 $\mu$m, and the same width as the interval between both edge portions of the two heating elements 6—6.

Figure 78:
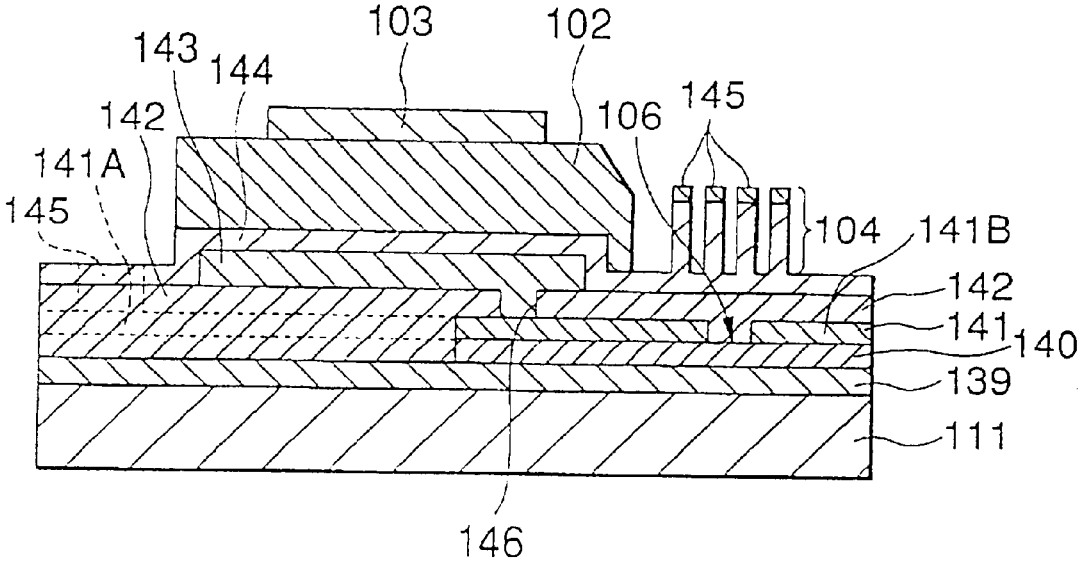
FIG. 78 is a sectional view for schematically showing a further manufacturing step of the heater chip according to this embodiment.

FIG. 78 is a sectional view for representing a positional relationship among the bonding pad 135 for extracting the separate electrode 141A, the through hole 146, and the heater 106, and also is a sectional view, taken along a line LXXVIII—LXXVIII of FIG. 87.

As described above, the heating elements (heater) 106 for heating the dye, the respective wiring conductors involving the electrodes 141A and 141B, the group of the small cylindrical members 104, and the dye supplying branch path 107 are formed on the substrate 111. The resulting members/substrate 111 are cut by a preselected size of the heater chip, so that the above-explained manufacturing steps are completed.

The heater chip 101 manufactured in accordance with the above-described manufacturing steps is adhered on the head base 110, the bonding pad 135A of each of the separate electrodes 141A is connected to the pad 116*a* of the IC chip 116 mounted on the printed circuit board 112, which corresponds to this bonding pad 135A, by way of the bonding wire 136, and further the bonding pad of the common electrode 141B of the heater chip 101 is connected to the pad of the printed circuit board by the bonding wire 136. Thereafter, JCR 17 shown in FIG. 8 is employed to coat the resulting heater chip 101 which will then be thermally hardened.

Figure 15:
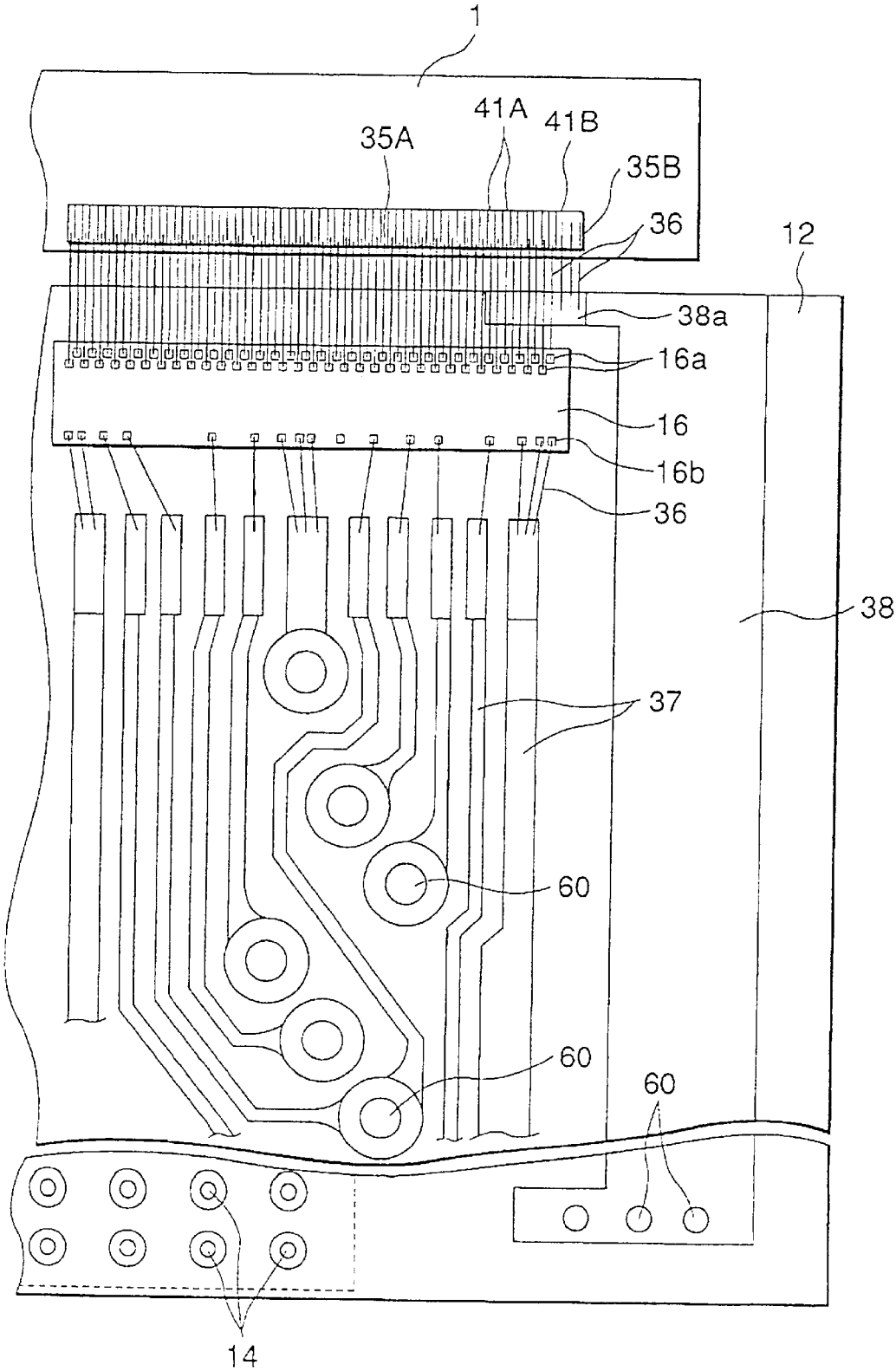
FIG. 15 is a plan view for partially indicating an electric connection made between the heater chip and a connector.
Figure 89:
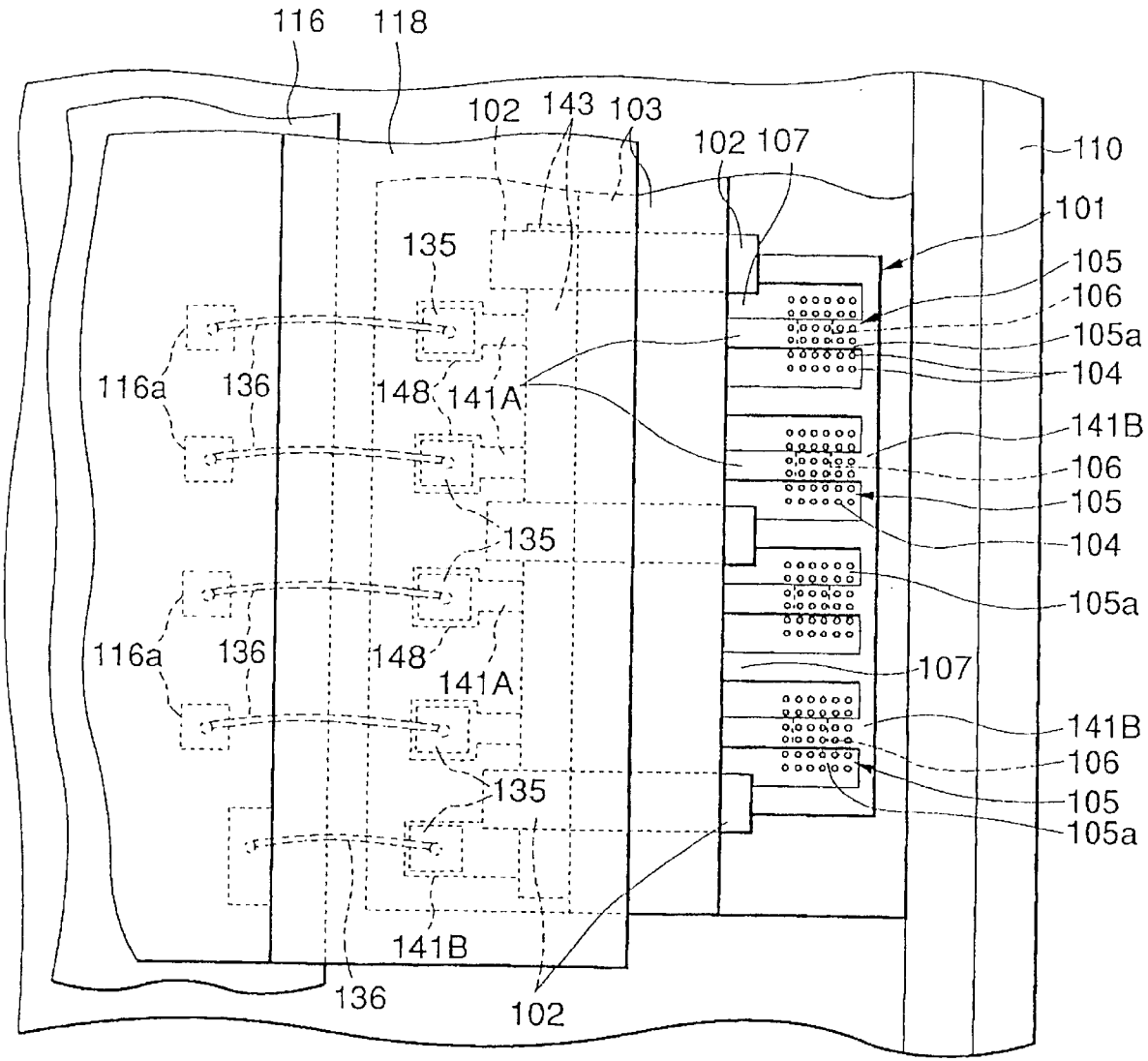
FIG. 89 is a plan view for schematically representing a major portion of such a condition that the printer heater chip and the IC chip are covered with a cover.

FIG. 89 is a plan view for indicating a major portion of the recording head under such a condition that a series of the above-explained manufacturing steps are completed, and the cover 118 is finally mounted on this recording head. In this manner, the recording head 125 shown in FIG. 7 is accomplished. For the sake of easy understandings, the above-described drawings except for FIG. 15 briefly represent the structures, the sizes, and the layouts of the respective members.

In accordance with this embodiment, as previously explained, since the dimension of the branch path 107 required to supply the dye is not restricted by the space between the dye jetting portions 105, a sufficient amount of dyes 147 can be supplied to the respective dye jetting portions 105, and also the manufacturing method does not require high precision and complex requirements.

Since such a structure is employed, a large number of dye jetting portions 105 per a unit area can be provided. Accordingly, the dot intervals are narrowed so as to increase the dot density, so that the high image resolution can be realized.

Figure 90:
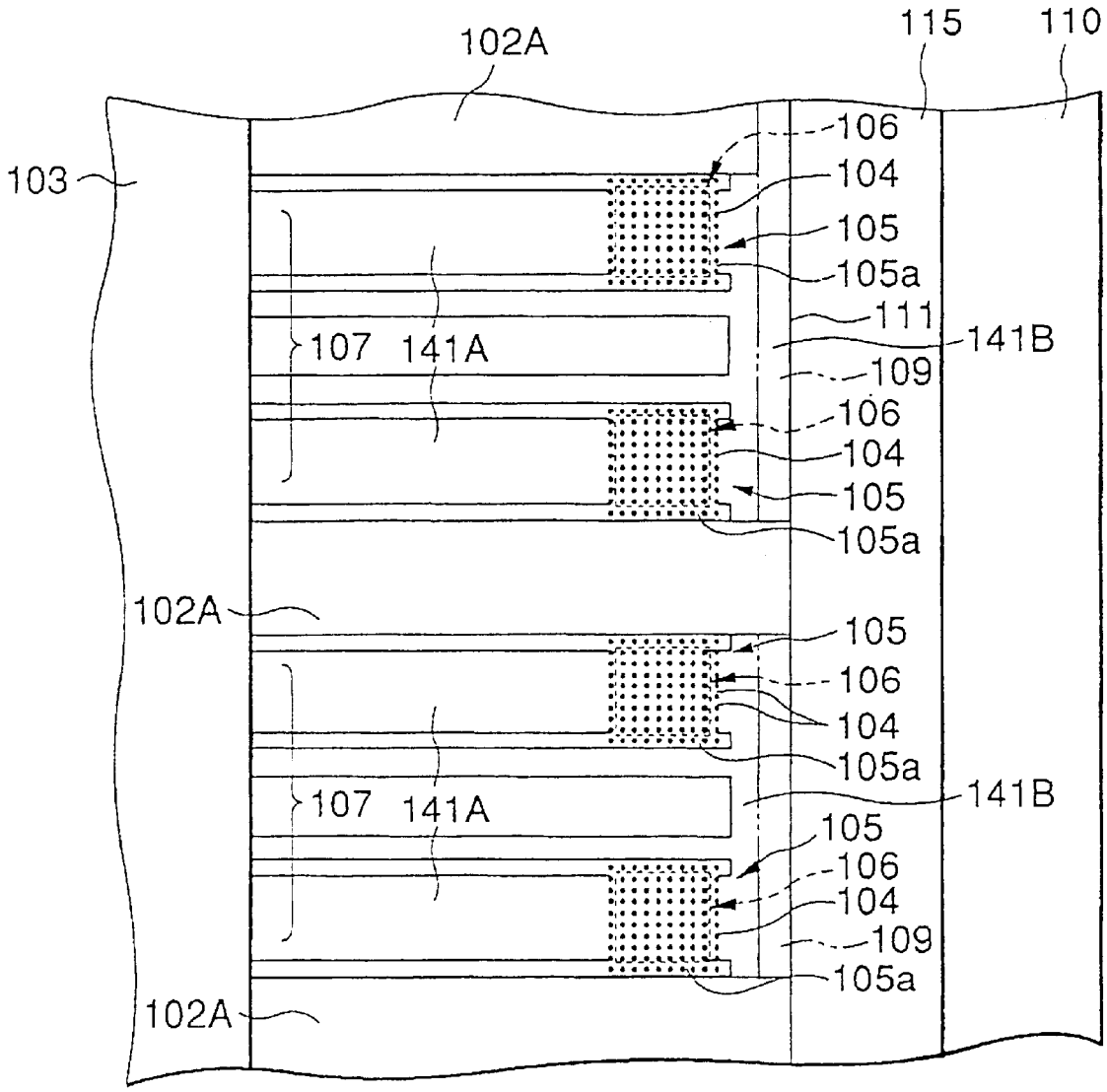
FIG. 90 is a plan view for schematically indicating a major portion of a printer head according to another embodiment of the present invention.

FIG. 90 is a plan view for showing a major portion of a modification with respect to the above-explained embodiment.

A difference of this modification from the above-explained embodiment is such that a branch path wall is extended as 102A up to a tip portion of the heater chip 101. Other portions of this modification are manufactured in a similar manner to that of the above-described embodiment.

As a consequence, in this modification, the supply regions of the dyes supplied from the respective branch paths are provided at the tip portions of the respective branch paths 107. However, the dye may be alternatively supplied from one branch path 107 to the right/left dye jetting portions 105. Even in such a case, since there is no problem to supply the necessary amount of dyes 147, this alternative structure may achieve a similar effect as that of the previous structure.

While the embodiments of the present invention have been described, the above-described embodiments may be modified based on the technical idea of the present invention.

For instance, the positional relationship between the above-explained head and the printing medium may be varied, and further the inclined angle between them may also be varied. The structures, shapes, and materials of the respective head portions may be made different from the above-described structures/shapes/materials thereof. During the printing operation, the head may be transported in conjunction with the printing medium 120. The above-explained one branch path simultaneously supplies the dyes to the two dye jetting portions (otherwise, three, or more dye jetting portions). This idea is preferably introduced to all of the branch paths. Alternatively, instead of this featured structure, the known structure may be partially employed.

The porous structure to be formed in the vaporizing portion is not limited to the above-described porous structure, but may be changed. For instance, in the case of a pillar member, a height thereof, a plan/sectional shape thereof, and density thereof may be changed. Alternatively, this porous structure may be formed at any places in which a very fine pattern is required, a porous structure is required, or an enlargement of a surface area is required. As the porous structure, not only the pillar-shaped member, but also a wall-shaped member, a beads assembling member, and a fiber member may be manufactured.

Also, not only the dye vaporizing type thermoelectric system, but also the previously explained thermoelectric system by ablation may be utilized. In any of these systems, either the dyes or the recording materials are jetted to be transferred.

Also, a total number of recording material storage units for storing the recording materials (dyes), the dot number, and a total numbers of heating members and also of vaporizing portions may be varied. Alternatively, the arrangement shape and the size are not limited to those of the above-described embodiments.

As to the recording dye, the three colors, i.e., magenta, yellow, cyan (additionally, black) are used to carry out the full color recording operation. Alternatively, a two-color printing operation, a monochromatic printing operation, or a black/white printing operation may be performed.

Also, the heating element may be made of a metal, or a metallic material. Alternatively, a head base material may be formed by a high heat conductivity material such as aluminium, and ceramics, whereas the thermal characteristic of the recording head may be controlled by the heating element, the heat insulating material, and the head base material.

Furthermore, the present invention may also be applied to such an ink jet type recording system. That is, a recording fluid containing a recording solution and a substance (namely, carrier), the volume of which is expanded by melting, or dispensing and heating this recording material is supplied. The condition of this recording fluid is changed by being heated to produce fluid droplets, and then the fluid droplets are transported to a printing medium located opposite to the recording head.

In accordance with this embodiment, the recording head located opposite to the printing medium owns the recording material jetting unit for jetting the recording material to the printing medium, the recording material supply path for supplying the recording material, and the branch paths for branching the recording materials from this supply path to supply the branched recording materials to the dye jetting portion. The respective branch paths supply the recording materials to a plurality of recording material jetting portions at the same time. As a consequence, the recording materials can be simultaneously supplied from one branch path to a plurality of jetting portions, although the dye supply path and the dye jetting portion are not provided in one-to-one correspondence. As a result, a sufficiently large amount of recording materials can be supplied without reducing the sectional areas of the branch paths.

Accordingly, to satisfy the high resolution requirement of the printed image, the intervals of the recording material jetting portions are made narrow to increase the dot density. Thus, the image quality of the printed image and also the reliability thereof can be increased. Moreover, the manufacturing yield of the recording apparatus can be made higher than that of the conventional recording apparatus, since the complex manufacturing method of the recording apparatus is no longer required, but also the high precision is not required in forming the recording material supply path. As a consequence, the manufacturing cost can be suppressed.

Figure 91:
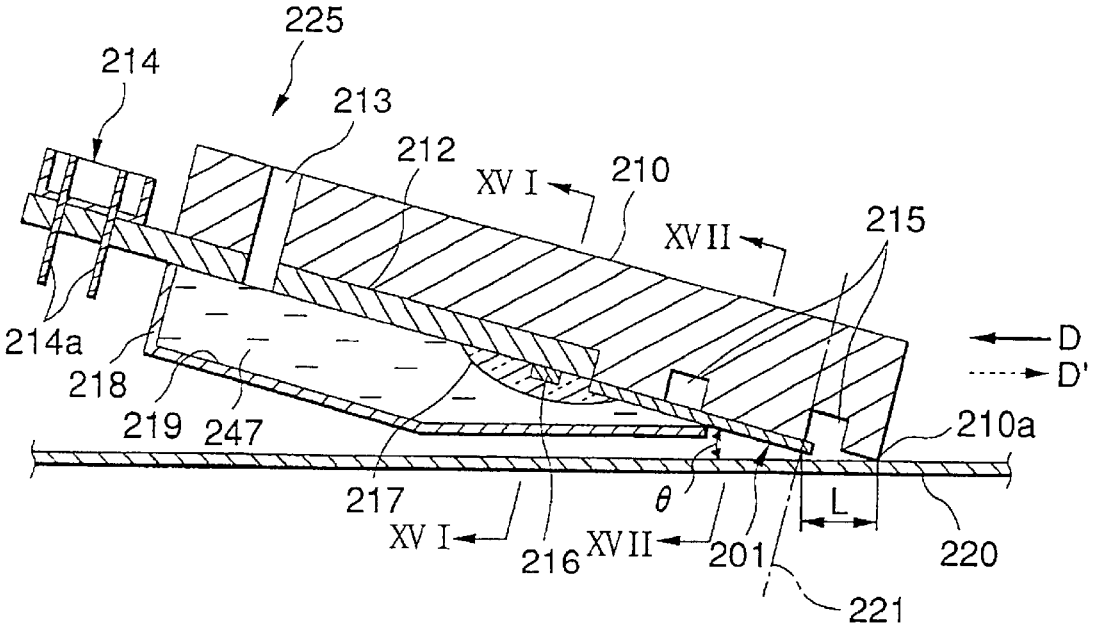
FIG. 91 is a sectional view (i.e., sectional view, taken along a line I—I of FIG. 108) for indicating a printer head according to another embodiment of the present invention.

FIG. 91 is a sectional view for showing a non-contact type dye jetting mode printer head according to a further embodiment of the present invention.

Figure 93:
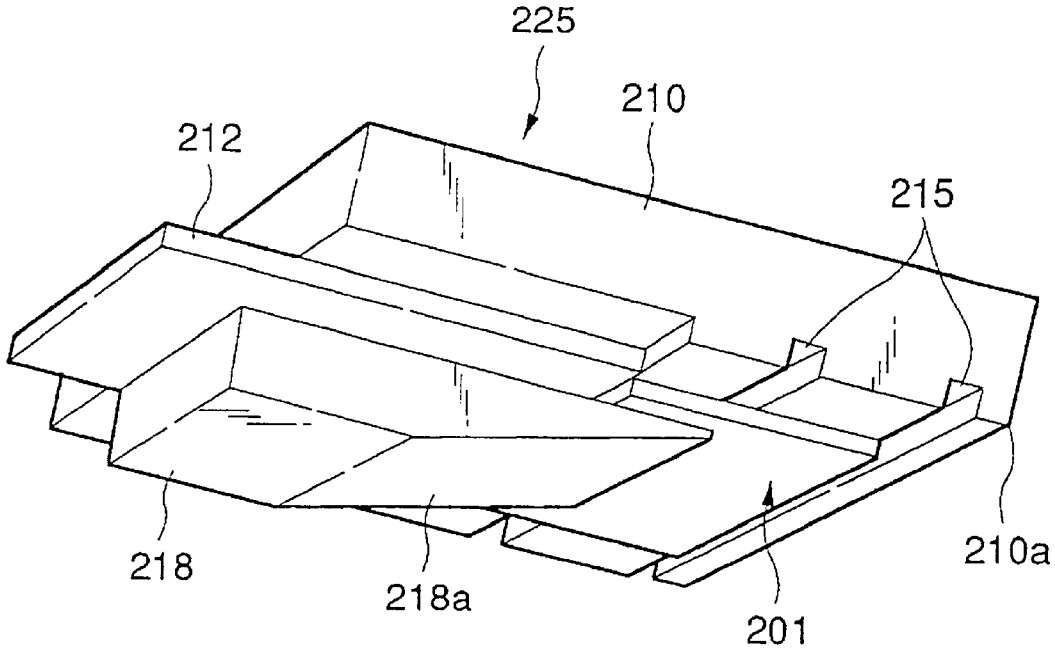
FIG. 93 is a perspective view for representing the printer head, as viewed from the downward direction.

In a printer head 225 according to this embodiment, a printed circuit board 212 and a heater chip 201 are adhered onto a base 210 in a parallel manner, on which a cover 210 is provided (see perspective view of FIG. 93). As indicated in this drawing, the recording head 225 is arranged downwardly, and one edge portion 210*a* of the base 210 is made in contact with a printing medium 220 in such a manner that this recording head 225 is inclined with respect to the printing medium 220 at a predetermined inclined angle "θ" (in this case, specifically, θ=14 degrees).

Then, a mounting portion of the base 210 for the printed circuit board 212 is made thin, which is defined by the thickness of the printed circuit board 212. A height of the base on which the printed circuit board 212 is being mounted, and which involves an IC chip 216 for driving a heating element mounted on this printed circuit board 212, is substantially equal to a height of an upper surface of the heater chip 201 mounted in parallel to this printed circuit board 212.

Figure 92A:
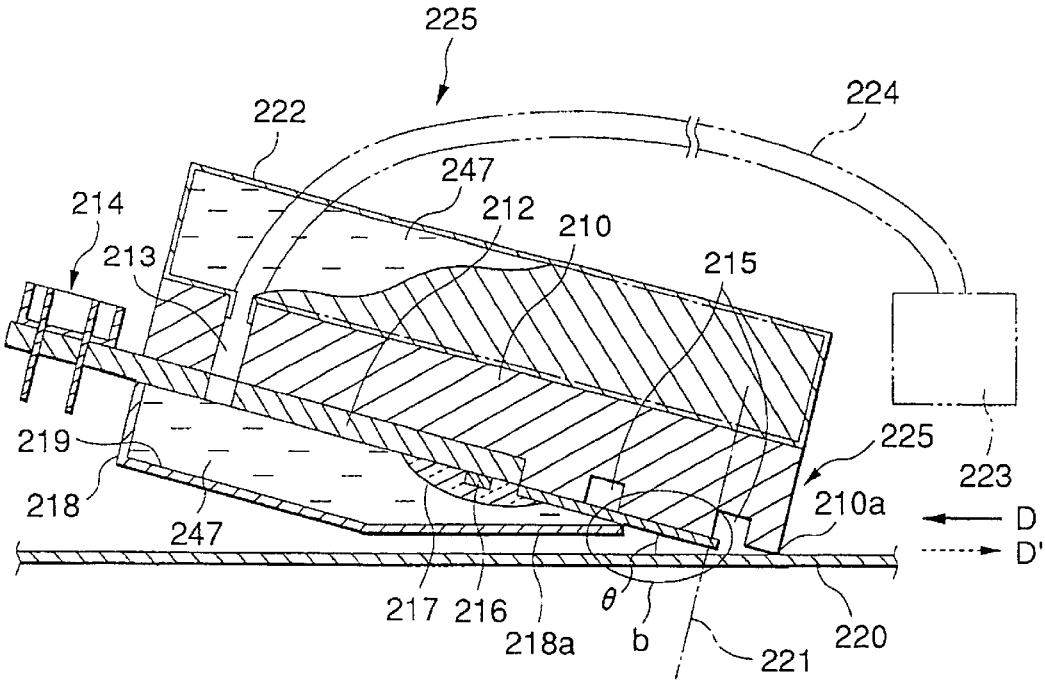
FIG. 92A is a sectional view for indicating such a condition that a dye reservoir tub is mounted on the printer head according to this embodiment.

As indicated in FIG. 91 and FIG. 92A, a dye conducting hole 213 penetrated through the base 210 is provided on the printed circuit board 212, and then a dye 247 is conducted from the base 210 to the space between the cover 218 and this base 210. Then, the cover 218 is adhered/sealed in order to cover a portion of the printed circuit board 212 and a portion of the heater chip 201. An inner surface of this cover 218 accepts the dye 247 conducted from the dye conducting hole 213, and constitutes a commonly used dye supply path 219 for supplying the dye 247 to the below-mentioned branch paths 207.

Then, as shown in FIG. 91 and 93, this cover 218 is shaped as a box as an entire shape in such a way that an inclined surface 218*a* is formed on a surface located opposite to the printing medium 220, and a side surface thereof constitutes a wall surface. Then, a tip portion of this cover 218 is closely made in contact with the heater chip 201, both the printed circuit board 212 and an adhesive surface of the cover 218 to the heater chip 201 are sealed by an adhesive agent in order that the dye 247 is not leaked.

In FIG. 91, an arrow "D" of a solid line shows a head scanning direction during the printing operation, and another arrow "D'" of a broken line shows a head travel direction during the head returning operation.

As the method for conducting the dye 247 from the base side to the dye conducting hole 213, as shown in FIG. 92A, a detachable type dye reservoir tub 222 is mounted on a rear portion of the base 210, and the dye 247 is automatically injected via the dye conducting hole 213 to the commonly used dye supply path 219 by receiving gravity.

It should also be noted that as indicated by a virtual line, the bottom wall of the dye reservoir tub 222 is made in a thin-plate shape and is inclined so as to have a rectangular-shaped inside sectional plane. Then, since the recording head 225 is inclined in a reverse direction during the non-operation condition, the dye left inside this dye reservoir tub 222 may be supplied from the dye conducting hole 213 onto the cover 218 so as to be recorded on the printing medium.

Also, as indicated by a virtual line in this drawing, the dye reservoir tub 223 may be provided at a place apart from the recording head 225, and thus the dye 247 may be alternatively supplied via a flexible conducting tube 224 which connects the reservoir tub 223 to the dye conducting hole 213.

Figure 92B:
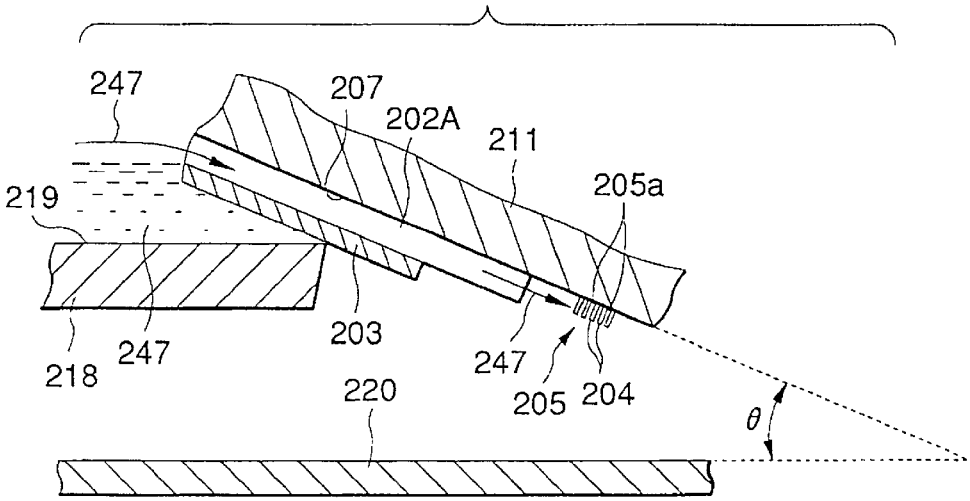
FIG. 92B is an enlarged sectional view for showing a portion "b" of the printer head of FIG. 92A.

FIG. 92B is an enlarged sectional view for showing a portion "b" in FIG. 92A. As indicated in FIG. 92B, the dye 247 supplied from the commonly used dye supply path 219 is distributed into a slit-shaped fine space branch path 207 which is constituted by a lid 203 and a first partition wall 202A as a branch path wall on the substrate 211 of the heater chip 201. Then, this dye 247 is conducted as indicated by an arrow, and is absorbed into a dye storage portion 205*a* constituted by a small cylindrical member (204) group as denoted by an arrow of FIG. 92B by way of the capillary phenomenon. This absorbed dye 247 is stored and held in this dye storage portion 205*a*. Then, a tip portion of this small cylindrical member (204) group constitutes a dye jetting portion 205.

In the dye jetting unit 205, a porous structure is formed by, for example, $SiO_2$, and this porous structure is constituted by a group of vary fine small cylindrical members 204, the width and the diameter of which are smaller than, or equal to 10 μm (for example, 1 to 4 μm), the interval of which is smaller than, or equal to 10 μm (for instance, 1 to 4 μm), and the height of which is smaller than, or equal to 20 μm (for instance, 1 to 10 μm). This small cylindrical member (204) group constitutes the dye storage portion 205*a* for holding/storing the dye 247 based on the capillary phenomenon. Then, the dye 247 stored in this storage portion 5*a* is heated by a heater (will be explained later) to be jetted.

The dye 247 is supplied from the commonly used dye supply path 219 via a plurality of branched branch paths 207. Then, this branch path 207 is formed by a first partition wall 202A made of a dry film (for example, sheet resist) having a thickness smaller than, or equal to 50 μm (for example, 10 to 30 μm), a lid 203 made of a nickel sheet having a thickness smaller than, or equal to 100 μm (for instance, 20 to 30 μm), and a substrate 211 made of silicon having a thickness smaller than, or equal to 5 mm (for example, 0.2 to 1 mm). As indicated in FIG. 92B, this branch path 207 is constituted as a slit-shaped space.

Figure 94:
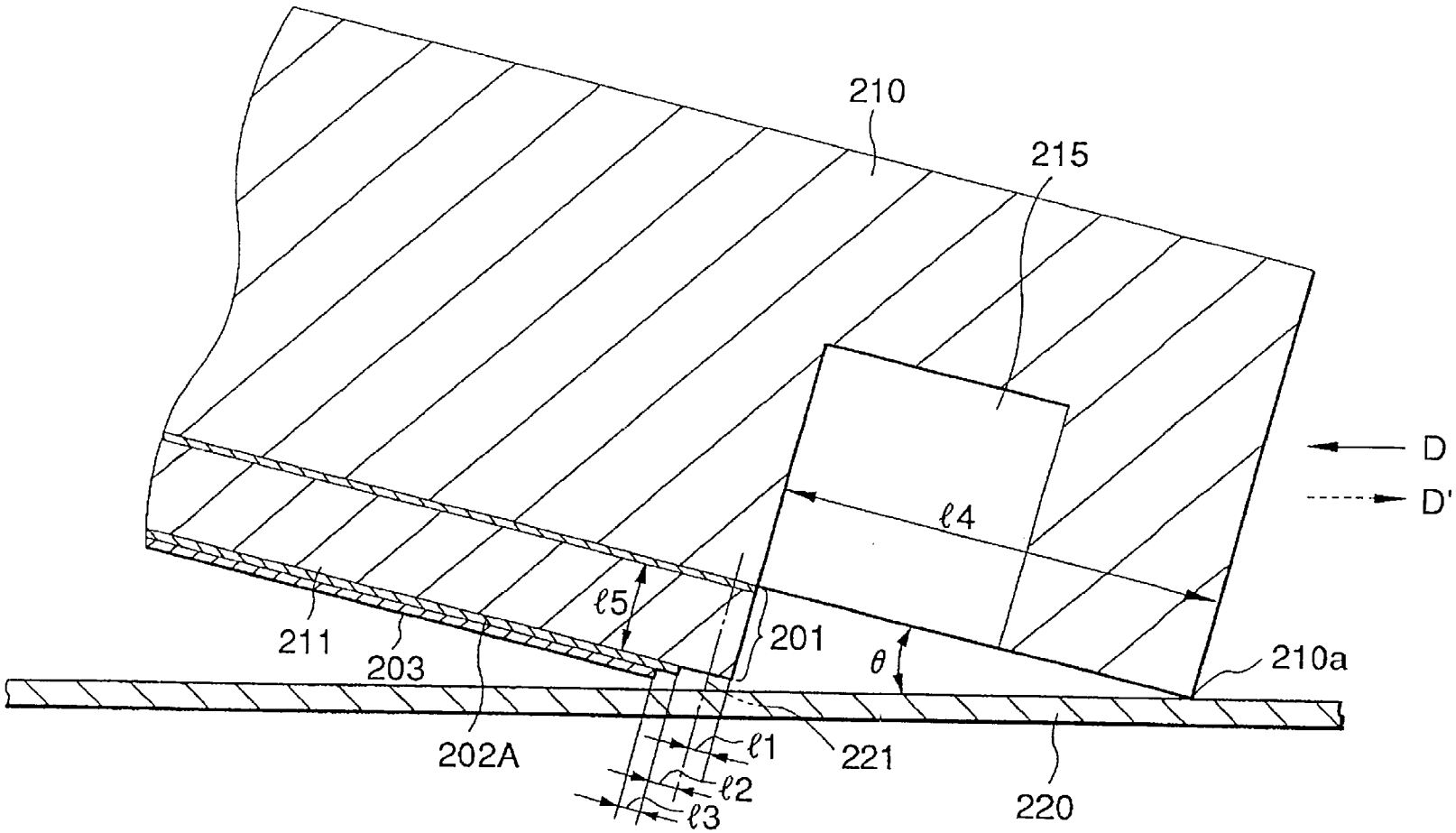
FIG. 94 is an enlarged diagram for showing a contact portion where the printer head is made in contact with the printing medium.

FIG. 94 is an enlarged view for showing an extraction of a contact portion 210*a* and a peripheral portion thereof, in which the base 210 is made in contact with the printing medium 220. As seen from this drawing, a portion of the base 210 is made in contact with the printing medium 220 with keeping a preselected angle of "θ", so that the dye jetting portion 205 can continuously maintain a constant interval between a center position 221 of this dye jetting portion 205 and the printing medium 220.

Then, in order to form the above-described inclination and interval, both the first partition wall 202A and the lid 203 laminated on the substrate 211 of the heater chip 201 are formed in such a manner that when these partition wall 202A and lid 203 are located at higher positions (as seen from substrate 211), the edges of the end portions are separated from the dye jetting portion 205. That is to say, a distance $l_1$=100 μm between the center 221 of the dye jetting portion and the end portion of the substrate 211 of the heater chip 201, whereas the end portion of the first partition wall 202A is located at the respective backward positions, namely another distance $l_2$=100 μm from the center 221 of the dye jetting portion, and another distance $l_3$=100 μm from the end portion of the first partition wall 202A.

As described above, since the dye storage portion 205*a* is made of the open end, the fluid surface of the dye stored in the dye storage portion 205*a* is controlled. Therefore, it is avoidable that the dye is excessively supplied. When the dye is excessively supplied to this dye storage portion 205*a*, energy supplied to a heater (will be explained later) required to vaporize the dye would be increased, resulting in lowering of the transfer efficiency. Also, since the higher edge positions of the first partition wall 202A selected from all edge portions and also the lid 203, measured from the reference planes, are positioned apart from the vaporizing portion (namely, the above-described center 221), it is possible to prevent the establishment of the contact established between the recording head and the printing medium 220 when this recording head is positioned opposite to the printing medium 220.

As represented in FIG. 94, since such a measure is introduced, even when the recording head 225 of this embodiment is inclined at a preselected angle of "θ"=14 degrees with respect to the printing medium 220, there is no risk that the heater chip 201 is made in contact with the printing medium 220.

Figure 95:
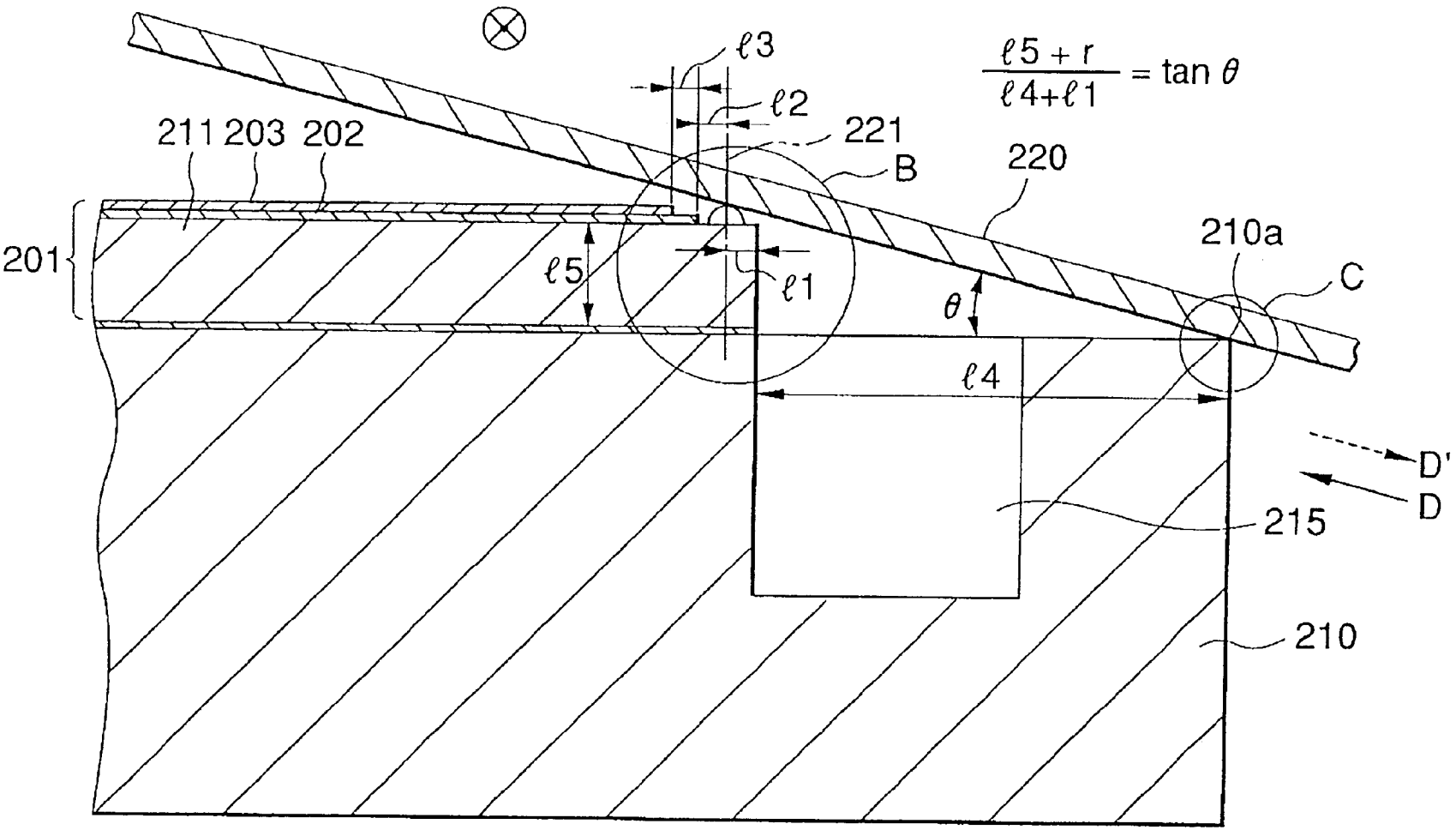
FIG. 95 is a diagram for showing the contact portion in an inverted manner along the upper/lower direction.

In FIG. 94, a distance "$l_4$" defined from the end of the base 210 to the end of the heater chip 201 is equal to 1750 μm, and a thickness "$l_5$" of the substrate 211 of the heater chip 201 is equal to 410 μm (involving an adhesive agent layer having a thickness of 10 μm used to adhere substrate 211 and base 210). Furthermore, the angle "θ" between the base 210 and the printing medium 220 is kept at 14 degrees in order that a distance "r" (see FIG. 96) between the dye jetting portion 205 and the printing medium 220 becomes 50 μm, and this dye jetting portion 205 is located above the heater fabricated on a silicon substrate (will be described later). It should be understood that for the sake of easy explanations, FIG. 95 shows the same printer head as in FIG. 94 in the reverse direction along the vertical direction.

As a consequence, as previously explained, since the distance "$l_1$" between the center 221 of the dye jetting portion and the substrate 211 is equal to 100 μm, the angle "θ"=14 degrees may be determined based upon such a relationship:

$$(l_5+r)/(l_4+l_1)=\tan\theta.$$

In other words, if this angle "θ" is determined, then the interval between the dye jetting portion 205 and the printing medium 220 can be continuously set to a desirable distance (in this case, 50 μm) based on the value of tan θ. It should also be noted that an arrow "D" of a solid line indicates the travel direction of the recording head, and an arrow "D'" of a broken line shows the return direction of this recording head. Then, after the printing operation is carried out for 1 line, the recording head 225 is moved along the X direction in FIG. 110, and then the printing operation is performed for the next line.

Figure 96:
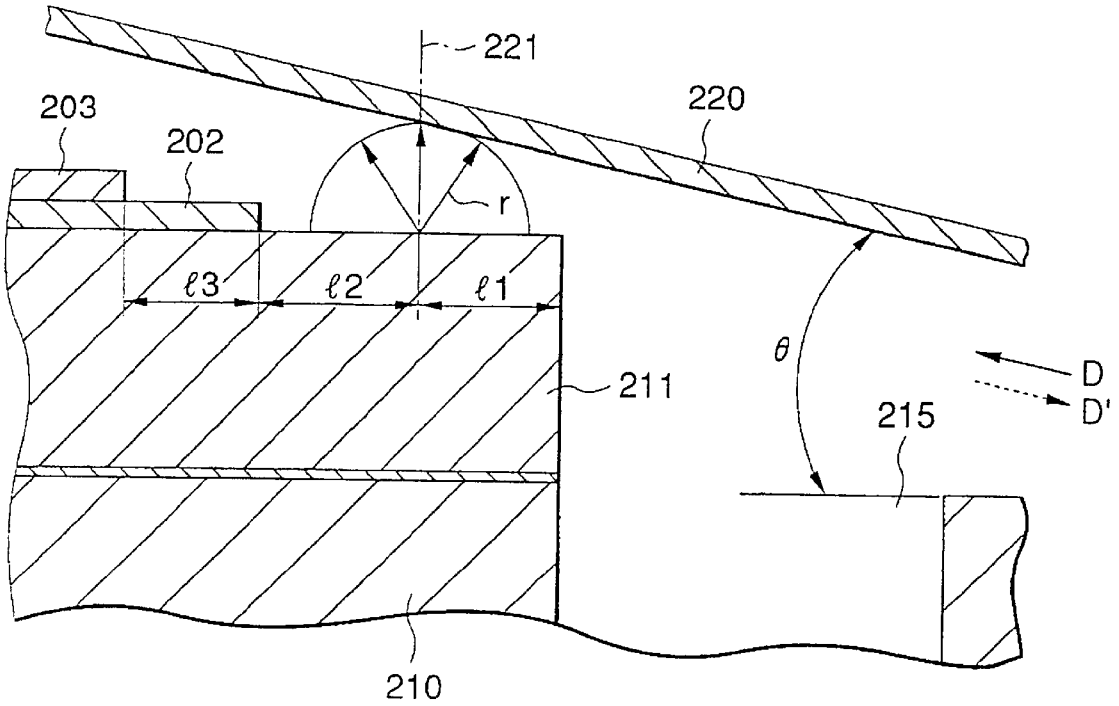
FIG. 96 is an enlarged diagram for indicating a portion "B" of FIG. 94.

FIG. 96 is an enlarged sectional view of a portion "B" shown in FIG. 95. As previously explained, the interval between the dye jetting portion 205 and the printing medium 220 may be arbitrarily set. When the jetting radius "r" of the dye is especially set to 50 μm, all of the resolution, the optical density, and the gradation with respect to the recorded image could be set to better conditions. In the case that this interval (radius "r") exceeds 50 μm, since the dye particles which are vaporized and jetted are very small, i.e., on the order of sub-microns, these dye particles may be readily dispersed. As a result, there is such a trend that the optical density of the printed image is low, and also both the gradation and the resolution thereof are deteriorated. Conversely, when the interval (radius "r") is shorter than 50 μm, since the diameter of the formed dot becomes small, the dot diameter suitable to the resolution cannot be produced, and the undesirable interval is made, resulting in lowering of the optical density.

In accordance with this embodiment, since the above-described interval (r) is especially set to 50 μm, as will be discussed later, the dot interval (namely, pitch between adjoining heating elements) of 84.7 μm can be realized. The stable dot density of 300 DPI can be achieved in conjunction with the above-described dot interval of 84.7 μm. As a result, the superior gradation, optical density, and resolution of the printed image can be obtained.

Generally speaking, in the case that this sort of recording head is assembled into a printer, the interval between the dye jetting portion 205 and the printing medium 220 is adjusted, or controlled. However, as previously explained, in accordance with this embodiment, since one end of the base 210 is made in contact with the printing medium 220 at a preselected incline angle "θ", if the dimensions ($l_1$, $l_4$, $l_5$) of the above-described respective portions are preset, then the above-explained interval can be precisely determined. As a consequence, the interval adjustment executed when the recording head is assembled to the printer is no longer required. It should be understood that a fine adjustment may be carried out after the recording head has been assembled into the printer.

Figure 97:
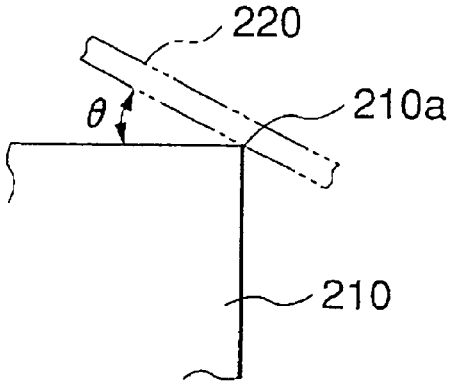
FIG. 97 is an enlarged diagram for indicating a portion "C" of FIG. 94.
Figure 98A:
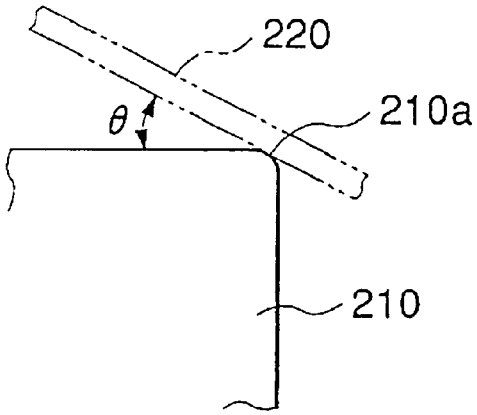
FIG. 98 is a diagram for showing a modification example of the portion "C"
Figure 98B:
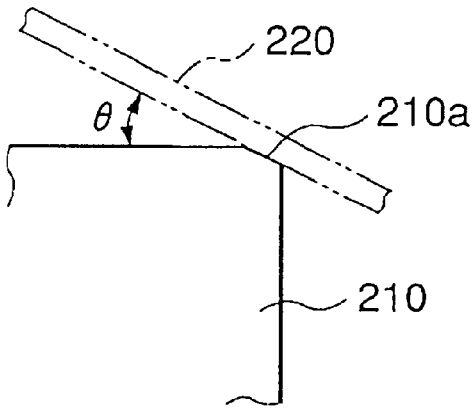

FIG. 97 is an enlarged diagram for showing a portion "C" of FIG. 95. FIG. 97 indicates a contact portion 210*a* between the heater base 210 and the printing medium 220. As indicated in this drawing, an edge of the base 210 is made in contact with the printing medium 220, and while this edge is smoothly moved on the surface of the recorded member 220, the printing operation is carried out. Also, this edge may have an effect to flatten the surface of the printing medium 210. However, to achieve more smooth movement of this edge, for instance, as indicated in FIG. 98A, this edge may be rounded. Otherwise, as shown in FIG. 98B, this edge may be cut away so as to furthermore achieve better smoothing operation. Alternatively, when an anodic oxide coating process is performed on the surface of the base 210 including the edge, the anti-wearing characteristic thereof may be improved.

The printing operation by this recording head 225 is carried out by scanning the recording head 225 along a direction indicated by an arrow "D" of a solid line, as shown in FIG. 95 and FIG. 96, as previously explained. In this embodiment, as previously described, although the contact portion 210*a* of the base 210 is made in contact with the transferred dye surface on the printing medium 220 immediately after the dye has been transferred, there is no problem. In other words, since the scanning speed of the recording head 225 is selected to be, for instance, 84.7 μm/10 msec, as represented in FIG. 95, a time duration becomes 0.2 to 0.3 seconds, during which the contact portion 210*a* is moved over a distance $(l_4+l_1)/\cos\theta$ between the center 221 of the dye transfer position and the base 210, and then is reached to the dye transfer position 221. As a result, the transferred dye may be sufficiently absorbed and fixed on the printing medium 220 during this time period.

As a consequence, there is no risk that the printing surface is not dirtied, or scratched by the contact between the contact portion 210*a* and the surface of the printing medium 220. Also, in such a case that, for instance, weaving is produced on the surface of the printing medium 220 by this contact, since such an effect to extend this weaving to be flattened is applied, the print image with the better condition can be produced. It should be noted that the recording head 225 can be very smoothly moved along the direction "D", depending upon the above-explained angle "θ". Also, there is no problem that the recording head 225 is returned along the direction "D'".

It should be understood that when the recording head 225 is inclined at the angle of "θ" with respect to the printing medium 220, a phenomenon as indicated in FIG. 99 will occur.

Figure 99A:
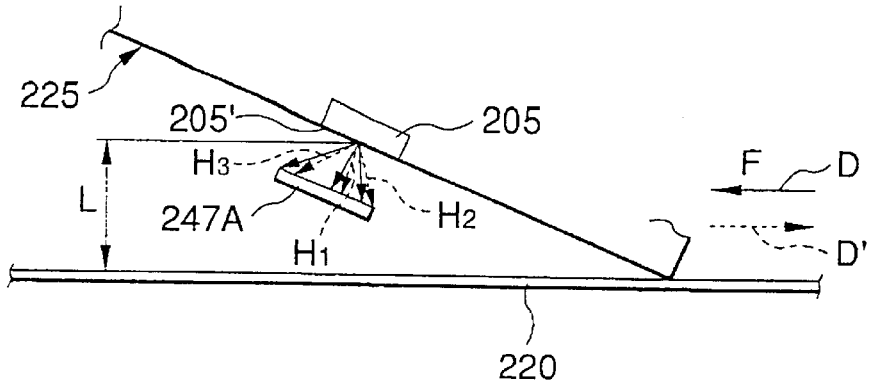
FIG. 99 is a schematic diagram for explaining printing operation by dye vaporization by the printer head according to this embodiment.
Figure 99B:
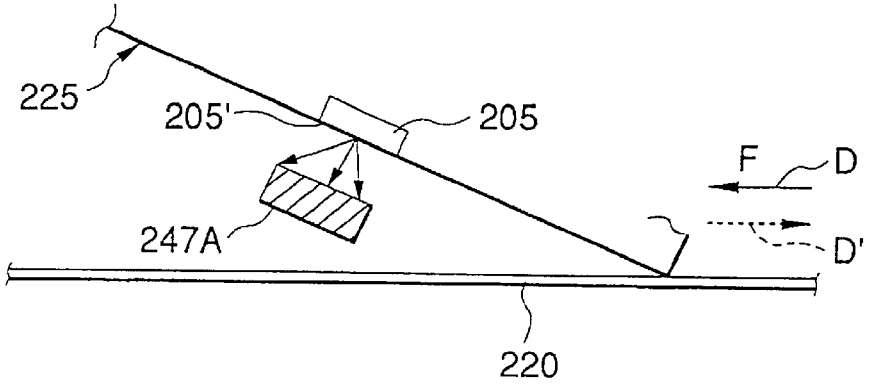
Figure 99C:
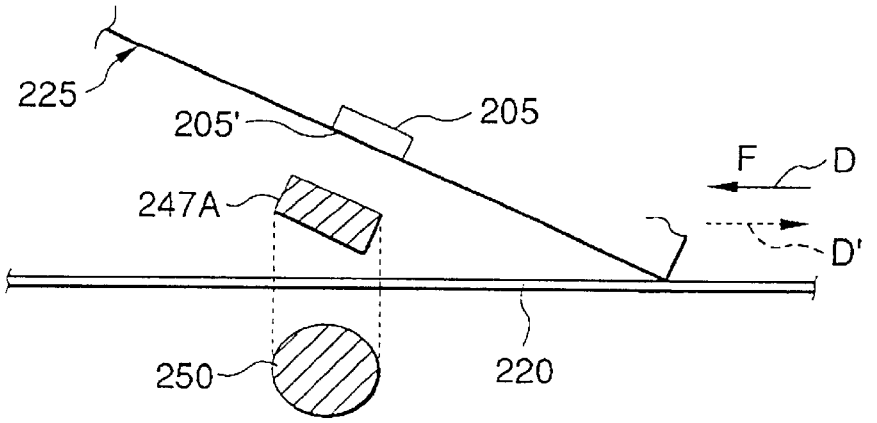

That is to say, even when a distance "L" between the dye jetting portion 205 and the printing medium 220 is equal to 50 μm, a mechanical vector "F" is exerted along the scanning direction "D" of the recording head 225 on a dye 247A which is vaporized and jetted from a jetting surface 205' of the dye jetting portion 205 of the recording head 225. As a result, as shown in FIG. 99A, with respect to a central component "H1" of this jetted dye 247A, a diffusion component "H2" thereof along the backward direction, and a diffusion component "H3" thereof along the forward direction when the recording head 225 is not moved, which are indicated by broken lines, respectively, the diffusion component H3 along the forward direction receives force of a component corresponding to cos θ of the vector F along the direction D, whereas the diffusion component H2 along the backward direction is conversely attracted along the forward direction, as indicated by solid lines, since the recording head 225 is moved along the direction "D". As a result, the surface area of the vaporized dye 247A becomes small. Then, as shown in FIG. 99B, the thickness of the vaporized dye 247A is increased while time has passed. As indicated in FIG. 99C, when this vaporized dye 247A is adhered onto the surface of the printing medium 220 to form a pixel 250, a size of the pixel 250 obtained as a projection image of the vaporized dye 247A is comparably reduced.

Figure 100:
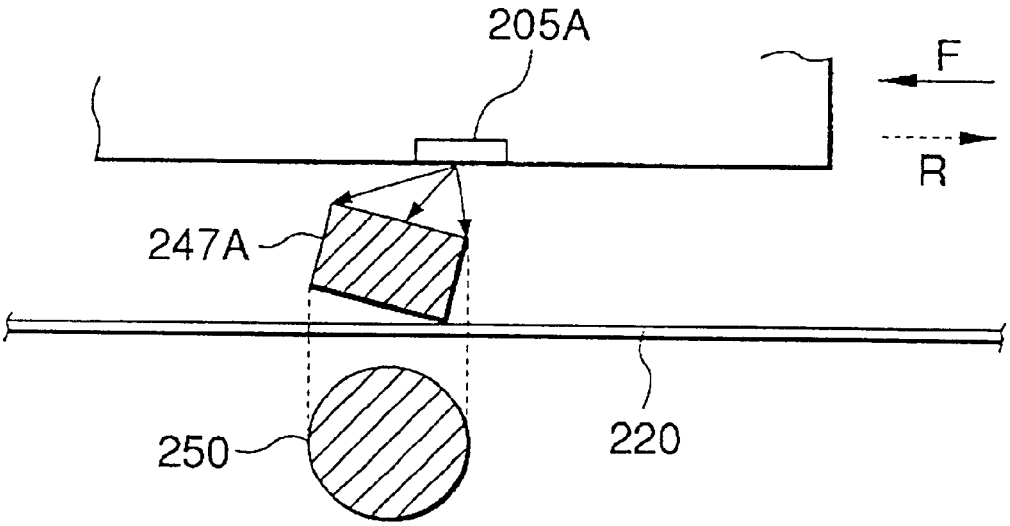
FIG. 100 is a schematic diagram for explaining printing operation by dye vaporization by the printer head according to another embodiment.
Figure 101:
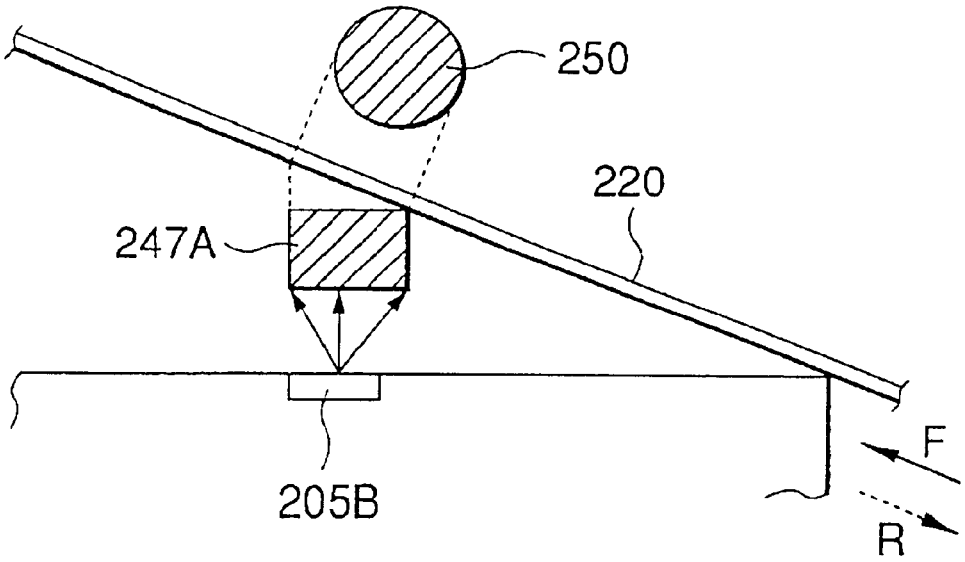
FIG. 101 is a schematic diagram for explaining printing operation by dye vaporization by the printer head according to a further embodiment.

As previously described, in the case of FIG. 99, the dot diameter of the pixel 250 is reduced, as compared with such a case that, for instance, in FIG. 100, the recording head 225 is arranged in parallel to the printing medium 220. It should be noted that the present invention may include the case of FIG. 100, and also another case of FIG. 101. That is, the arrangement of the recording head 225 and the printing medium 220 is reversed along upper/lower directions, as compared with the arrangement of FIG. 98. In any cases, the vectors are similarly exerted, so that the pixel 250 like the projection image may be formed.

In this embodiment, if the recording material jetting portion of the recording head 225 is brought into the lower direction state, even when the jetted dyes are rapidly cooled by ambient air and then the cooled dyes are condensed, the condensed dyes are directly dropped and are adhered onto the printing medium 220. As a consequence, most of the jetted dyes are transferred, and the image whose optical density is higher than, or equal to 3 can be obtained. It should be noted that this recording material jetting portion 205 may be used under upward condition.

In accordance with this embodiment, since the contact portion 210*a* is continuously made in contact with the printing medium 220 and a preselected angle "θ"=14 degrees is stably held, the interval between the dye jetting portion 205 and the printing medium 220 can be kept by 50 μm. Even when the above-explained vector is exerted, an oval close to a true circle can be formed.

Next, a description will now be made of experimental data acquired in the case that the above-explained interval between the dye jetting portion 205 and the printing medium 220 is varied.

In general, due to such a characteristic specific to a transfer mechanism of a dye jetting type printer for directly vaporizing a dye to transfer the vaporized dye onto a printing paper, a change in an interval (gap) between a recording head (heater portion) and a printing paper will appear with a high sensitivity as a difference between resolution of a printed picture and optical density. Since the terminal of the vaporizing portion is made open (open terminal) in accordance with the structure of this embodiment mode 3, most of the vaporized dyes may be jetted toward the printing paper located opposite to this vaporizing portion due to volume expansion of the vaporized dyes. It is conceivable that there is a substantial amount of vaporized dye components which are extended with having a solid angle. As a consequence, the below-mentioned phenomenon may represent in view of qualitative analysis.

In such a case that this gap between the heater portion and the printing paper is excessively wide, 1) a dot diameter is extended, so that a dot contour is blurred and a defocus occurs, because resolution is lowered;
2) a dot diameter is extended, so that optical density is lowered in dyes vaporized with the same energy; and
3) since the gap is widened, an amount of vaporized dyes which may reach the surface of the printing paper is reduced, so that optical density is lowered.

Conversely, in such a case that this gap is excessively narrow, 1) there is a high risk that the recording head is made in contact with the printing paper. When this recording head is actually made in contact with the printer paper, the dyes are adhered onto the printing paper irrelevant to the printing data. Thus, scratches are made along the scanning direction of the recording head, which may dirty the printing paper.
2) a dot diameter is reduced, so that a space is made between the adjoining dots. For instance, when the printing paper is tried to be solid printed, white colored paper surfaces will appear. As a result, optical density is lowered.

Under such circumstances, optical density comparison experiments were carried out when the gap was changed to 50 μm, 110 μm, and 170 μm. A table 1 represents these experimental results:

TABLE 1

| | | | |
|---|---|---|---|
| Gap (μm) | 50 | 110 | 170 |
| Half-width (μm) | 75 | 105 | 140 |
| Optical density (relative value of peak) | 0.56 | 0.42 | 0.35 |

The experimental results were made as follows: When the gap "r" between the recording head and the recording paper was changed to 50 μm, 110 μm, and 170 μm (while the inclined angle "θ" of the recording head with respect to the recording paper is kept constant, one or two sheets of spacers each having a thickness of 60 μm was inserted into the contact portion, and then was moved along a parallel directions to form the gaps of 110 μm and 170 μm), the optical density of the lines printed by a single heater was measured by way of the microscopic spectrometer. As apparent from the above-described facts, when the gap is made wider, the line width (half-width corresponding to dot diameter) becomes wide and further the optical density is lowered.

Figure 102:
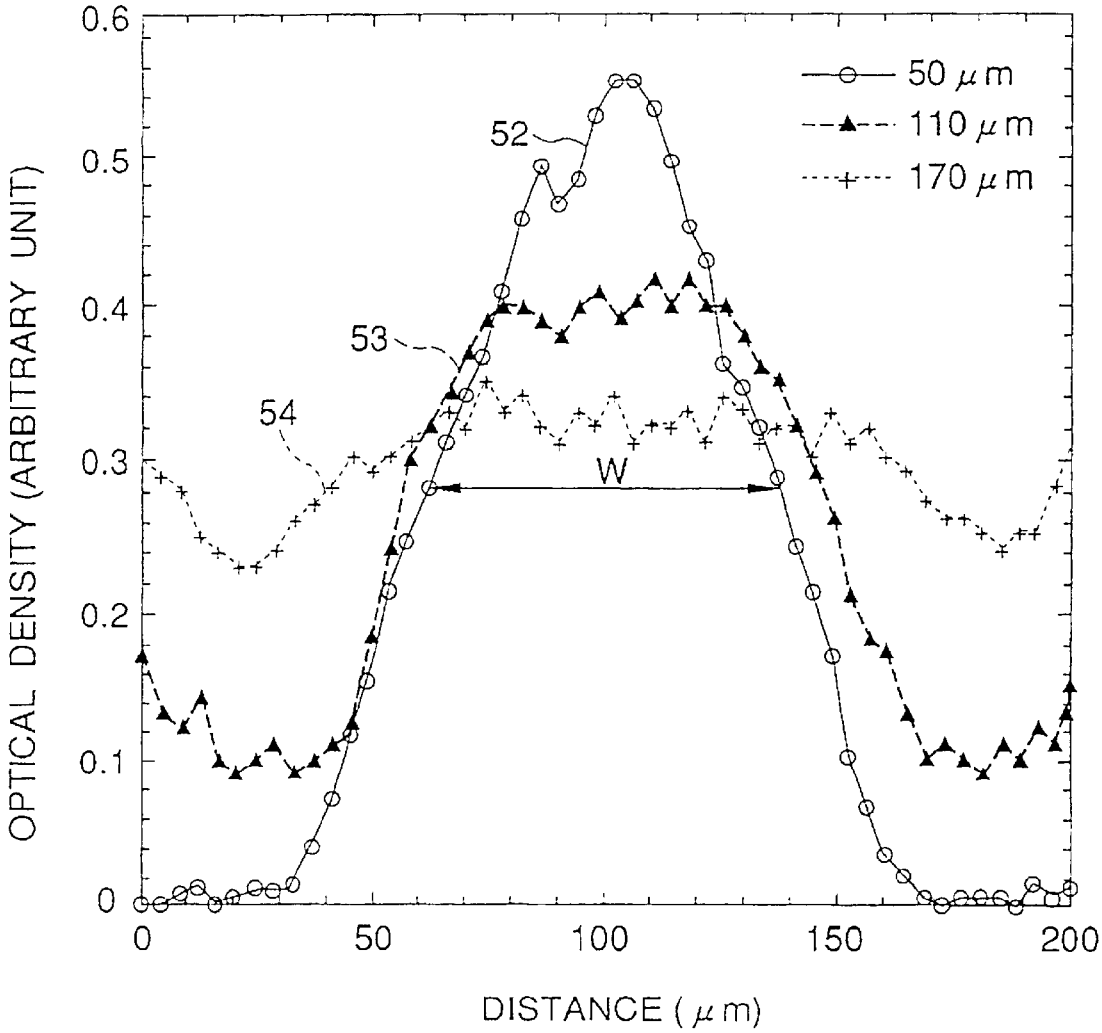
FIG. 102 is a graphic representation for indicating measurement values of optical density for 1 line at various sorts of gaps in the printer head according to this embodiment.

FIG. 102 graphically represents that the data for 1 line acquired in the above-described experiment are plotted. In this graphic representation, a curved line 52 indicates an optical density distribution within a width of 1 line when the gap is selected to be 50 μm. Also, a curved line 53 indicates an optical density distribution within a width of 1 line when the gap is selected to be 110 μm. Also, a curved line 54 indicates an optical density distribution within a width of 1 line when the gap is selected to be 170 μm. As apparent from this optical density distribution result, when the gap is selected to be 50 μm, such a profile is obtained that the highest optical density could be achieved at a center of the 1-line width, and the optical density at both sides of this center is rapidly lowered. This gap may provide the higher resolution with the optimum dot diameter while the higher optical density may be obtained and the half-width "W" may become narrow. In contrast, the wider the gap becomes, the broader the optical density profile becomes, so that there is a small difference between the high density region and the low density region, and the half-width is increased. It can be recognized that the wider the gap becomes, the thinner the density of the vaporized and jetted dyes which will be dispersed becomes.

Figure 103:
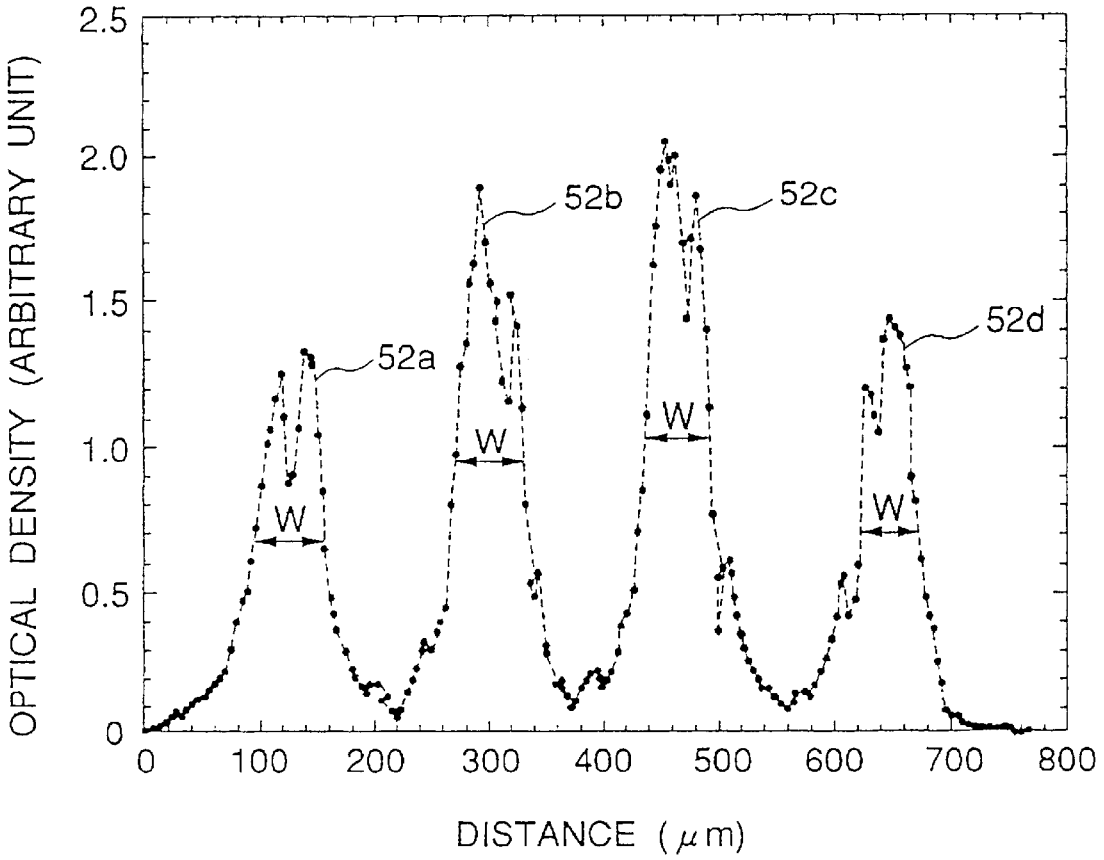
FIG. 103 is a graphic representation for indicating measurement values of optical density for 4 lines at a gap of 50 $\mu$m in the printer head according to this embodiment.

FIG. 103 graphically shows measurement results of optical density of 4 printing lines when the gap is selected to be 50 μm. In this graphic representation, curved lines 52*a*, 52*b*, 52*c*, and 52*d* of each of these four lines correspond to the curved line 52 shown in FIG. 102. There are differences in the optical density every line. This is because the optical density depends upon image signals. However, in this case, when the comparisons are made among the respective lines, the half-width W is small, and the variation thereof is very small. Also, the sharp optical density profile and the high optical density can be obtained.

Figure 104:
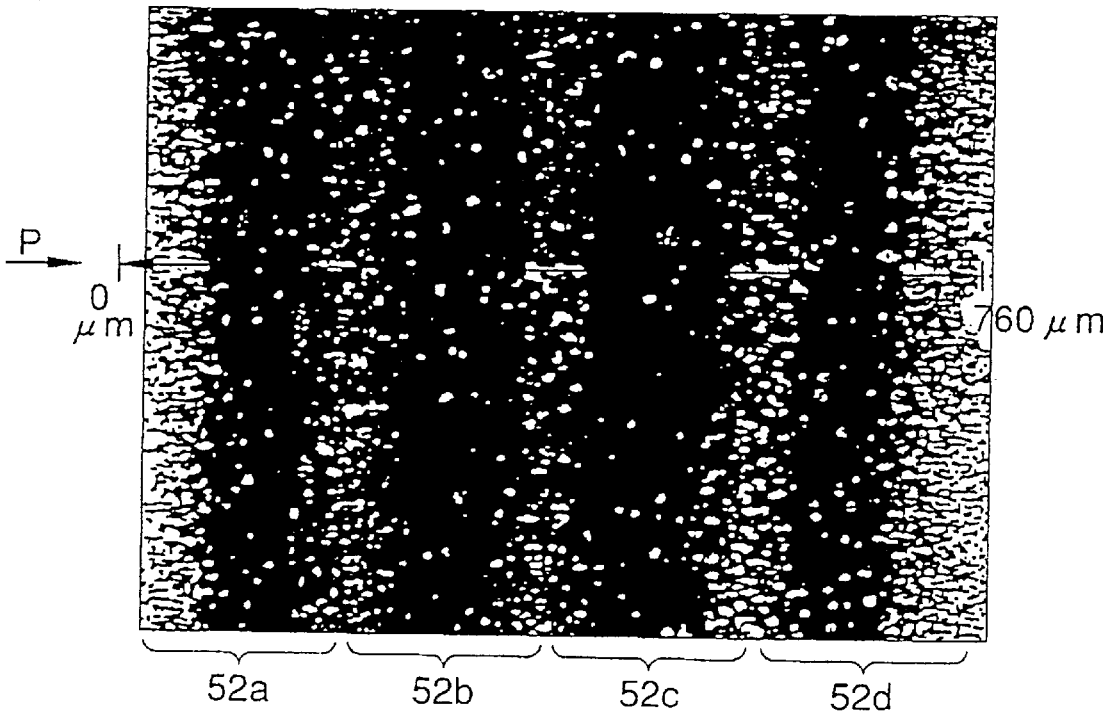
FIG. 104 is a sketch for illustrating a microscopic photograph of a printed plane for 4 lines by the printer head according to this embodiment.

FIG. 104 is a sketch of a microscopic photograph for the above-explained 4 printing lines. An arrow "P" indicates a data measurement position of FIG. 103. Also, apparent from FIG. 104, it can be confirmed that the optical density within the respective lines becomes substantially stable.

Figure 105:
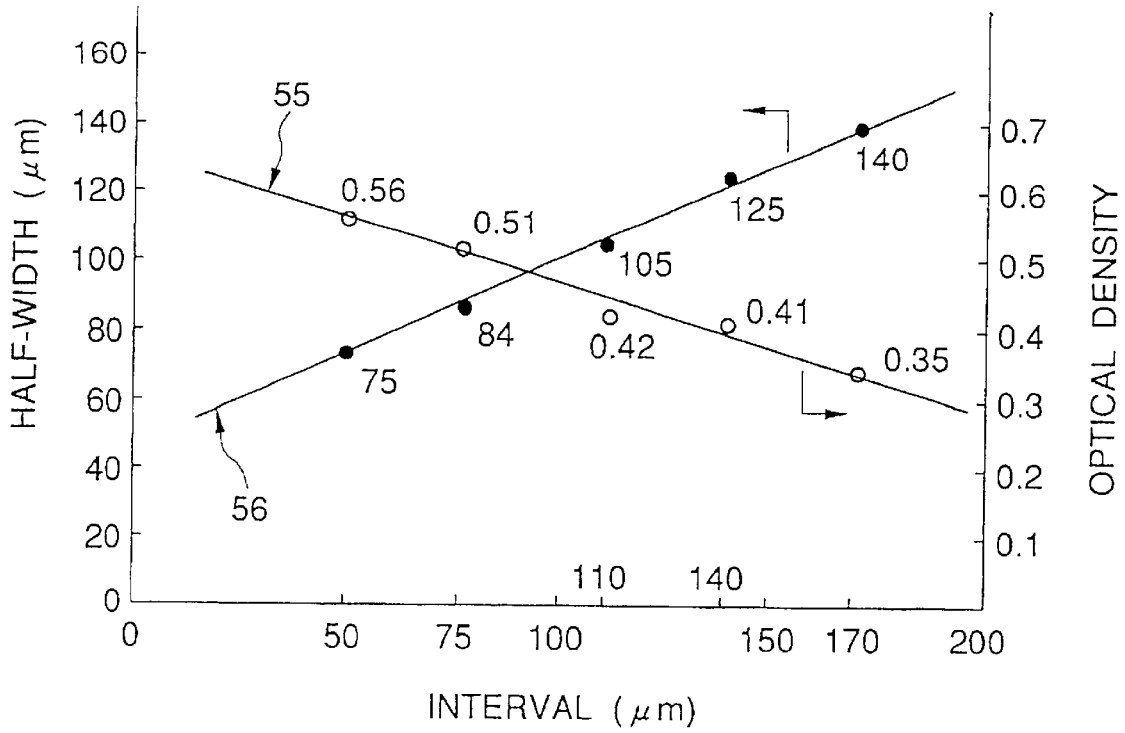
FIG. 105 is a graphic representation for indicating the optical density by the gaps based on the experimental results, and a change in half band widths by the printer head according to this embodiment.

There is such a trend that both the optical density and the half-width are changed in response to the change in the gaps. FIG. 105 graphically represents a change 55 in optical density and a change 56 in half-widths with respect to a gap width (interval). A confirmation is made that the wider the gap becomes, the lower the density is decreased and also the half-width is widened.

Based upon the above-described experimental results, such a confirmation can be established. That is, the interval (gap) between the dye jetting portion 205 and the printing medium 220 may constitute one of the major items capable of giving influences to the resolution and also the gradation of the printed image. As previously explained, since the gap is selected to be 50 μm in accordance with this embodiment mode 3, any of these characteristics could be improved.

Subsequently, the structure of the recording head having the above-explained feature functions, according to this embodiment mode 3, will now be described.

Figure 106:
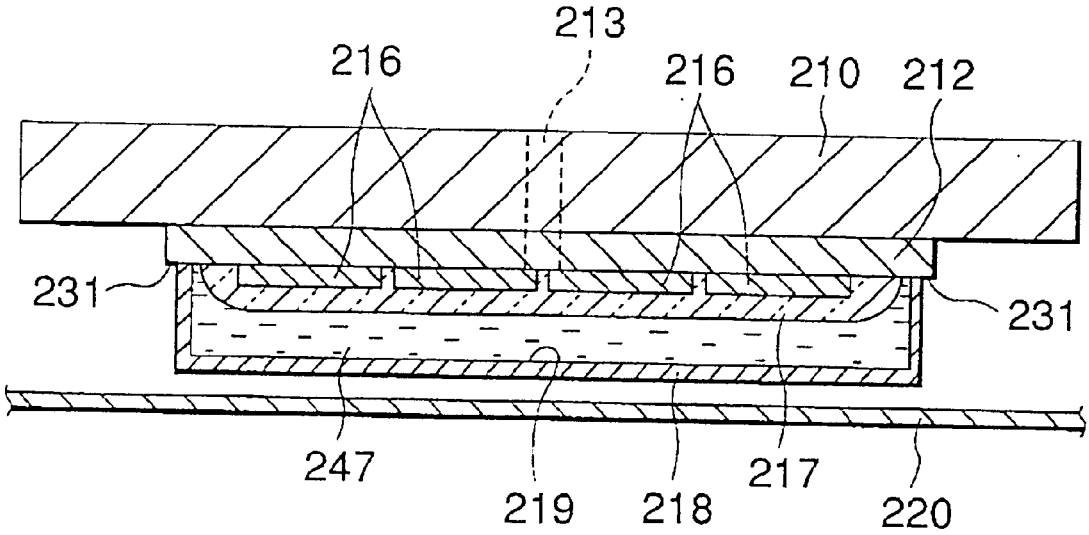
FIG. 106 is a sectional view of the printer head, taken along a line XVI—XVI of FIG. 91.
Figure 107:
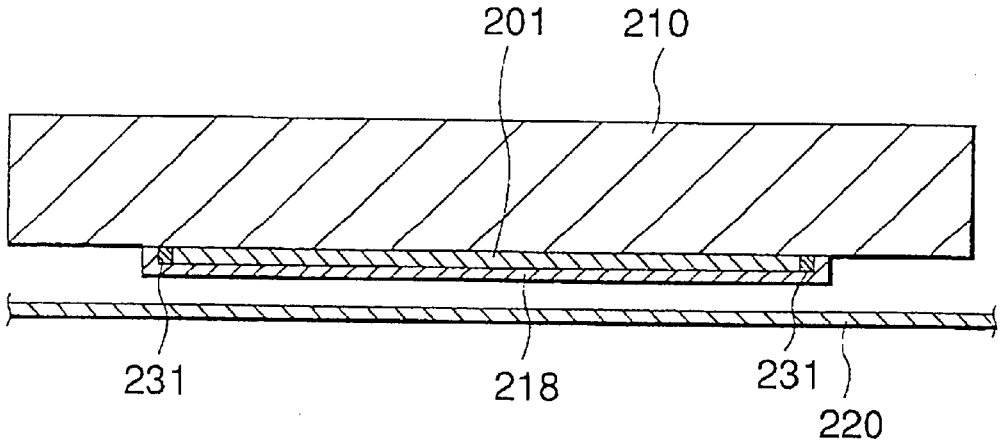
FIG. 107 is a sectional view of the printer head, taken along a line XVII—XVII of FIG. 91.

FIG. 106 is a sectional view for showing the non-contact type dye jetting mode printer head, taken along a line XVI—XVI of FIG. 91. Similarly, FIG. 107 is a sectional view, taken along a line XVII—XVII of FIG. 91. The cover 218, the printed circuit board 212, and the heater chip 201 and adhered to each other by using an adhesive agent so as to be completely sealed. As a result, the dye 247 which has been conducted from the dye conducting hole 213 into the common dye supply path 219 within this cover 218 may be supplied to the branch path 207 (see FIG. 92B and FIG. 112) without any leakage.

Figure 108:
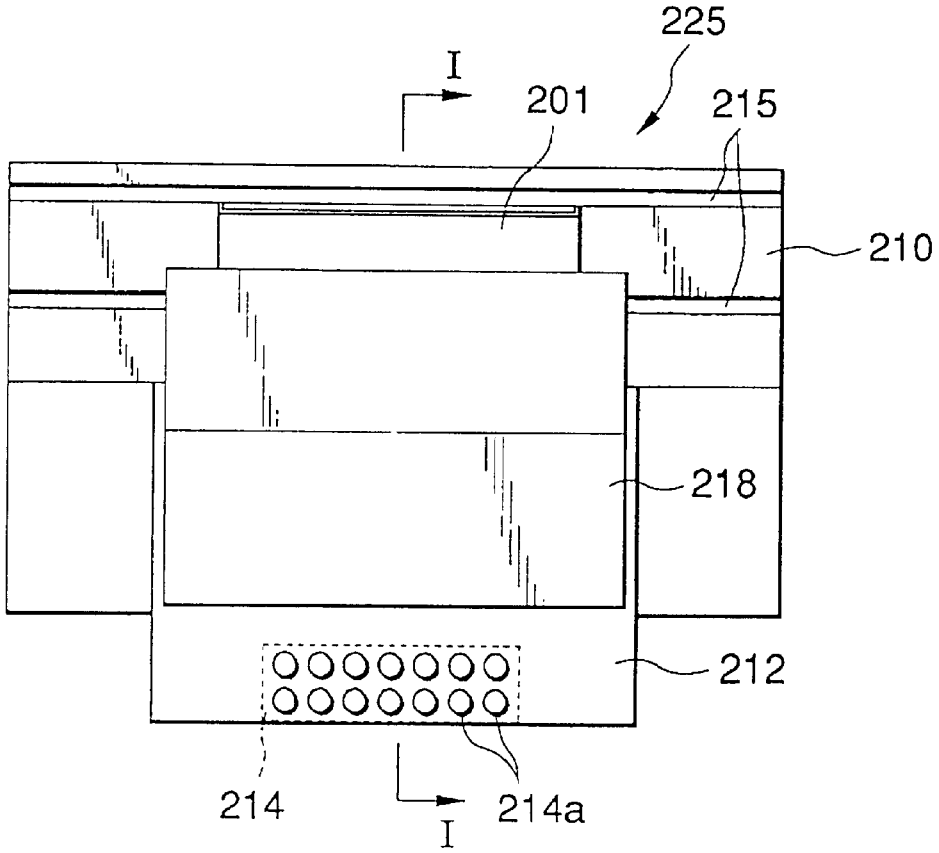
FIG. 108 is a plan view for showing the printer head of FIG. 91.
Figure 109:
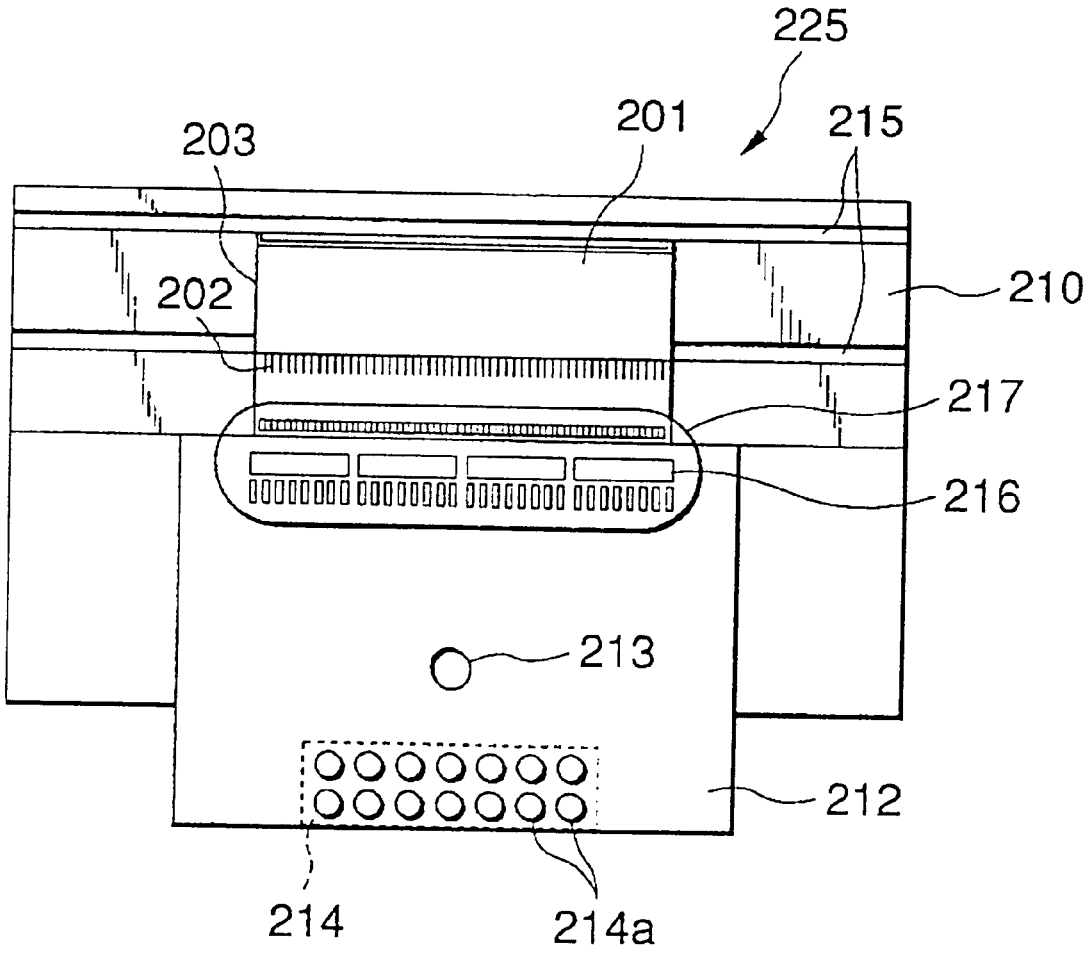
FIG. 109 is a plan view for indicating such a condition that the cover is removed from the printer head of FIG. 91.

FIG. 108 is a plan view for indicating the recording head 225 according to this embodiment mode 3. FIG. 109 is a plan view indicating such a condition that the cover 218 is removed from the condition of FIG. 108. In this recording head 225, both the printed circuit board 212 and the heater chip 201 are adhered onto the base 210 made of aluminium and having the heat sink function by employing an adhesive agent of silicone compound. Furthermore, the cover 218 is adhered onto the members by using the same adhesive agent.

To uniformly adhere the heater chip 201 onto the joint portion of the heater chip 201, a groove 215 is formed on the base 210. Thus, the unnecessary adhesive agent used to adhere the heater chip 201 may be escaped into this groove 215. Then, as shown in FIG. 91 and FIG. 92A both the connection portion between the electrode on the heater chip 201 and the IC chip 216, and also the connection portion between the IC chip 216 and the wiring lines on the printed circuit board 212 are coated with the coating material JCR (junction coating resin) 217 of silicone compound, which is thermally hardened in order to protect the bonding wires for connection purposes.

Figure 112:
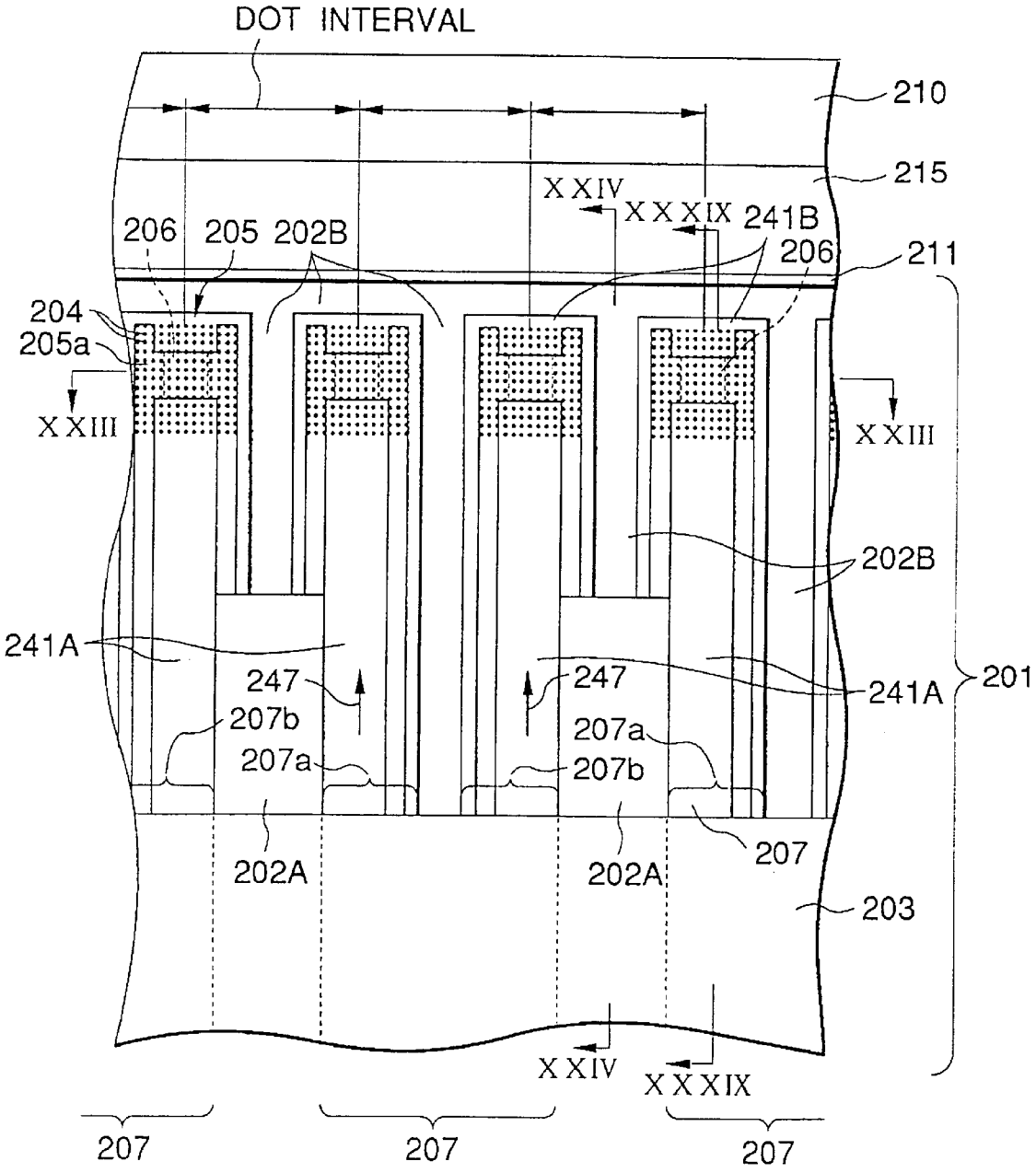
FIG. 112 is a plan view for indicating a major portion of the printer head according to this embodiment.

In this embodiment, as represented in FIG. 112 (will be discussed later), 256 pieces of heaters 206 are formed having an interval of 84.7 μm. Since each of these heaters 206 transfers 1 dot, resolution of 300 DPI can be realized. Each of these heaters 206 is fabricated by polysilicon having a dimension of 20 μm×20 μm. A separate electrode 241A and a common electrode 241B are connected to the heater 206 in order that a signal voltage is applied in response to an image signal to energize the heater 206.

Figure 110:
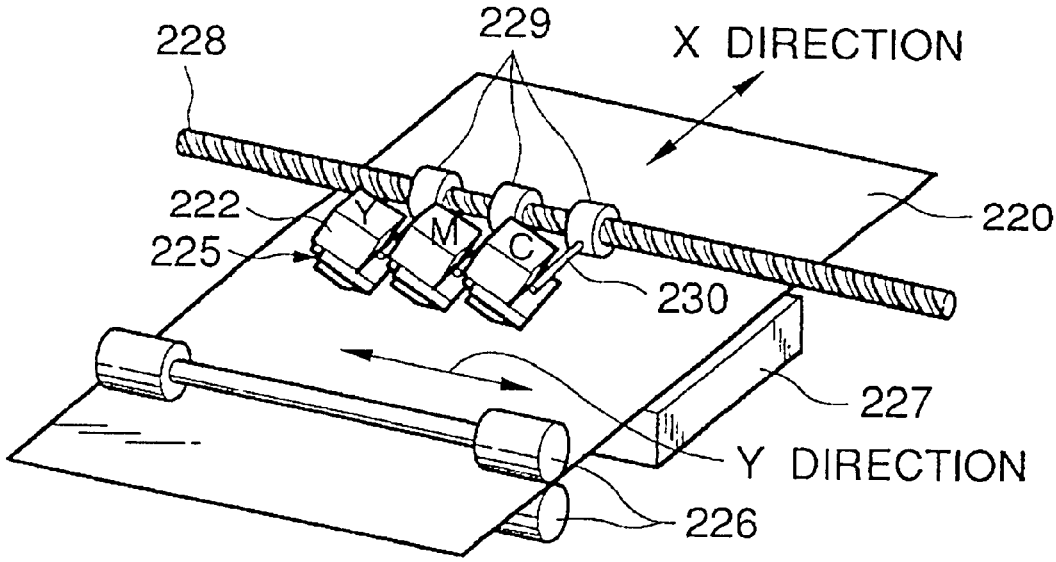
FIG. 110 is a perspective view for representing a use condition of a serial type printer assembled with the printer head according to this embodiment.
Figure 111:
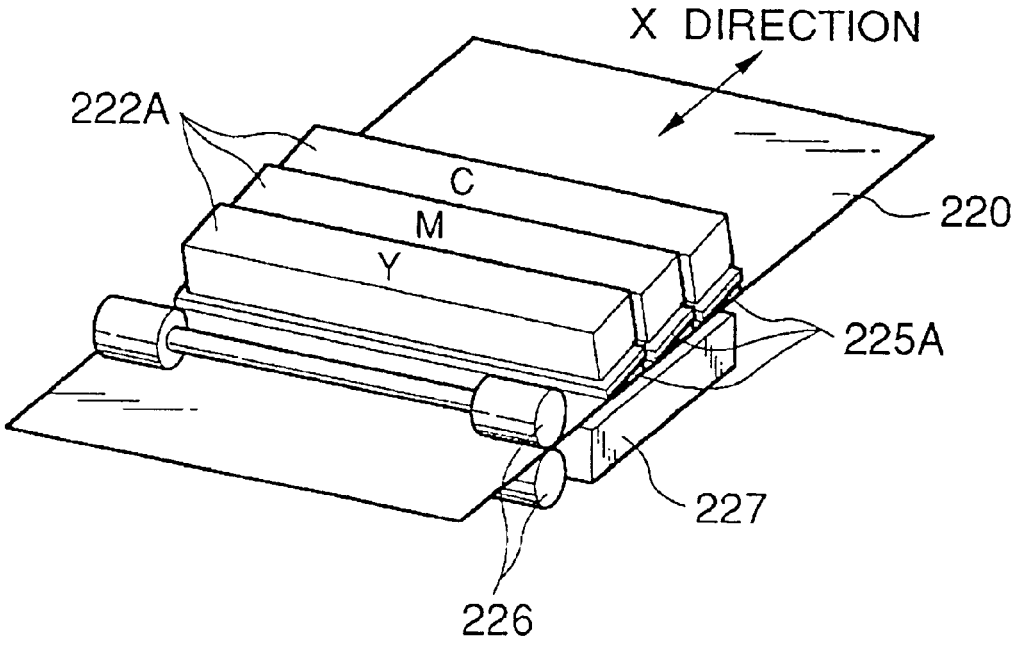
FIG. 111 is a perspective view for representing a use condition of a line type printer assembled with a modified printer head according to this embodiment.

FIG. 110 and FIG. 111 are a perspective views for schematically indicating use conditions that the above-explained recording head manufactured in accordance with this embodiment is applied. FIG. 110 is a perspective view for schematically representing one use condition that the above-explained recording head manufactured in accordance with this embodiment is applied to the serial type recording system. FIG. 111 represents another example that this recording head is applied to the line system.

As the dye 247, a yellow (Y) dye, a magenta (M) dye, and a cyan (C) dye were used which were produced by solving 15 weight % of solvent yellow 256, disperse red 201, solvent blue 235, respectively, into dibutyl phthalate at 50° C. When this dye 247 heated at 50° C. is conduced into the dye reservoir tub 222 of the recording head 225, the dye 247 may be automatically conduced via the dye conducting hole 213 to the dye storage portion 205*a*.

In the case of the serial type recording system, as indicated in FIG. 110, dye reservoir tubs 222 (see FIG. 92) for storing, for instance, three-primary-color (Y, M, C) dyes (further black dye may be added) are mounted on 3 sets of recording heads 225 arranged in parallel to each other. The recording heads are coupled to a movable piece 229 which is engaged via a coupling member 230 to a feed shaft 228. Since this feed shaft 228 is engaged with the movable piece 229 by using a screw, the respective recording heads 225 are reciprocated along the Y direction in connection with the rotations of the feed shaft 228 by a drive source (not shown).

On the other hand, the printing medium 220 arranged opposite to this recording head 225 is transferred along the X direction by the feed roller 226 every time the recording head 225 is scanned for 1 line. As a result, the printing operation is carried out by the recording head 225 with respect to the printing medium 220 positioned to be sandwiched between the platen 227 and the recording head 225. It should be understood that the recording head is connected via a flexible harness to a drive circuit board (not shown) and the like.

Since 256 pieces of heaters 206 are provided in the recording head of this embodiment mode 3, the printing operation for 256 lines can be performed during one scanning operation. When one scanning operation is accomplished, the printing medium 220 is fed over a distance equal to 256 lines by the paper feed drive roller 226. In order that the respective color recording heads may start the color printing operations from preselected positions on the printing medium 220, the timing is sequentially changed every one color to commence the printing operation, and thus a full color image is printed within one time.

In the case of this line type recording system, as shown in FIG. 111, a recording head 225A having a length corresponding to the width of the printing medium 220 is arranged along the X direction with respect to each of three colors. A dye reservoir tub 222A for storing one of three-primary-color (further black may be added) dyes Y (yellow), M (magenta), and C (cyan) is mounted on this recording head 225A.

As a consequence, the printing medium 220 which is positioned opposite to the above-explained recording head 225A and is sandwiched by this recording head 225A and a platen 227, is printed by the recording head 225A. After a predetermined printing operation is carried out, while the printing medium 220 is transferred along the X direction by a feed roller 226, the subsequent printing operations are executed.

The recording head 225 according to this embodiment owns such a small-sized width as indicated in FIG. 110, whereas the recording head 225A of the line system shown in FIG. 111 owns such a long-sized width. However, there are only differences in the dimensions and specifications, but these structures and basic ideas are identical to each other. Accordingly, this content is not shown.

Figure 113:
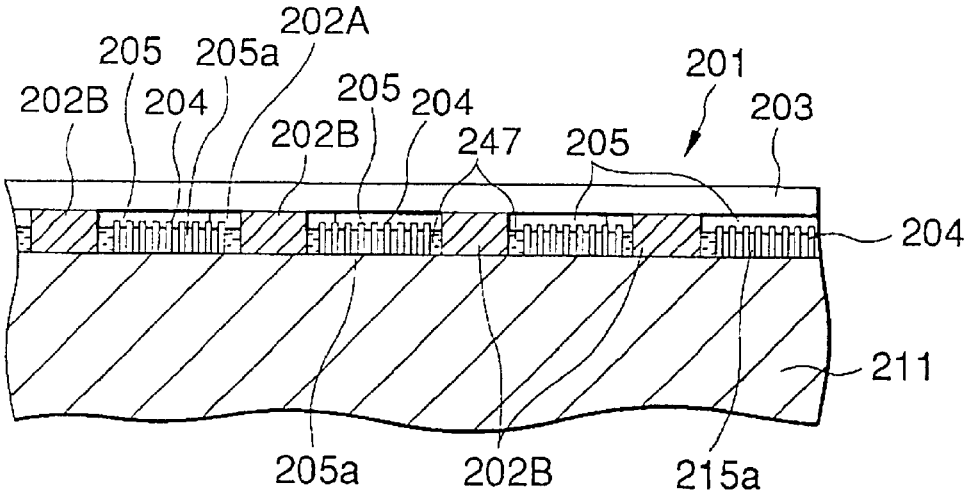
FIG. 113 is a sectional view of the printer head, taken along a line XXIII—XXIII of FIG. 112.
Figure 114:
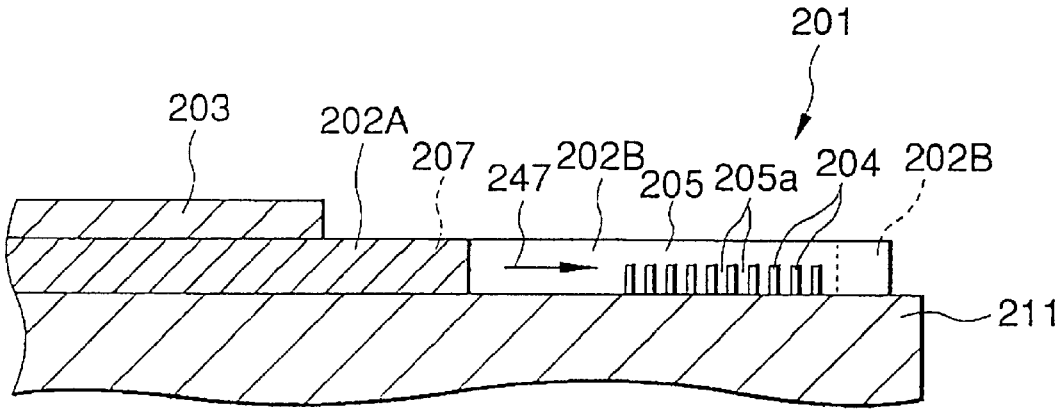
FIG. 114 is a sectional view of the printer head, taken along a line XXIV—XXIV of FIG. 112.

FIG. 112 is a plan view for showing a major portion of the heater chip according to this embodiment mode 3. FIG. 113 is a sectional view for indicating this major portion, taken along a line XXIII—XXIII of FIG. 112. FIG. 114 is a sectional view for representing this major portion, taken along a line XXIV—XXIV of FIG. 112.

The heater chip 201 is partitioned by a first partition wall 202A on the substrate 211, on which a lid 203 is covered. Thus, a slit branch path 207 is formed. As indicated in FIG. 112, the first partition wall 202A is provided in correspondence with two sets of dye jetting portions 205, and is projected up to an intermediate position between the edge of the lid 203 and the tip portion of the header chip.

Then, a second partition wall 202B having a width narrower than that of the first partition wall 202A is elongated from the tip portion of each first partition wall 202A on a common electrode 241B. A tip portion of this second partition wall 202B is coupled to the tip portion of the heater chip 201, and is furthermore elongated from this coupling portion to the edge portion of the lid 203 at the separate electrodes 241A located adjacent to this second partition wall 202B. As a result, the dyes 247 are supplied from the respective branch paths 207 to the respective dye jetting portions 205, and each of the dye jetting portions 205 is surrounded by the second partition wall 202B, so that the dyes can be supplied and vaporized under stable conditions.

Then, as represented in FIG. 113 and FIG. 114, a porous structure made of a small cylindrical member (204) group is formed in the dye jetting portion 205, and this small cylindrical member (204) group may form a dye storage portion 205*a*.

The other edge side of the above-explained branch path 207 is located opposite to the commonly used dye supply path 219, as described with reference to FIG. 91, from which the dyes 247 are supplied to the respective branch paths 207. Furthermore, the dyes 247 are branched to paths 207*a* and 207*b* separately provided with the dye jetting portions, and thereafter are supplied to the respective dye storage portions 205*a* of the respective dye jetting portions 205. Then, the heater 206 constructed of heating members is provided on each of the dye jetting portions 5. The dyes 247 are heated by this heater 206 to be vaporized. The vaporized dyes are jetted to the printing medium.

As indicated in FIG. 112, large numbers of separate electrodes 241A, and of the common electrodes 241B and provided on the heater chip 201. The temperature of the heater 206 is increased by energizing the separate electrodes 241A and the common electrodes 241B to thereby heat the dyes stored in the dye storage portion 205*a*. Then, the signals are supplied from the separate electrodes 241A to the respective heaters 206 in response to the image information, so that these heaters 206 are operable.

Figure 115:
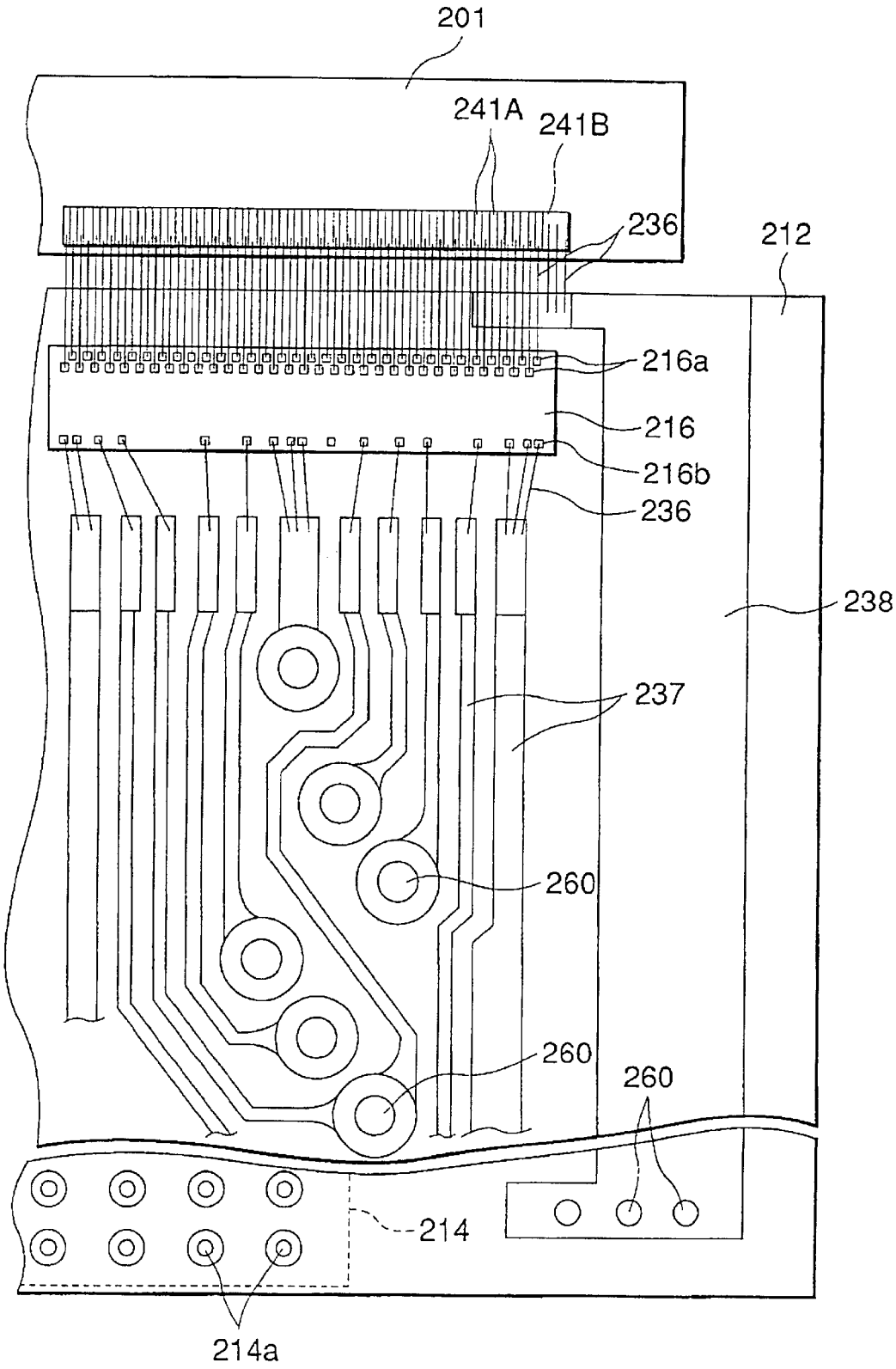
FIG. 115 is an enlarged plan view for partially showing a connection between a heater chip of the printer head and a printed circuit board, according to this embodiment.

A circuit wiring connection between the separate electrode 241A/the common electrode 241B of the heater chip 201 and the printed circuit board 212 is made as shown in FIG. 115. FIG. 115 is an enlarged plan view for partially showing these connections, namely indicated only one (right end) of 4 pieces of the IC chips 216 arranged on the printed circuit board 212.

Each of large numbers of separate electrodes 241A formed on the heater chip 201 is connected to one bonding pad 216*a* of the IC chip 216 by the bonding wire 236, and the common electrode 241B of the heater chip 201 is connected to a common electrode wire line 238 of the printed circuit board 212. The other pad 216*b* of the IC chip 216 is connected to a circuit wire line (pattern) 237 of the printed circuit board 212 by the bonding wire 236. The respective wire lines 237 and 238 are conducted via a through hole 260 to the connector 214, depending upon places.

As a result, a signal in response to image information supplied from a signal cable (ribbon cable in this case) (not shown) connected to the connector 214 is furnished via this connector 214 from the circuit wire line 237 of the printed circuit board 212 through the IC chip 216 to a preselected separate electrode 241A of the heater chip 201.

Then, each of the heaters 206 (concretely speaking, polysilicon heating member) provided between the separate electrode 241A of the heater chip 201 and the common electrode 241B is energized so as to heat the dye 247 held in the small cylindrical member (204) group formed on the heaters 206, so that the heated dye 247 is jetted to the printing medium 220.

As a result, a sufficient amount of dyes 247 must be continuously held during the image recording operation in the dye jetting portion 205 having the porous structure and constructed of the small cylindrical member (204) group. Moreover, the dyes 247 which are consumed by the image recording operation must be supplied without any problem. This requirement can be sufficiently satisfied by the below-mentioned structures which will be described.

It should be noted that, for example, even when the small cylindrical member (204) group is not present in the dye jetting portion 205, the recording material may be jetted. Even in such a case, the current may flow through a predetermined separate electrode 241A in response to image information, and thus the heater 206 provided under the dye jetting portion 205 is heated by this current, so that the dye 247 existing above this dye jetting portion 205 may be vaporized and jetted. However, in such a case that the jetting structure constructed of the small cylindrical member 204 is employed, when the surface tension of the dye 247 is lowered due to the heating action, a sufficient amount of dyes 247 can be held in the dye jetting portion 205, and therefore, the dye can be jetted under better condition.

Next, a manufacturing step of the above-described head according to this embodiment will now be explained. FIG. 116 to FIG. 130 are sectional views for representing the heater chips in the respective manufacturing steps. FIG. 131 to FIG. 139 are plan views for showing the heater chips in a portion of the manufacturing steps corresponding to the above-described manufacturing steps.

Figure 116:
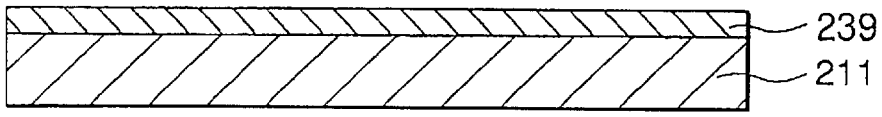
FIG. 116 is a sectional view for showing one manufacturing step of the printer head according to this embodiment.

FIG. 116 represents a first manufacturing step at which a silicon wafer having a better heat radiation characteristic (namely, high thermal conductivity) is used as a substrate 211, and an $SiO_2$ layer 239 having a thickness of on the order of 1 to 2 $\mu$m is formed on this substrate 211 by way of the thermal oxidation method, or the CVD (chemical vapor deposition) method. Since the $SiO_2$ layer 239 may function as a heat storage layer immediately under the heating element (will be discussed later), the thickness of this $SiO_2$ layer 239 must be determined by considering the heat radiation characteristic of the heat sink of aluminium which constitutes a base. FIG. 116 shows a portion mainly corresponding to the sectional view, taken along a line XXXIX—XXXIX of FIG. 117. FIG. 112 is a sectional view subsequent to FIG. 116, and a portion of a plan view subsequent to FIG. 131.

Figure 117:
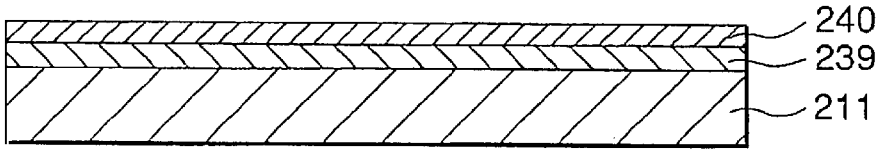
FIG. 117 is a sectional view for representing another manufacturing step of the printer head according to this embodiment.

Subsequently, as indicated in FIG. 117, a film of a polysilicon layer 240 which constitutes a resistance member (heating element) is formed on the $SiO_2$ layer 239 by way of the decompression CVD method under such a condition that a thickness of this polysilicon film layer is on the order of 0.4 $\mu$m. The film of this polysilicon layer 240 is manufactured by doping phosphorus in order that a sheet resistance thereof is on the order of 4 kΩ.

Figure 118:
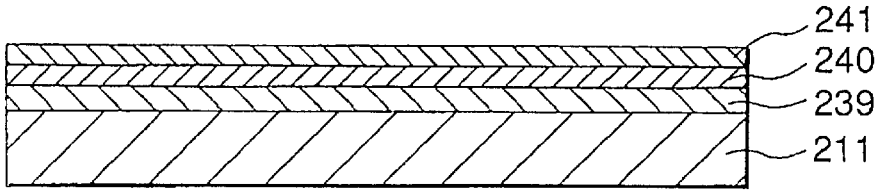
FIG. 118 is a sectional view for representing another manufacturing step of the printer head according to this embodiment.

Next, as indicated in FIG. 118, a film of aluminium 241 into which titanium is slightly doped is formed on the polysilicon layer 240 by way of the sputtering method, and this film has a thickness of on the order of 0.7 $\mu$m. In this case, any metals other than aluminium, such as gold, copper, and platinum may be used as the conductive material.

Figure 119:
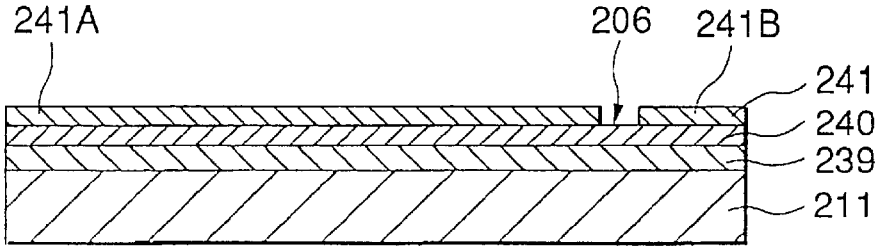

Next, as shown in FIG. 119, in order to expose the polysilicon layer 240 where the heater 206 is formed as the heating element 206, photoresist having a preselected pattern is formed, and aluminium of this portion is selectively removed by way of the etching process. In this etching process, a mixtured acid fluid is used as the etching fluid by mixing the following acid and water at the below-mentioned ratio: phosphoric acid:nitric acid:acetic acid:water=4:1 :4:1. Then, FIG. 131 is a plan view for indicating this condition. FIG. 119 is a sectional view, taken along a line CXIX—CXIX of FIG. 131.

Next, wiring patterns used to energize the respective heater portions 206 are formed by way of the etching process. That is, while photoresist is used as a mask, aluminium is etched away by using the above-described etching fluid to form conductor patterns, so that such patterns as shown in FIG. 132 are formed. It should be noted that in FIG. 132, the plan shapes of the respective aluminium patterns shown in FIG. 91 are simply illustrated.

Subsequently, the polysilicon layer 240 which is not etched away by the above-described etching fluid, but therefore is left is etched away by using carbon fluoride gas ($CF_4$) by way of the RIE (reactive ion etching) method, while using the above-described photoresist as a mask in such a manner that this polysilicon layer 240 is formed as a pattern similar to an aluminium layer 241. A plan view of this condition is shown in FIG. 133.

At this time, since the photoresist is located on the polysilicon layer 240 of the heating element 206, the polysilicon layer 240 of this portion is not etched away. As a result, the polysilicon layer 240 is processed as the conductor pattern having the same shape as the aluminium layer 241 other than the heating elements which are exposed at the preceding step of FIG. 119. Aluminium is made in ohmic-contact with polysilicon by executing a heating process at the subsequent step, which may function as a conductor. Then, the portion 206 where polysilicon is exposed becomes a resistive member having a high resistance value, which may function as a resistive heating heater.

Figure 120:
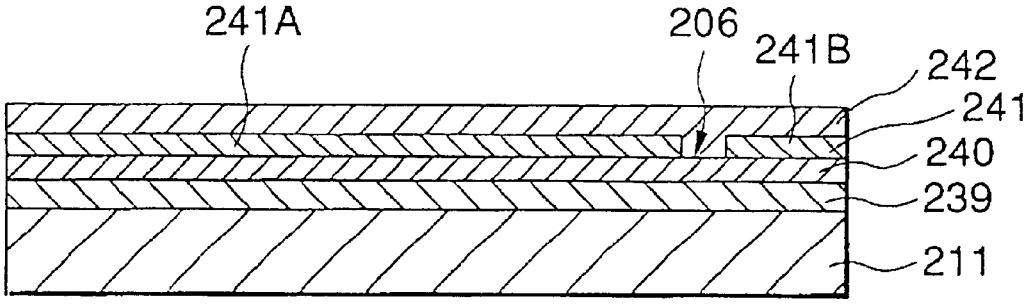

Next, as shown in FIG. 120, an $SiO_2$ layer 242 having a thickness of on the order of 0.5 $\mu$m is formed on the entire surfaces of the conductor patterns and the heater portion, which have been manufactured in the above-explained manner by way of the CVD method. This is an insulating film used to form two-layer wiring patterns of the common electrode 241B.

Next, as shown in FIG. 121, photoresist having a predetermined pattern is formed. While using this pattern as a mask, the $SiO_2$ layer 242 is etched away by way of the RIE method to thereby form a through hole 246 used to conduct a first layer of aluminium wiring line 241 to a second layer of aluminium wiring line which is formed at a subsequent step. A plan view of this condition is indicated in FIG. 134. FIG. 121 is a sectional view, taken along a line CXXI—CXXI of FIG. 134.

Figure 122:
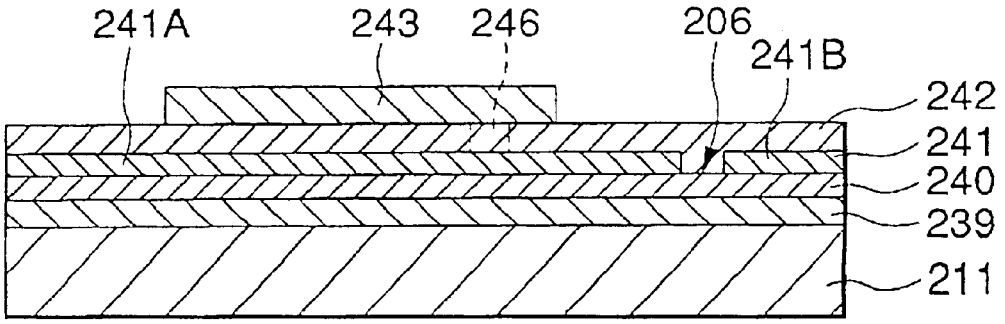

Subsequently, as indicated in FIG. 122, an aluminium film having a thickness of on the order of 1.0 $\mu$m is formed by way of the sputtering method under such a condition as shown in FIG. 121. Photoresist having a predetermined pattern is formed. Then, while using this photoresist as a mask, aluminium is etched away by using an etching fluid. The second layer of the aluminium wiring line 243 which has been formed in this manner is made as a pattern capable of covering a wide range except for the heater portion 206, and the electrode extracting portion 248, so that the resistance value of the common electrode 241B can be made low as being permitted. A plan view of this condition is indicated in FIG. 135. FIG. 122 is a sectional view, taken along a line CXXII—CXXII of FIG. 135.

Figure 123:
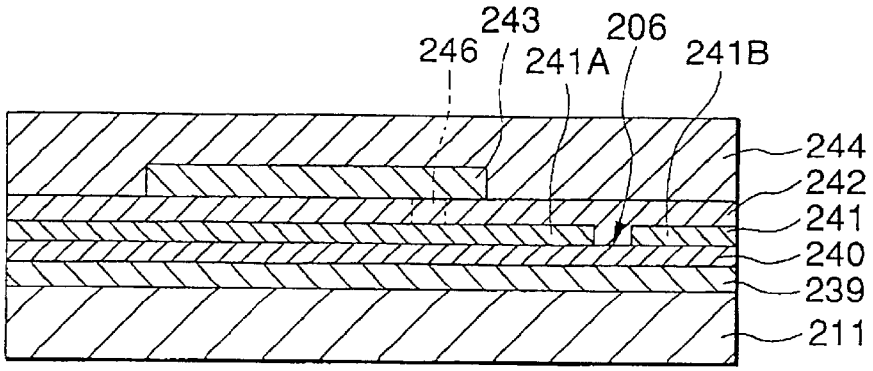
Figure 124:
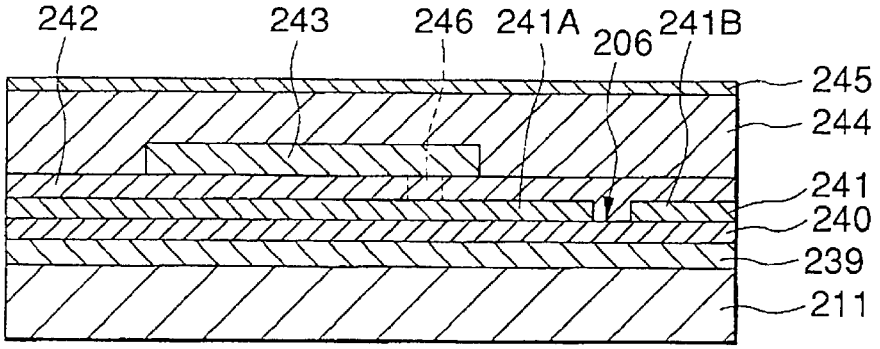

Next, after a film of an $SiO_2$ layer having a thickness of on the order of 0.5 $\mu$m and functioning as a protective film has been formed by way of the CVD method, this $SiO_2$ layer film is annealed for 30 minutes at a temperature of 450° C. within a nitrogen atmosphere. After a sintering process is carried out in order to make up an ohmic contact between polysilicon (reference numeral 240) and the aluminium electrode (reference numeral 241), as shown in FIG. 123 a film of an $SiO_2$ layer 244 having a thickness of on the order of 6 μm is formed by way of the CVD method.

Next, as shown in FIG. 134, a film of a nickel film 245 (in actual, laminated film of Ti/Ni) having a thickness of on the order of 0.2 μm is formed by way of the vacuum vapor deposition method, and this nickel film 245 constitutes a metal mask when the small cylindrical member 204 and a dye storage portion 205*a*. In this case, in order to improve the close fitting characteristic between the $SiO_2$ film 244 and the nickel film 245, after titanium having a thickness of 0.02 μm has been vapor-deposited, a nickel film is continuously vapor-deposited.

Figure 125:
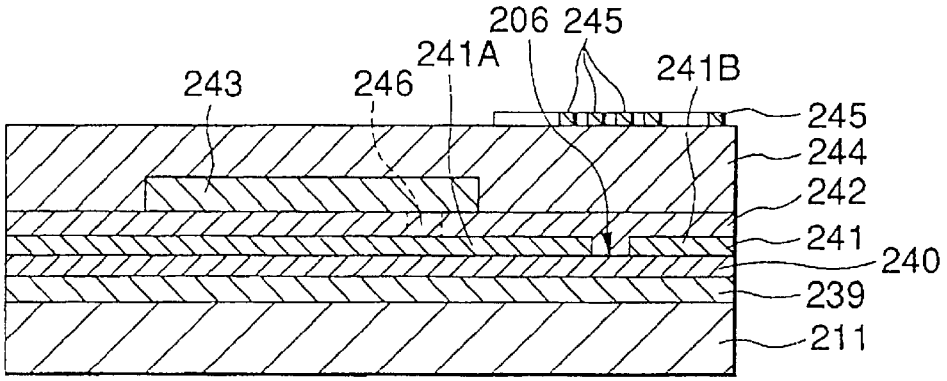

Next, as indicated in FIG. 125, in order to form the small cylindrical member 204 and the dye storage portion 205*a*, photoresist having a predetermined pattern is formed, and the unnecessary titanium/nickel film 245 is removed by the ion milling apparatus to thereby form a metal mask 245. A plan shape under this condition is FIG. 136, and FIG. 125 is a sectional view, taken along a line CXXV—CXXV of FIG. 136.

Figure 126:
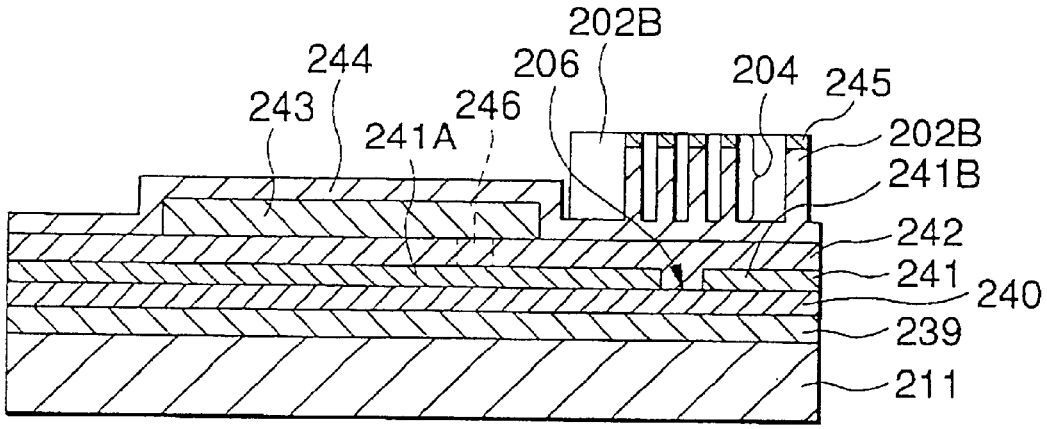

Thereafter, as shown in FIG. 126, while employing the titanium/nickel film 245 formed as a predetermined pattern as a mask, the $SiO_2$ film 244 is treated by way of the RIE (reactive ion etching) method so as to form the recording material storage portion 205*a* and the small cylindrical member (204) group in the $SiO_2$ layer 244, so that the dye jetting portion 205 is constituted. Furthermore, a second partition wall 202B is formed. These members are formed on each of the heating elements.

Figure 127:
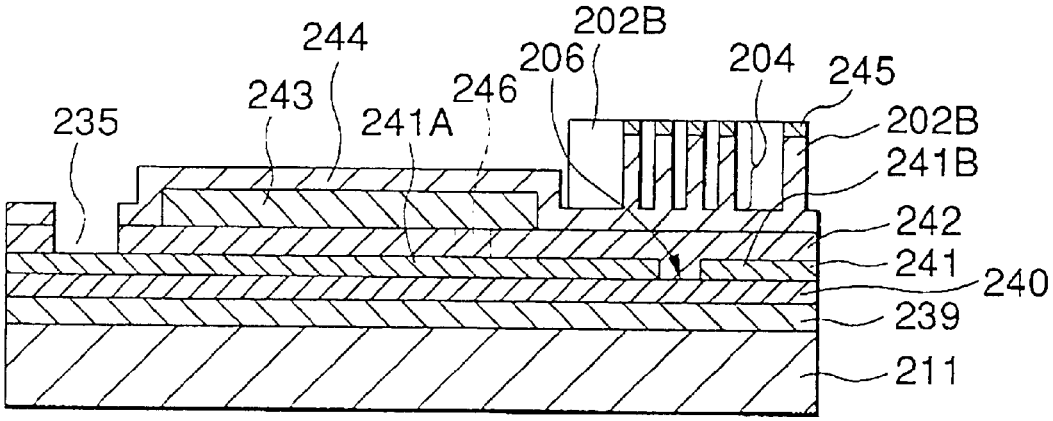

Next, as indicated in FIG. 127, photoresist having a predetermined pattern is formed in order to open the bonding pad 235 for the separate electrode and the bonding pad for the common electrode. Then, $SiO_2$ is etched away by way of the RIE method, so that aluminium 241A and 241B of electrodes are exposed as bonding pads. A plan view under this condition is shown in FIG. 137. FIG. 127 is a sectional view, taken along a line CXXVII—CXXVII of FIG. 137.

Figure 128:
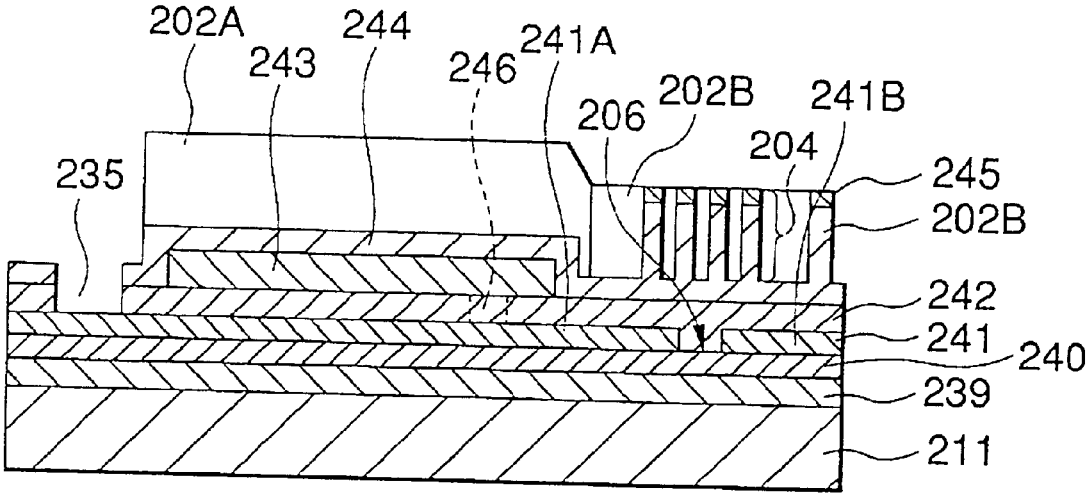

Subsequently, as shown in FIG. 128, a dry film (sheet resist) having a thickness of on the order of 25 μm is laminated as a branch path wall 202A, and a patterning process is carried out with respect to a pattern of the dye supplying branch path. At this time, the edge portion on the side of the heater 206 of the sheet resist 202A is set to a position separated from the center position of the heater 206 by 100 μm. Alternatively, polyimide may be employed instead of the sheet resist 202A to be patterned in a similar manner. A plan view under this condition is shown in FIG. 138. FIG. 128 is a sectional view, taken along a line CXXVIII—CXXVIII of FIG. 138.

Figure 129:
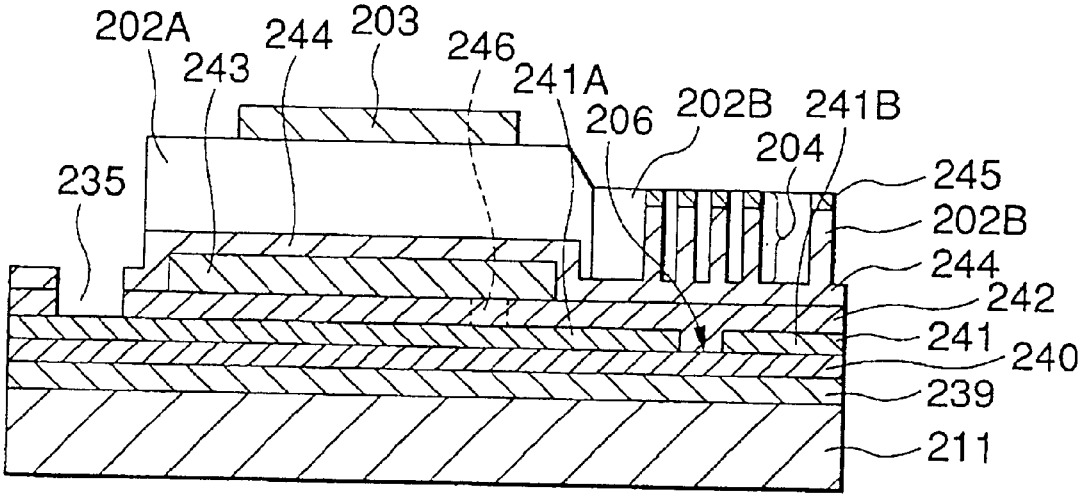

Next, as represented in FIG. 129, a nickel sheet having a thickness of on the order of 25 μm and having a lateral side longer than a longitudinal side is employed as a lid 203, and this lid 203 is positioned perpendicular to the above-explained branch wall 202A. This lid 203 is depressed against the branch path wall 202 under pressure of 4 to 6 $kg/cm^2$ at a temperature of 150 to 180° C. for approximately 5 minutes so as to be thermally pressured with each other. At this time, the edge portion on the side of the heater 206 of the nickel sheet 203 is set to such a position further separated from the edge portion of the sheet resist 202 by 100 μm along the backward direction. For instance, a stainless sheet, a silicon substrate, a quartz substrate, and a glass substrate may be employed other than the nickel sheet, if these members own similar functions as the nickel sheet. A plan view under this condition is indicated in FIG. 139. FIG. 129 is a sectional view, taken along a line CXXIX—CXXIX of FIG. 139. As a result, a slit-shaped branch path 107 is formed as a dye path. This slit-shaped branch path owns a height of on the order of 25 μm, and the same width as the interval between both edge portions of the two heating elements 206-206.

Figure 130:
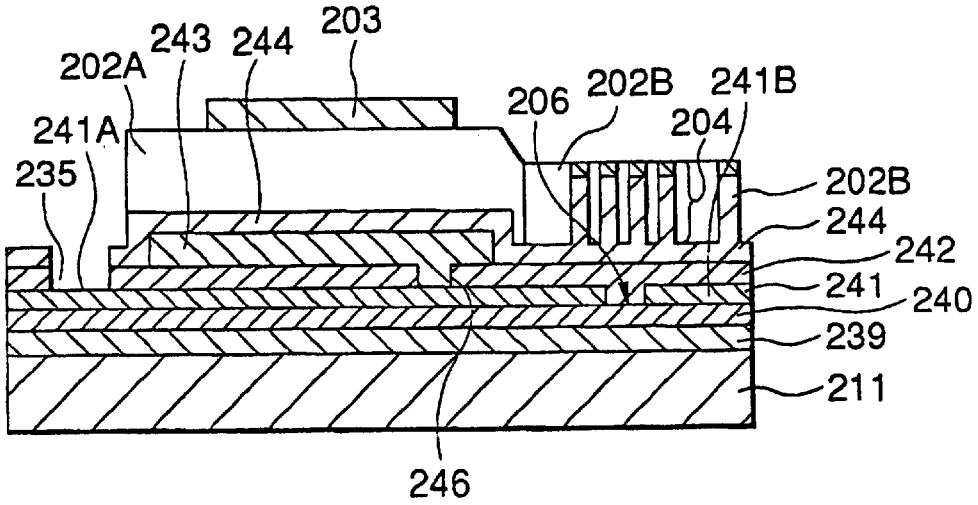

FIG. 130 is a sectional view for representing a positional relationship among the bonding pad 235 for extracting the separate electrode 241A, the through hole 246, and the heater 206, and also is a sectional view, taken along a line CXXX—CXXX of FIG. 139.

As described above, the heating elements (heater) 206 for heating the dye, the respective wiring conductors involving the electrodes 241A and 241B, the group of the small cylindrical members 204, and the dye supplying branch path 207 are formed on the substrate 211. The resulting members/substrate 211 are cut by a preselected size of the heater chip, so that the above-explained manufacturing steps are completed.

The heater chip 201 manufactured in accordance with the above-described manufacturing steps is adhered on the head base 210, the bonding pad 235 of each of the separate electrodes 241A is connected to the pad 216*a* of the IC chip 216 mounted on the printed circuit board 212, which corresponds to this bonding pad 235, by way of the bonding wire 236, and further the bonding pad of the common electrode 241B of the heater chip 201 is connected to the pad of the printed circuit board by the bonding wire 236. Thereafter, JCR 217 shown in FIG. 99 is employed to coat the resulting heater chip 201 which will then be thermally hardened. Furthermore, a cover 218 is adhered so as to complete the recording head 225.

FIG. 141 is a plan view for indicating a major portion of the recording head under such a condition that a series of the above-explained manufacturing steps are completed, and the cover 218 is finally mounted on this recording head in this manner, the recording head 225 shown in FIG. 98 is accomplished. For the sake of easy understandings, the above-described drawings except for FIG. 115 briefly represent the structures, the sizes, and the layouts of the respective members.

As illustrated in FIG. 91, the printer head 225 manufactured in this manner is made in contact with one edge of the base 210 with respect to the printing medium (printing paper) 220, and is held with keeping a predetermined angle of θ with respect to the printing medium 220. As a consequence, the interval between the vaporizing portion 205 and the printing medium 220 can be kept constant. In particular, since the angle θ defined between the base 210 and the printing medium 220 is kept at 14 degrees in order that the distance between the dye jetting portion 205 and the printing medium 220 becomes 50 μm, it is surely possible to produce the image having high resolution and high density.

Also, according to this third embodiment, when the members for constituting the recording head 225, particularly both the resist 202A and the sheet 203 are located at higher positions, as viewed from the IC chip substrate 211, these members are separated from the dye jetting portion 205. As a result, even when the interval between the recording head 225 and the printing medium 220 is shortened, the interval with respect to the printing medium 220 can be kept at 50 μm, or more by maintaining the above explained angle θ. Therefore, the contact between the recording head and the printing medium 220 can be avoided, and also the tip portion of the recording head 225 becomes the open end, so that the fluid plane of the dye 247 at the upper portion of the heater 206 can be controlled in order not to excessively supply the dyes. It should be understood that if the edge portion is unnecessarily moved backwardly, then the portion of the open end (not tightly closed) of the dye storage portion 205*a* is extended, and thus a shortage of dye supply will occur. As a consequence, this edge portion need not be unnecessarily moved backwardly. Also, since the printing medium 220 is arranged downwardly and also the recording head 225 is directed to the lower direction, all of the jetted dyes 247 can be effectively used to print the images.

FIG. 142 to FIG. 145 are plan views for representing a major portion of a printer head according to a further embodiment of the present invention.

A difference between this printer head and the previously explained printer head is given as follows. That is, in the above-explained embodiment, the respective dye jetting portions 205 are surrounded by the second partition walls 202B whereas in this embodiment, this second partition wall is not employed, but instead thereof, a communication portion 208 is formed between branch paths 207 and 207.

In other words, as indicated in FIG. 142 to FIG. 144, a lid 203 is covered on a partition wall 202, and the branch path 207 is formed in a slit shape, and then the dye 247 is supplied from a common dye supply path 219 to this branch path 207. The partition wall 202 is projected up to an intermediate portion between the edge portion of the lid 203 and the tip portion of the heater chip 201, and a further extending portion from this intermediate portion constitutes the communication portion 208.

As a consequence, each of the branch paths 207 mainly supplies the dye to the dye jetting portions 205 provided on both sides of the further extending portion thereof. As indicated by a broken line 247' in FIG. 145, the dyes may be supplied via the communication portion 208 to other dye jetting portions 205.

In accordance with this embodiment, in order to avoid the dye flows into the unnecessary portions, as represented in FIG. 142 and FIG. 145, volatile oil paint 209 is coated between the tip portion of the heater chip and the groove 215 of the base 210. Other arrangements of this embodiment are constructed in a similar manner to those of the above-described embodiment, and the use conditions of this embodiment such as the inclination of the printer head and the downward dye jetting operation are the same as in the above-explained embodiment.

In accordance with the printer head 225 of this embodiment, since the dyes 247 which are supplied via the branch path 207 are simultaneously to two sets of the dye jetting portions 205, even when the interval between the recording material jetting structures 205 is made narrow in correspondence with the high resolution requirement of the printed image, the interval between the recording material supply paths 207 need not be narrowed. As a consequence, a sufficient amount of dyes can be supplied. Then, the method for manufacturing the recording apparatus does not become complex. Moreover, since not higher precision is required in the manufacturing steps of the recording material supply paths 207, the manufacturing yield of the recording apparatus can become higher than that of the conventional recording apparatus, and therefore the manufacturing cost can be suppressed.

FIG. 143 is a plan view for representing a flow of dyes in the recording head according to this embodiment. As previously explained, since the tip portion of the partition wall 202 of the branch path 207 is formed as the communication portion 208, even when the dye is not supplied from a predetermined branch path 207 due to a certain reason, the dye may be supplied as 247' from another branch path 207. As a result, there is no problem in the printing operation.

While the embodiments of the present invention have been described, the above-described embodiments may be modified based on the technical idea of the present invention.

For instance, the positional relationship between the above-explained head and the printing medium may be varied, and further the inclined angle between them may also be varied. The structures, shapes, and materials of the respective head portions may be made different from the above-described structures/shapes/materials thereof. During the printing operation, the head may be transported in conjunction with the printing medium 220. The above-explained one branch path simultaneously supplies the dyes to the two dye jetting portions (otherwise, three, or more dye jetting portions). This idea is preferably introduced to all of the branch paths. Alternatively, instead of this featured structure, the known structure may be partially employed.

Also, the structures, shapes, and materials of the respective portions/members of the above-explained heater 206 may be changed from those of the above-described portions/members. The substrate 211 may be manufactured by employing ceramics such as alumina and also the thermal characteristic of the recording head may be controlled by the heating member, the thermal insulating member, and the substrate.

The height, the sectional/plan shape, the density, and the material of the small cylindrical member 204 formed in the vaporizing portion may be varied. For example, a pattern fitted to the pillar-shaped member (namely, negative-to-positive inverted shape) is formed by photoresist, and a metal pillar such as nickel may be formed by way of the electrolytic plating method. In this case, a film having an electric conductivity may be previously formed as an under layer.

The pillar-shaped member forming method by the plating method can omit such lengthy process operations as the $SiO_2$ film forming process, the metal mask forming process, the $SiO_2$ etching process, as compared with the pillar-shaped member forming method of $SiO_2$. As a result, the pillar-shaped members can be formed within very short time by mass production.

The porous structure to be formed in the vaporizing portion is not limited to the above-described porous structure, but may be changed. For instance, in the case of a pillar member, a height thereof, a plan/sectional shape thereof, and density thereof may be changed. Alternatively, this porous structure may be formed at any places in which a very fine pattern is required, porous nature is required, or an enlargement of a surface area is required. As the porous structure, not only the pillar-shaped member, but also a wall-shaped member, a beads assembling member, and a fiber member may be manufactured.

Also, not only the dye vaporizing type thermoelectric system, but also the previously explained thermoelectric system by ablation may be utilized. In any of these systems, either the dyes or the recording materials are jetted to be transferred.

Also, a total number of recording material storage units for storing the recording materials (dyes), the dot number, and a total numbers of heating members and also of vaporizing portions may be varied. Alternatively, the arrangement shape and the size are not limited to those of the above-described embodiments.

Also, the structures and the shapes of the dye storage portion, the dye supply portion, the reading head, and the printer are not limited to the above-described structures/shapes, but may be properly modified. Further, other proper materials may be employed as the materials of the respective portions for constructing the reading head.

As to the recording dye, the three colors, i.e., magenta, yellow, cyan (additionally, black) are used to carry out the full color recording operation. Alternatively, a two-color printing operation, a monochromatic printing operation, or a black/white printing operation may be performed.

Also, the heating element may be made of a metal, or a metallic material. Alternatively, a head base material may be formed by a high heat conductivity material such as aluminium, and ceramics, whereas the thermal characteristic of the recording head may be controlled by the heating element, the heat insulating material, and the head base material.

Furthermore, the present invention may also be applied to such an ink jet type recording system. That is, a recording fluid containing a recording solution and a substance (namely, carrier), the volume of which is expanded by melting, or dispensing and heating this recording material is supplied. The condition of this recording fluid is changed by being heated to produce fluid droplets, and then the fluid droplets are transported to a printing medium located opposite to the recording head.

In accordance with this embodiment, the recording head located opposite to the printing medium owns the recording material jetting portion used to jet the recording material to the printing medium. This recording head is relatively inclined with respect to the printing medium to be made in contact therewith. Thus, the interval between the recording material jetting portion and the printing medium can be maintained at a preselected interval by this contact. As a consequence, the interval between the recording head and the printing medium can be kept by the recording head itself. Therefore, the transfer efficiency of the jetted recording material can be increased, and the image having the high density and the better gradation and further the high resolution can be recorded.

What is claimed is:

1. A recording apparatus comprising:

a plurality of recording head units constituted by such that recording materials are heated and are selectively transported to a printing medium in a plurality of recording material transporting units; and a recording head formed by arraying said plurality of recording head units positioned opposite to each other; wherein:

in each of said plurality of recording head units, said plurality of recording material transporting units include heating portions for heating said recording materials;

a first electrode and a second electrode which are used to energize said heating portion are provided with respect to each of said heating portions in such a manner that said first electrode is located opposite to said second electrode; and said first electrode among said first and second electrodes is located between said plurality of heating portions;

only said second electrode among said first and second electrode is present at edge portions of said plurality of recording head units that are positioned opposite to each other.

2. A recording apparatus as claimed in claim 1 wherein:

said first electrode and said second electrode are arranged in parallel to each other; said first electrode is conducted from one end side of the heating portion; and said second electrode is conducted from the other end side.

3. A recording apparatus as claimed in claim 1 wherein:

said second electrode is a separate electrode connected to a drive circuit unit; and said first electrode is a common electrode for the respective heating portions.

4. A recording apparatus as claimed in claim 1 wherein:

said heating portion is made of a thin-film heating member.

5. A recording apparatus as claimed in claim 1 wherein:

both said plurality of recording head units, and a printed circuit board for connecting a drive circuit element of said second electrode and said first electrode to an external circuit are fixed to a common base.

6. A recording apparatus as claimed in claim 1 wherein:

said recording apparatus is arranged in such a manner that the heated recording material is transported to the printing medium which is located opposite to said recording material transporting unit under non-contact state.

7. A recording apparatus as claimed in claim 3 wherein:

said first electrode functioning as a common electrode are mutually coupled to one ends of said respective heating portions, and are branched from this coupling portion.

8. A recording apparatus as claimed in claim 6 wherein:

said recording apparatus is arranged in such a manner that a recording material is vaporized; or ablated by the heating portion, and then the vaporized, or ablated recording material is jetted to the printing medium.

9. A recording apparatus comprising:

a recording head positioned opposite to a printing medium; wherein:

said recording head includes:

a recording solution jetting portion for jetting a recording solution to said printing medium;

a common recording material supply path used to supply said recording material; and a plurality of branch paths branched from said common recording material supply path, for supplying said recording material to said recording material jetting portion;

at least one of said plurality of branch paths supplies the recording materials to said plurality of recording material jetting portions at the same time; and a recording solution leakage preventing means for preventing recording solution leakage, the recording solution leakage preventing means being located at a position near said recording material jetting portion, and on the opposite side to the plurality of branch paths with respect to said recording material jetting portion.

10. A recording apparatus as claimed in claim 9 wherein:

said common recording material supply path is formed between a main body of said recording head and a cover portion provided on said main body; and said plurality of branch paths are formed among partition walls arranged between said main body of the recording head and said cover portion.

11. A recording apparatus as claimed in claim 9 wherein:

said plurality of branch paths branched from the common recording material supply path are mutually communicated with each other in a region of the recording material jetting portion.

12. A recording apparatus as claimed in claim 9 wherein:

said recording material leakage preventing means is made of volatile oil paint.

13. A recording apparatus as claimed in claim 9 wherein:

a heating means for heating the recording material to jet the heated recording material is provided on the recording material jetting portion.

14. A recording apparatus as claimed in claim 9 wherein:

said recording material jetting portion contains a porous structural body.

15. A recording apparatus as claimed in claim 9 wherein:

the recording head has a main body having a recording solution storage portion for supplying a recording solution to the common recording material supply path.

16. A recording apparatus as claimed in claim 9 wherein:

a recording solution supply tube is provided between a recording material storage portion and a main body of the recording head; and said recording material is supplied via said recording material supply tube to said common recording material supply path.

17. A recording apparatus as claimed in claim 9 wherein:

the recording material is vaporized, or ablated, and then the vaporized, or ablated recording material is jetted to the printing medium which is arranged opposite to said recording material jetting portion under non-contact state.

18. A recording apparatus as claimed in claim 10 wherein:

said partition walls are formed as a sheet shape; and said branch path between these partition walls is formed as a slit shape.

19. A recording apparatus as claimed in claim 13 wherein:

said heating means is constituted by a high resistance material, and one pair of electrodes capable of energizing said high resistance material.

20. A recording apparatus as claimed in claim 19 wherein:

said high resistance material and said one pair of electrodes are provided on a surface of a main body of the recording head under said partition wall.

21. A recording apparatus as claimed in claim 20 wherein:

said one pair of electrodes are conducted to one end portion of the main body of said recording head, and one of said conducted portions is connected to a recording head drive circuit.

22. A recording apparatus as claimed in claim 21 wherein:

both the main body of the recording head, and a printed circuit board containing a recording head drive circuit unit are fixed to a base member.

23. A recording apparatus wherein:

a recording head positioned opposite to a printing medium is comprised of a recording solution jetting portion for jetting a recording solution to said printing medium;

said recording head is relatively inclined with respect to said printing medium to be made in contact with said printing medium; and said recording material jetting portion and said printing medium are arranged in such a manner that a predetermined interval between said recording material jetting portion and said printing medium is kept by said contact made between said recording head and said printing medium.

24. A recording apparatus as claimed in claim 23 wherein:

said recording head is made in contact with said printing medium at a predetermined inclination angle with respect to said printing medium on a side of said recording material jetting portion.

25. A recording apparatus as claimed in claim 23 wherein:

said recording head is relatively slid with respect to said printing medium.

26. A recording apparatus as claimed in claim 23 wherein:

said recording head includes:

a common recording material supply path for supplying the recording material; and a branch path branched from said common recording material supply path, for supplying said recording material to said recording material jetting portion.

27. A recording apparatus as claimed in claim 23 wherein:

a heating means for heating the recording material to jet the heated recording material is provided on the recording material jetting portion.

28. A recording apparatus as claimed in claim 23 wherein:

said recording material jetting portion contains a porous structural body.

29. A recording apparatus as claimed in claim 23 wherein:

a recording solution supply tube is provided between said recording material storage portion and said main body of the recording head; and said recording material is supplied via said recording material supply tube to said common recording material supply path.

30. A recording apparatus as claimed in claim 23 wherein:

the recording material is vaporized, or ablated, and then the vaporized, or ablated recording material is jetted to the printing, medium which is arranged opposite to said recording material jetting portion under non-contact state.

31. A recording apparatus as claimed in claim 24 wherein:

said recording head is made in contact with said printing medium in such a manner that an interval between said recording head and said printing medium is gradually narrowed toward said recording material jetting portion.

32. A recording apparatus as claimed in claim 25 wherein:

said recording material jetting portion of said recording head is positioned downwardly, opposite to said printing medium so as to carry out a recording operation by said recording head.

33. A recording apparatus as claimed in claim 26 wherein:

said common recording material supply path is formed between a main body of said recording head and a cover portion provided with said main body;

a plurality of partition walls are provided between said main body of the recording head and said cover portion; and branch paths are formed among said partition walls.

34. A recording apparatus as claimed in claim 26 wherein:

a main body of the recording head has a recording solution storage portion for supplying a recording solution to the common recording material supply path.

35. A recording apparatus as claimed in claim 27 wherein:

said heating means is constituted by a high resistance material, and one pair of electrodes capable of energizing said high resistance material.

36. A recording apparatus as claimed in claim 31 wherein:

the interval between said recording head and said printing medium is increased on the side where said recording head is positioned opposite to said printing medium while said recording head is separated from the contact position between said recording head and said printing medium to the opposite side with respect to said recording material jetting portion.

37. A recording apparatus as claimed in claim 35 wherein:

said high resistance material and said one pair of electrodes are provided on a surface of a main body of the recording head under said partition wall as claimed in claim 33.

38. A recording apparatus as claimed in claim 37 wherein:

said one pair of electrodes are conducted to one end portion of the main body of said recording head, and one of said conducted portions is connected to a recording head drive circuit.

39. A recording apparatus as claimed in claim 38 wherein:

both the main body of the recording head, and a printed circuit board containing a recording head drive circuit unit are fixed to a base member.

* * * * *